US005206455A

United States Patent [19]

Williams et al.

[11] Patent Number: 5,206,455

[45] Date of Patent: Apr. 27, 1993

[54] LASER INITIATED ORDNANCE SYSTEMS

[75] Inventors: Michael S. Williams, Half Moon Bay; Robert R. Durrell, Moss Beach; Simon M. Kokoshvili, Mountain View; Charles J. Moore, Jr., San Mateo; Jeffrey M. Moser; Theodore J. Netoff, both of Oakland, all of Calif.

[73] Assignee: Quantic Industries, Inc., San Carlos, Calif.

[21] Appl. No.: 676,345

[22] Filed: Mar. 28, 1991

[51] Int. Cl.[5] ..... F42C 19/08

[52] U.S. Cl. ..... 102/201

[58] Field of Search ..... 102/201

[56] References Cited

U.S. PATENT DOCUMENTS

| | | | |
|---|---|---|---|
| 3,362,329 | 1/1968 | Epstein | 102/201 |
| 3,408,937 | 11/1968 | Lewis et al. | 102/201 |
| 3,528,372 | 9/1970 | Lewis et al. | 102/201 |
| 3,618,526 | 11/1971 | Baker | 102/201 |
| 3,812,783 | 5/1974 | Yang et al. | 102/201 |
| 3,911,822 | 10/1975 | Boling | 102/201 |
| 4,391,195 | 7/1983 | Shann | 102/201 |
| 4,635,552 | 1/1987 | Battle | 102/201 |
| 4,719,014 | 4/1990 | Loughry et al. | 102/201 |
| 4,862,802 | 9/1989 | Streifer et al. | 102/201 |
| 4,870,903 | 10/1989 | Carel et al. | 102/201 |
| 5,052,300 | 10/1991 | Josse | 102/201 |

*Primary Examiner*—Charles T. Jordan

*Attorney, Agent, or Firm*—Burns, Doane, Swecker & Mathis

[57] ABSTRACT

The present invention relates to ordnance ignition systems and methods having significantly improved safety and reliability characteristics. In a preferred embodiment, laser energy is used to fire both deflagrating initiators and deflagration-to-detonation devices via fiber optic cable assemblies (FOCA). Relative to known explosive transfer assemblies, FOCAs are lighter, more reliable, less costly, and can be easily and thoroughly tested nondestructively. Although the laser initiated devices (LID) contain moderately sensitive pyrotechnics, their electrical isolation renders them immune from inadvertent initiation by electromagnetic and abnormal optical environments.

59 Claims, 76 Drawing Sheets

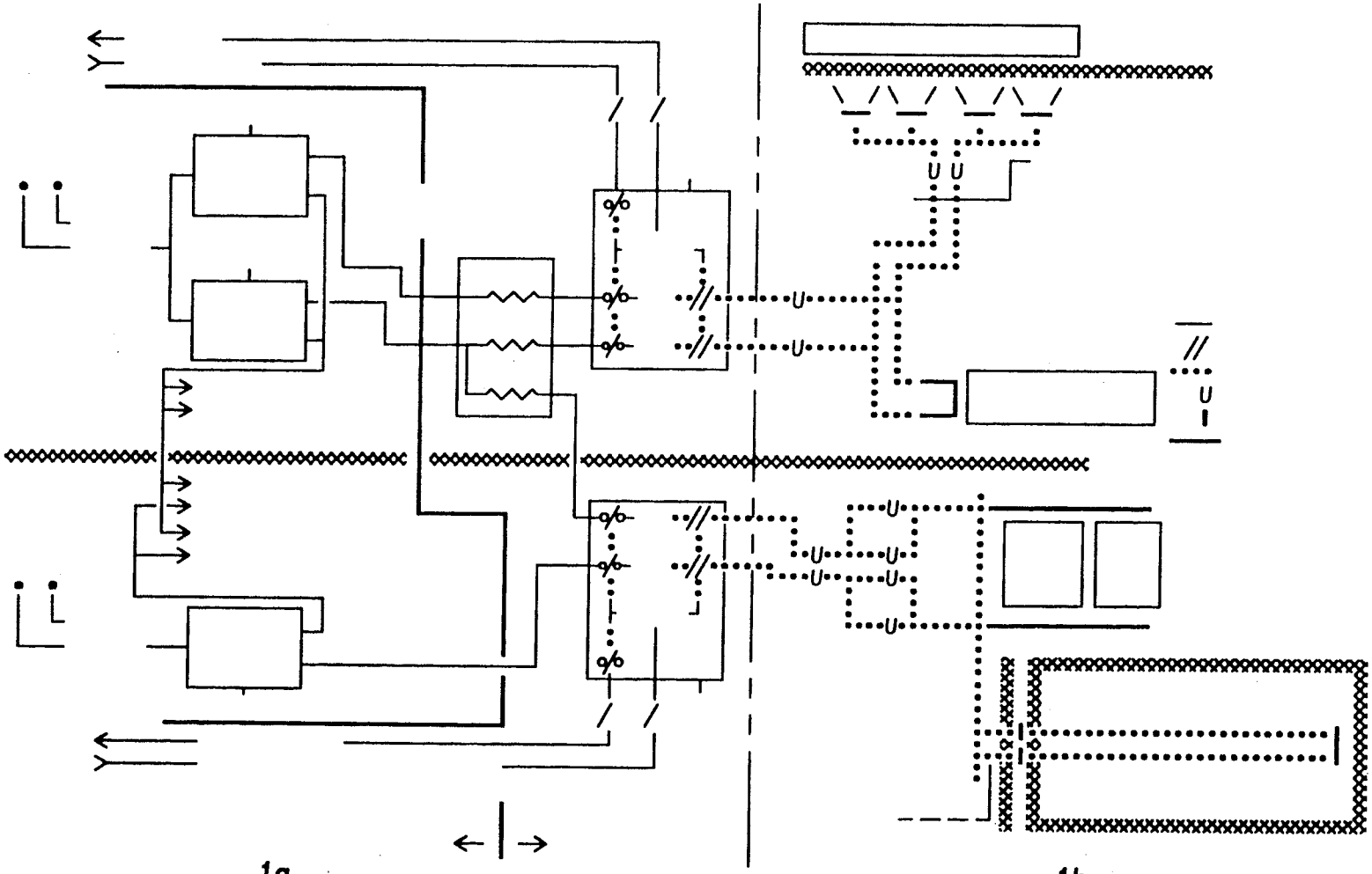
FIG. 1 (MAP)

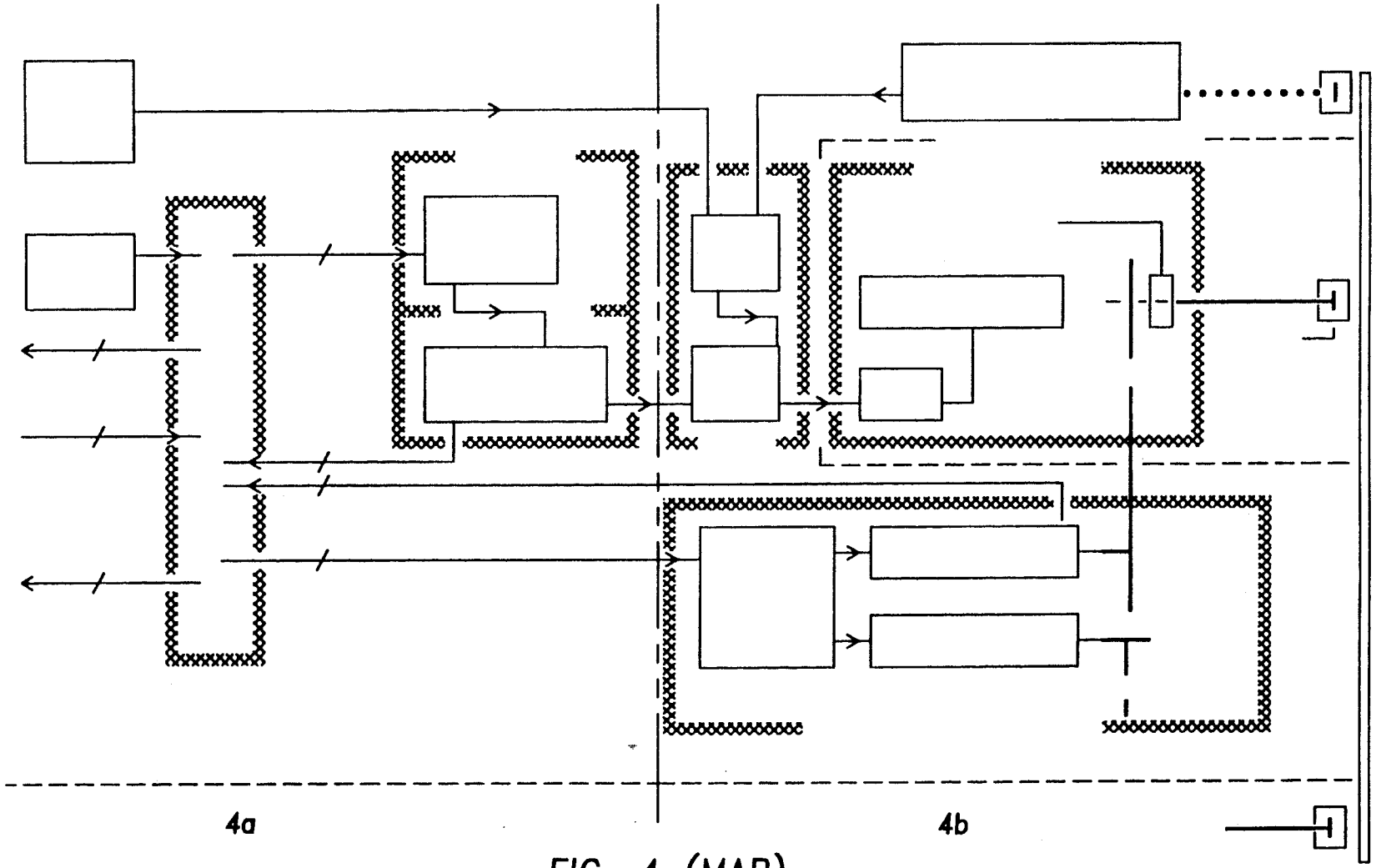
FIG. 4 (MAP)

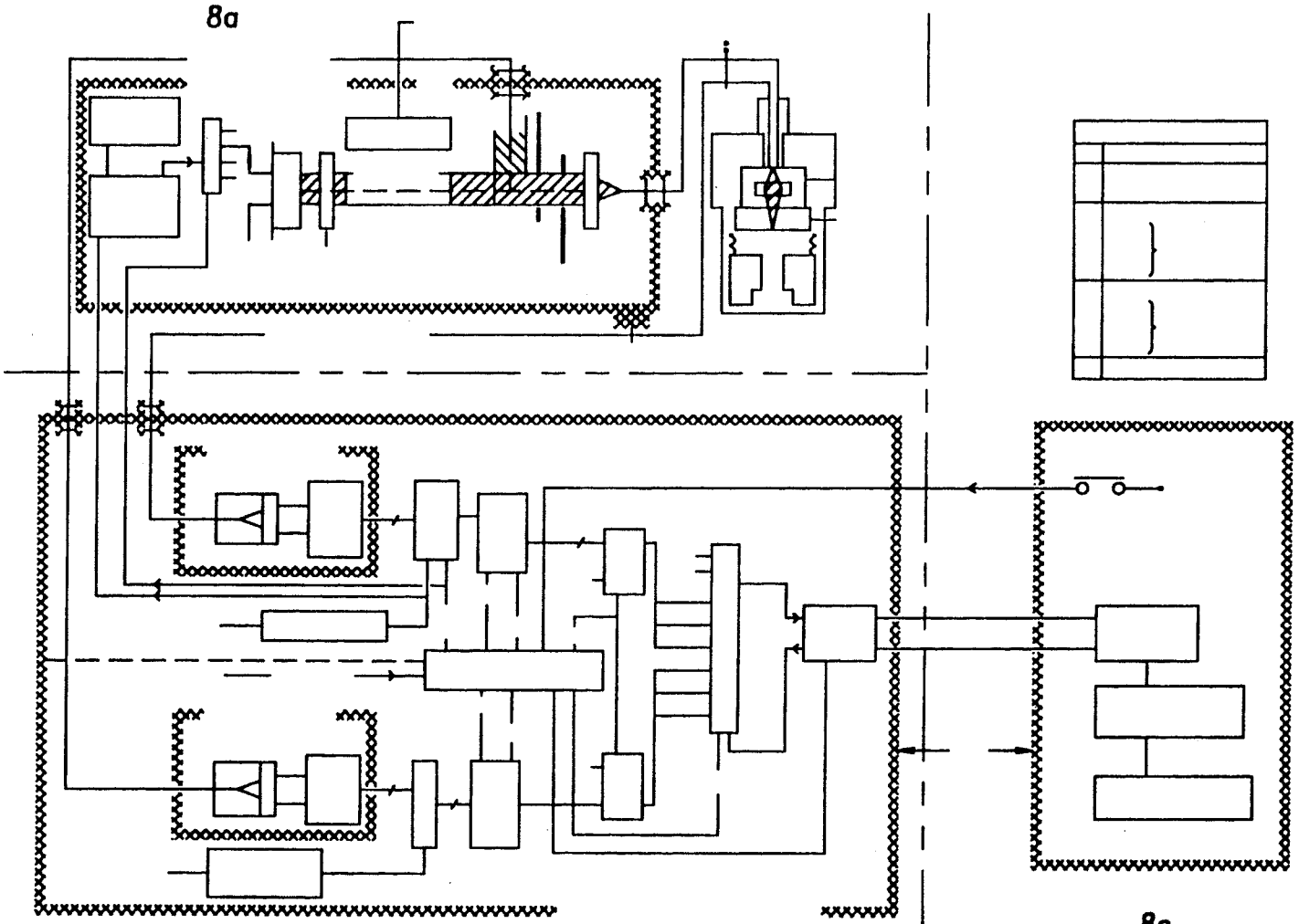
FIG. 8 (MAP)

| DATA FORMAT | |
|---|---|
| BIT | BIT ASSIGNMENT |
| 0<br>1 | DFU NUMBER FROM<br>ADDRESS DECODER |
| | CONTINUITY BIT DATA |
| 2<br>3<br>4 | CH 1<br>CH 2<br>CH 3 } 1 = PASS<br>0 = FAIL |
| | ENERGY BIT DATA |
| 6<br>7<br>8 | CH 1<br>CH 2<br>CH 3 } 1 = PASS<br>0 = FAIL |
| P | PARITY |

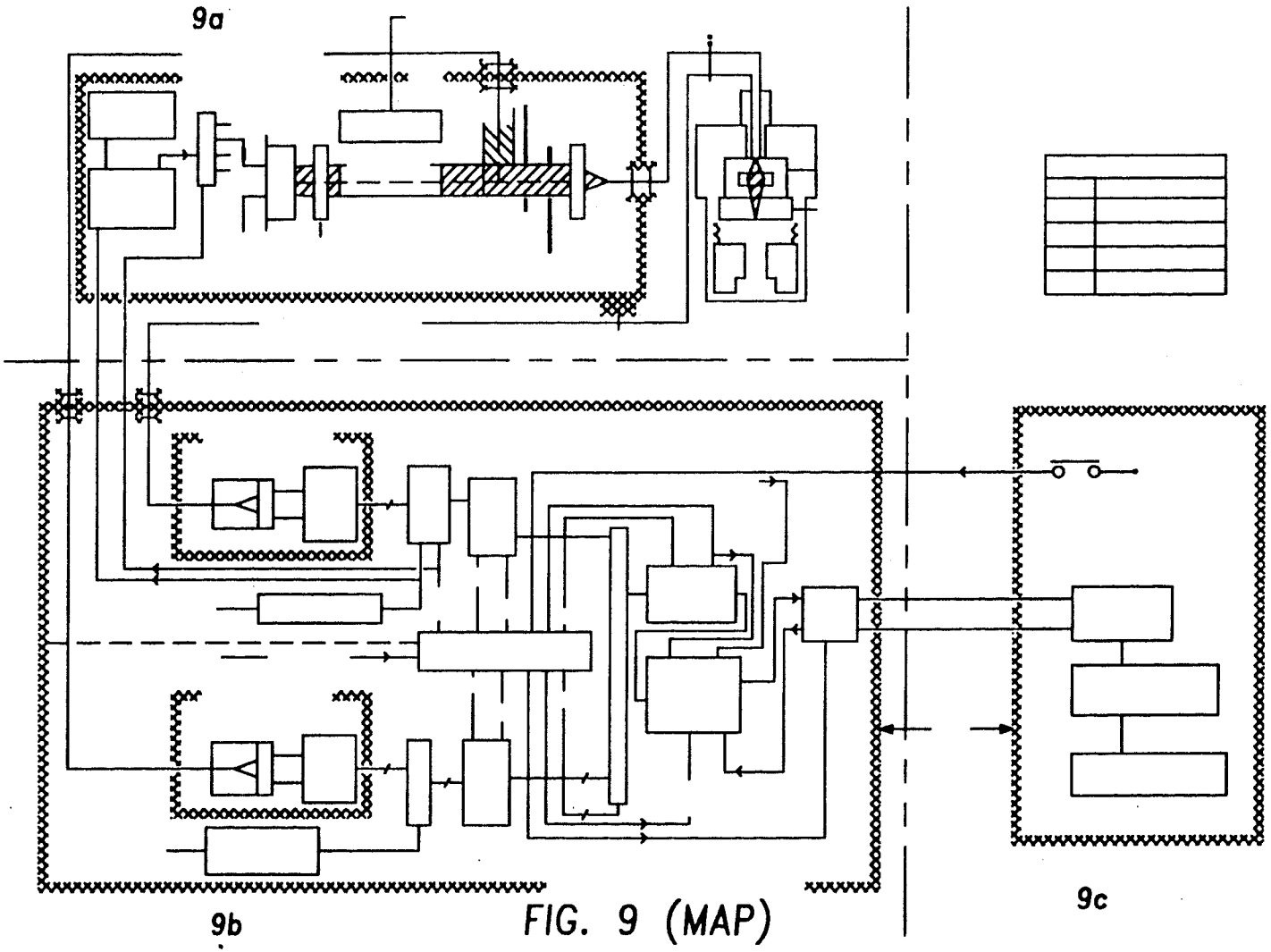
FIG. 9 (MAP)

| DATA FORMAT | |
|---|---|
| BYTE | ASSIGNMENT |
| 0 | DFU NUMBER |
| 1 | CH. 1 DATA |
| 2 | CH. 2 DATA |
| 3 | CH. 3 DATA |

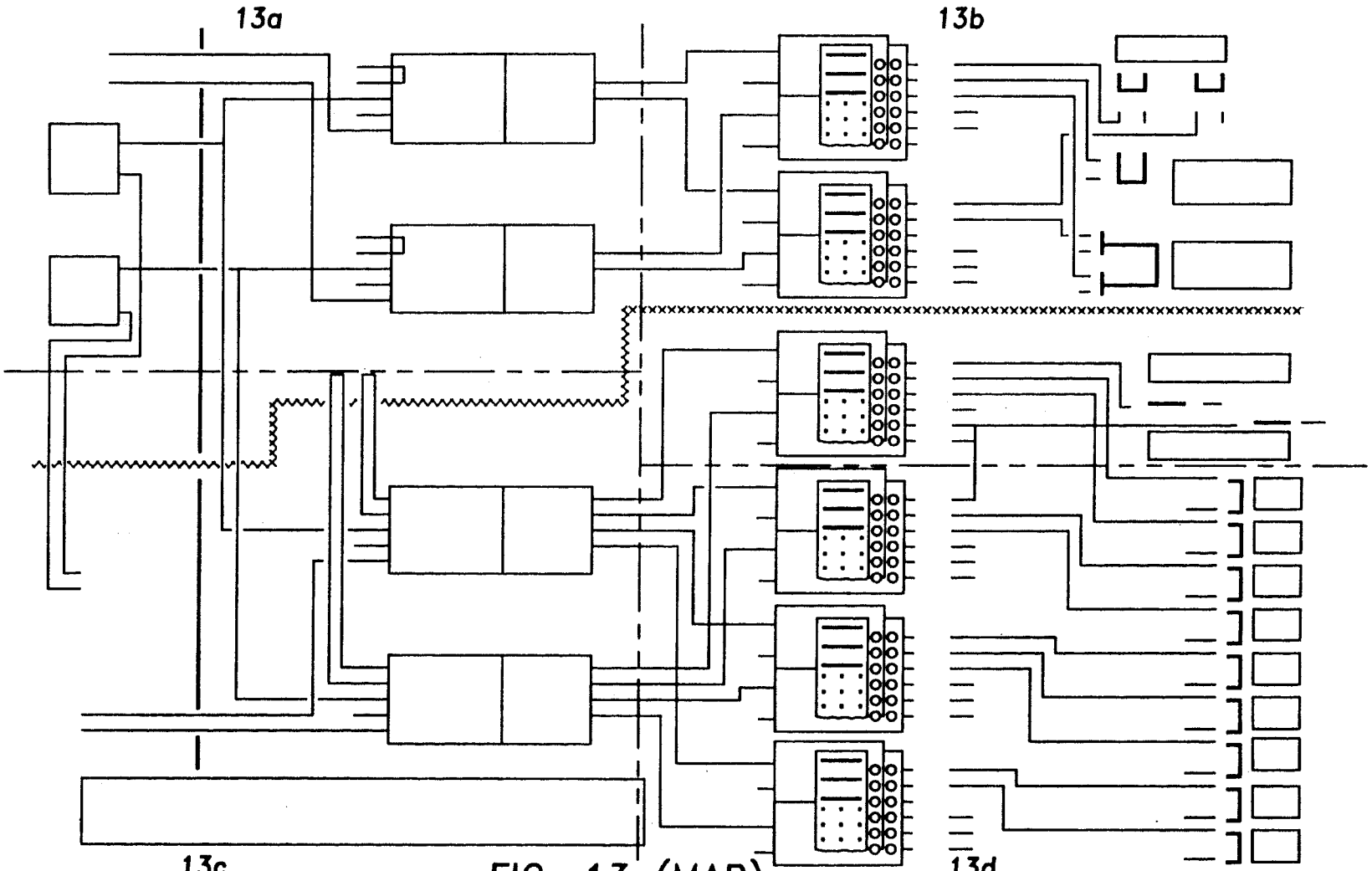
FIG. 13 (MAP)

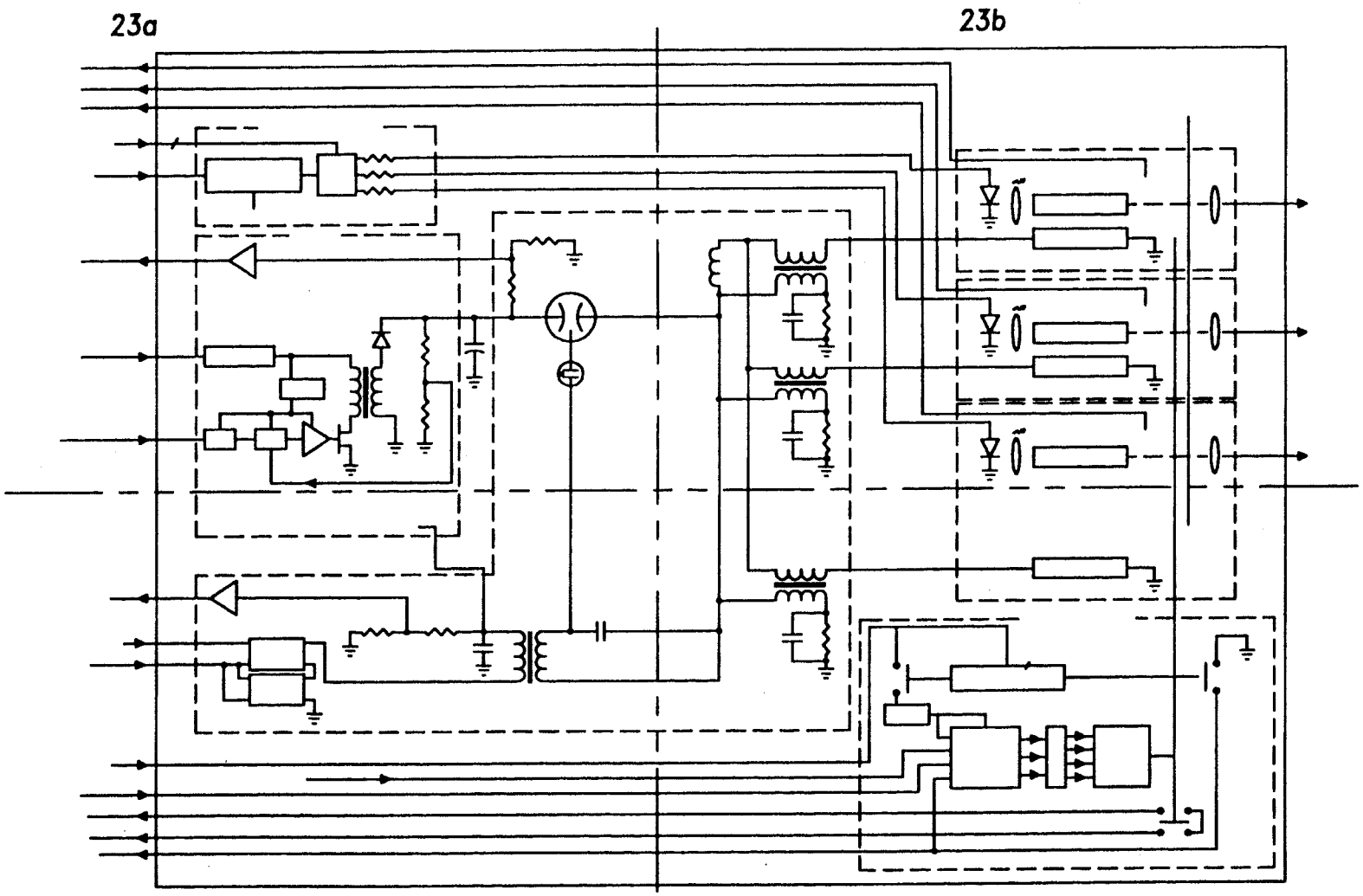
FIG. 23 (MAP)

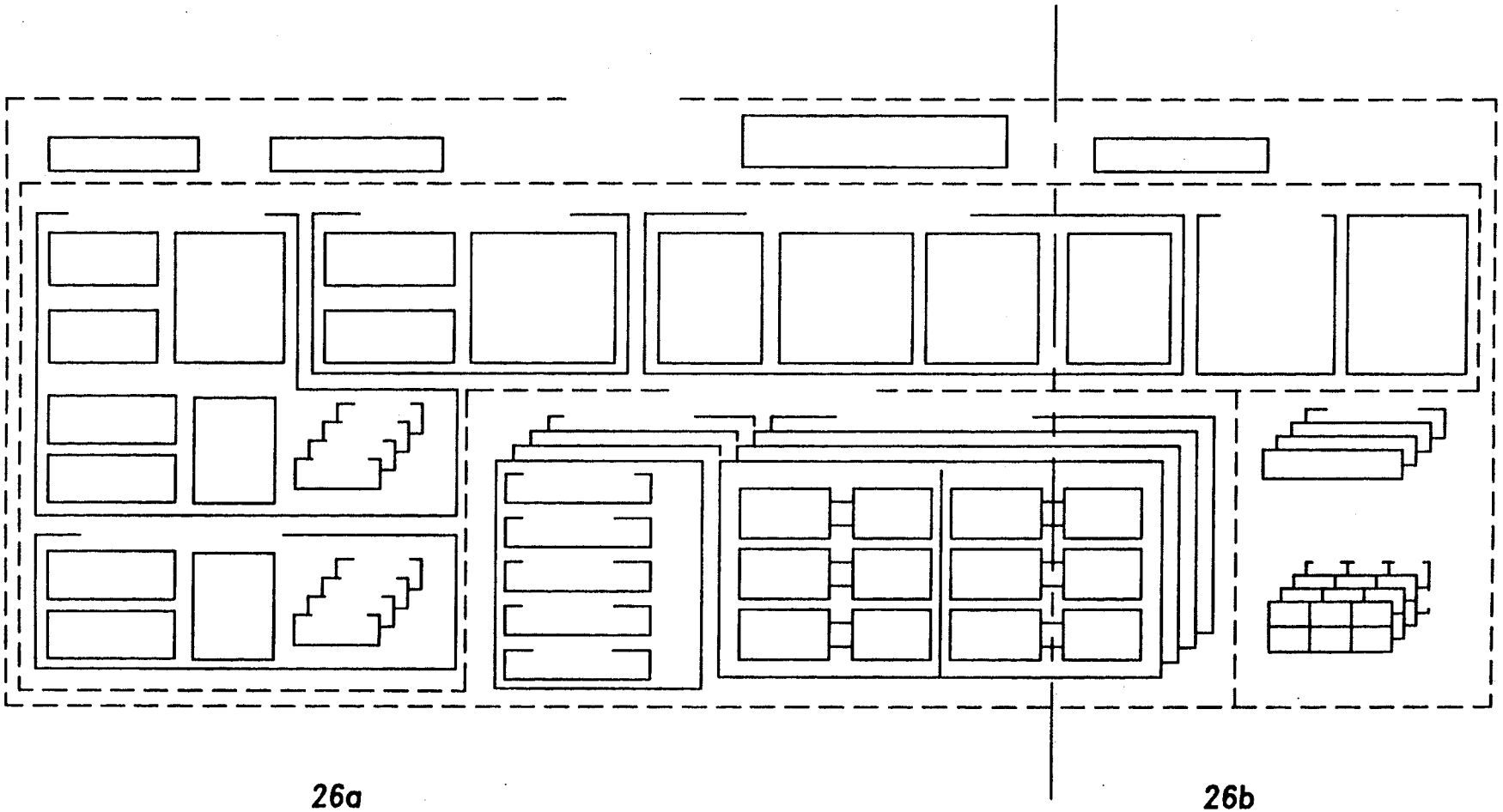
FIG. 26 (MAP)

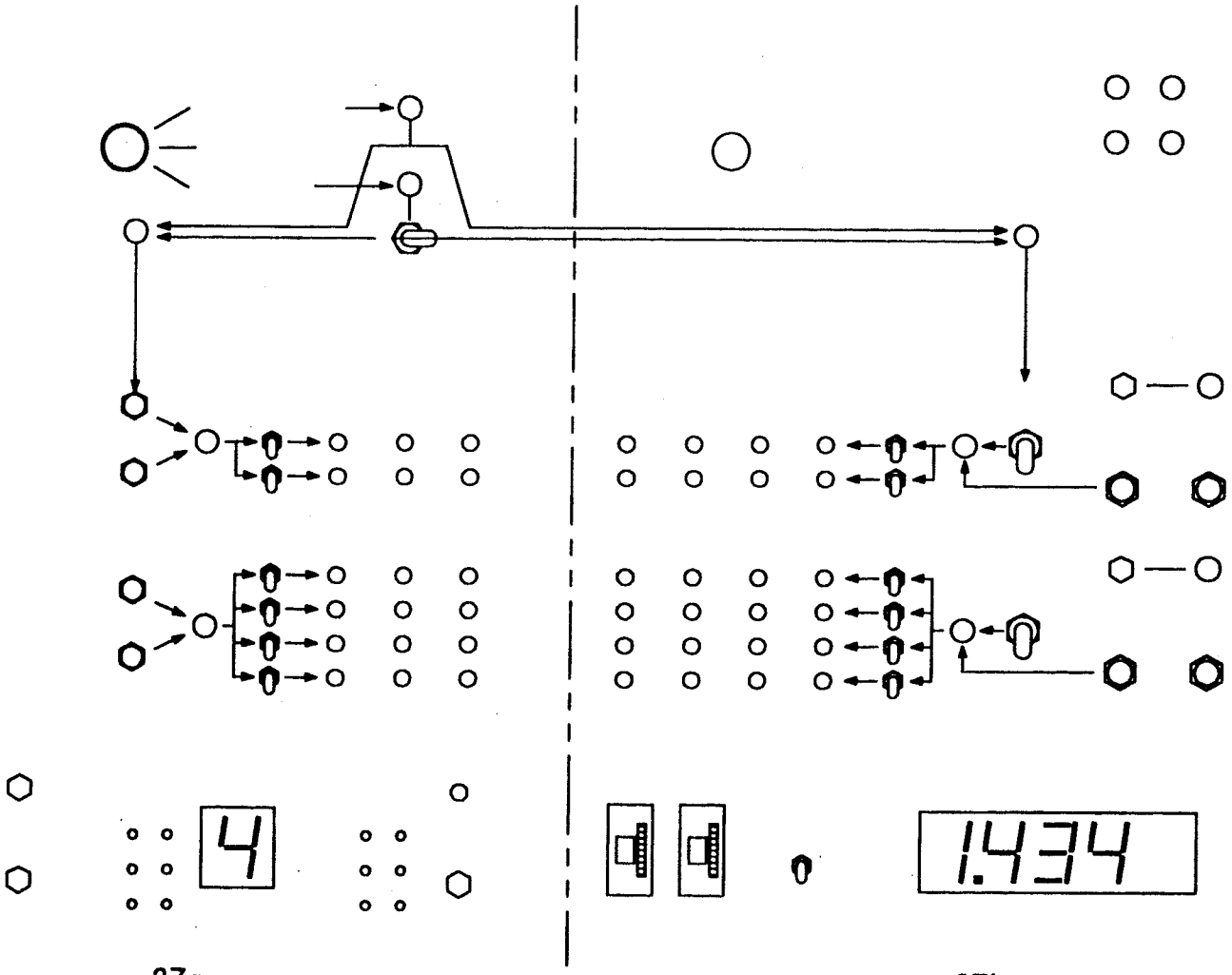
FIG. 27 (MAP)

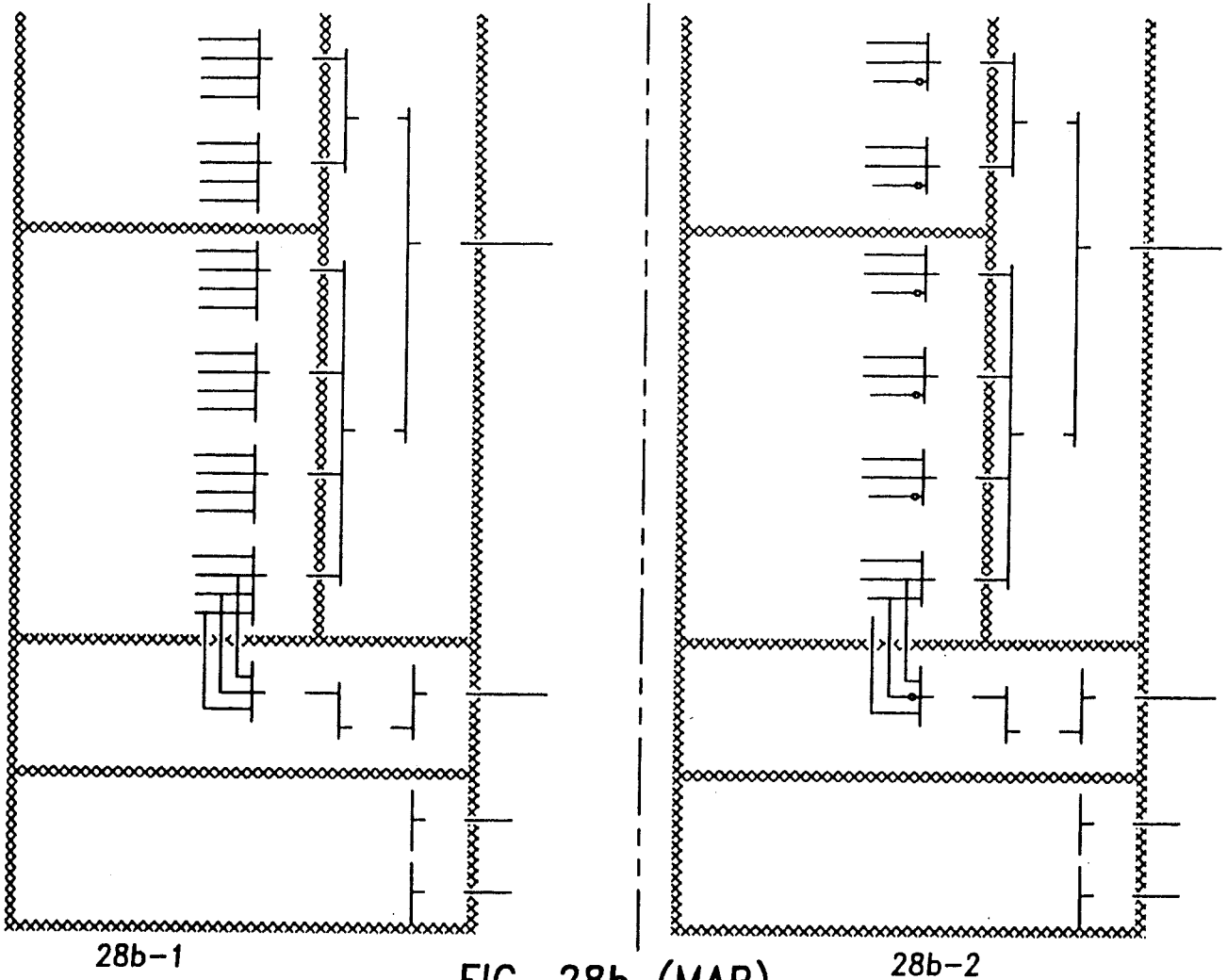
FIG. 28b (MAP)

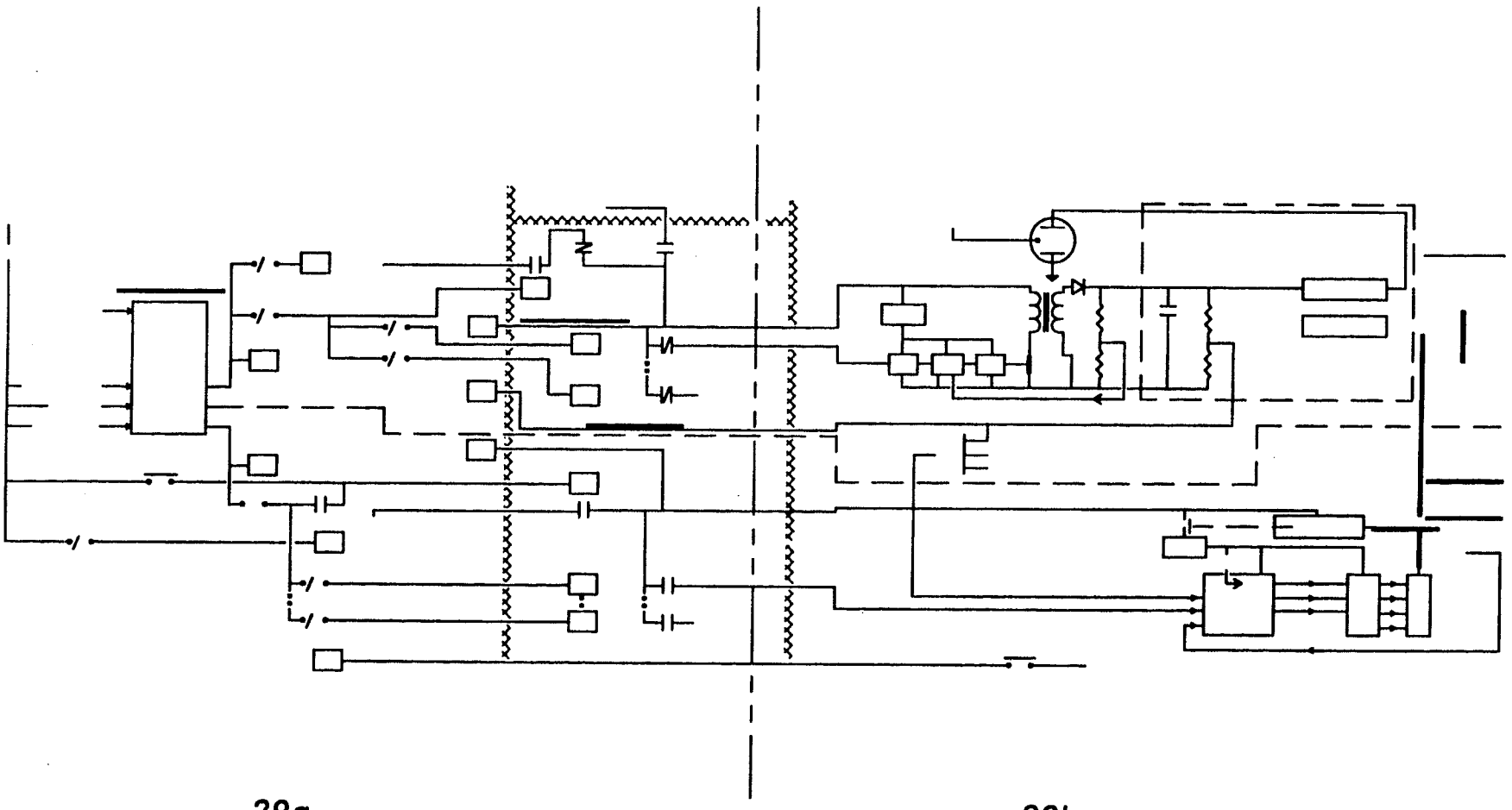
FIG. 29 (MAP)

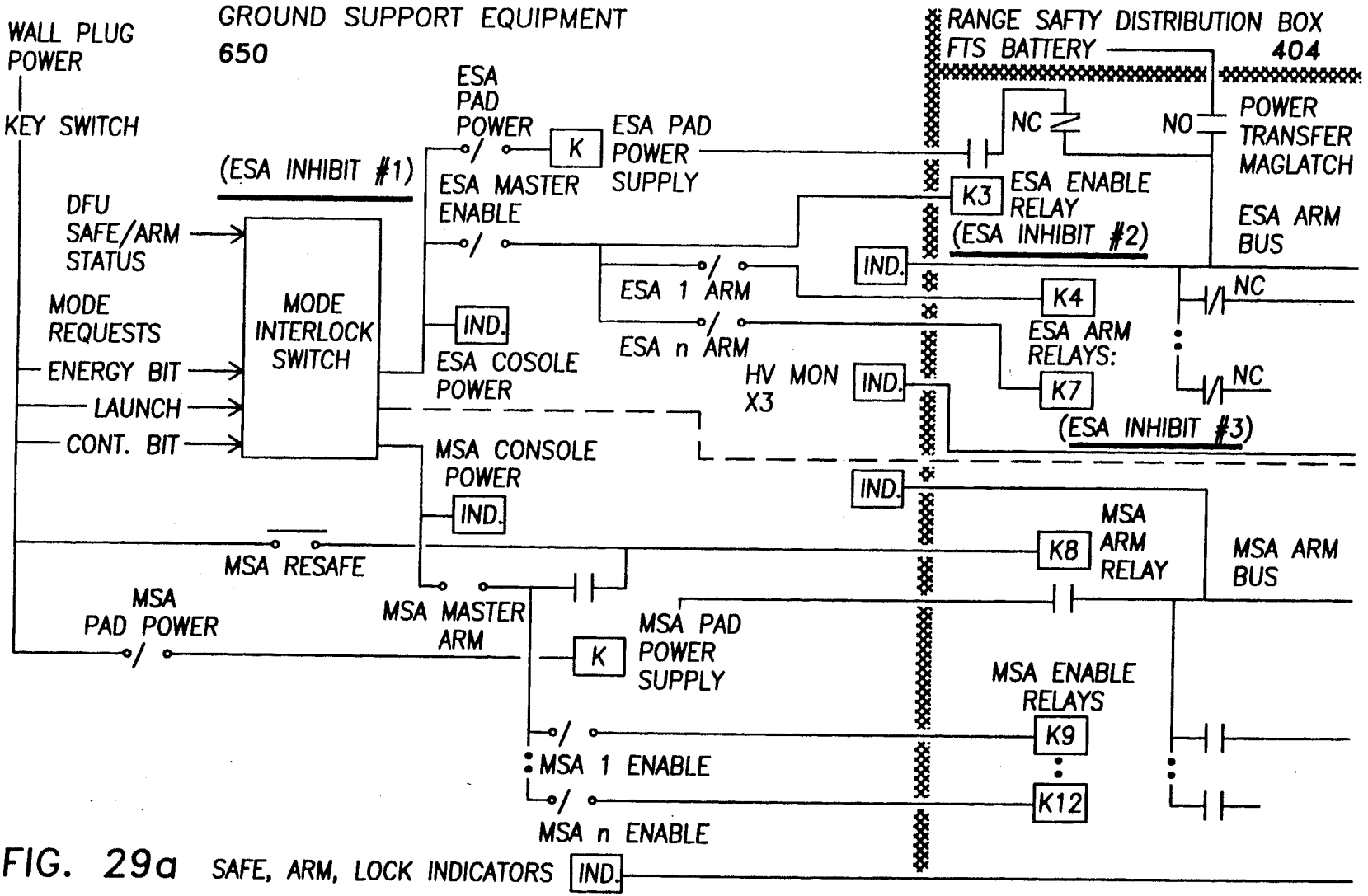
FIG. 29a SAFE, ARM, LOCK INDICATORS

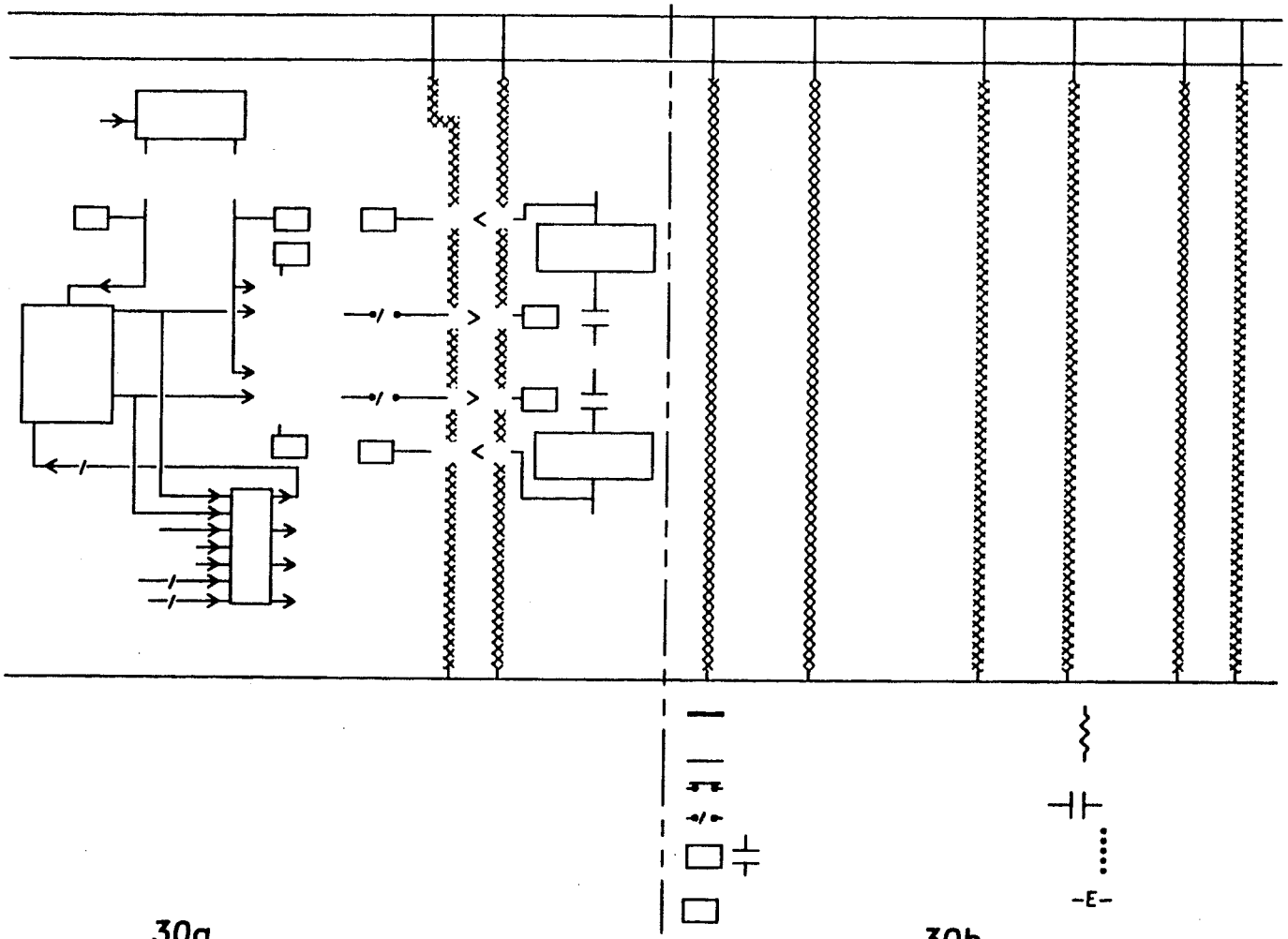
FIG. 30 (MAP)

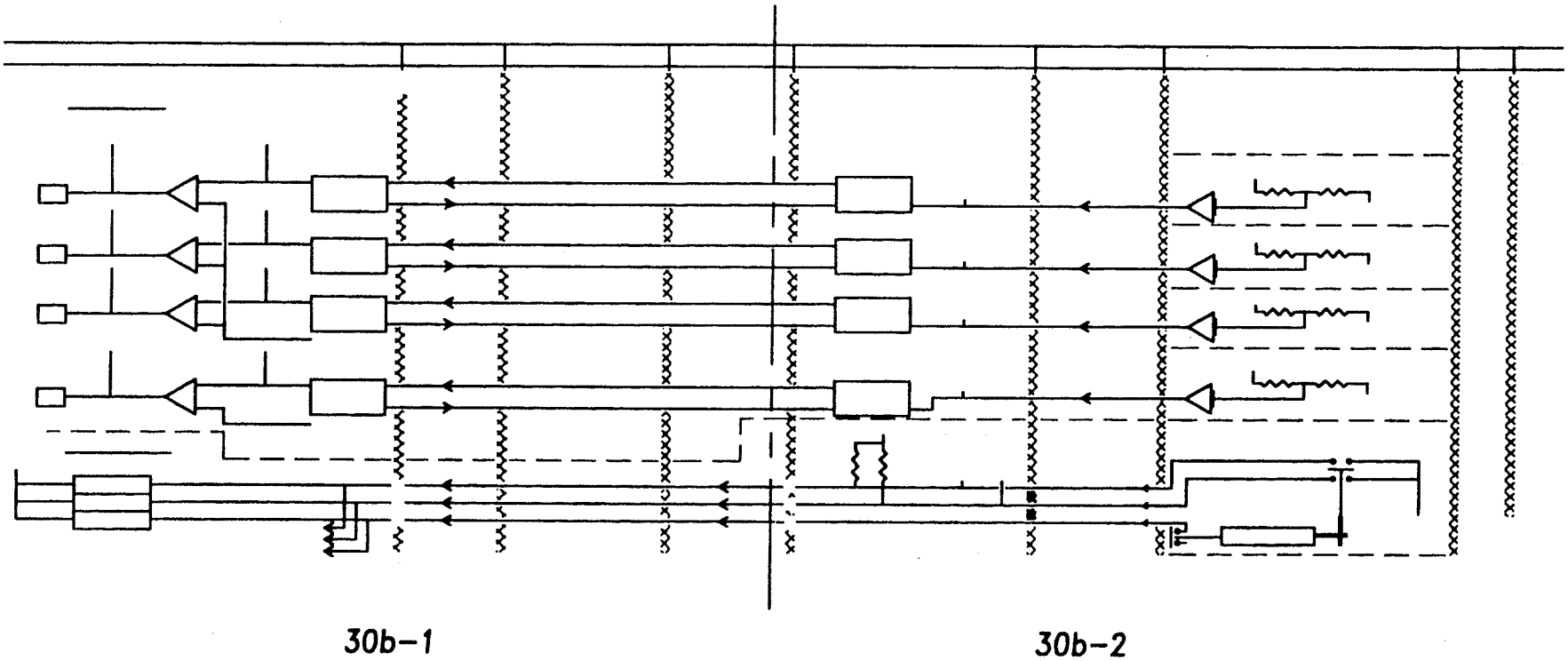
FIG. 30b (MAP)

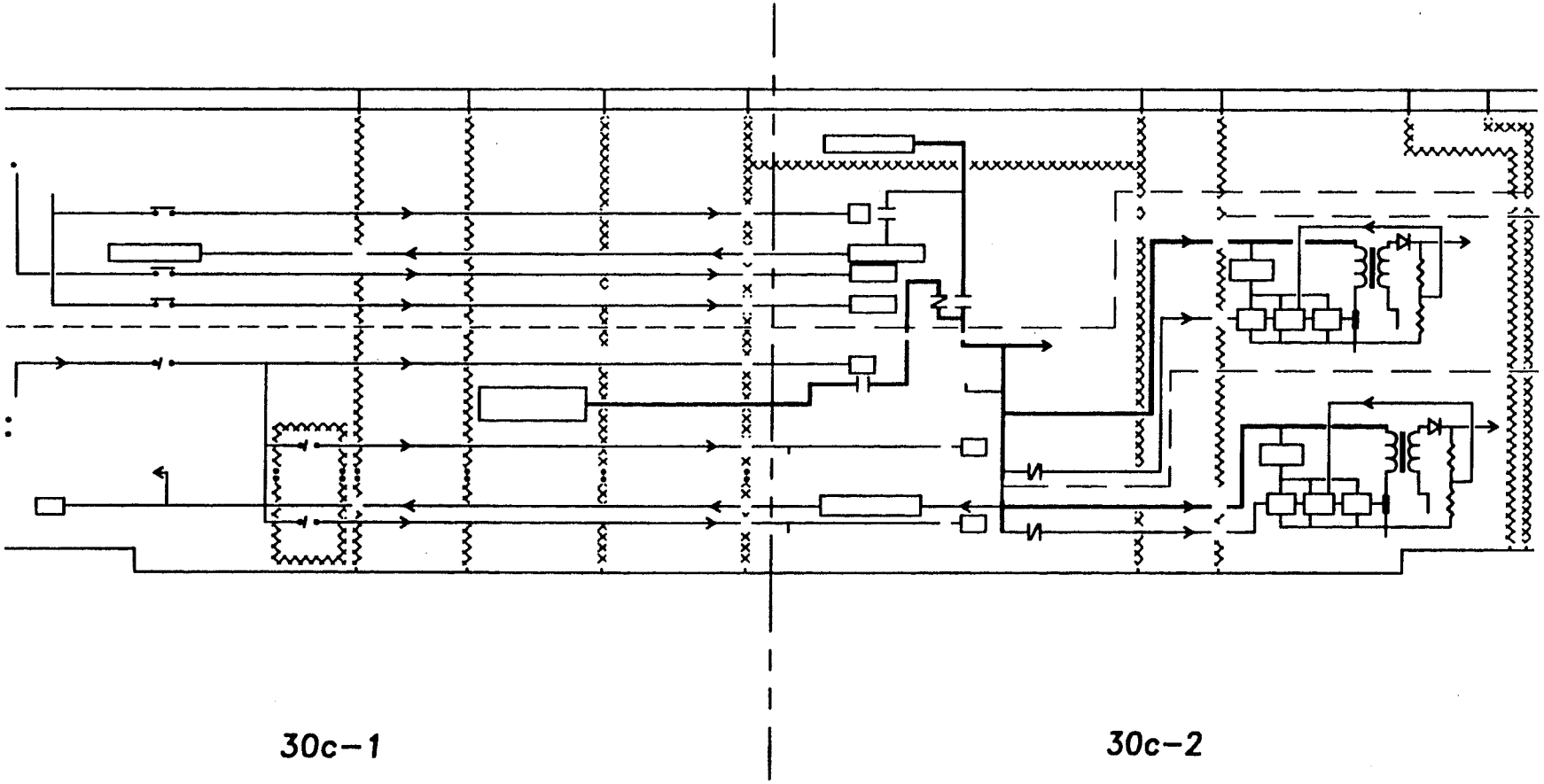
FIG. 30c (MAP)

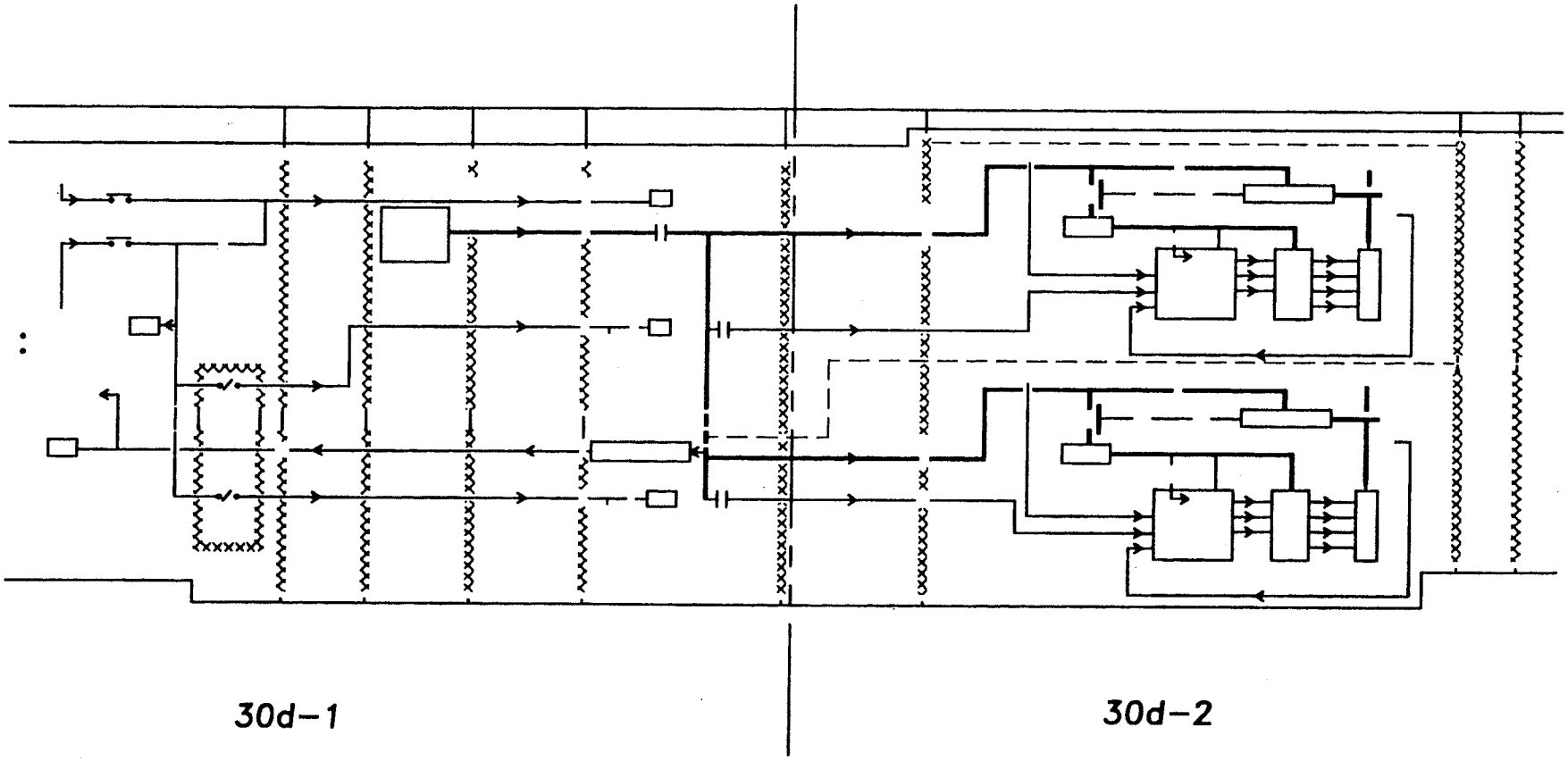
FIG. 30d (MAP)

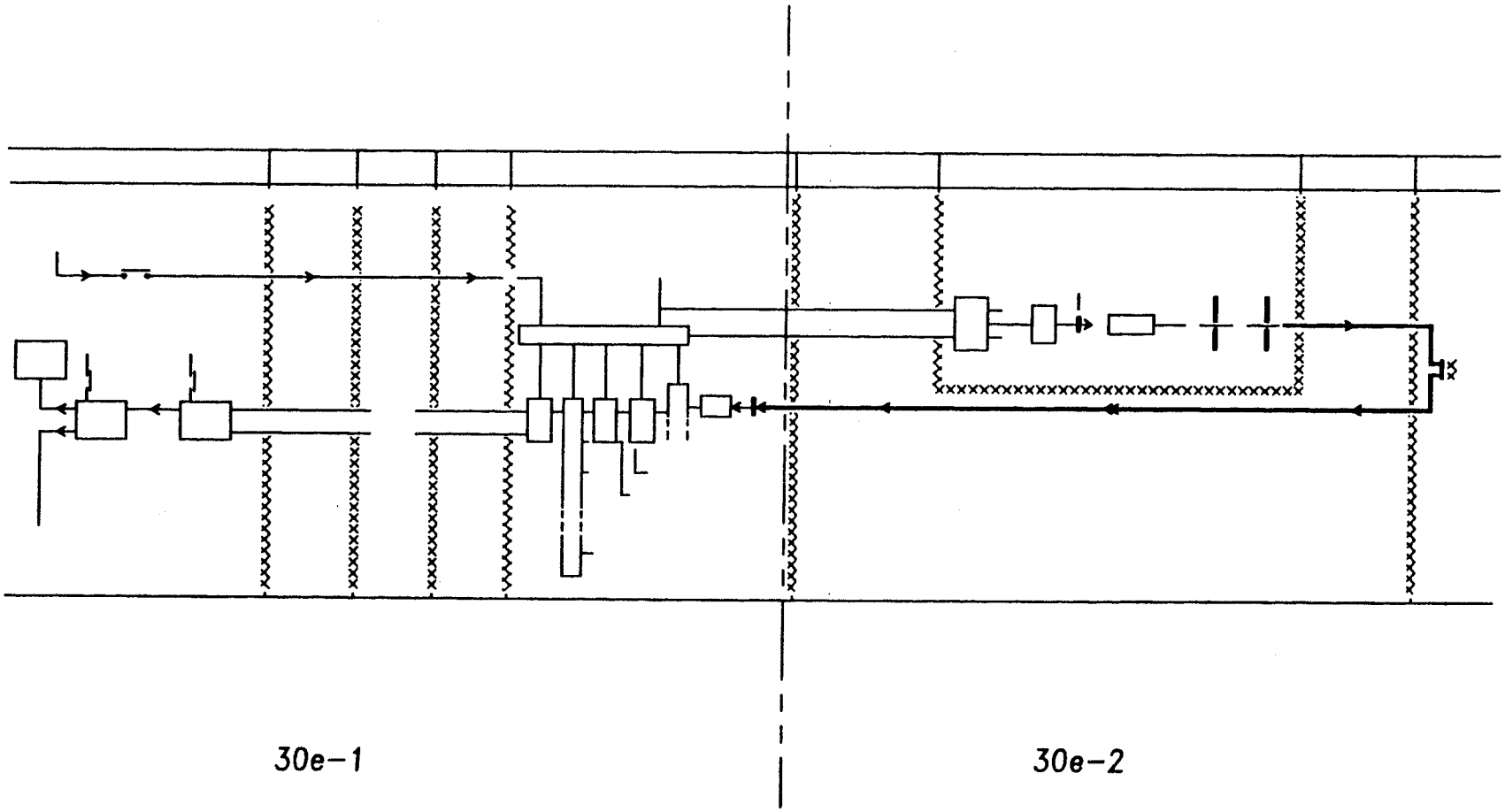
FIG. 30e (MAP)

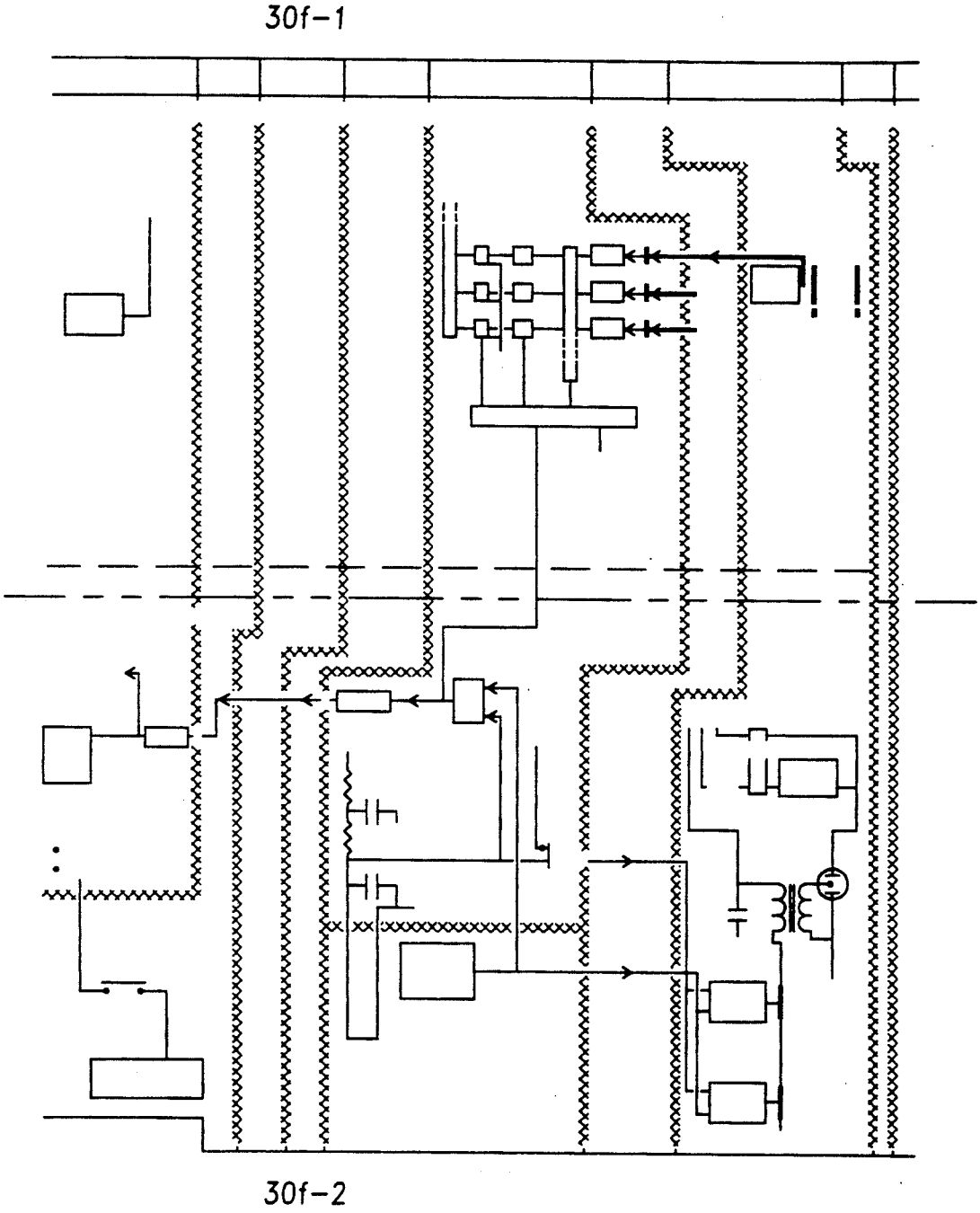
FIG. 30f (MAP)

LASER INITIATED ORDNANCE SYSTEMS

BACKGROUND OF THE INVENTION

1. Field of the Invention

The present invention relates generally to launch vehicle ordnance ignition system and in particular, to laser initiated ordnance (LIO) systems used for flight initiation and termination of launch vehicles.

2. State of the Art

Presently, launch Vehicles are used to propel devices (e.g., satellites) into space. For this purpose, energy sources such as solid and liquid fuel ordnances are provided. Electronic ordnance systems (OIS) are typically used to actuate the firing of an ordnance.

Upon initiation of a vehicle launch, there is a possibility of malfunction or error in launch trajectory and/or flight control. To account for such a situation, destruct charges are typically provided onboard the vehicle. These charges constitute a flight termination system (FTS), for destroying the vehicle while in motion. Flight termination destruct action involves simultaneously initiating destruct charges and other ordnance devices located throughout a launch vehicle.

Because of the potential risks involved in controlling the launch and flight trajectory of launch vehicles, range safety requirements are a key concern. These requirements primarily relate to OIS and FTS reliability standards. Currently, ordnance initiation systems do not comply with proposed range safety requirements.

For example, known electrical subsystems (e.g., exploding bridgewire firing units) for initiating ordnance activation in OIS or FTS control systems do not permit reliable testing. Further, the present explosive transfer assemblies (ETA) used to distribute energy to the various destruct charges limit OIS and FTS reliability to approximately 0.994, weigh a great deal, and are expensive and difficult to install. The electroexplosive devices (EED) used to initiate the present ETAs are also sensitive to stray voltages, and require the use of an in-line/-out-of-line mechanical safe-arm device to protect against inadvertent EED detonation.

Presently known systems such as the Atlas, Delta, and Titan ordnance systems all have non-compliant ordnance control systems in need of replacement. Further, testing energy-measuring loads prior to hookup must be performed for the EED-based systems about 5 days prior to launch with the known test equipment during a flight program verification (flight simulator) exercise.

A general diagram of an exemplary, known Delta II 7925 FTS system is shown in FIG. 1. The system includes a first stage 703 with solid rocket motor (SRM) boosters, a second stage 704 and a third stage 705, and performs both thrust termination and destruct functions.

Thrust termination events, plotted on the left side of the figure, are electrically controlled valving operations set in motion by Arm Signals issued by the command destruct receivers 700, 701 (CDR) in response to a properly coded transmission from ground-based range safety transmitters. The first and second stage thrust termination functions do not involve ordnance and are not within the scope of the present invention. Third stage thrust prevention/termination is presently accomplished by having a third stage destruct explosive transfer assembly (ETA) sever an electrical harness.

For purposes of background information, the first stage SRM booster destruction is effected by arming and monitoring an electromechanical in-line/out-of-line safe & arm (S/A) 706 containing a pair of electro-explosive devices (EEDs) 707, 708 via the first stage umbilical 709. Upon transmission of a suitably coded destruct command from range safety (which generally follows the thrust-terminating arm command by several seconds), CDRs fire the EEDs with destruct signals by closing internal relays to +28 Vdc. In the case of the first stage S/A, one EED is fired by the CDR 710 in the first stage while the second is fired by CDR 701 in the second stage.

The EEDs detonate ETAs which transfer energy to two linear cutting charges 711, 712 that destruct the first stage LOX and fuel tanks 164, 166 and, via nine redundant quick-disconnect ETAs, to nine circular linear shaped charges (CLSCs) 713 one on the front dome of each SRM. Explosive harnesses 714, 715 interconnect both EEDs to all of these 11 destruct charges so that failure of one EED does not impede any destruct action.

As shown in FIG. 1, the Delta II 7925 configuration uses redundant linear destructor assemblies 711, 712 which longitudinally rupture the LOX tank 164 of the first stage destruct device along its full length and the fuel tank 166 along part of its length. The rupturing disperses the LOX and fuel into the atmosphere. Each 63.8-foot long linear destruct assembly consists of six strands of PETN 100 plastic primacord, two of which are coupled to an explosive harness via explosive relays and unions which in turn are coupled to the energy transfer system (ETS) which terminates at the S-A outputs.

In addition, explosive relays are used on the two coupled strands to improve the reliability of initiating the other four. The first stage ETS of the current Delta II is designed to transfer the high energy (detonation shock) from the FTS firing units (S/A) redundantly to each destruct device.

For the second and third stage destruction, an S/A identical to that in the first stage is located in the second stage and is armed and monitored via the second stage umbilical 716. Upon range safety destruct command, each of the two second stage CDRs fires one of the two EEDs. ETAs transfer detonation from the S/A to a linear shaped charge 170, which destructs the second stage propellant tanks, and to four conical shaped charges 183 (mounted on the second stage) which destruct the third stage SRM 180. Each of the two ETAs 176, 178 leading to the third stage destruct harness is dressed around the third stage event sequencing ignition wiring harness to cut this harness. There is no ordnance cross-over between the redundant second stage ETAs other than that provided by the 1D47087 linear shaped charge itself.

The Delta II 7925 configuration uses a single 3.5-foot length copper sheathed, 300 gr/ft (RDX) linear shaped charge (LSC) 170 configured in a U-shaped configuration as the second state destruct device. Both ends are terminated (butt joint only, no fitting) with redundant 27.3-foot long lengths of 100 gr/ft (PETN) detonating fuze. The butt joint is maintained by a heavy wall molded polyethylene part which also fits over the U-shaped length of LSC to maintain the required standoff. The redundant detonating fuze assembly is connected to redundant 6.1-foot lengths of 2.5 gr/ft (HNS) mild detonating cold (MDC) wrapped with multilayer fiber-glass with an explosive relay and union. The opposite ends of the redundant MDCS attach to the S/A 172 located in a forward skirt of the second stage.

The U-shaped LSC mounts directly to both the fuel and oxidizer tanks 174 on the second stage. Upon destruct command, the two CDRs 700, 701, co-located with S/A 172 in the second stage, fire the S/A detonators which then initiate the LSC destruct device 170 to cut the tanks open causing the fuel and oxidizer to mix.

For third stage FTS, the Delta II 7925 configuration uses an ETS consisting of two strands of 70 gr/ft (PETN) primacord, each of which are connected on one end to the second stage ETS 716, 717 via ETAs 176 and 178 in FIG. 1. This connection is made using crimped explosive relays and a plastic tee. The opposite end of each primacord is routed through a hole in the aft end of two modified hemispherical-shaped charge destructors (MHSCD) which are mounted on the second stage side of a spintable structure. The charge destructors are represented as the conical charges 183 in FIG. 1.

The hole in each charge destructor is perpendicular to the centerline of the MHSCD and passes over a 68 milligram RDX booster pellet which is initiated by the side-breakout of the primacord detonation. The booster in turn initiates a 38 gram RDX main charge which then collapses the modified hemispherical linearly to create a high velocity jet.

The jet from each of the four MHSCDs 183 travels through air across the second stage/third stage interface (approximately 14.0 inches total) 185 to impact and rupture the solid rocket motor (SRM) case 180. The 38 gram MHSCs, commonly known as "oil-patch completion charges" in the industry, will produce a hole of 0.5 inch diameter in the motor case and the molten metal jet will cause the propellant to burn and vent outward through each hole produced. If either leg of the ETS fails, only two such holes are produced.

In addition, each leg of the ETS is routed around the third stage event sequencing system ignition wiring cable 182 enroute to MHSCDs. The side breakout of the primacord detonation cuts this cable to inhibit spin-up, separation, and solid motor ignition.

Presently, known energy transfer systems (ETS), such as the Delta II ETS are complex networks of various lengths of primacord, TLX, and FCDC (flexible confined detonating cord) all interconnected with a variety of explosive fittings, couplers, and relays. Further, in addition to deficient characteristics such as non-hermeticity and sensitivity, known destruct systems, such as that of FIG. 1, lacks inadvertent separation destruct system (ISDS) capabilities used with powered stages not containing CDRs.

Accordingly, there is a need for improved ordnance ignition systems having enhanced safety and reliability. Further, it is in the best safety management interest of the range safety agencies that any forthcoming OIS and FTS systems have as much in common as possible.

SUMMARY OF THE INVENTION

The present invention relates to ordnance initiation systems and methods having significantly improved safety and reliability characteristics. In a preferred embodiment, laser energy is used to fire both deflagrating initiators and deflagration-to-detonation devices via fiber optic cable assemblies (FOCA). These initiators and devices will be referred to as laser initiated devices (LIDs). Relative to the aforementioned explosive transfer assemblies, the FOCAs are, for example, 1/25th the weight, an order of magnitude more reliable, 1/5th the cost, and can be easily and thoroughly tested nondestructively. Although the LIDs contain moderately sensitive pyrotechnics, their electrical isolation renders them immune from inadvertent initiation by all electromagnetic and all credible abnormal optical environments.

Use of an LIO system modularity featuring six solid-state lasers per laser firing unit (LFU) is used in a preferred embodiment. The various LFUs (designated destruct firing units (DFUs) when used for FTS) are connected to ground and missile systems by redundant LIO interface units. These flight system interface units for the LIO/FTS are called range safety distribution boxes. An exemplary LIO/FTS in accordance with an exemplary embodiment (e.g., equipped with solid state lasers and S-level support circuitry) for the known Delta II system exceeds 0.9995reliability, weigh 200 lbs less than the existing FTS, and costs substantially less than a compliance EED/ETA system.

BRIEF DESCRIPTION OF THE DRAWINGS

Other objects and advantages of the present invention will become more apparent from the following detailed description of preferred embodiments when read in conjunction with the accompanying drawings, wherein like elements have been designated with like numerals, and wherein:

FIGS. 4, 4*a* and 4*b* show generic elements of a preferred LIO/FTS system;

FIGS. 8, 8*a*–8*c* show an exemplary BIT block diagram;

FIGS. 9, 9*a*–9*c* show an alternate BIT block diagram;

FIGS. 13, 13*a*–13*d* is a summary ship set interconnect diagram for an exemplary baseline system;

FIGS. 23, 23a—23d show a summary schematic of one-half of a DFU;

FIGS. 26, 26a and 26b show range safety distribution box circuits;

FIGS. 27, 27a and 27b show a control panel layout;

FIGS. 29, 29a and 29b show a summary system control architecture; and

DETAILED DESCRIPTION OF THE PREFERRED EMBODIMENTS

In the following discussion, section A reviews general characteristics of a preferred LIO/FTS system for a Delta II system. Section B then explains a technical approach for an exemplary baseline embodiment described in Section C. For purposes of the following discussion, particular reference will be made to an exemplary preferred embodiment of a flight termination system (FTS) for the known Delta II system. It will be appreciated by those skilled in the art that the invention is equally applicable to ordnance initiation systems as well, and in some cases, modifications useful for implementing preferred OIS embodiments will be described.

A. General Characteristics of a Preferred FTS Embodiment

Figure 1A:
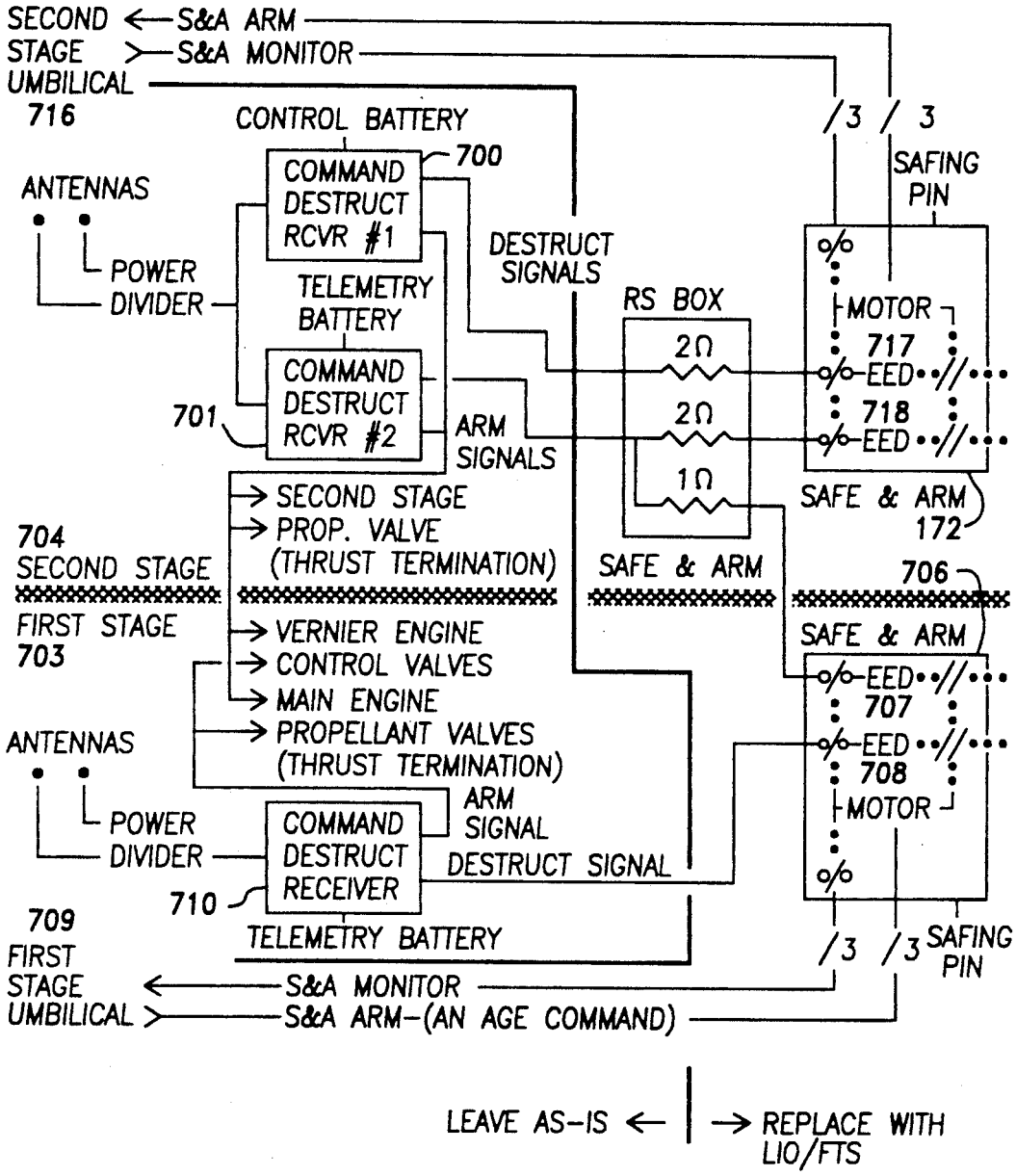
FIGS. 1, 1*a* and 1*b* show a general diagram of an exemplary, known FTS system.
Figure 1B:
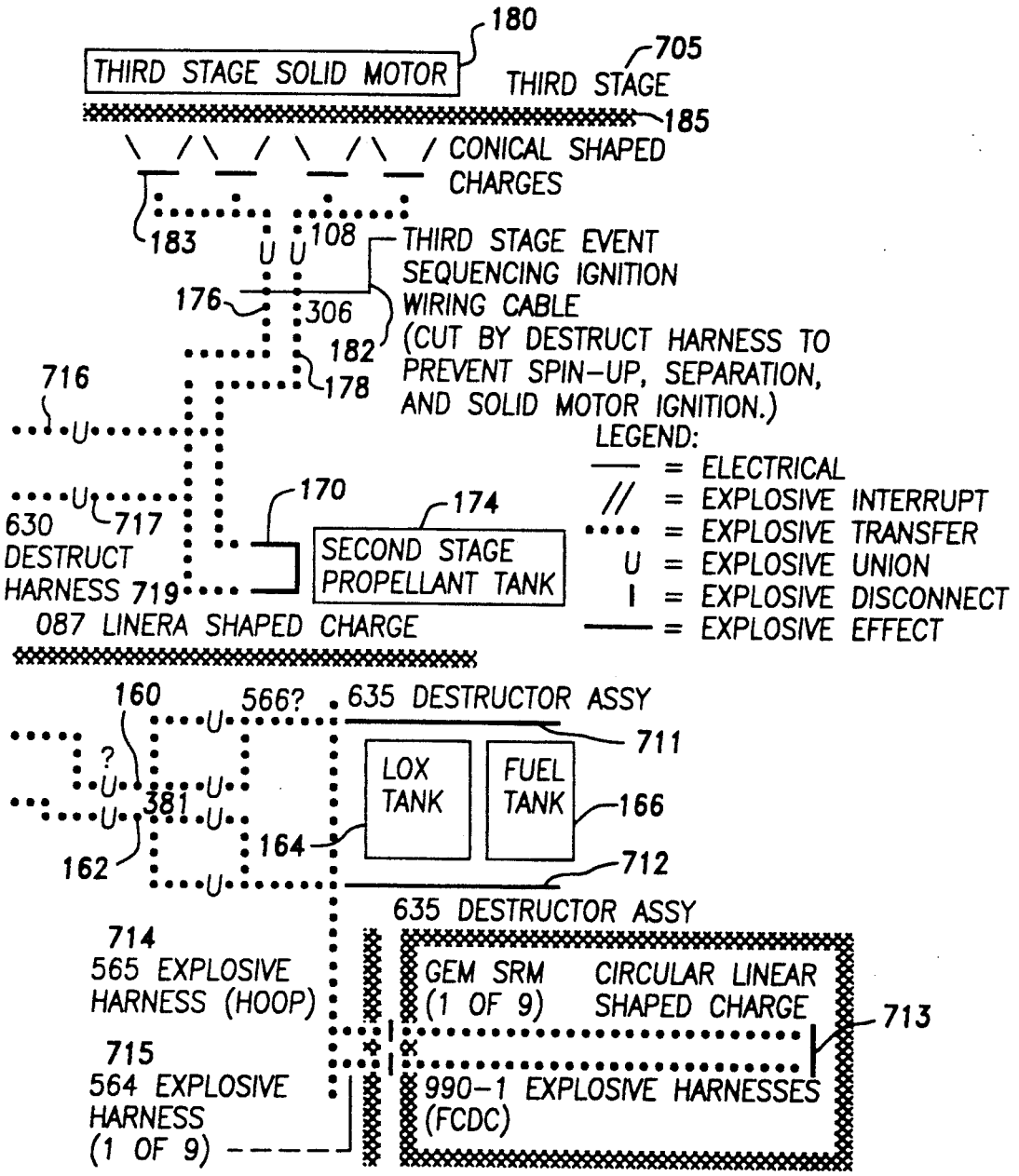
Figure 2:
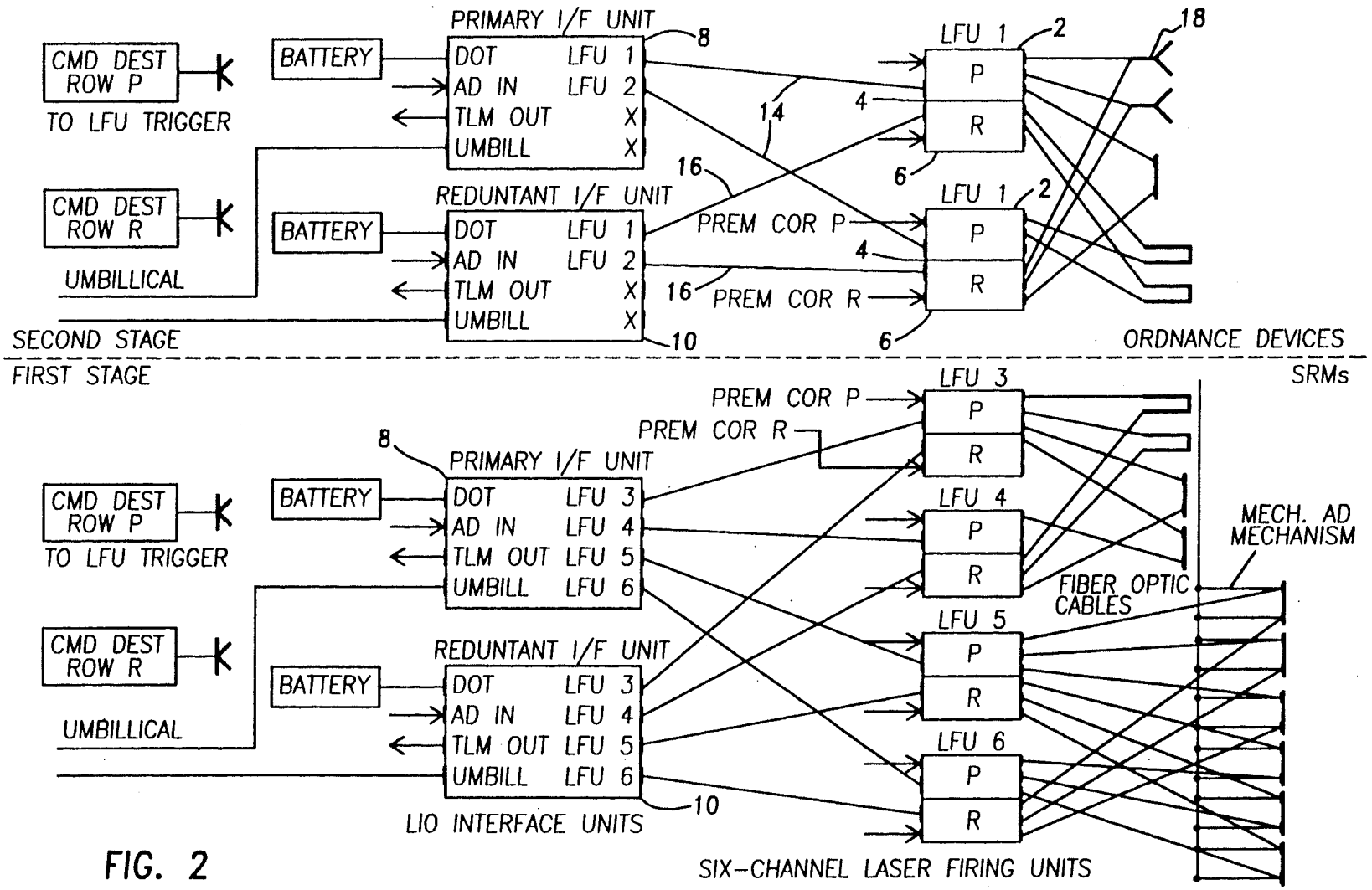
FIG. 2 shows a generalized diagram of an exemplary preferred LIO architecture for both FTS and OIS applications.

FIG. 2 shows a generalized diagram of an exemplary preferred LIO architecture for both FTS and OIS applications. The FIG. 2 diagram shows a modular system composed of six-channel laser firing units (LFUs) or DFUs labelled 2. Each LFU includes six solid state lasers, equally divided among two banks 4 and 6. A primary flight interface unit 8 and a redundant flight interface unit 10 receive signals from a launch vehicle interface via line 12 from a missile and ground support equipment (GSE) interface. Outputs from the interface units 8 and 10 are directed to the LFUs via lines 14 and 16. Each of the LFUs activate an ordnance via line 18.

Those skilled in the art will appreciate that the system can be generalized to two or more LFUs in each stage. At least two LFUs are used in each stage to comply with a desired scheme that each ordnance device is redundantly initiated by lasers located in different LFUs.

Further, autodestruct inhibit inputs are connected to each LIO interface unit 8, 10. These inputs are used to inhibit autodestruct operation during normal stage separation. Thus, the inhibit function can be derived from two independent sources to prevent a single point failure from falsely inhibiting autodestruct operation.

With the FIG. 2 architecture, the only significant variant between DFUs and LFUs is that while all DFU lasers are fired simultaneously (bank-fired) for FTS destruct, LFU lasers are fired in various size groups at different times (discretely-fired) to accommodate the OIS firing sequence. In a preferred embodiment, identical bank-fired DFUs and LFUs are used for FTS and OIS. However, it will be appreciated by those skilled in the art that a reduction in LFU count can be obtained by scheduling different firing times within the six-channel LFUs.

Further, while an FTS is armed on the launch pad, an OIS is, at the user's option, armed on the launch pad via a guidance computer (GC) or umbilical; or is armed in flight via GC. FTS fire command sources include CDRs (command destruct mode) and premature separation/breakup sensors (autodestruct mode), while OIS fire command sources include a guidance computer.

Likewise, the LIO Interface Units 8 and 10 are substantially identical in their core logic for LFU and DFU uses, differing only in their launch vehicle interfaces to missile and ground systems and in the number of firing unit services. In addition, when and if system interfaces are upgraded (e.g., to take advantage of bus standards), the LIO systems are easily adapted by changing the interface units 8 and 10, leaving LFU, DFU, and intra-system harnessing intact.

In a preferred embodiment, solid state Nd:YAG rod lasers produce an ample energy margin. It will, however, be appreciated by those skilled in the art that solid state laser diodes can be used to provide initiation energy.

Figure 3A:
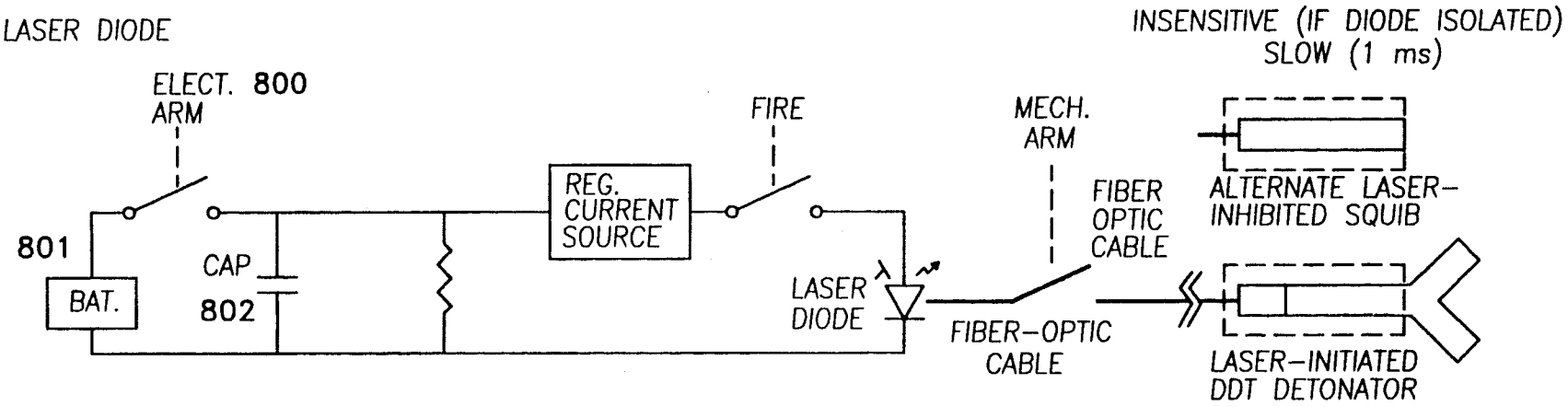
FIG. 3*a* shows a laser diode firing channel.

FIG. 3a shows a typical configuration for a laser diode firing channel. As in the case of ordnance initiation circuits in general, the electrical arming switch or switches 800 make energy available to the firing circuit.

For a system exhibiting optical power losses in hermetic optical connectors and stage-to-stage connectors, the laser diode should, for example, produce about 20 W and have a conversion efficiency of 33% (range cited is 20 to 40%), such that about 60 watts of electrical power is required. If the voltage drop across the diode is about 3 volts, then some 20 amps of current are required to drive the diode. Although this current would be available directly off a "robust" battery bus, the need to fire multiple channels simultaneously would result in preferred use of storage capacitors to accumulate the firing energy for each laser diode.

Hence, the arming switch(es) are illustrated between the system power source (battery) 801 and energy storage capacitors 802. This arrangement is similar to the arming switch locations for known electrical initiation devices, such as the exploding bridgewire (EBW) and exploding foil initiator (EFI) as well as rod laser firing circuits including th free-running rod laser as shown in FIG. 3b.

Figure 3B:
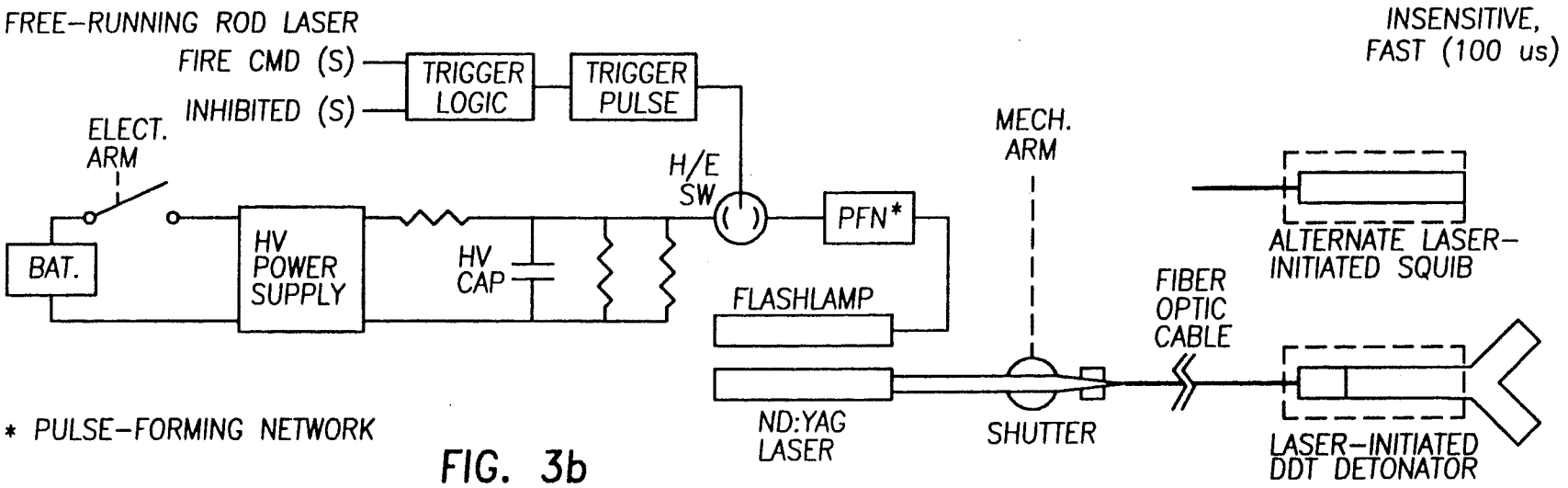
FIG. 3*b* shows a rod laser firing channel.

FIGS. 3a and 3b further show how laser-initiated squibs and laser-initiated detonators can be used interchangeably in laser diode and free-running rod laser systems by designing the detonators and squibs with the same initiation mixture (or mixtures having equivalent sensitivities). The squib is used wherever a deflagration output is required (e.g., rocket motor ignition, gas generator ignition, cable cutter, and so forth), while the detonator is used wherever a detonation output is required (e.g., destruct charge, explosive bolt, and so forth).

In a preferred embodiment, a one-laser/one-LID approach is used to avoid use of any moving parts other than safe-arm shutters. These latter mechanisms are operated only in the ground environment.

High-energy switching devices are used 10 to fire the flashlamps which pump the rod lasers. Since LIO/FTS systems are fully armed before launch, these switches constitute potential single-point failure mechanisms whose premature operation will inadvertently destruct the mission. Because of this criticality, known EBW (exploding bridgewire) range safety firing units use DOE-furnished Sprytron triggered vacuum gap switches for high-energy switching. Commercial triggered gas gap switches are also available at lower cost, but with an attendant reduction in reliability.

The selection of high-energy switches trades cost and availability against reliability. In an exemplary embodiment, two redundant trigger circuits and one triggered vacuum gap switch are provided per three-laser bank. Such an embodiment minimizes the number of switches required and thus reduces cost.

LIO technology affords the opportunity for a high level of built-in test (BIT). Two separate BITs will be discussed; laser energy BIT and continuity BIT. In the first test, laser energy output is measured by firing the laser into a built-in optical energy measuring device rather than into the ordnance initiation fiber optic cable assembly (FOCA). In the second test, a much lower-energy optical source is directed through optical paths of the firing channels to laser initiated devices (LIDs) and means are provided to confirm optical continuity of the paths.

BIT should also be considered within the context of non-built-in tests. For example, laser test firings into inert loads are conducted earlier in the missile assembly/launch processing cycle. BIT capabilities should therefore first address those system elements that are most subject to reliability degradation during launch processing.

As beneficial as BIT might be, it adds cost and complexity to the LIO systems. Additionally, laser energy BIT involves high voltage arming of the LFU/DFUs, and continuity BIT requires optical arming if its implementation requires safe-arm shutters to be opened. These partial arming requirements for BIT burden the LIO systems with additional safety inhibits and interlocks to guard against inadvertent ordnance firing during BIT exercises. However, because exemplary LIO/OIS and LIO/FTS systems include as many as 70 and 32 LIDs respectively, BIT can be cost effective.

The inherent safety of LIDs versus known EEDs renders end-to-end LIO tests relatively fast and simple. Further, LIO/FTS firings into inert loads can be performed within 24 hours of launch and satisfy range safety requirements without LIO/FTS BIT.

Regardless of the technology employed, the underlying philosophy behind an FTS is the ability to destroy an errant flight under all possible conditions to the extent that subsequent breakup poses minimal hazard to personnel and property. The Western (Vandenburg) and Eastern (Canaveral) Space and Missile Centers specify design, test, and performance requirements for flight termination systems in documents identified as WSMCR 127-1 and ESMCR 127-1 respectively. These range safety documents impose MIL-STD-1576, Electroexplosive Subsystem Safety Requirements and Test Methods for Space Systems.

None of the foregoing documents address the laser-initiation systems to be described herein. However, a pending USAF laser-initiated ordnance standard being processed at Aerospace Corporation and a pending NASA standard for laser-initiated devices will augment present government standards MIL-STD-1512 and MIL-I-23659 currently imposed on electroexplosive devices (EED) and initiators.

A review of WSMCR and ESMCR 127-1 requirements will not be provided. It will be appreciated that embodiments designed to comply with these requirements are merely exemplary. For example, the number of DFUs used in an FTS embodiment, may be modified as desired to reduce or enhance safety of the FTS (or OIS).

To comply with the foregoing requirements, an exemplary preferred embodiment of an LIO/FTS provides three positive and verifiable inhibits (two-fault tolerance) in all built-in test modes. Further, separate connectors are provided for safety critical redundant sub-systems.

An exemplary embodiment further minimizes connectors and provides discrete hard-wired ground arming and resafing control and ground safe-arm status monitoring. All control power in the FTS control console is provided by a main power switch. For multi-stage powered vehicles, an automatic destruct system (ADS) is also provided within FTS.

The proposed LIO/FTS also provides both command destruct and autodestruct of the solid rocket motors (SRMs). The proposed automatic destruct system (ADS) is activated by SRM or first-stage separation and remains operational for a keep-alive period after loss of operating power. Activation in response to vehicle break-up can also be provided. The proposed SRM and first-stage ADS systems operate all SRM and first-stage destruct charges, respectively.

In a preferred embodiment, the SRM ADS system is activated by lanyard-operated percussion detonators. The first-stage ADS system is activated by energized breakwires, which action is also used to fire the SRM destruct charges. Further, the first-stage ADS system is powered by redundant FTS batteries located in the first stage.

To satisfy redundancy requirements and, in particular, the requirement for maximum physical separation between redundant components, a primary channel of one DFU and a redundant channel of another DFU are used in an exemplary embodiment to fire each redundantly initiated destruct charge. This physical separation is also applied to the energy transfer system ETS, which includes fiber optic cable assemblies. To provide design simplicity, the ETS (typically consisting of many types of detonation transfer mediums and associated explosive fittings and couplers) is replaced with a single continuous fiber optic.

In a preferred exemplary FTS embodiment, the destruct devices themselves are at least 0.99995 reliable at 95% confidence. Given substantial initiation margins, all modern high explosives will detonate high order with a probability approaching 1.0 under all natural and induced environments. The bulk of the reliability allocation is therefore assigned to the LIO/FTS which is fully redundant.

For example, if the reliability of each redundant LIO/FTS=0.993, then the redundant system will be:

$$Rs=0.993+0.993-(0.993\times0.993)=0.99995$$

With the exception of the LID, the entire LIO/FTS including the ETS is fully testable in a preferred embodiment (as opposed to the existing one-shot detonation transfer lines). This reliability can be demonstrated at 95% confidence by a sufficient number of tests.

A preferred embodiment further permits arming of the LIO/OIS and provides an ability to monitor the armed status of three inhibits. The exemplary baseline embodiment to be described includes the provision for hardwire monitoring at the FTS/GSE console and provision of a telemetry interface. In addition, the baseline embodiment includes provisions for prelaunch hardwire resafing from the FTS/GSE console via two common-mode shutters in each DFU.

The exemplary baseline design uses S-level parts for flight-active functions, and nonstandard parts are screened up to that level to the greatest extent possible. The primary and redundant LIO/FTS systems use separate harnesses and connectors with the harnesses being separated as much as possible.

To satisfy specific component requirements, several design characteristics are implemented in the preferred embodiment. For example, hermetic sealing is provided on all DFUs, and GSE testability is provided, for which LIO is particularly suitable.

The LID reliability consists of the product of the reliabilities of a laser receiving window, an interface of the receptor charge to the window, the receptor charge, an interface of the receptor charge to the DDT charge, a DDT charge, a interface of the DDT charge to a booster charge, the booster charge, and the interface of the booster charge to the destruct device for a total of eight interfaces/elements. Because the LID is a one-shot device, a total of, for example, 446 can be fired as part of qualification testing to demonstrate greater than or equal to 0.993 reliability at 95% confidence as opposed to extrapolating data from a typical 40-shot Bruceton series.

In a LIO/FTS, the energy transfer system (ETS) is all fiber optic and transmits high energy in the form of photons. An in-flight telemetry monitoring system is also provided. An interface is provided in the exemplary baseline system to monitor inhibit status. A telemetry monitor (TLM) interface is also provided in the baseline system to monitor high-energy capacitors and trigger capacitors.

With respect to ground system test equipment, LIDs can be installed during launch vehicle build-out and the LIO/FTS is fully testable throughout its life cycle. Further, LID simulators can be produced in an alternate embodiment to record the optical energy at the end of the ETS. An FTS umbilical connects the LIO/FTS to a ground control console to monitor all desired functions.

In accordance with the preferred embodiments, an LIO approach will be considered on two distinct levels—first, features for achieving required performance within a single laser initiation channel, and second, integration of the several dozen required laser channels into an LIO/FTS system. The first level is dominated by optical, mechanical, and high-energy switching design considerations. The second level is dominated by electrical control and communications design issues.

It will be appreciated by those skilled in the art that all characteristics of the LIO must be evaluated with respect to performance (safety and reliability); producibility as a function of performance (not just cost); robustness (fault tolerance), and the relationship of these to the launch vehicle (ease of installation, launch vehicle build-out, maintainability, weight implications, and so forth), and risk (performance, cost, schedule). Accordingly, the preferred embodiments described herein are considered in all respects to be merely illustrative.

B. Technical Approach for Exemplary Baseline System

1. Overview

Figure 4A:
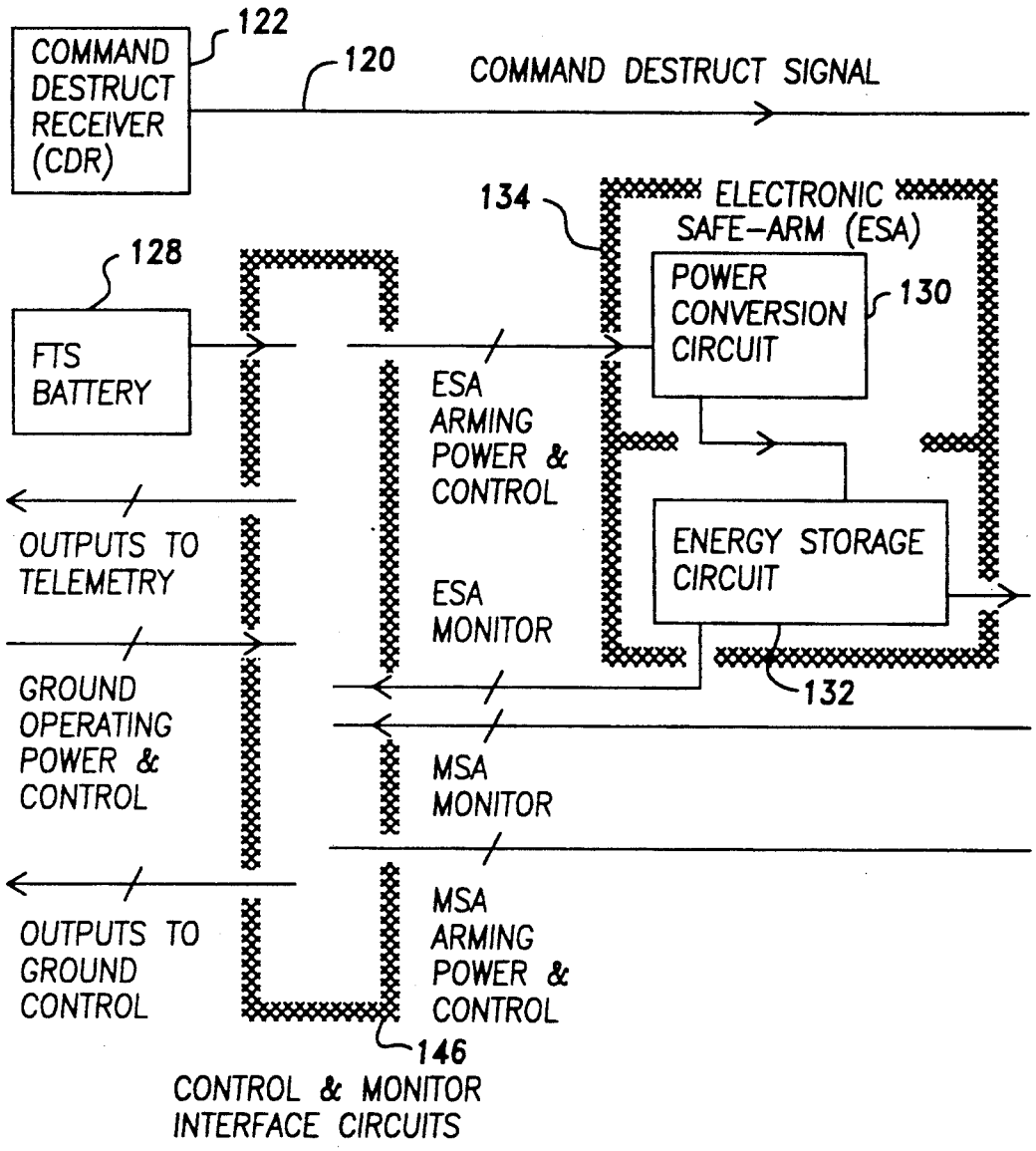
Figure 4B:
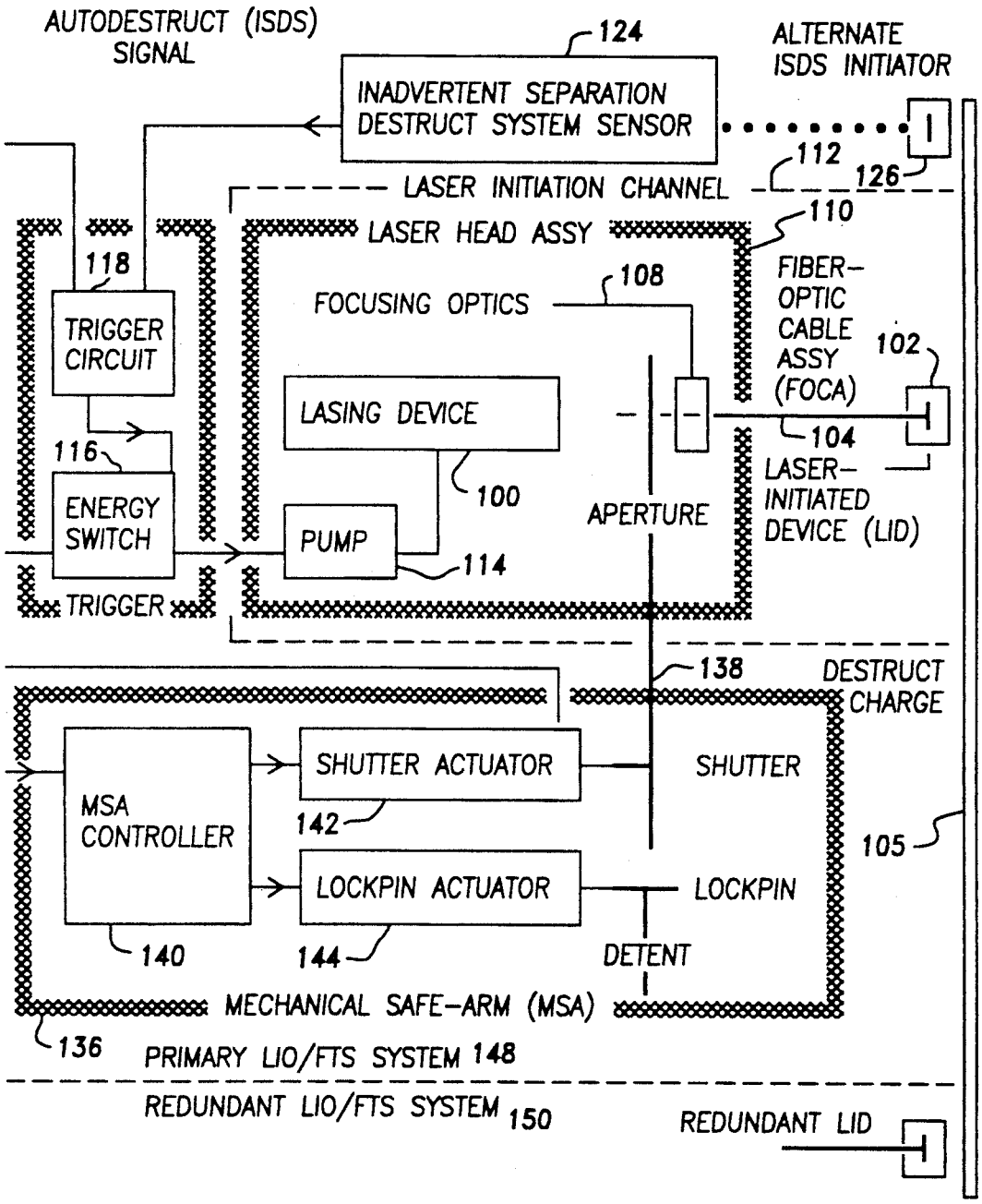

FIG. 4 shows the generic elements of an exemplary LIO/FTS system. A lasing device 100 is optically coupled to a laser-initiated device (LID) 102 via a fiber optic cable assembly (FOCA) 104 for activating a destruct charge 105. This FOCA operates as an energy transfer system (ETS) between the lasing device and the LID. The lasing device and focusing optics 108 constitute a laser head assembly 110. Each laser head assembly and its associated FOCA and LID constitute a laser initiation channel 112.

The lasing device 100 is made to lase by pumping energy into it. In the case of a solid state laser, the pump 114 converts electrical energy into optical energy to stimulate the laser. In the case of a laser diode, the pumping energy is electrical. The pump is operated by switching electrical energy to it via a firing switch, or triggering switch, 116. The firing switch in turn is controlled by a trigger circuit. The trigger circuit is fired by a command destruct signal on line 120 from one or more command destruct receivers (CDR) 122.

Autodestruct firing may be accomplished by a firing signal from an ADS, or inadvertent separation destruct system (ISDS) sensor 124. Alternately, the ISDS action may be accomplished by directly initiating the destruct charges via explosive transfer assemblies (ETAs) 126.

The electrical arming energy used to pump the laser should be present in the LIO/FTS system prior to launch. If the pump requires a power form other than that supplied by an FTS battery 128, then a power conversion circuit 130, and possibly an energy storage circuit 132, are required. Collectively, these are represented as part of an electronic safe-arm (ESA) 134.

To provide required ground safety, one or more mechanical safe-arm (MSA) devices 136 may be present to interrupt the optical path between the lasing device 100 and the LID 102. This interruption can be a displaced optical path element or a shutter 138. In the case of an optically-pumped laser, this interruption can also be effectively applied between the pump and laser. A mechanical safe-arm controller 140 and shutter actuator 142 control displacement of the shutter 138. An independently controlled and verifiable shutter locking device, represented as lockpin actuator 144, allow the MSA to be counted as two inhibits for range safety purposes.

The ESA/MSA elements are interfaced to ground and flight systems by control and monitor interfacing circuits 146. Built-in-test features to be described later represent additional elements not shown in the general FIG. 4 diagram. All of these elements are organized to form a primary LIO/FTS system having the desired number of LIDs. A redundant set of elements is organized to form a redundant LIO/FTS system. Each destruct charge or ordnance device is fired by an LID from each system (i.e., the primary system (P), represented generally as 148 and the redundant system (R), represented generally as 150).

Figure 5:
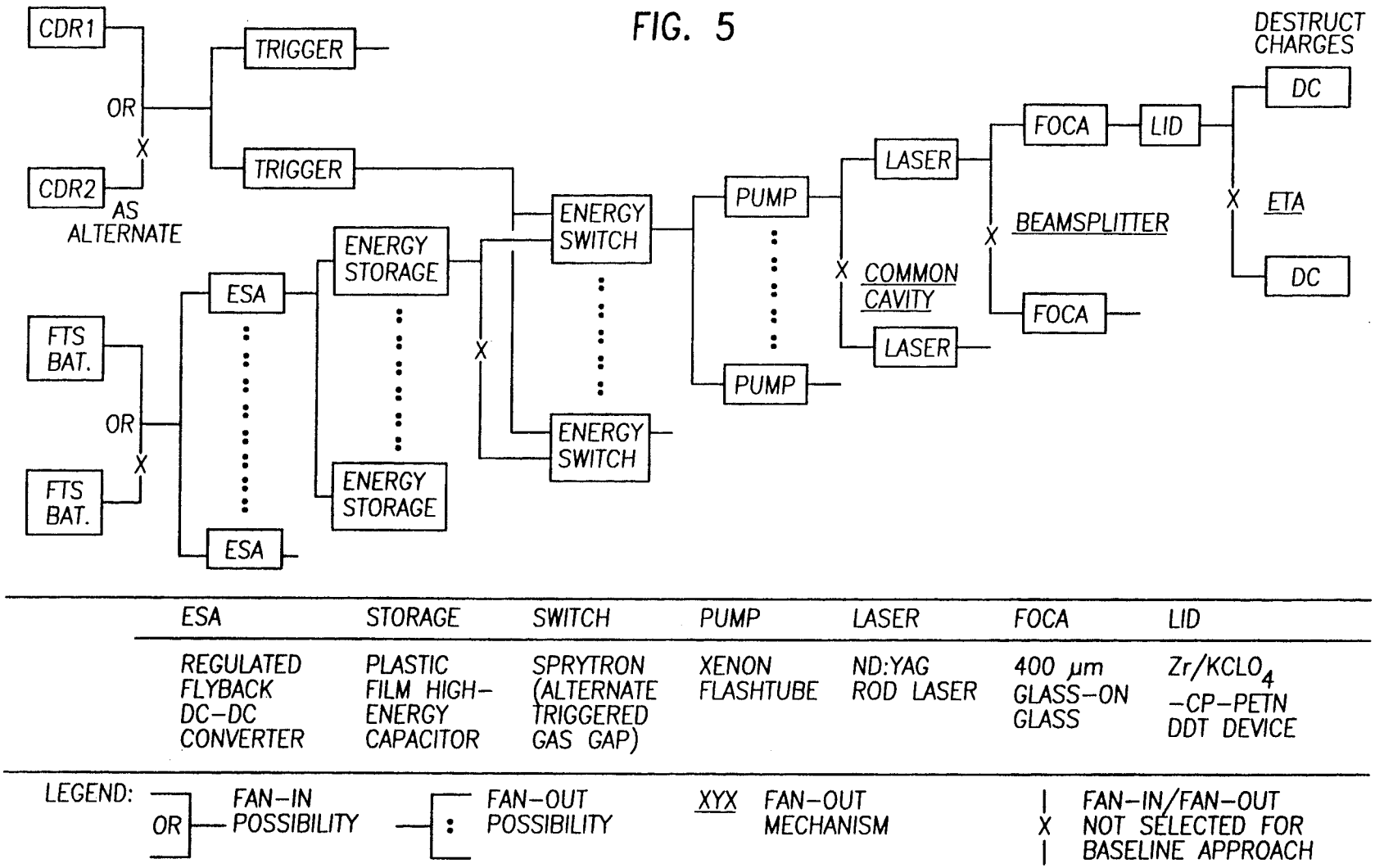
FIG. 5 shows exemplary fan-in and fan-out possibilities which exist between the launch-vehicle arming and triggering.

Although the laser head assembly shown in FIG. 4 includes one pump, one laser, and fires one LID through one FOCA, the elements constituting an LIO/FTS system can be combined in many ways. FIG. 5 shows exemplary fan-in and fan-out possibilities which exist between the launch-vehicle arming and triggering source, and the ordnance devices.

"Fan-in" refers to a combination of several stimuli to act on a single element. For example, just as two LIDs (P and R) are fanned-in to each destruct charge to enhance forward reliability, primary and redundant command destruct receivers (CDRs) or FTS batteries could be crossed over such that each is able to operate both P and R systems. In the exemplary embodiment discussed herein, a fan-in feature is only disclosed at the destruct charge.

"Fan-out" refers to the operation of several downstream elements from a common upstream element. Fan-out is used to reduce the number of elements required in the system. Fan-out reduces cost and can improve system reliability where the count of critical elements can be reduced. As FIG. 5 indicates, multiple ESAs are operated from the same power source, to charge multiple capacitors with each ESA, and to operate multiple pumps with each energy switch. However, in a preferred embodiment, only one laser is fired with each pump, and only one LID is initiated with each laser.

As mentioned previously, a preferred embodiment of an LIO/FTS system packages six lasers in each destruct firing unit (DFU). As described with respect to FIG. 2, each DFU consists of two sections, one controlled by the primary system and the other controlled by the redundant system. Each section contains a bank of three lasers and their associated ESA, energy storage, and triggering circuits. Each section also controls an MSA spanning all six laser outputs. Aside from these two common-mode MSAs, the DFU sections are independent. This arrangement provides fully redundant, positive resafing operation. A more detailed description of these features will be discussed with respect to the exemplary baseline embodiment.

2. Destruct Devices

Many, if not all existing destruct charges (e.g., those used with known Delta II systems) are non-compliant due to lack of hermeticity. Accordingly, in a preferred embodiment, the destruct charges themselves are replaced, and a cable cutter is supplied for third stage thrust prevention or termination. All of these devices are redundantly initiated by LIDs fired by DFUs over FOCAs. Again, exemplary embodiments will be described below in detail.

The Delta II 7925 configuration uses the graphite epoxy motor (GEM) as the solid rocket motor, SRM. The GEM destruct is accomplished using a single circular linear shaped charge (CLSC) assembly to cut an 8-inch diameter hole through the forward dome of each GEM. In the known FIG. 1 system, the CLSC is redundantly initiated by two explosive outputs from an electromechanical safe and arm (S/A) via a complex ETS consisting of a network of confined detonating fuze (CDF), TLX cord, FCDC, and a multitude of associated explosive fittings and connectors.

However, in a preferred embodiment of the present invention, the CLSC is configured to accept inputs from LIDs. Autodestruct operation of the charge is also provided and will be discussed later.

A brief discussion of the destruct devices mentioned previously will now be provided. As mentioned previously, an exemplary embodiment of the present invention essentially uses the known first stage destruct charges. The linear destruct charge configuration 711, 712 in FIG. 1 is replaced with a bulk charge/flying plate destructor (BC/FPD) which is directly initiated by redundant LIDs coupled to the FOCA. The BC/FPD will be described in greater detail with respect to FIG. 17.

Two redundant BC/FPDs are located within the first stage center body along with the redundant DFUs. One BC/FPD faces the LOX tank 164 (FIG. 1) and the other faces the fuel tank 166. Both provide a 6-inch minimum hole to disperse the LOX and fuel into the atmosphere, and additional massive (dependent upon filled versus empty volume) tank breakup can be anticipated. Further, a breakwire-type ADS is added to the first stage destruct firing units.

In a preferred embodiment, the second stage destruct device is also similar to that of the known FIG. 1 system. However, in a preferred embodiment, the U-shaped LSC 170 is reconfigured to accept LIDs (i.e., add two LID ports) and includes the addition of metal-to-metal seals. Further, the ETS is replaced with a FOCA.

For the third stage destruct, a preferred embodiment (e.g., FIG. 20) includes replacement of the ETS with a FOCA to eliminate the ETS cable cutting feature. Thus, a separate guillotine type third stage cable cutter is provided, along with a separate PAM (payload assist modules) destruct device.

The holes produced in the motor case by the existing MHSCs (e.g., 183 in FIG. 1) are acceptable. In a preferred embodiment however, the MHSCs are reconfigured to accept LIDs (i.e., add an LID port to the MHSCSD) and to include the addition of metal-to-metal seals.

In an exemplary embodiment, the separate cable cutter is a straight-forward propellent-driven guillotine design with a suitable opening that passes over the third stage event sequencing system ignition cable without disconnecting either end of it. The third stage cable cutter is hermetically sealed and includes two redundant FOCA ports in lieu of the LID ports used elsewhere since detonation input is not required. The FOCA interface is mechanically and optically identical to the LID interface so that laser firing channels can be used interchangeably between the cable cutter and the destruct charges.

3. Laser Initiated Devices (LID)

All of the LIDs required for the LIO/FTS destruct charges provide detonation outputs. In an exemplary embodiment, deflagration-to-detonation (DDT) type LIDs are used for the LIO/FTS. Alternately direct detonation of an insensitive explosive such as HNS can be performed with optical energy. The direct detonation approach is useful for applications requiring the ultra-precise timing of laser-initiated events. For example, a mechanism similar to that used with exploding foil initiation (EFI) can be used except that the shock-initiating flyer is propelled by a plasma generated by optical vaporization of some material rather than by the high-current vaporization of metal foil.

Direct detonation requires that a very high level of laser energy be delivered to the plasma-forming material within a very short period. The short pulse width can be achieved with, for example, a Q-switched laser.

Figure 6:
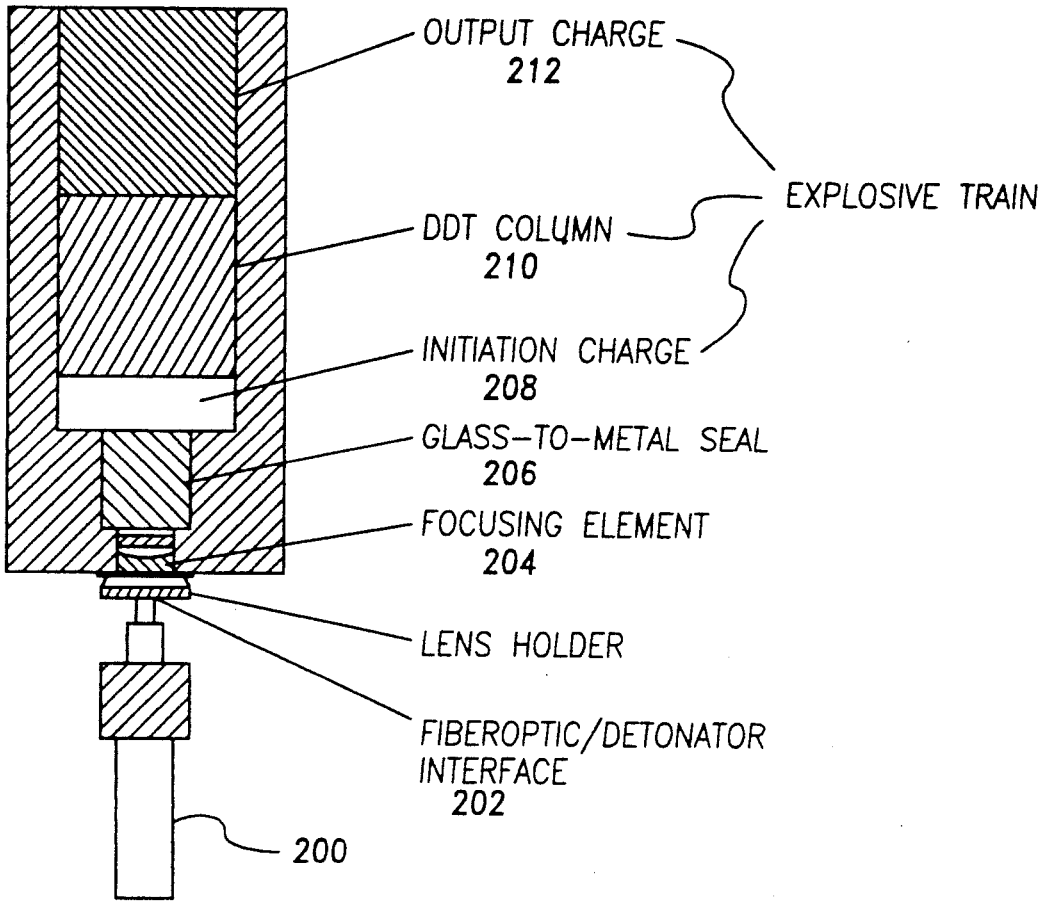
FIG. 6 shows a DDT laser initiated device.

FIG. 6 shows the basic elements of a DDT LID. In the DDT, laser energy is directed via a fiber optic cable 200, an interface 202, a focusing element 204 and a glass-to-metal seal 206 at a pyrotechnic material 208 representing an initiation charge.

The laser energy raises the pyrotechnic material to its auto-ignition temperature. This initiation material in turn ignites a column of a second pyrotechnic material 210 selected for its ability to generate a detonation output from a deflagration input. This DDT column must be adequately contained (confined) for reliable transferto-detonation. The DDT column then detonates an output charge 212 which is the donor to the destruct charge being detonated by the LID.

Since the initiating energy is delivered optically, the LID has no electrically conductive elements other than its case. Therefore, other than at the small aperture through which the initiating optical fiber must pass, the LID housing acts as Faraday shield, effectively isolating the pyrotechnic materials from both conducted and radiated electromagnetic hazards. In a preferred embodiment, the LID is hermetically sealed.

Further, in a preferred embodiment, the selected initiation mixture is $Zr/KClO_4$ (zirconium potassium perchlorate), which is identical to the NSI (NASA standard initiator) ignition mixture, and has an autoignition temperature of 550 degrees F (287° C.). The selected DDT material is CP, which will detonate when its temperature reaches 680° F. (360° C.). The selected output charge is PETN, which melts at about 392° F. (200° C.). Thus, in case of a fuel fire hazard, the PETN will melt. This interrupts the explosive train well before the $Zr/KClO_4$ ignites or the CP spontaneously detonates.

In direct conflict with the fuel fire hazard criteria, the LID initiation mixture must be selected for an autoignition temperature low enough to be attained with fiber-coupled laser energy. The complete model of thermal ignition by optical energy is complex. Temperature rise is the result of molecular agitation caused by the absorption of photons. The absorption of a given pyrotechnic mixture is wavelength dependent, and is also affected by the grain size of the material.

In addition, since the initiation mixture is in contact with the optical interface, the LID housing, and the CP column, its temperature rise depends upon the net difference between the rate of absorption and dissipation. For preferred laser pulse durations, only the optical interface presents a significant thermal sink. However, for lower levels of steady-state irradiation, such as might be used for built-in-continuity test, the autoignition mechanism should be modeled as a volume phenomenon.

Empirical results for a given physical and chemical LID configuration and a given wavelength of light show that initiation depends upon both the incident energy density (Joules/$cm^2$) and the duration of exposure (laser pulse width). That is, for an amount of energy capable of producing All Fire performance in a short period of exposure, performance deteriorates to No Fire as the same energy is delivered at progressively slower rates.

Similarly, if the total energy and period of exposure are held constant, All Fire performance achieved with a small spot size deteriorates to No Fire performance as the spot size is progressively increased. Both these results conform to the thermal dissipation model that, for a given amount of incident optical energy, predicts the initiation material temperature rise to both the spatial and temporal concentration of the incident photons.

The $Zr/KClO_4$ mixture, when tested under thermal dissipation conditions similar to those of the proposed LID, demonstrates an initiation threshold (maximum No-Fire level) of approximately 1.0 J/$cm^2$ when illuminated by a 400 um diameter spot of 1.064 um light for 200 us (half-power pulse width). Under the same conditions, 10 mJ of energy (an energy density of 7.9 J/$cm^2$) provides minimum All Fire energy.

Therefore, in an exemplary embodiment, 30 mJ is used to satisfy 300% All Fire energy margin requirements. The preferred embodiment supplies 35 mJ, an energy level easily achieved with a small, non-Q-switched Nd:YAG laser. Therefore, $Zr/KClO_4$ is selected as the initiation mixture.

For the DDT column, CP is selected as an exemplary, preferred DDT material. The choice material for output charges is PETN. PETN has a charge weight nearly identical to existing EBWs, and has the relatively low melting temperature discussed above.

Since the DDT LID must be hermetic and also provide sufficient containment for DDT action, a conservative optical interface, such as a thick glass window is sealed to the LID housing by a glass-to-metal seal. This seal is of the classic compression type, using silica-based glass for high optical transmission efficiency and a 304L stainless steel ring that is laser-welded to the LID housing.

For example, DDT LIDs can be fabricated for a 155 mm cannon primer using 0.250 inch windows. These windows can withstand the 60 Kpsi propellant back pressure generated by the cannons without leaking.

Unlike EEDs and EBWs, whose performance are degraded by test currents or other factors that create a void between the initiating wire and the initiating material, a small gap between the optical interface and the surface of the initiating material is not critical. However, a window that is thick relative to the diameter of the initiating optical fiber causes an increase in the spot size impinging the initiating mixture, since light exiting an exemplary optical fiber used diverges at a full cone angle ranging from 24.2 to 42.4 degrees.

The spot size will exceed the fiber diameter if this light must pass through a glass window prior to impinging the initiation mixture and the diameter will grow as the window thickness is increased. To compensate for this spot dilation, a converging lens is provided in front of the window to focus the incident energy back to a 400 um diameter spot at the initiation mixture surface. To aid focusing, the window should be as free of straie as possible. Further, to provide selective rejection of built-in-test optical energy, in a preferred embodiment, a dichroic filter that reflects approximately 98% of the test energy while passing greater than 95% of the 1.064 um laser energy is used.

The optical/explosive interface approach described above is consistent with the use of simple and inexpensive industry standard fiber-optic connectors for the attachment of the initiating optical fiber to the LID. In those cases where it is necessary to prevent the false connection of FOCAs to LIDs, mechanically keyed fiber-optic connectors can be used.

However, it will be apparent to those skilled in the art that alternate optical/explosive interfaces can be used. For example, embedding the fiber in the initiating material, or having its end in close contact with the material, prevents the optical beam from broadening, and preserves a high energy density, which is favorable for initiation. This can be accomplished by implementing the optical interface as a short stub of optical fiber hermetically sealed in a header with low-melting point glass, such as S-glass. Alternatively, the fiber can be metalized and soldered into a header. Alternately, in the case of a laser initiated squib, where the backpressure containment requirements are moderate, and where material compatibility regulations permit, the stub can be sealed into a header with epoxy.

Regardless of the method of sealing, the hermetic stub is interfaced to the energy transfer FOCA in the same manner that two lengths of FOCA are interfaced to each other. That is, the emitting and receiving fiber faces are concentric and nearly touching. This coupling provides the same optical power loss as an in-line FOCA connector. To facilitate continuity testing using a two-fiber approach, the hermetic stub can be made of a somewhat larger diameter fiber as the energy transfer FOCA, and the face to face distance between the energy transfer fiber and the stub can be made somewhat larger. The return continuity fiber face, placed adjacent the energy transfer fiber face, then receives energy reflected off the stub face. This reflection can be enhanced by applying a dichroic filter to the stub face which is reflective at the continuity test wavelength.

4. Fiber Optic Cable Assembly (FOCA)

The use of fiber optic energy transfer in preferred embodiments of the present invention affords several advantages in addition to those already mentioned. Although the current ETS can be retained in alternate embodiments and initiated with LIDs embedded within the DFU, a FOCA is provided between multiple DFUs and the LIDs at the destruct device end of preferred embodiments. The FOCA still transfers high energy in the form of photons from the firing units to the destruct device initiators. This approach is relatively simple, and reliable.

More particularly, all explosive interfaces are eliminated thus simplifying installation in a launch vehicle. Further, FOCAs can reduce launch vehicle build-out hours by a substantial amount over the current ETS. In addition, the inert FOCAs can be installed by less skilled assemblers in any factory environment, and the weight savings provided by the FOCA over the current FTS will increase payload capability.

FOCAs are also cost effective. For example, FOCAs are a fraction of the aggregate cost of individual ETS components procured from various vendors. Finally, and most significantly, the current ETS consists of non-testable (except by LAT(lot acceptance test)) one-shot components while the FOCA can be 100% tested, at will, throughout its life cycle.

In preferred embodiments, FOCAs are selected on the basis of optical transmission loss, optical coupling and manufacturing considerations and mechanical strength. Telecommunications is the major optical fiber application in both military and commercial systems. The military is making increasing use of optical fibers for remote sensing and remote command and control, as in the NLOS (non-line-of-sight) missile and various unmanned land vehicle programs.

For long-haul links, the fibers are engineered to provide the lowest possible attenuation at the wavelengths used, which are typically in the near infrared (1 to 2 nm) range. This performance is satisfied only by glass-on-glass fibers. Cost-sensitive applications are starting to be served by plastic optical fibers. Because the FOCAs used in preferred embodiments of the LIO/FTS should introduce as little energy loss as possible, glass-on-glass optical fibers having a fused silica core and a fluoride-doped fused silica cladding are used.

Optical fibers with the required optical performance are available in diameters ranging from 100 um up to 600 um. Smaller diameters provide some advantage in ordnance initiation because they produce smaller spot sizes and hence greater energy densities for a given energy level coupled into the fiber. However, the smaller diameters present significant system design and manufacturing challenges.

The smaller the fiber diameter, the harder it is to couple energy into the fiber such that care must be taken in designing and assembling the laser head optical elements used to focus laser energy onto the end of the fiber. Further, the smaller diameter fibers also require more precise alignment of optical connectors used in the missile assembly and launch processing environments.

Thus, in preferred embodiments, a relatively large 400 um diameter fiber is used. This diameter does not present any significant alignment problems in the system and yet produces a small enough spot size to meet the LID initiation energy margin with an Nd:YAG laser.

The LIO/FTS FOCAs should be as rugged as possible to survive both flight environments and handling during installation and launch vehicle (LV) processing. Fortunately, installation and environmental stresses experienced by telecommunications fibers are also significant, and the field-deployed optical links developed for military use must withstand severe mechanical stresses.

Figure 21B:
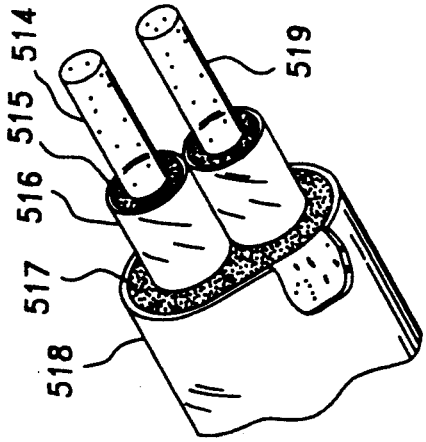
FIG. 21 shows a typical fiber-optic cable assembly (FOCA)
Figure 21A:
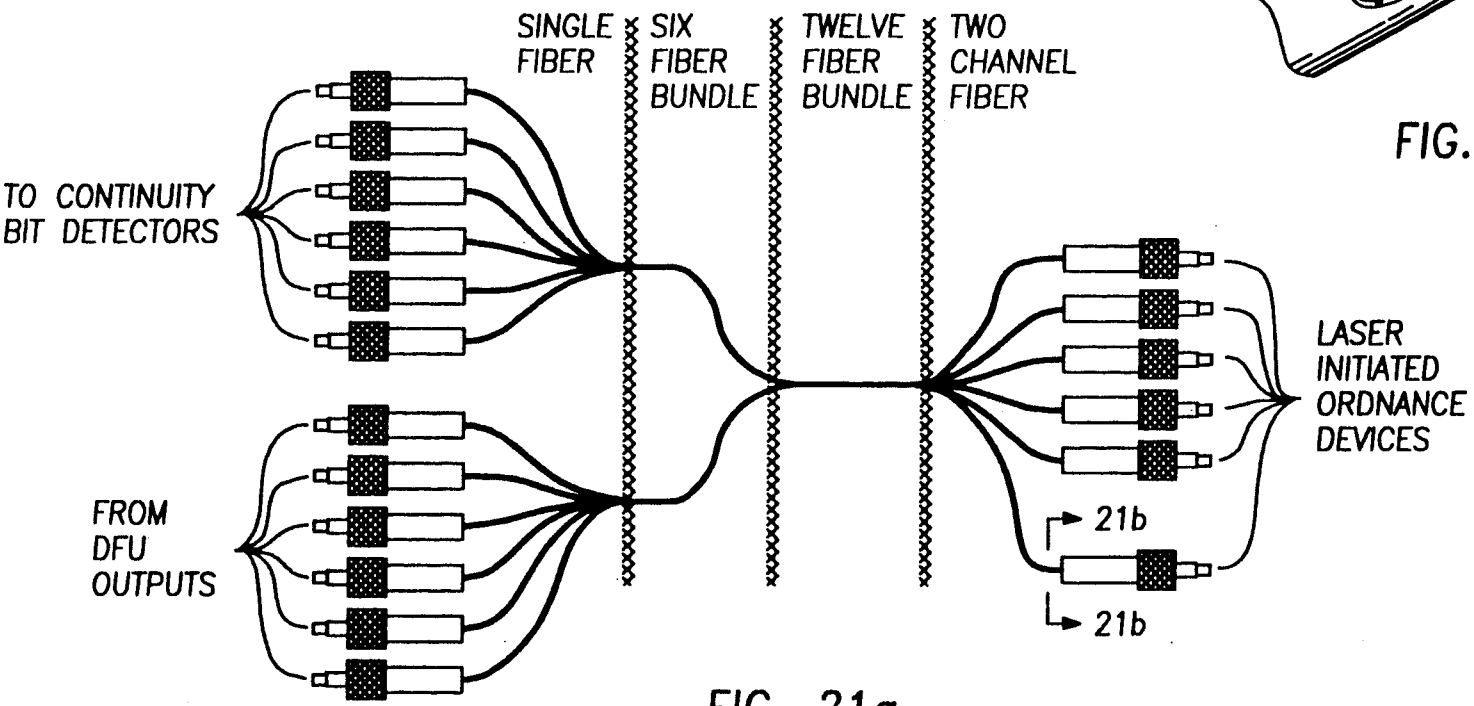

A fiber-optic cable, such as that shown in FIG. 21 can be manufactured from Hareaus Amersil preforms, and provides adequate mechanical properties. The glass cladding is covered by a polyimide buffer to protect the optical elements from abrasion. This buffer is covered with two layers of Kevlar braid to provide strain relief. A high density polyethylene outer jacket provides moisture and abrasion resistance.

FOCA connectors are also selected on the basis of various considerations, such as, optical requirements. Connectors used in the laser-firing channels exhibit well-controlled low optical loss characteristics under all rated thermal and vibration environments. Fiber optic connectors depend upon holding the ends of the two mated fibers parallel and concentric to maximize energy transfer. To avoid mechanical damage, spacing between fiber ends is maintained between 5 and 30 um. For 400 um fibers, center-to-center concentricity of less than 60 um is required to hold losses to less than 1.5 dB per connection.

A preferred embodiment of the LIO/FTS system which uses dual-fiber connections at LIDs will be described. A modified screw-on industry standard connector is used in a preferred embodiment because it is available to standard MIL-C-83522 and is relatively inexpensive. The connector is modified to accept two fiber optics. The connector provides adequate strain relief with conventional assembly techniques. The industry standard connector, once installed, is prevented from loosening under vibration by safety wiring.

Stage-to-stage transition of initiating FOCAs is avoided in a preferred embodiment except at the first stage/SRM interfaces, where each SRM receives redundant FOCAs. The initiating FOCA interconnects should be physically separated. A two-fiber quick disconnect (initiating and continuity BIT FOCAs) can be used for each SRM interface (P and R). Further, to provide convenient harness rework, single-fiber industry standard connectors are used to terminate the initiating FOCAs to hermetic industry standard feedthroughs on the DFUs.

5. Laser and Output Coupling

In a preferred embodiment, a set of solid state laser and associated output couplings are included with each DFU. A wide variety of lasing devices has been developed over the years to satisfy various scientific, industrial, commercial, consumer, and military requirements. Accordingly, the invention is not limited to use of such lasers. For example, laser diodes can also be used in alternate embodiments.

Laser diodes produce coherent light when operated from a current source; that is, they are electrically pumped. The diodes can be prepared to emit light mainly from the front facet or proportionally from both rear and front facets. The emerging light is uncollimated and diverges in an elliptical cone.

To achieve greater power levels with laser diodes, junctions can be stacked to produce "striped arrays" with overlapping output beams. To achieve greater instantaneous optical power levels, laser diodes can be operated in a pulse mode by supplying short pulses of drive current well in excess of continuous wave (CW) thermal operating limits. However, pulse widths required for ordnance initiation can exceed the pulse mode limits, forcing the diodes to be operated in the "quasi-CW" mode. Recent laser diode arrays have been demonstrated to produce several watts in CW operation.

In a preferred embodiment, relatively inexpensive solid state laser and xenon flash-lamp components are used. Rod lasers made of ruby, Nd: glass, Nd:YAG, and other doped, glassy materials lase when stimulated with a sufficient intensity of optical energy spanning the proper wavelengths; that is, they are optically pumped.

Another condition for lasing is that the rod is operated in an optical cavity formed by two parallel reflective surfaces: a totally reflective surface at the rear of the cavity and a partially reflecting one at the front. These surfaces reflect and re-reflect lasing energy back and forth through the rod. Thus, the optical intensity in the rod builds to a high enough level to induce stimulated emission of the majority of electrons pumped to higher energy levels by the pumping photons. When this occurs, highly collimated coherent radiation is emitted through the front facet of the cavity.

The conversion efficiency of this type of laser is very low (1% for the type selected). Therefore, it is not feasible to operate them in a steady state mode because sufficiently intense steady state pumping sources are not presently practical. When pumped by a pulsed optical source, the laser output envelope closely follows the pump's output envelope. However, if the pump output is not sufficiently high, the rod laser will not lase at all.

Satisfactory optical performance is obtainable with either Nd:glass or Nd:YAG rods. Nd:glass has the higher Nd concentration and hence conversion efficiency. However, Nd:YAG possesses more mechanical strength (Knoop Hardness of 1215 versus 543.6 for Nd:glass) and is available to existing MIL-STDs.

Therefore, a preferred embodiment uses Nd:YAG lasers, which lase at 1.064 um, a region near infrared which is favorable for both fiber transmission and absorption by the proposed LID initiation mixture. A self-resonating rod, with the reflecting surfaces plated onto the ends of the rod, or an externally resonated rod with separate reflectors can be used with the laser. The self-resonating approach is preferred for ELV applications because it reduces the number of elements that must be kept mutually aligned.

To achieve the desired performance in a compact format, a rod length of 2 inches (50.8 mm) is selected, which is available as a MIL-SPEC item from several manufacturers (e.g., Allied-Signal Synthetic Crystal Division of Charlotte, N.C., and EG&G Electro-Optics of Salem, Mass.). The rod thickness must satisfy both focusing requirements, (that favors a thin rod), and mechanical strength, (that favors a thick rod). Accordingly, a 3 mm diameter rod is used in an exemplary embodiment to achieve the best balance between these objectives.

In a preferred embodiment, the output coupling of the laser includes a focusing lens 108 (FIG. 4). More particularly, to successfully couple laser energy into a 400 um diameter fiber 104, the energy must be focused to a small spot, preferably 100 um diameter, impinging the end of the fiber with a full-cone convergence angle of 24 degrees or less. The concentricity requirement is more severe than the 60 um offset error tolerable in fiber-to-fiber coupling. Therefore, the laser rod, the focusing lens, and the receiving optical fiber should be held in precise mutual alignment throughout the high random vibration environment.

The needed focusing accuracy can be achieved with a single uncoated converging lens of sufficiently long focal length to confine the laser energy within the fiber's cone of acceptance. The converging lens can be a conventional lens such as plano-convex, or it can be a gradient index (grin) lens. An anti-reflection coating can also be used to minimize optical losses due to Fresnel reflection at the lens surfaces. The preferred embodiment uses a coated plano-convex lens as the focusing element.

It is also possible to precede the focusing lens with a collimating lens if the divergence of the laser beam is deemed to be problematic for a given optical configuration. For example, a rod laser with a high diameter-to-length aspect ratio has a larger divergence than a narrower rod of the same length. If the mechanical design of a particular laser firing unit requires relatively thick rod lasers for ruggedness and also requires a large working distance between the rods and the focusing lenses to locate shutters or other apparatus, it may be desirable to use a collimating lens at the output of each rod. If used, a collimating lens will increase optical power losses due to Fresnel reflection at the lens surfaces. This loss can be reduced by the use of an antireflection coating. The preferred embodiment does not use a collimating lens.

In an alternate embodiment, it is possible to use optical beamsplitters so that a single laser can drive two or more LIDs. However, since each splitting operation reduces the output available to each LID, a more intense laser and pumping source must be used. Also, beamsplitting compounds the laser head alignment problem. Given the relatively low cost of the solid state lasers and the simplicity afforded by direct on-axis coupling to the initiating FOCAs, one laser rod per LID is used in a preferred embodiment.

6. Laser Firing Unit Hermeticity

WSMCR 127-1 paragraph 4.7.4.1.3 stipulates that all arming devices be hermetically sealed such that the leak rate does not exceed the equivalent of $10^6$ STD CC/SEC of helium. O-rings and other forms of compression gaskets marginally approach this requirement if properly engineered. Likewise, organic sealants such as epoxy are capable of producing the required performance under certain conditions, namely that the gas diffusion rate in the material be low, that the path length through the material be long, that the steady state pressure differential across the material be low, and that the sealed unit be tolerant of outgassing from the sealing compound.

The preferred lowest risk method of achieving the desired hermeticity is to provide the laser firing unit with a welded metal hermetic enclosure. Electrical inputs and outputs are accomplished with hermetic electrical connectors welded into cutouts in the enclosure.

The optical initiation outputs can be rendered hermetic in a number of ways. An approach providing for convenient product assembly uses, for each laser output, a welded-in fiber optic bulkhead connector with a hermetically captive fiber optic stub having the same diameter as the energy transfer FOCA fiber. A short fiber optic cable is connected to the interior receptacle of the connector while the energy transfer FOCA to the LID is connected to the exterior receptacle of the connector.

In a preferred embodiment, the stub can be hermetically sealed in a hole in the connector body by a number of methods. An inexpensive method is to seal the stub in a suitable epoxy. If the clearance between the stub and connector body is kept small and the stub is relatively long (e.g. ½"), then the aspect ratio of the epoxy seal is deemed sufficiently low to provide the required hermeticity during LFU logistical storage and flight operations.

A more expensive, higher integrity method of obtaining a hermetic stub seal is to metalize the stub and solder it into the hole in the connector body. Another method is to seal the stub in a hole in a glass-to-metal seal using S-glass (solder-glass), a form of low-melting-temperature glass. However, neither of these approaches are as cost effective as epoxy sealing.

To reduce the number of optical interfaces at the hermetic seal, it is possible to eliminate the jumper-to-stub interface by replacing the hermetic stub with a hermetically captive fiber optic pigtail leading to the laser head. To seal the connector end of the pigtail in S-glass, the pigtail is stripped to the cladding to withstand the fusing temperatures. The pigtail then has to be protected by the addition of a new buffer coat. The pigtail end could be stripped, metalized, and soldered into the connector body, or, more conveniently, it could be stripped and epoxied into the connector body. In either case, the laser heads are mechanically isolated from the LFU's hermetic enclosure by the fiber optic pigtails, leading to design which can independently suspend the laser head assemblies for additional shock and vibration isolation in very severe environments.

A preferred embodiment of the LFU hermetic optical interface achieves optical efficiency and compactness by having each laser beam focused directly onto the fiber stub face of a hermetic stub bulkhead connector. This approach is made feasible by integrating the connector body with the focusing lens lensholder and welding the connector/lensholder into the LFU housing via a thermally and mechanically compliant diaphragm.

An advantage of this approach is the ability to achieve still better optical efficiency by modifying the design to use the focusing lens itself as the hermetic optical interface. Now, the connector contains no fiber optic stub element, but rather is a receptacle which positions the face of the LID initiating FOCA at the focal spot of the focusing lens. The focusing lens, of whatever type, is edge-metalized and soldered into the connector/lensholder which, as before, is welded into the hermetic enclosure via a thermally isolated and mechanically compliant structure. This arrangement provides the most efficient possible optical interface since there are no optical surfaces between the focusing lens and the initiating FOCA's input face.

The cavity on the outboard side of the lens is subject to the accumulation of foreign particles unless adequate logistical measures are taken to keep the initiating FOCA receptacles covered at all times. It is possible that a particle, not blocking the fiber face during prelaunch testing, could migrate to block the fiber face during flight and cause the initiating channel to fail.

7. Laser Pumping

The laser pumping method in accordance with a preferred embodiment will now be described. A rod laser can be pumped on a one-shot basis by a zirconium wool flashbulb which is placed next to the rod and electrically flashed. However, the exemplary LIO/FTS system described herein uses a non-destructive optical pumping method for testability. A standard approach is to use xenon-filled flashlamps.

Xenon filled flashlamps are available to MIL-SPEC. They typically contain xenon gas at 450 torr pressure in a silica glass envelope of about 1.0 mm wall thickness. The size appropriate for use with the laser rod selected above is 89 mm long and 5 mm in diameter. The flashlamp is activated by the discharge of current between two electrodes at opposite ends of the envelope. To avoid exploding the lamp, the current is limited by an external element.

The optical coupling of the pump to the laser is effected by spectral distribution of the flashlamp output. The spectral distribution of light emitted by the xenon flashlamp depends strongly on the current density of the xenon arc, which in turn is affected by the bore diameter of the lamp. To most efficiently couple to the Nd:YAG rod, the flashlamp should be positioned parallel to the rod and as close to it as possible. Further, the flashlamp should be fired by a critically-damped circuit that consistently and efficiently transfers the stored energy into the lamp.

To enhance the optical coupling, the lamp and laser can be located in a cavity (not to be confused with the lasing cavity within the rod) having an elliptical cross-section such that the lamp and rod each occupy one focus of the ellipse. The walls of this cavity can be coated with a highly reflective coating such as "Spectralon", a trademark of Labsphere Inc. of North Sutton, N.H.

Also, a cavity with circular cross-section is much easier to manufacture than one with elliptical cross-section and provides nearly the same coupling efficiency. A circular, well-polished cavity plated with a high-quality metallic reflector can also be used.

Because the lasers in the exemplary LIO/FTS system must be fired simultaneously, each flashlamp can be surrounded with several laser rods in a common pumping cavity. However, where high shock and random vibration levels are a concern, a one pump—one laser rod laser firing head design is preferred. This arrangement, packing each lamp and rod in a small cavity, provides the best opportunity to engineer a laser-head housing having the "optical bench" rigidity needed to assure precise optical alignment under all environmental conditions. This approach also preserves commonality with LIO/OIS applications which benefit from firing lasers at different times.

A testable, non-destructively operated device is used as a high-energy switch to control the discharge of capacitively-stored electrical energy through the flashlamps. In an exemplary baseline embodiment to be described later, a known "Sprytron" vacuum arc switch is used. Alternately, a less expensive triggered gas gap switch can be used with little DFU design impact.

The high energy switching requirements are similar to those for EBW and EFI firing units, where high-energy switches transfer about 1 joule of energy into the initiators. Since energy stored in a capacitor increases as the square of the voltage, compact packaging favors the energy storage at relatively high voltages, typically 2.5 to 3.0 kV in the case of EBW and EFI firing units.

Like the exemplary LIO/FTS described herein, range safety EBW firing units are armed (high-energy capacitor charged) prior to launch. This requires the use of a triggered switch rather than a fixed breakdown switch. The triggered high-energy switch constitutes a single-point failure risk since inadvertent breakdown of the switch leads to inadvertent mission destruct.

Alternately, the laser-pumping flashlamp itself can be used as the high energy switching element in one of two ways: parallel injection triggering and series injection triggering. The flashlamp selected for the baseline laser firing head has a nominal self-breakdown voltage of 6 kV, and under nominal conditions, the flashlamp is capable of standing off the 1 kV operating potential.

With parallel injection triggering, a helical electrode wound around the flashlamp is pulsed with high voltage from a trigger circuit. Electrostatic coupling from this electrode ionizes gas in the flashlamp, causing it to conduct and discharge the bulk energy stored at 1 kV.

With series-injection triggering, a transformer in series with the high-energy capacitor and the flashlamp is excited by a trigger circuit and injects a high voltage pulse on top of the 1 kV pedestal applied to the flashlamp. This transient causes the tube to breakdown and discharge the capacitor. With both types of injection, an inductive pulse-forming network (PFN) is required in series with the flashlamp to limit peak current and tailor the discharge interval.

Triggered gas gap switches have been used for decades to fire EBW initiators. For these applications, such as space vehicle sequencing, devices having self-breakdown voltages in the range of 4.5 to 5.5 kV are required to stand off operation voltages on the order of 3 kV. They are fired by applying a high voltage pulse between the trigger electrode and the adjacent main electrode, causing the gas to ionize and form a conduction path between the main electrodes.

The main concern about using triggered gas gaps for sensitive applications is the small margin between the operating and self-breakdown voltages. They are also subject to breakdown below the nominal self-breakdown voltage if the main gap potential risetime is short.

Vacuum arc switches, like the aforementioned "Sprytron" (available from EG&G Electro-Optics of Salem, Mass.) are a second category of triggered gap switches. They offer a higher margin between operating voltage and self-breakdown voltage than do triggered gas gaps and thus, when properly designed and manufactured, offer superior immunity from inadvertent breakdown.

These devices use a hard vacuum to stand off the operating voltage applied between the main electrodes. A trigger electrode, generally concentric to one of the main electrodes, is electrically connected to this "adjacent" electrode via a well-controlled carbon surface path. When voltage, typically several hundred volts, is applied between the trigger and adjacent electrodes, sufficient carbon is vaporized to create a conducting atmosphere, which causes the main gap to break down. When the initial arc is established, it erodes metal from the main electrodes to sustain the current discharge through the tube as a metal-vapor arc. The trigger pulse risetime must be very short, so it is a common practice to use a small fixed breakdown gas gap in series with the trigger electrode.

Because of the tendency of the arc-forming and sustaining materials to migrate within the tube after each firing, the material selection and geometry of vacuum arc switches are extremely critical. Another critical problem is that the self-breakdown voltage decreases considerably if gas leaks into the tube (however further leakage to atmospheric pressure again raises this threshold).

The "Sprytron" vacuum arc switch includes the "Sprytron" switch, the trigger circuit gas gap switch, and the trigger transformer. The circuit can be modified to accommodate gas gap high-energy switches with no form/fit impact on the rest of the DFU.

Given the potential reliability issue of the triggered gas gap switch and the high cost of the "Sprytron" alternative, the number of high-energy switches used in the exemplary LIO/FTS (and LIO/OIS) is minimized. This approach is feasible because both types of triggered gap switches are rated for several times the 500 A required by each flashlamp (typical gas gap peak current is 2.5 kA, while "Sprytron" peak current is 10 kA). Thus, either type of switch is capable of operating the flashlamp bank that comprise each redundant half of the proposed DFU.

A preferred method of operating a number of flashlamps with a common triggered gap switch 230 is to locate the gap switch on the high side of the flashlamps 222 shown in FIG. *7a*. This configuration minimizes the number of nodes and components which are held at high voltage prior to triggering, and consequently simplifies the packaging design and provides better immunity from inadvertent high voltage discharge. In addition, no potential is applied across the flashlamp until the moment of triggering. In the preferred embodiment, the triggered gap switch is a "Sprytron" vacuum arc switch, although a lower-cost gas gap can be substituted with minor modifications.

In FIG. *7a*, a high-voltage power supply charges a high-energy storage capacitor 224 to a voltage on the order of 1.5 to 2.5 kV, depending upon the type and number of flashlamps to be fired. A pair of bleed resistor networks 225 wired in parallel to the high-energy storage capacitor provide redundant discharge paths to bleed off the stored energy within several seconds of the removal of input power.

Two FET switches (trigger switches A and B) are operated simultaneously to discharge a trigger capacitor 217 into a trigger transformer 234. When the pulse amplitude across the secondary of the trigger transformer rises to the self-breakdown voltage of a small gas gap switch 236, a fast-risetime trigger pulse is applied to the "Sprytron" trigger input, causing the "Sprytron" main gap to conduct.

The low side of the "Sprytron" is connected to three flashlamps 222 via a network of series injection transformer networks 226 (one network per flashlamp) and an air-core choke 227. Upon initial conduction, the "Sprytron" charges the capacitors in the series injection networks. The inrush current to each capacitor induces a voltage transient of approximately 12 kV peak voltage in the secondary of each transformer. These transient pulses cause the flashlamps to break down and conduct. The discharge of current from the high-energy storage capacitor through each flashlamp is governed by the inductance of the choke and of the series injection transformers.

The transformers are designed to saturate at the discharge current level (typically 500 A) through each flashtube and yet retain sufficient residual inductance to assure sharing among the three flashlamps. This high-energy switching circuit can be used to fire some number of flashlamps other than three depending upon the current rating of the high-energy switch.

Another feasible high-energy switching circuit shown in FIG. *7b* uses a series arrangement of two silicon controlled rectifiers (SCR) 229, 231 and a series-injection transformer 233 between a high energy storage capacitor 235 and a flashlamp 237. The upper SCR is operated by one of two redundant trigger circuits, while the lower SCR is operated by the other redundant trigger circuit. Each SCR is rated to stand off the stored voltage so that the short-circuit failure of any one SCR does not induce a discharge path to the flashlamp. When both SCRs are fired simultaneously, a capacitor in the series-injection network is charged from the high-energy storage capacitor. As in the case of the triggered gap switch circuit, this action creates a voltage transient across the flashlamp, leading to discharge of the stored energy through the lamp.

Available SCRs cannot switch the current necessary to operate multiple flashlamps. Therefore, in this alternate embodiment, each flashlamp is served by a dedicated high-energy switch, namely two SCRs in series. However, the single-point fault tolerance of this circuit, coupled with the relatively lower cost of SCRs vs. "Sprytrons", makes the SCR high-energy switching approach attractive. When multiple high-energy capacitors are used in an LFU section (primary or redundant), means must be provided to monitor the armed status of each capacitor. Therefore, although the preferred embodiment of the LFU includes a "Sprytron" circuit as shown in FIG. *7a*, diagrams related to system-level control portray three capacitors per LFU section to maintain generality.

8. Destruct Firing Unit (DFU) Modularity

The previous paragraphs on destruct charges, FOCAs, laser-initiated devices, lasers, and laser pumping methods have presented exemplary approaches to firing a destruct charge with a laser. The second level of an exemplary approach is how to aggregate and control the dozens of laser firing channels within the exemplary LIO/FTS system. The issue of firing multiple lasers with a common high-energy switch is the bridge from the single-channel functionality level to the LIO/FTS system level.

In a preferred embodiment, a "6-pack" modular laser-firing unit is provided for both LIO/FTS and LIO/OIS applications. An OIS option of firing the various lasers at different times is also preferred.

Range Safety regulations require that primary and redundant destruct functions be functionally independent and as physically separated as possible, and further require that stages that do not contain CDRs be equipped with autodestruct capabilities. The autodestruct function requires that firing units for first stage destruct be located in the first stage, and, of course, the firing units for second stage destruct cannot be located in the first stage.

To achieve redundancy, both the first and second stages each require at least two DFUs. In the Delta II 7925 configuration, the second stage DFUs each require five laser initiation channels to operate the second and third stage destruct charges (and cable cutter). Each of the two first stage DFUs requires 11 laser firing channels to operate the first stage and SRM destruct charges. At the other extreme, laser firing channels could be packaged singly, resulting in 10 second-stage and 22 first-stage DFUs.

Several factors favor a high level of modularity in preferred embodiments. For example, a high level of modularity minimizes box count and interconnect harnesses, and optimizes use of common elements such as power supplies and mechanical safe/arm shutters. On the other hand, a low level of modularity reduces qualification hardware cost, and provides an opportunity to supply standard modules to several ELV applications (thereby reducing NRE (non-recurring expense), manufacturing, and logistical costs).

By using common modules for all expendable launch vehicles (ELV), not only is the non-recurring engineering for each reduced, but economies-of-scale at the component level will prevail on deliverable DFUs. For instance, if known Delta, Atlas, and Titan launch vehicles all have 100% unique DFUs and LFUs and each purchase ten shipsets, the maximum DFU production for each does not result in synergistic savings. However, if each has a unique DFU and LFU design but all use a common laser head, the total number of laser heads in the 10 (each) shipsets results in substantial savings on that component.

If the DFU/LFU is also a common design, then additional savings at the box level will result. Any number of laser heads could be assembled into a DFU. However, a preferred embodiment uses DFUs/LFUs having six laser heads. This arrangement provides the best overall match to the FTS and OIS initiation requirements for Atlas, Delta and Titan, using this six-channel modularity, the unused percentages of laser heads per ELV is as follows: Delta II—4.6% (5/108 lasers); Atlas IIAS—9.0% (12/132 lasers without SRM destruct) or 2.8% (4/144 lasers with SRM destruct); and Titan IV—19.6% (20/102 lasers with ETA's) or 12.8% (20/156 without ETA's).

The laser heads are packaged within the DFU housing in two banks of three laser heads each. One bank is the primary initiation source and the other bank is the redundant initiation source.

9. Built-In-Test (BIT)

Built-in-test (BIT) affects DFU packaging and LIO/FTS inhibit/interlock design so much that this important topic will be discussed at this juncture. Full BIT is considered to comprise two separate tests:

Laser energy output test

Continuity test

Since BIT requires partial arming of the DFUs, the presence of BIT adds inhibit and interlock requirements to the FTS/LIO. The exemplary baseline DFU includes provisions for BIT capabilities for commonality with a DFU/LFU modular design approach.

Figure 8A:
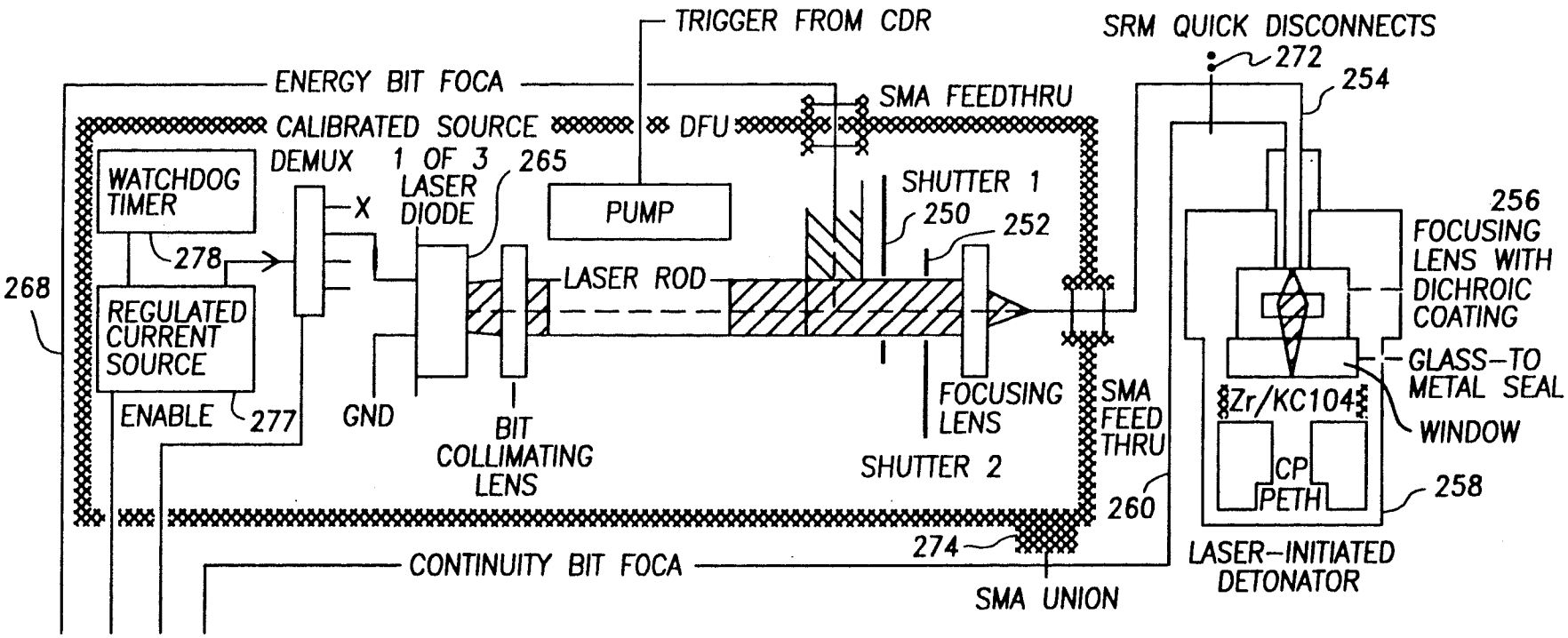
Figure 8B:
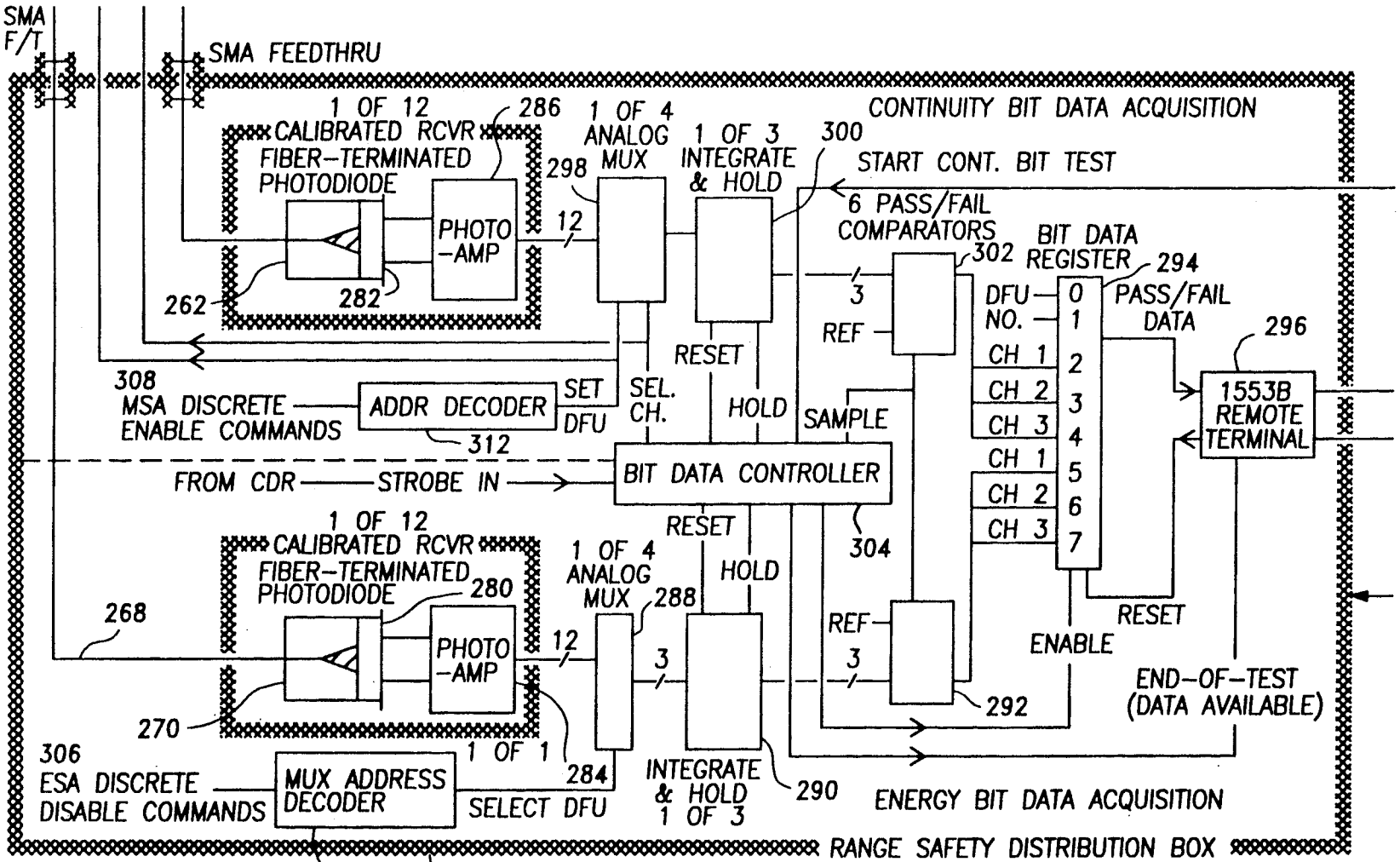
Figure 8C:
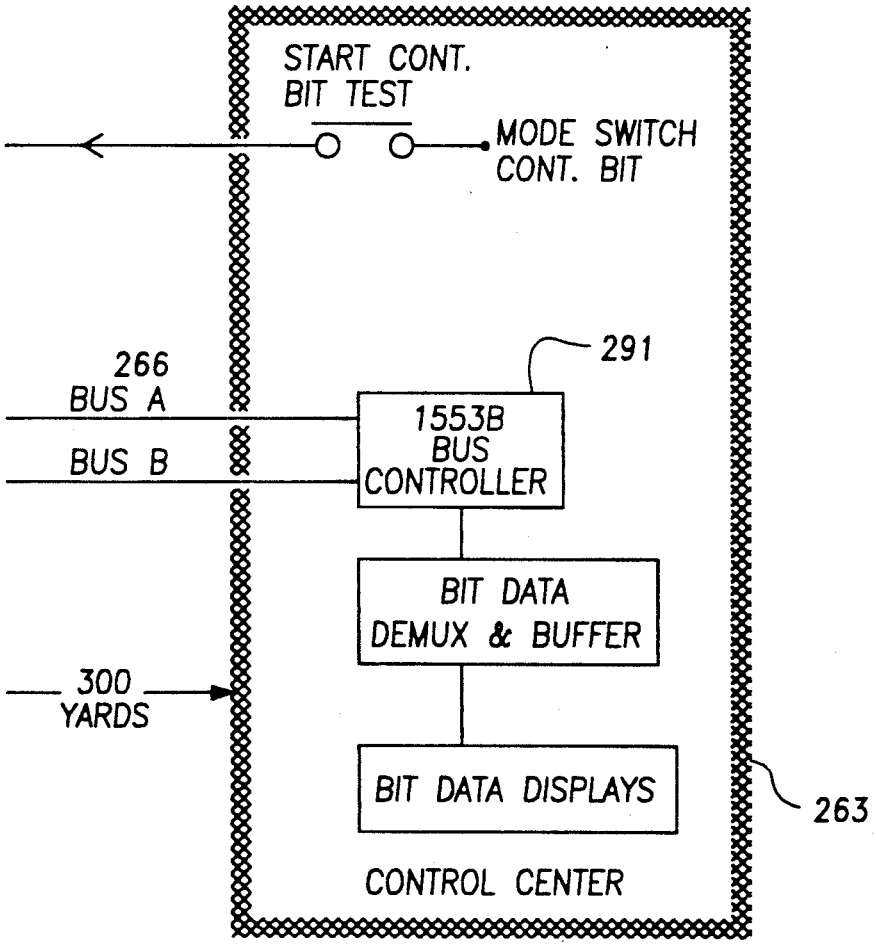
Figure 9A:
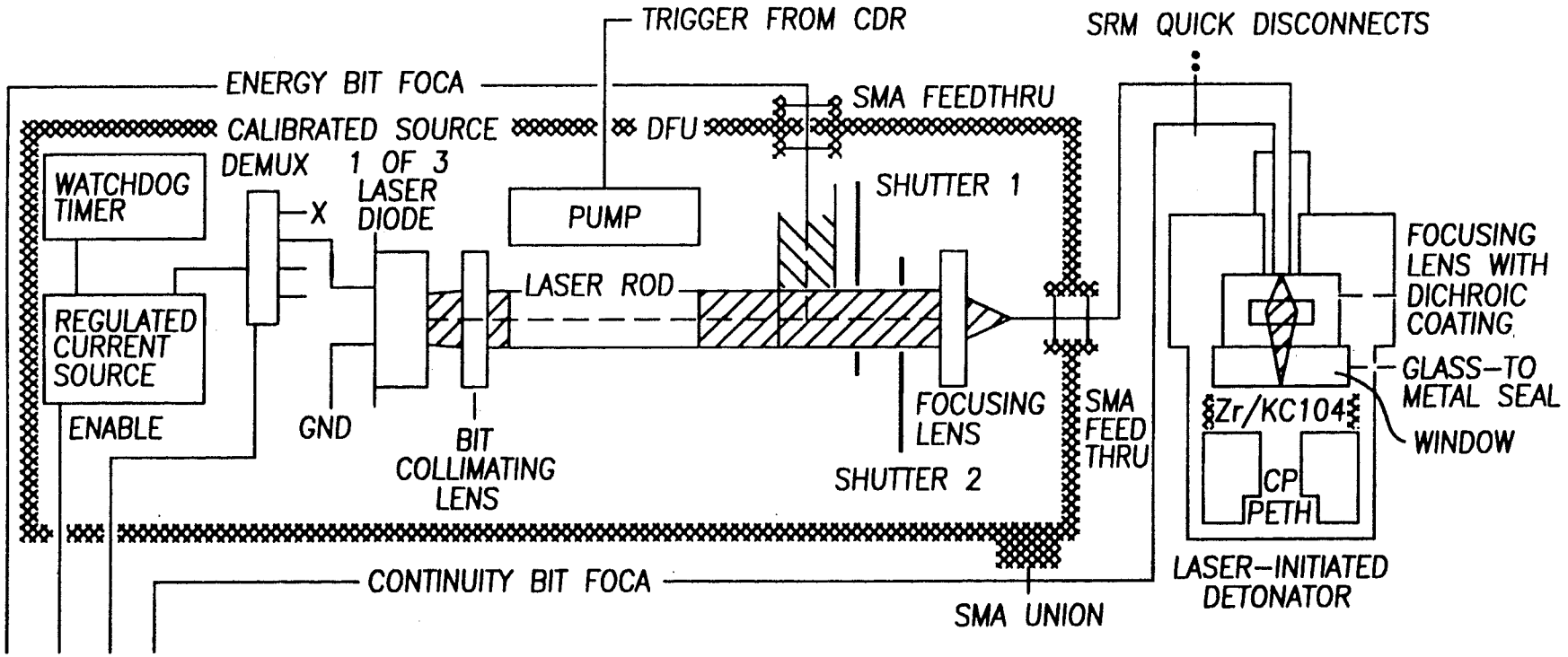
Figure 9B:
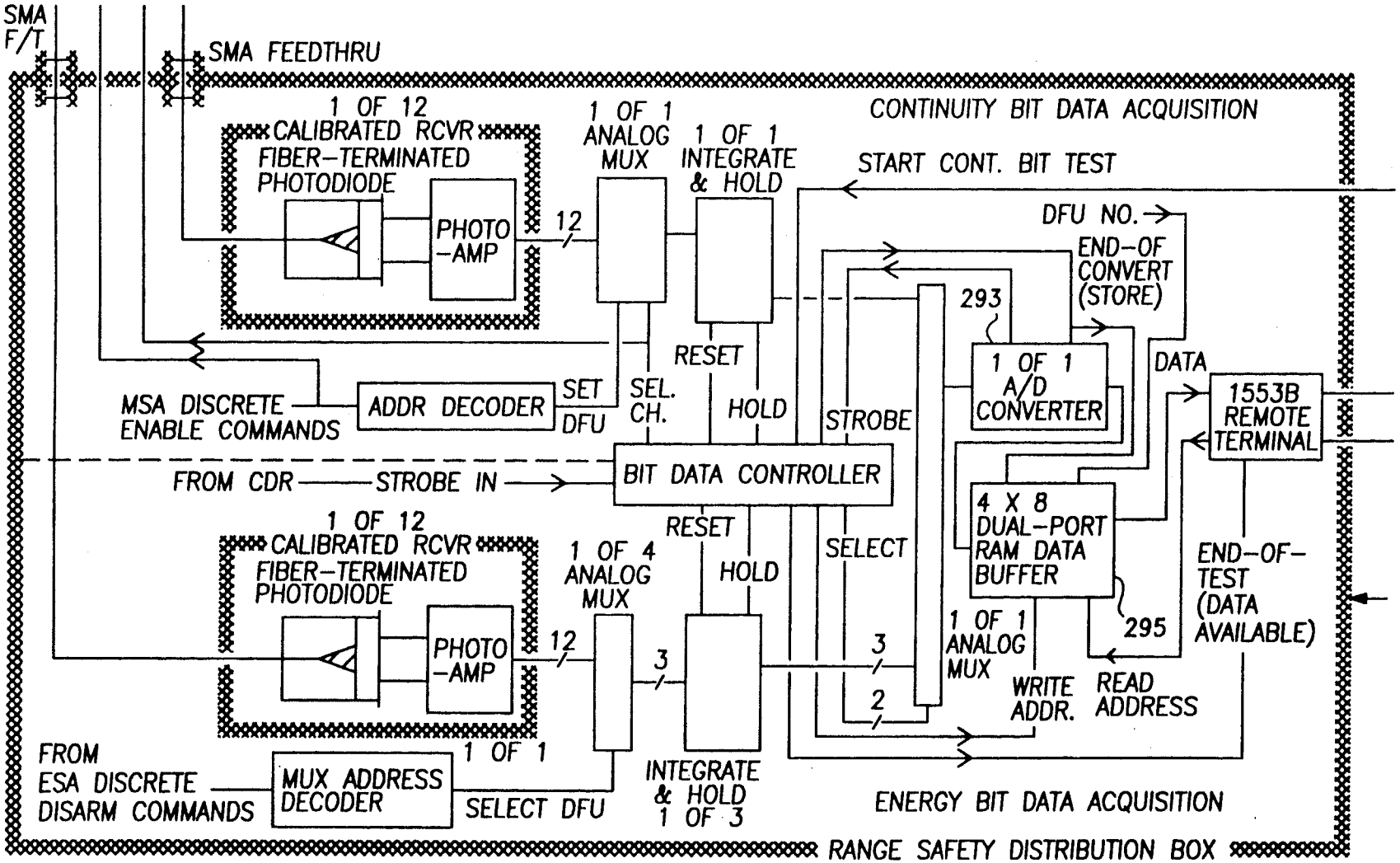
Figure 9C:
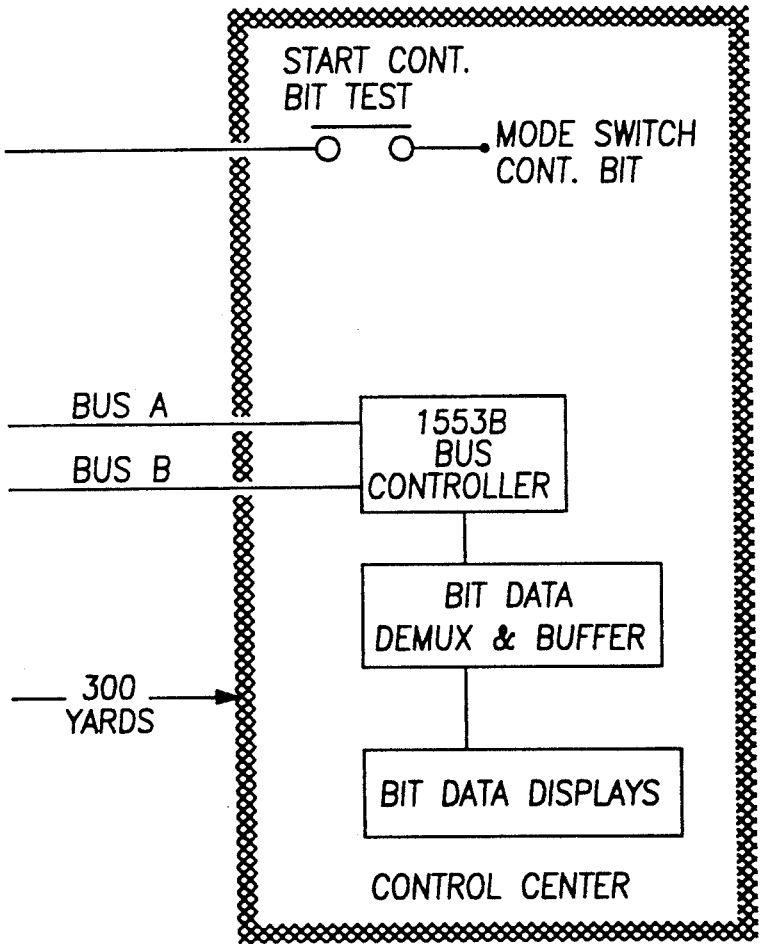

The exemplary baseline embodiment provides pass-/fail data as shown in FIG. 8. An exemplary proportional data approach as shown in FIG. 9 adds insignificant cost to the on-board hardware and is an alternative where direct readouts are preferred.

The preferred baseline approach of FIG. 8 for continuity BIT is to provide through-the-laser test energy. This energy passes through two open shutters 250 and 252, through the initiating FOCA 254, where it reflects off a dichroic filter 256 in the LID 258, and through a separate return FOCA 260 to a fiber-terminated photodiode 262 in the range safety distribution box 264 (RSDB). The test results are transmitted to the control center 263 as serially coded pass/fail data over a MIL-STD-1553B bus link 266.

The exemplary baseline approach for laser energy BIT is to reflect laser energy off a closed shutter into a FOCA 268 to a fiber-terminated photodiode 270 in the RSDB 264. The test results will be transmitted to the control center as serially coded pass/fail data over the same 1553B bus.

The exemplary baseline approach to BIT control is to allow selective BIT of each DFU (P and R sections separately) to minimize the extent to which the entire LIO/FTS must be partially armed at a given time to accomplish BIT objectives. The continuity BIT sources are selectively and sequentially energized by a discrete hard-wired "start test" command sent through the umbilical(s). The laser energy tests are fired via the CDRs to avoid the incorporation of a test trigger path to the DFUs.

a. Continuity BIT

An objective of the continuity BIT test is to verify optical continuity of the energy transfer system between each laser and its respective LID. To be thoroughly comprehensive, the continuity test should detect all reliability-degrading optical transmission faults, including:

| |
|---|
| Laser misalignment |
| Laser head focusing optics displacement and damage |
| DFU-to-FOCA connection |
| FOCA integrity |
| Stage-to-stage FOCA interconnects (if any) |
| FOCA-to-LID connection |
| Overbending of FOCA interconnects |

Because the LIDs are used in confined locations and must maintain their electrical isolation, no BIT instrumentation is incorporated in the LIDs of the preferred embodiment.

The continuity BIT involves passing low-energy light down the initiating FOCA and detecting its presence after it has interacted with the LID. Various alternate embodiments differ in how the energy is introduced at the DFU and how the conditions at the LID are sensed. In any case, WSMCR 127-1 requires that the continuity test energy delivered to the LID is less than $10^{-4}$ times the LID's minimum All-Fire (MAF) energy. This energy limit may be called the maximum safe stimulus, or MSS.

An elegant approach to continuity BIT is to use a known technique called optical time-domain reflectometry (OTDR) to isolate faults in FOCAs. An OTDR set sends a brief pulse of light down the FOCA under test and records the intensity vs. time of reflected energy returned by the FOCA. Because light is reflected by discontinuities of refractive index along its path, OTDR is able to show both the location (time) and magnitude (intensity) of optical discontinuities within the FOCA.

If an OTDR transponder were located behind the laser and directed into the energy transfer FOCA, the OTDR set could ensure that the FOCA is continuous to the LID, that the FOCA/LID interface is optically nominal, and that there are no anomalous discontinuities between the DFU and the LID or within the DFU.

Disregarding the issue of optical-to-pyro integrity within the LID, OTDR provides the full test scope. However, because OTDR requires very fast photonic devices and very high-speed circuitry, its implementation as on-board BIT hardware can be costly. Therefore, OTDR is not used as a BIT strategy in a preferred exemplary embodiment to be described below.

OTDR can also be used to afford BIT capability where the only BIT hardware on-board the launch vehicle is a BIT FOCA running from the back facet of each laser, through the FTS umbilical(s) and terminating at an OTDR test set located in equipment space at the fixed umbilical tower. The OTDR set would require a mechanical positioner to position each FOCA at the OTDR aperture in turn. The OTDR set would then be used to view each LID through the laser and the initiating FOCA. By repositioning the BIT FOCA termination array from the OTDR set to detector array, the same set of BIT FOCAs could be used to confirm laser energy output, since back facet emission is a fixed percentage of front facet emission.

OTDR is not used as a BIT strategy in the preferred, exemplary embodiment to be described below. However, OTDR during factory assembly can be used very effectively as ground-support equipment (GSE) to diagnose FOCA harnesses both before and after they are installed in the launch vehicle.

Non-OTDR methods depend upon detecting energy reflected from the LID without depending on time-of-flight information to discriminate against reflections from other surfaces. To include the laser and all laser-focusing optics in the continuity test, collimated continuity test energy must impinge the back facet of the laser and illuminate the FOCA through the laser and laser head optics. Any significant misalignment of the laser or associated optics will significantly reduce the amount of test energy captured by the initiating FOCA, resulting in test failure.

This through-the-laser approach requires exposing the laser to the LID. Therefore, this approach must invoke three positive and verifiable interlocks in the laser pump arming chain in addition to any optical shutters and lockpins provided between the laser and the LID.

On the other hand, if laser and laser-optic fault detection is excluded, the continuity test energy source can be injected on the LID-side of any optical shutters and directed into the FOCA by a mirror or prism. In this way, the continuity BIT requires no additional interlocks, since the laser is not exposed to the LID.

As mentioned above, another frequency selective element, such as a dichroic filter, can be added to the LID window to enhance the test energy reflectance (thereby reducing its transmission to the pyro interface)

while passing the laser energy with minimal attenuation. The use of such a filter allows using a more intense test energy level and is necessary to provide adequate test energy at the continuity detectors. Such a filter blocks 98% of the energy in its stopband while passing 95% of the energy in its passband.

Just as continuity testing with OTDR could be done through a single FOCA connecting the DFU to the LID, it simplifies the LID design and the LIO/FTS harnessing if a static continuity test using only the initiating FOCA is used. It is not sufficient to use a single FOCA with a gross measurement of reflected energy because anomalous discontinuities between the test source and the LID likely mimic the energy returned by the LID.

A dual fiber LID approach to continuity BIT is therefore achieved by terminating a second FOCA at the LID. This "continuity return" FOCA (e.g., 260 in FIG. 8) gathers energy reflected off the dichroic filter in the LID and returns it to a photodetector in the LIO/FTS system. The output of this photodetector is compared to a threshold value to produce a pass/fail indication of initiation path continuity. Although this approach requires a second FOCA, its implementation is straight-forward.

Because the continuity BIT data must be routed through the RSDBs to be linked to the control center, the continuity photodetectors are preferably located in the RSDBs. This eliminates the need for an additional electrical interface between the DFUs and the RSDBs.

Fiber-terminated photodiodes are used to measure the continuity BIT energy. These devices are widely used in fiber-optic communications and are available in MIL-SPEC.

Regardless of whether the test energy is injected through the laser or not, it can either be generated by an optical source located in the DFU or coupled into the DFU over a FOCA from an optical source located in the RSDB. Because both LEDs and laser diodes produce divergent output beams, it is difficult to focus this energy into an optical fiber. Therefore, in a preferred embodiment the continuity test sources and their drive circuits are located in the DFUs (e.g., 265 in FIG. 8) so that the light is coupled directly into the laser rod without an intermediate FOCA.

To take advantage of a frequency-selective dichroic filter in the LID, the test energy source should operate in a spectral region removed from the laser wavelength. It should provide a power level that does not exceed the MSS at the LID pyrotechnic interface yet provide sufficient power for detection by a photodector located at twice the optical path distance from the test source.

To construct an energy budget for the continuity test source, it is first helpful to calculate the test source power necessary to produce the maximum safe stimulus (MSS) at the LID pyrotechnic interface. This level can be called the MSS-limited test power. The LID No-Fire energy density is 1 J/cm$^2$ for a spot diameter of 400 um and a laser pulse width of 200 us. This converts to a delivered No-Fire energy of 1.26 mJ, which can be limited to 1 mJ for convenience of analysis, making the MSS 0.1 uJ (40 dB below No-Fire) at the pyrotechnic interface. This energy corresponds to an average power level of 0.5 mW over the 200 us pulse duration.

However, the stop band of a dichroic filter between the fiber-optic and pyrotechnic interface provides at least 98% attenuation. Therefore, 50 times the MSS power level, 25 mW, should be delivered to the filter to produce the MSS level at the pyrotechnic interface.

To evaluate the detectivity of 25 mW impinging the filter, an estimate is made of how much of this power can be collected by the return continuity FOCA and delivered to a photodetector. In a preferred embodiment, the return path contains as many as three in-line-connectors (SRM quick-disconnect 272, industry standard union 274 at DFU, and industry standard RSDB feedthrough 276 at FIG. 8), each producing a 1.5 dB loss for a path loss of 4.5 dB (the optical fiber itself has a loss of about 10 dB/km, or 0.01 dB/m, which is negligible).

The major loss occurs in capturing the energy reflected off the dichroic filter. This loss must be experimentally determined. A conservative estimate is that 1/100 of the test power impinging the dichroic filter can be delivered to the continuity BIT photodetector. This 20 dB return path loss will reduce the MSS-limited test power level to 0.25 mW at the photodetector.

A high quality fiber-terminated photodiode has a sensitivity of 0.45 A/W and an ambient dark current of 2 nA. The 0.25 mW of MSS-limited test power reaching the photodiode produces a signal current of 0.11 mA, which is over 50,000 times the ambient dark current. Since dark current can increase about 40 times ambient level at high temperatures, the worst-case signal current is still over 10,000 times the dark current.

Under these assumptions, the test power level can be reduced to 1/100 of the MSS-limited level and still provide a signal current of 100 times the dark current. This MSS/100 level corresponds to a 0.25 mW power level at the dichroic filter.

Assuming that 1/20 of the continuity BIT test source can be coupled through the laser head assembly into the initiating FOCA and delivered to the dichroic filter, then the MSS/100 test source should produce an optical power level of 5.0 mW. This power level can easily be achieved with a small laser diode, but is above the range achieved by most LEDs. Therefore, laser diodes are used in a preferred embodiment. The preferred family of devices operates at 904 nm, which is sufficiently removed from 1.064 um to provide the necessary dichroic discrimination in the LID.

A source operating at MSS/100 power level should operate for $100\times200$ us$=20$ ms to deliver the MSS-limited energy to the LID and for 20 ms$\times10^4=200$ seconds to deliver a No-Fire energy of 1 mJ. At this low rate of power input, the thermal dissipation of the initiation mixture prevents its temperature from rising to the autoignition threshold.

For certain system configurations, it is possible to implement a safe built-in-test (BIT) continuity test design featuring steady-state test sources. This eliminates the need for both pulse-width and current-limiting safety control of the laser diodes. For the exemplary baseline embodiment to be discussed later, however, the laser diodes are operated with gated current sources 277 and a back-up watchdog timer 278 is 15 provided to shut off test power in case of main timer failure. Because photodetector output integration improves signal/noise ratio, the test source must be gated on for as long as possible, which for this analysis is the 20 ms required to deliver the MSS energy.

Operation for milliseconds is considered CW (continuous wave) operating mode for a laser diode. A diode rated to produce a MSS/100 CW power level will, if forced into high-current operation by a current regulator fault, burn out well before MSS-limited energy can be produced. Therefore, combining a suitably rated laser diode with a backed-up gating circuit will provide ample continuity test safety.

b. Laser Energy BIT

The laser energy built-in-test (BIT) will now be described. The test objective is to confirm that the laser, when fired, produces the specified optical energy. If laser alignment is tested in the continuity BIT, the laser energy test must only confirm the laser's energy level and not its precise beam orientation.

In this case, it is sufficient to reflect the laser beam off a target mounted on the inner shutter and capture a representative sample of the beam with a detector. The laser produces about 60 mJ of energy at an average power level of 300 W, and if its beam is directed onto the photodetector 282 in the DFU, significant attenuation is required to avoid damaging the detector.

Picking up the reflected laser beam with an optical fiber using inefficient coupling, is a convenient way to provide this attenuation. The coupling method is selected to minimize errors due to mirror position. Therefore, a diffusely-reflecting target is preferable to a mirror. Having committed the laser energy fraction to an optical fiber, it is most convenient to locate the detector in the RSDB. In a preferred embodiment, the detector 282 is the same as that used for continuity BIT, namely a fiber-terminated photodiode.

It is also possible as an alternate embodiment to determine laser energy by measuring the energy emitted by the back facet. The back facet/front facet emission ratio is fixed and stable for a given cavity design (about 1% in this case). However, use of such an embodiment is limited where the back facet is used for continuity test injection, as described previously.

Further, as mentioned in the OTDR discussion above, there is an alternate BIT approach which accomplishes all BIT objectives with a single FOCA from the back facet of each laser to OTDR and energy-measuring ground support equipment (GSE) located at the fixed umbilical tower.

c. BIT Signal Processing

BIT signal processing can be described in the context of: calibration, laser energy data acquisition, continuity data acquisition, BIT control data and BIT data communications. Calibration of the BIT signal processing will be described initially.

Both continuity and energy BIT measurements must be provided by calibrated circuits. The degree of calibration depends upon the allowable pass/fail margins. For example, if nominal laser energy is well above the required 300% energy margin, relatively large calibration guard-bands can be allowed. Likewise, empirical data on FOCA continuity readings with and without induced faults will indicate the degree of calibration required. Since these factors will not be known at the start of a given system design, adequate calibration provisions should be included in the design from the start.

A reasonable design goal for energy BIT data is within 5% of actual laser output, as verified by laboratory instruments, over the specified LIO/FTS operating range. The same accuracy goal for continuity BIT appears to be appropriate.

For both types of BIT tests described previously, the sources (laser and laser diode) are located in the DFUs while the detectors are located in the RSDBs. To avoid box-matching requirements, the sources and detectors should be individually calibrated so that valid results can be obtained with any combination of boxes.

For laser energy BIT, source calibration is performed by orienting the energy pick-off fiber, since that is the only variable available. For continuity BIT, the test power level coupled into the initiating FOCA depends upon the laser diode current source, the laser diode itself, and the entire laser head assembly optical path. Here, coarse calibration is accomplished by alignment of the laser diode and its collimating lens to the rear facet of the laser, and fine, temperature-compensated calibration will be applied to the current source as required.

Detector calibration requires corrections for fiber coupling, photodiode dark-current (offset calibration) and sensitivity (gain calibration). This calibration is performed with select-at-test (SAT) resistors in photoamplifier circuits 284 and 286, rendering the fiber-terminated photodiode and its photoamplifier a calibrated receiver. Note that if the BIT data transmission format is proportional (FIG. 9) rather than pass/fail, offset calibration for continuity BIT can be performed from the control center by performing a test cycle with shutters closed.

The laser energy test involves a measurement of three simultaneous transient events, namely the 200 us output pulses of the three lasers (P or R) in the selected DFU. Transmitting replicas of these pulses to the control center in real time involves a wide-band channel and sophisticated synchronization and is not necessary. There are two pulse waveform parameters which can be used to represent the laser performance. The first is peak power level, which corresponds to peak photoamplifier output voltage, and which can be captured by a peak voltage detector. The second is cumulative power, or total laser energy, which corresponds to the integral of the photodiode output current, and which can be captured by an analog integrator. The second approach provides better signal-to-noise performance and is therefore preferred.

To minimize hardware, the 12 laser energy receivers in each RSDB (only six required in the second stage boxes) are multiplexed via multiplexer 288 into three integrate-and-hold circuits 290. At the end of the energy BIT for a given DFU, the three integrators hold the BIT data. In the exemplary baseline pass/fail system, the integrators are then read by three pass/fail comparators 292 and the results set in a register 294 for transmission to the ground via a remote terminal 296. In an alternate proportional system, the integrators are multiplexed into a common analog-to-digital (A/D) converter 293 (FIG. 9) and the results stored in a dual-port RAM 295 for transmission to the ground.

The continuity test also involves the measurement of transient data, assuming that gating the energy source is required to stay below MSS. However, relative to the laser energy measurements, the continuity measurements can be performed over the course of milliseconds and can be done one laser initiation channel at a time. Since the continuity test safety favors the use of the lowest possible test energy, it is important that integration be applied to the continuity photodetectors 262 (FIG. 9) to obtain the best available signal-to-noise ratios.

Accordingly, a multiplexer 298 and integrator 300 are used. Therefore, an exemplary continuity data acquisition scheme is the same as that for the laser energy test except that the integration times can be much longer and only one processing channel is required instead of three. The test data, if pass/fail, can be produced by three comparators 302, and, if proportional, by the same A/D converter of FIG. 9 used for laser energy measurements.

Since both laser energy and continuity BIT use the same approach to data acquisition, but are performed at different times, the measurements are controlled by a common controller 304 (FIG. 8) in each RSDB. To minimize wiring to the control center, the controller is configured to read the ESA and MSA discrete enable relay signals 306 and 308 coming into the box via address decoders 310 and 312 to determine which BIT mode and DFU-under-test have been selected by ground control. One armed ESA indicates laser energy BIT intended for the (partially) armed DFU. One armed MSA indicates continuity BIT intended for the (partially) armed DFU. No ESA or MSA or several ESAs and/or MSAs armed results in no action by the BIT data controller.

The BIT data controller 304 has no control over any LIO/FTS arming or laser firing functions. Its sole control over stimulus is to operate the continuity test sources, and here it is backed up by the watchdog timer 278. This controller could be implemented with a microprocessor, but a state machine is preferred. A state machine controller is less expensive than the firmware for a microprocessor. State machines can also be used for safety interlock purposes (interlock generator in the control panels, and stepper motor controller in the MSAs) as will be discussed later. BIT data communications involve the supply of the BIT data over a MIL-STD-1553B bus between each RSDB and the control center.

10. System Safe/Arm (Mechanical Safe/Arm-MSA; Electrical Safe/Arm-ESA)

Figure 27A:
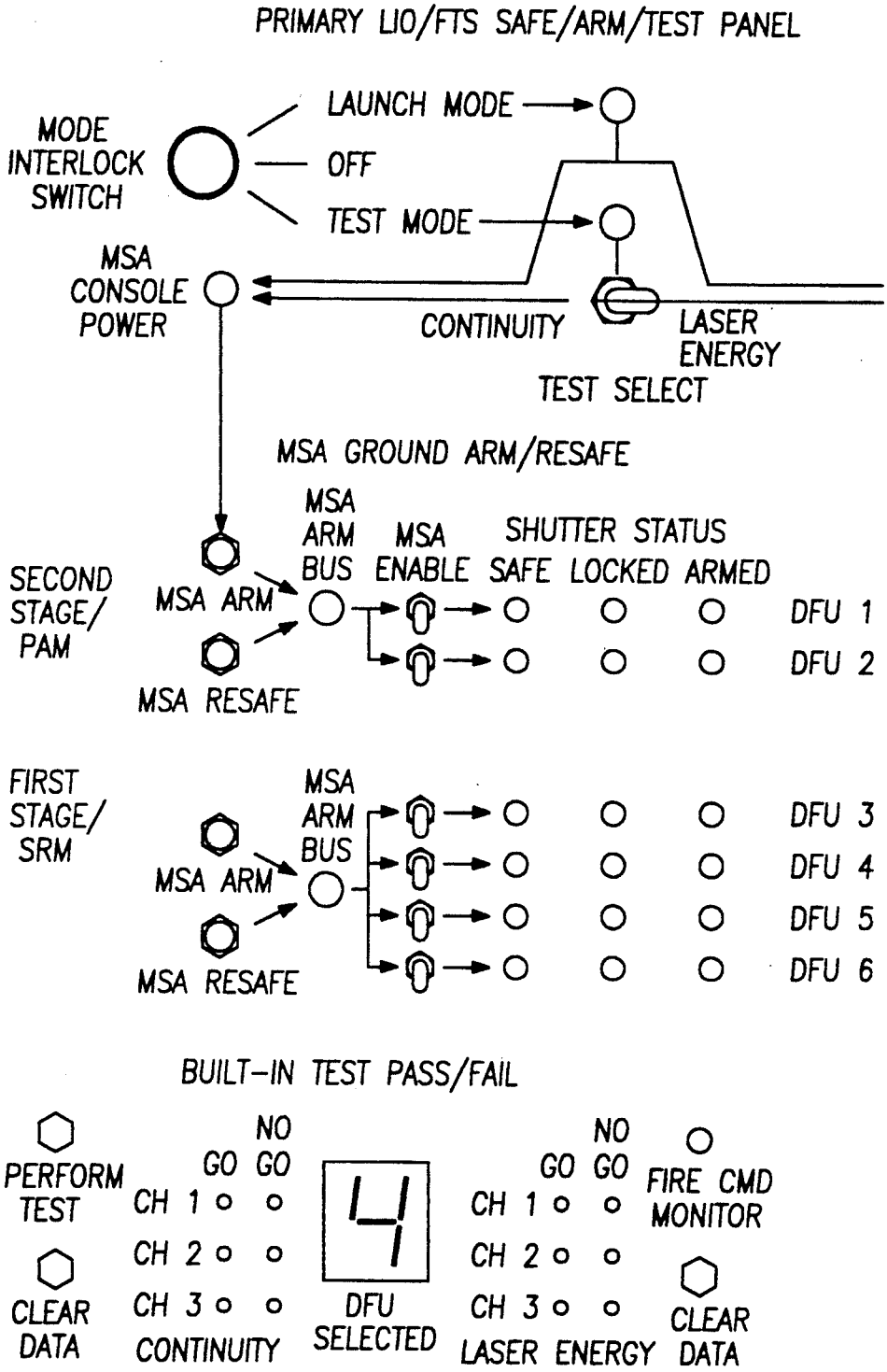
Figure 27B:
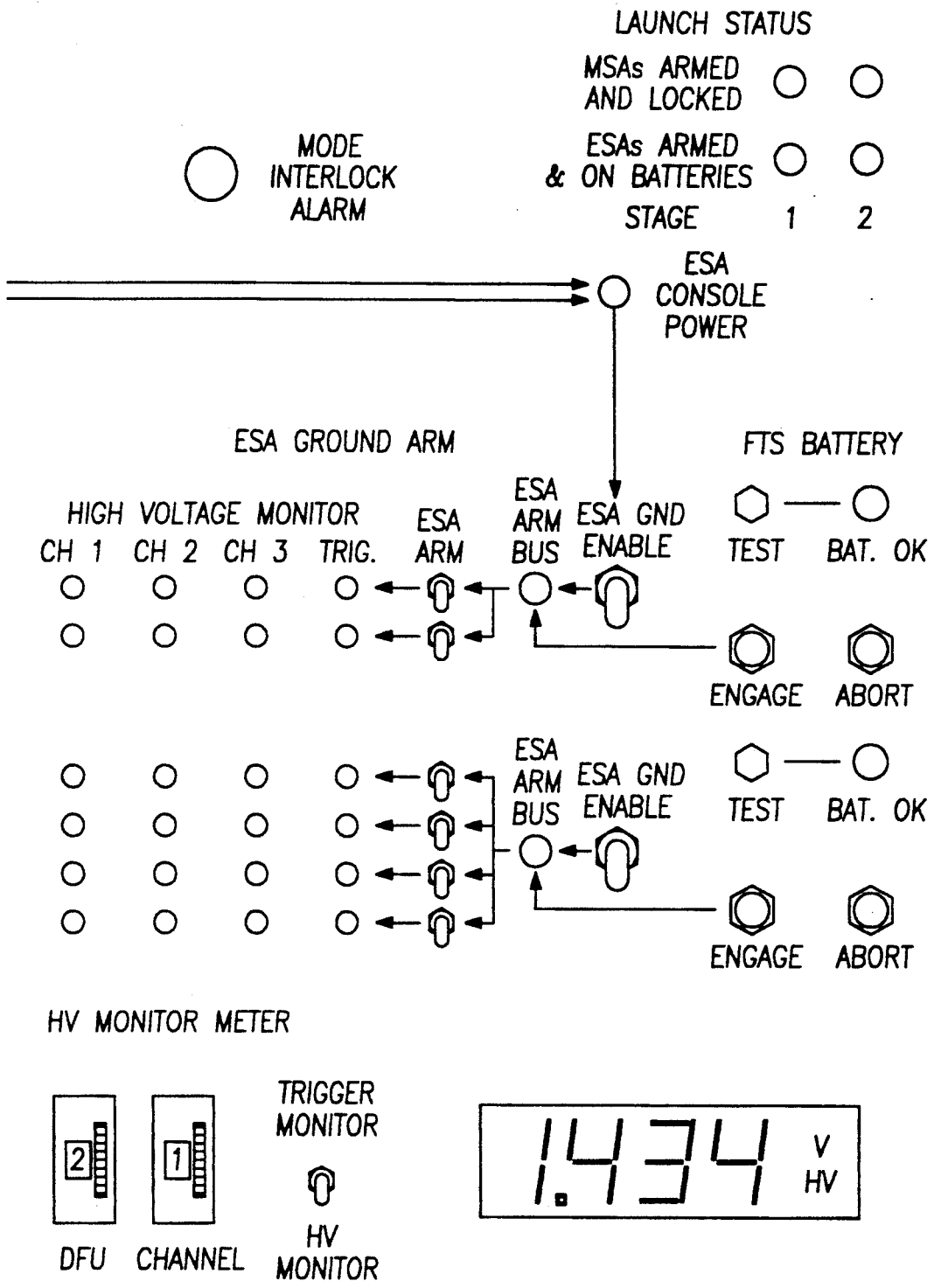

Now that the exemplary baseline BIT features have been discussed, it is possible to discuss the system arming and resafing control. Reference is made to FIGS. 27 and 28*b* which will be discussed later. The diagrams represent the primary and the redundant LIO/FTS systems, which are identical. In summary, preferred arming and resafing control use the following inhibits and interlocks:

| |
|---|
| MSA Inhibits |
| A common-mode opaque shutter and lockpin - controlled by the primary system (the primary MSA). |
| A common-mode opaque shutter and lockpin controlled by the redundant system (redundant MSA). |
| ESA Inhibits |

-continued

| |
|---|
| Mode interlock switch in control console. (ESA Inhibit 1) |
| ESA master enable relay and power transfer maglatch in RSDB. (ESA Inhibit 2) |
| ESA discrete arming relays in RSDB. (ESA Inhibit 3) |
| Interlocks |
| State machine MSA controllers do not allow shutters to open when ESA high voltage present. |
| Mode interlock logic in control console locks out BIT modes if LIO/FTS safe/arm/HV status not safe for test. |

Figure 10:
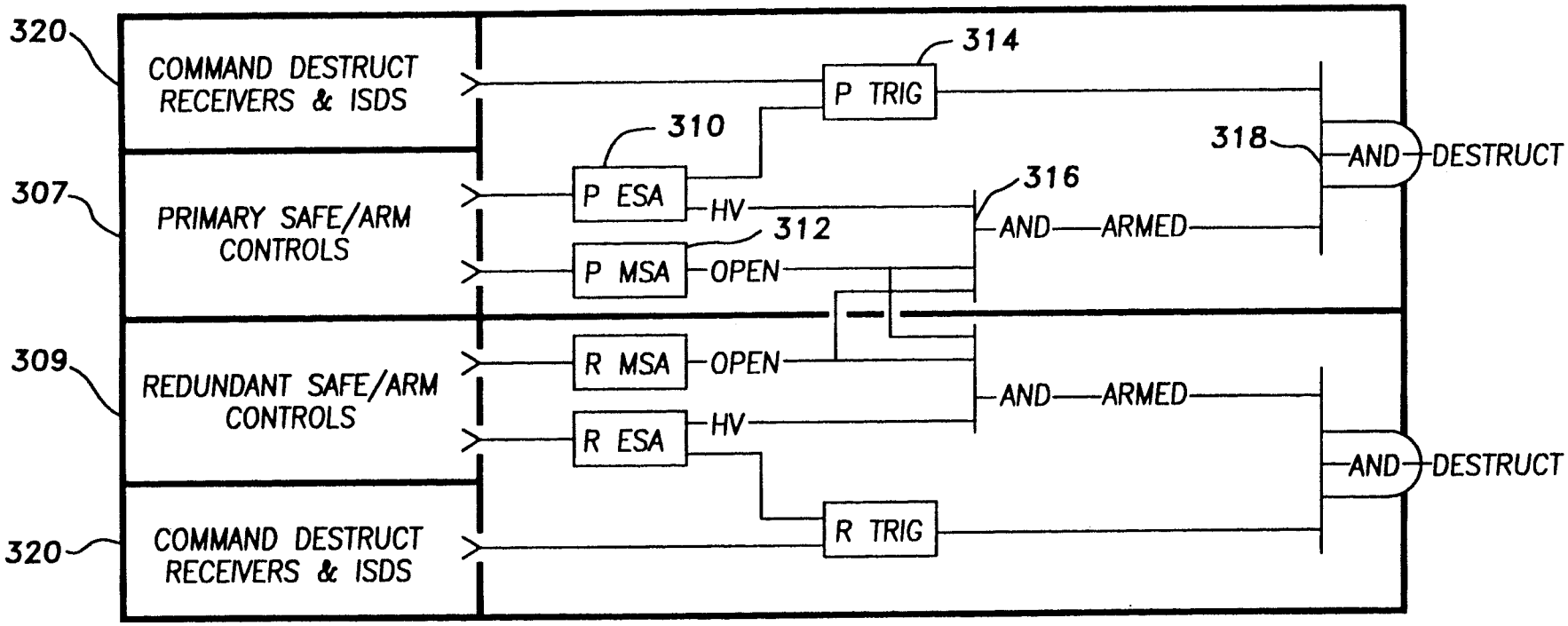
FIG. 10 shows a primary and redundant DFU control model for LIO/FTS systems.

FIG. 10 shows an exemplary DFU control model. For control purposes, each half (partition) of the exemplary DFU includes three mechanisms: a high voltage power supply, representing an electronic safe & arm (ESA) 310A; an optical shutter, also called a mechanical safe & arm (MSA) 312A; and a trigger circuit 314.

The trigger circuit receives power from the ESA and firing signal from the command destruct receivers. The MSAs are common mode; each MSA, although controlled by one partition of the DFU, spans the optical paths of all six lasers. Therefore, the state of each DFU partition can be represented by two virtual AND gates 316 and 318. Each partition is armed if its ESA is armed (HV on capacitors) and if both MSAs are armed (shutters open). Each partition produces destruct outputs if it is armed and if it is fired by the CDR(s) 320.

The system operating modes spring from the separate control of the ESAs and MSAs to accomplish the required BIT and operational tasks. For example, these tasks are indicated below for an exemplary embodiment.

| DFU | Ground Power | | | | Flight Power |
|---|---|---|---|---|---|
| Arming Mechanism | (System Off) | Laser Energy BIT Mode | FOCA Cont. BIT Mode | Launch Mode | Flight Mode |
| MSA (Shutters) | Closed & Unpowered (Safe) | Closed & Unpowered (Safe) | Open & Unpowered (Armed) | Open & Unpowered (Armed) | Open & Unpowered (Armed) |
| ESA (HV Power Supply) | Unpowered (Safe) | Charge & Hold (Armed) | Unpowered (Safe) | Charge & Hold (Armed) | Hold With FTS Battery (Armed) |

Of the four powered operating modes, three are ground operating modes powered by ground power. The fourth mode is the flight mode powered by the FTS battery power. The ESA and MSA mechanisms have diametrically opposite control requirements in the flight mode. Both mechanisms should be cycled on and off in a mutually exclusive manner to place the DFU in the ground BIT test modes, and both mechanisms should be able to be resafed upon command. However, once committed to battery power and launched, the ESA should remain powered-up. Conversely, once committed to launch, the MSA must remain open and must fail open in the face of component failures and credible abnormal environments.

The DFUs are fully armed and capable of responding to a destruct command only in the launch and flight modes. In the remaining two operating modes and in the unpowered mode, three independent and verifiable inhibits are provided.

An inhibit in a firing circuit is typically used to interrupt or open energy flow in a circuit. (See, for example, Owen/Whitaker memorandum entitled "Design/Testing of Missile Laser Ordnance Firing Systems at the Western Space and Missile Center", presented Oct. 18, 1990). To be valid, an inhibit must be positive (not prone to failure) and independently verifiable. Interlocks are devices which prevent an action, such as removing an inhibit, unless certain conditions are satisfied. In the case of the exemplary LIO/FTS system, since all command and control originates from range safety operators, the purpose of interlocks, if provided, is to mitigate against operator errors.

In a preferred LIO/FTS embodiment, the safe-arm condition is distributed in the various DFUs and includes both electrical (stored high voltage) and mechanical (open shutters) states. Therefore, the safe-arm control and the LIO/FTS system monitoring is intrinsically more complicated because there are more features to control and monitor. The addition of BIT features requiring partial arming for test purposes further complicates the LIO/FTS safe-arm control.

Because the laser energy test requires arming the ESA and firing the trigger, all of the laser energy test inhibits are located between the laser and the LID. A shutter with an independent lock pin qualifies as two inhibits and a second shutter qualifies as the third inhibit. For design uniformity, the second shutter also has a lock pin, so that the exemplary baseline MSA design provides four inhibits for laser energy testing.

In the exemplary baseline embodiment of continuity test inhibits, both shutters must be open to perform the continuity test. Therefore, there are three electrical inhibits that prevent operation of the ESA and prevent application of a destruct signal. Since the high-energy switch in the trigger is possibly a single-point failure element, the safest role of these inhibits is to block arming energy to the ESA.

A preferred embodiment uses a state-machine-controlled mode interlock relay in the control console to prevent the console from being placed in the continuity BIT mode or remaining in that mode with any high voltage present in the DFUs (ESA Inhibit 1). The second inhibit is a master ESA ground enable relay and a power transfer maglatch in each RSDB. The third inhibit is a discrete ESA arming relay for each DFU, also located in the RSDBs.

The various inhibits incorporated for BIT purposes also satisfy the need for three inhibits in the unpowered state. In this state, all of the electrical and opto-mechanical inhibits are open, so that in the exemplary baseline embodiment there are seven independent and verifiable inhibits in place (two shutters, two lockpins, and three ESA power inhibits).

a. Mechanical safe/Arm (MSA)

Preferred embodiments of the MSA, including an MSA control interface, an MSA mechanism and controller and an MSA state machine controller and safety interlock will now be discussed. The MSA and its associated control circuitry, regardless of where located, is designed to reduce the possibility of inadvertent activation in flight, resulting from either component failure or sneak circuit (e.g., due to insulation failure between wires).

This is accomplished by having the MSA drive circuit receive its operating power and arming signal from a dedicated, isolated MSA arm bus in the RSDB. In turn, the power supplied to this bus comes strictly from ground sources. The MSA arm bus is isolated from the FTS battery.

In a preferred embodiment, the MSA mechanism and controller includes a shutter mechanism, a shutter drive motor, and a lockpin actuator. The shutters interrupt the optical path between the permanently aligned laser head optical components. By providing sufficiently large apertures and travel, the required safe-arm action does not depend upon precisely repeatable shutter positioning. In contrast, interrupts which depend upon alignment/misalignment of optical components should maintain precise indexing under flight environments. Since solid state rod lasers are used, ample room can be provided for the two common-mode shutters.

The design of the shutter mechanism conforms to the desire for a rigid "optical bench" frame holding the laser head optical components. The mechanism also remains armed in an unpowered state under all flight environments. Therefore, a preferred embodiment of the MSA uses a pair of concentric rotary shutters. Each shutter is equipped with a solenoid-actuated lockpin to provide positive detenting in both the safe and armed positions.

The required shutter actuation is provided by stepper motors, since they provide the required motion without the use of reduction gears or clutches and thereby reduce development risk. An off-the-shelf MIL-SPEC integrated stepper motor drive circuit can also be used since it provides a reduction in parts count over discrete drive transistors. A drive IC (e.g., element 543 in FIG. 23) has three control inputs—set (S) to position the stepper to the nearest incremental angle prior to applying drive pulses, direction (R) to specify clockwise (CW) vs counter-clockwise (CCW) motion, and trigger (T) to advance the motor one increment.

In principle, the S, R, and T stepper drive IC inputs can be operated from the control console or the RSDB to drive the shutters. However, to reduce system interconnects, a state machine controller (e.g., 542 in FIG. 23) is located in each DFU section (P and R) to operate the stepper drive ICs. This approach also provides the opportunity to incorporate a safety interlock in the DFUs with essentially no additional parts and no degradation of in-flight reliability.

One goal of the LIO/FTS interlock scheme is to prevent the opening of shutters if high voltage is present in that DFU, unless the intent is to launch the vehicle. A reliable interlock between the ESA and MSA in each DFU section (P or R) is an interlock within the DFU, since its integrity is not threatened by box interconnect problems.

The MSA state machine controller, which will be described in detail later, provides safety by preventing the MSA from responding to an arm command if the DFU sections (P or R) high voltage monitor reflects an unsafe (armed or partially armed) ESA status. Although these control functions can be performed by random logic, a state machine approach is more compact.

The MSA controller can also be provided with a mode-dependent input to allow it to distinguish intent-to-test (enforce interlock) from intent-to-launch (relax interlock). However, in accordance with a preferred embodiment, mode-dependent input to the DFU can be avoided with a system control rule which requires MSA arming prior to ESA arming in the launch arming sequence. This renders the MSA controller interlock unconditional. If the launch arming sequence requires ESA arming prior to MSA arming, the MSA controllers should be furnished a launch mode signal.

b. Electronic Safe/Arm (ESA)

Preferred embodiments of the ESA include a dc/dc converter, overvoltage protection, resafing, and high voltage monitoring. Because the available ground and flight operating power for the FTS is +28 Vdc, the ESA should include a dc/dc converter of some type. Such a converter includes one or more solid-state switching devices, called choppers or dynamic switches, to periodically interrupt the incoming direct current so that energy is coupled through a transformer and converted to a high-voltage power form.

There are many alternate dc/dc designs, or topologies, that can be used. For example, a parallel multiple-transformer forward power oscillator design which provides unregulated high voltage from +28±4 Vdc input power can be used. Alternately, a pulse-width modulator (PWM) can be used to drive a flyback converter providing regulated high voltage from the same +28 Vdc input power form. High voltage regulation improves system reliability by ensuring adequate all-fire energy without risk of stressing components with excessively high voltage levels.

In a preferred, exemplary baseline DFU, a flyback converter is regulated by a PWM implemented with discrete S-level parts. With such a design, the PWM oscillator can be located remotely as a safety feature. ESA safety design involves careful management of the connection of the oscillator (dynamic arming signal) to the PWM's dynamic switch. However, the inhibits provided by the LIO/FTS optomechanical shutters render this approach unnecessary. For electromagnetic compatibility, the exemplary baseline has the oscillators located in the DFUs. The oscillators are gated on and off to control dynamic switch operation.

There are several ways to guard against runaway high voltage levels. For example, the converter can be designed so that its operating output voltage is just slightly below its maximum unregulated output voltage. Alternately, a coarse backup feedback loop can be used to take over regulation if the main loop fails.

In a preferred embodiment, discharging the high-energy capacitors to provide positive resafing action upon removal of ESA operating power is achieved via redundant high-voltage bleed resistors across each high-energy capacitor. The resistors should be scaled to discharge the capacitors to below a specified voltage within a specified time.

However, alternate resafing methods can be used. For example, an active crowbar circuit can also be used to quickly discharge the capacitors upon command.

The high voltage monitoring uses a resistive divider to produce a low voltage proportional to stored high voltage. The redundant bleed resistors can be used as dividers, with one set providing feedback to the PWM and the other set providing a monitor signal for control console display and interlock purposes, and for telemetry. The processing of these signals will be described later.

11. Destruct Trigger Management

The previous sections have covered safe-arm management of the LIO/FTS. This section describes triggering the system. Presently, the CDRs are used to generate destruct signals by closing internal relay contacts to +28 Vdc battery power. These signals presently fire EEDs.

In a preferred embodiment of the LIO/FTS, CDRs generate signals which are used to trigger the DFUs. In a preferred embodiment, distribution occurs via interface boxes such as the RSDBs to obtain high reliable command destruct signal distribution.

Each of the nine SRMs has an autonomous autodestruct system (ADS) capability. If it is satisfactory to destruct each SRM after separation, regardless of whether the separation is premature or scheduled, an ADS inhibit function can be eliminated during normal staging. To prevent SRM destruct action from interfering with mission progress, a five-second delay between separation sensing and destruct action is considered acceptable.

To process ADS destruct through DFUs involves locating redundant DFUs in each SRM, since a DFU cannot detonate a LID once the initiating FOCA is severed by stage separation. To avoid the cost and complexity of this arrangement, SRM autodestruct action is accomplished by redundant lanyard-operated percussion detonators that function the SRM destruct charges via redundant ETAs. An ordnance delay element between each percussion detonator and ETA furnishes the function delay. As described previously, each of the SRM destruct charges is fitted with four initiation points, two for redundant LIDs for command destruct via DFUs and two for the redundant autodestruct ETAs.

Unlike the SRM ADS system, the first stage ADS system cannot be specified to produce unconditional destruction of the first stage after separation. The first stage may contain considerable propellant after normal separation. An autonomous ADS time delay would have to be of sufficient duration to ensure that the first stage is destructed far enough away from the upper stages after normal separation to avoid damaging the upper stages. Such a long delay is not acceptable for first stage destruction after premature separation or launch vehicle breakup. Therefore, means must be provided to disable the first stage ADS during and after normal first stage separation.

Normally, range safety policy requires an FTS to be functionally independent from all other launch vehicle systems. This provision is intended to ensure that failures in other systems do not propagate to the FTS, rendering it inoperable. However, to incorporate an autonomous ADS inhibit function within the FTS would require the FTS to contain an accurate, independent timebase and means to synchronize this timebase to the mission control timebase maintained in the guidance computer.

Since it is not desirable to burden the FTS with a mission timebase requirement, range safety policy permits ADS inhibit commands to be generated by elements outside the FTS with the proviso that these commands are generated by the actions of two independent mechanisms, only one of which is timebase. For example, the ADS inhibit can be generated by rocket motor pressure and/or vehicle acceleration sensors gated by the guidance computer timebase to produce an ADS inhibit command only if required dynamic conditions such as rocket motor tailoff or vehicle deceleration occur within a predetermined timeframe.

In a preferred embodiment, each of the two first stage RSDBs is provided with a powered breakwire crossing the first stage/second stage separation plane and routed within the first stage in such a manner as to be parted by structural deformation within the first stage. Each first stage RSDB is also provided with an ADS inhibit input which receives an ADS inhibit command from mechanisms located in the upper stages. Each first stage RSDB contains an ADS inhibit register which continues to suppress ADS operation after normal first stage separation and until loss of ESA operating power due to FTS battery run-down. With these provisions, the first stage will be destructed if either breakwire is parted prior to the receipt of an ADS inhibit command by the RSDB connected to that breakwire. The ADS inhibit command does not override command destruct operation.

In a preferred embodiment, each of the two first stage RSDBs is provided with a powered breakwire crossing the first stage/second stage separation plane. Breakwire separation starts an electronic time delay that, upon timeout, causes trigger signals to be issued to each DFU.

It is preferred to distribute command destruct signals from the second stage CDRs to all DFUs, and ISDS destruct signals from the first stage RSDBs to all first stage DFUs in a manner that maximizes trigger forward reliability while minimizing the probability of false triggering. The high-energy switching device has previously been identified as a single-point failure element whose premature breakdown leads to inadvertent destruct action by the laser firing channels controlled by the failed switch. This situation has been tolerated in EBW FTS because there is no satisfactory way to stack these switches and synchronize their action to eliminate the single-point exposure. As previously mentioned, a fault-tolerant SCR switching circuit can be used in alternate embodiments.

Figure 11:
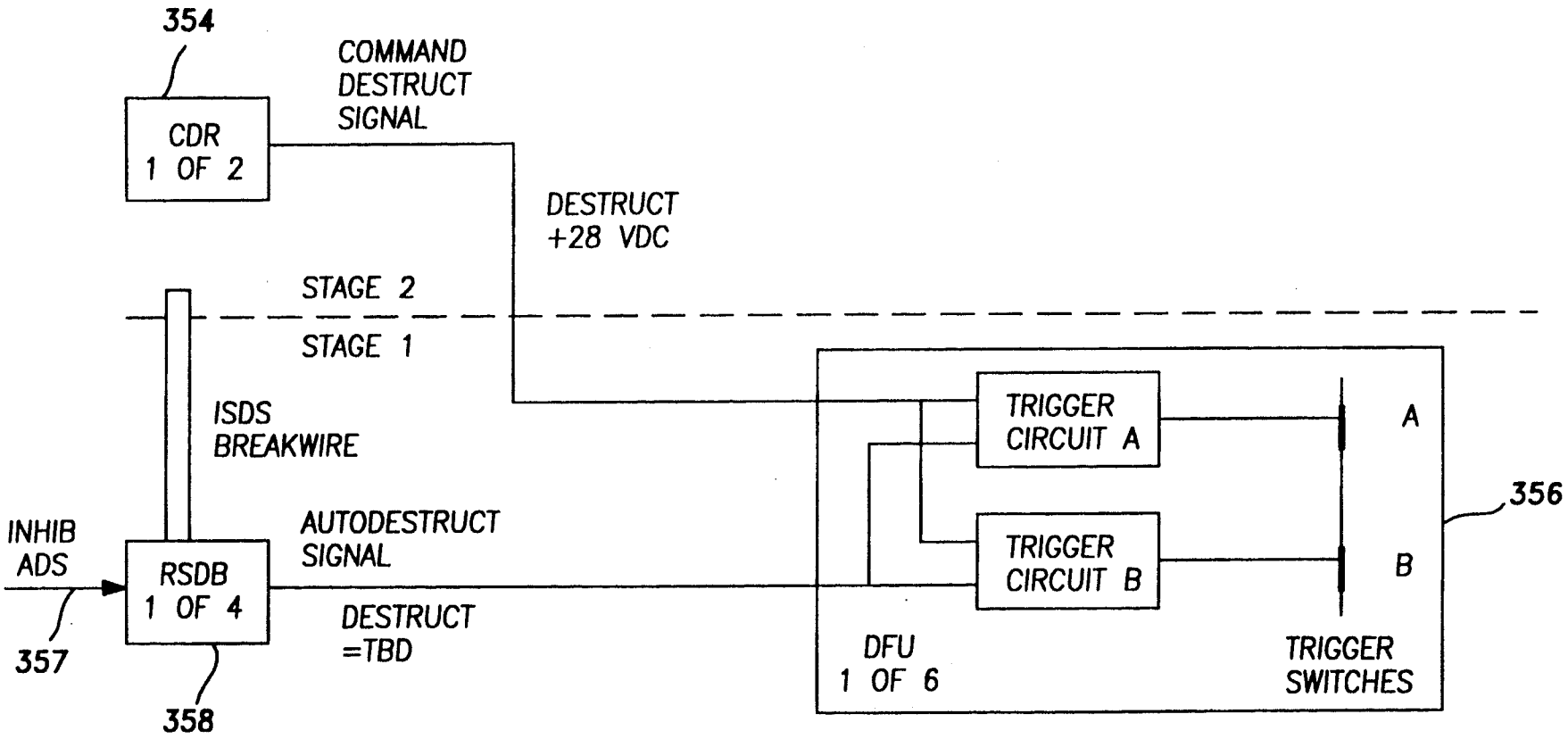
FIG. 11 shows a direct-to-DFU destruct signal distribution.

FIG. 11 shows an exemplary straightforward distribution of destruct signals. In this scheme, the +28 Vdc command destruct signal from each CDR (P or R) 354 is wired directly to each DFU 356 in that system (P or R). Meanwhile, the autodestruct signal generated in each first stage RSDB (P or R) 358 is independently distributed to each first stage DFU in that system (P or R). The signals are OR'd in the DFU trigger circuits. An autodestruct (ADS) inhibit signal 357 is input to the RSDB 358 as described above.

It will be appreciated by those skilled in the art that other trigger signal distribution embodiments can be used. Because the laser energy BIT involves acquisition of the transient laser output pulses, some positive means should be provided to trigger the data acquisition circuits in the RSDBs in anticipation of the laser outputs. This can, for example, be accomplished by routing the CDR destruct signals through the RSDBs. If this is done, the command destruct signals can be OR'd with the autodestruct signal in the RSDB and one trigger line sent to each DFU section.

Since false triggering due to EMI should be suppressed by the system, it is possible to provide optoconverters at the CDR outputs and distribute the destruct signals optically to each DFU. It may also be beneficial to provide command destruct cross-over at that point. The destruct signal from each CDR is coupled to all DFUs, not just the DFUs in one partition (P or R) of the LIO/FTS system. The cross-over should ensure that no component failure or missile breakup situation is able to disable both systems (P and R).

12. LIO/FTS Telemetry Interface

In the exemplary baseline embodiment, the organization and buffering of status signals already present in the RSDBs for ground control and monitoring purposes is included. These signals do not include logic voltage status from the DFUs. The signals are presented in buffered, analog form at a multipin telemetry connector on each RSDB. No calibration features are applied that are not already present for ground monitoring purposes. Accordingly, these features need not be described in detail for purposes of the present preferred embodiments. However, in accordance with the present invention, alternate embodiments of the telemetry interface will be described.

Since the scope of telemetry data is essentially the scope of information required for ground control and monitoring, the telemetry and ground monitoring data formats in the RSDBs can be combined in an alternate preferred embodiment, and the same data stream can be presented to both the telemetry transmitter and a ground link to the control center via the umbilical.

13. Range Safety Distribution Box (RSDB) Interface

In the exemplary baseline embodiment to be described later, the various DFUs are located within a short (approximately 4 to 20-foot) cable run of their respective RSDBs. The primary and redundant DFU sections are operated via separate cables and serviced by separate connectors on the DFU. A key requirement for these interfaces is that cable shearing during missile breakup should not lead to resafing of the DFUs prior to autodestruct operation. This is not a problem with the ESAs, since energy storage capacitors and trigger keep-alive circuits will keep the DFUs alive for several seconds.

However, under the exemplary MSA control approach described previously, power applied to the MSA enable/resafe power line resafes the DFUs by closing the shutters if the power is applied for hundreds of milliseconds. This feature provides positive ground resafing capabilities.

In-flight resafing due to cable shear can be mitigated in several ways. For example, the MSA (unpowered in flight) and ESA (powered in flight) control wires can be routed through different harnesses and connectors. Alternately, the ESA operating power in the RSDBs can be current limited so that it cannot source enough current to operate the MSA unlock solenoids. This latter approach is preferred if ground arming time not adversely affected and in-flight reliability is not compromised.

14. LIO/FTS Ground Interface

The ELV is interfaced to the range safety control console in the control center 263 via range safety distribution boxes (e.g., 264 in FIG. 8). The distance from the control center to the fixed umbilical tower at the pad is approximately 300 yards. The cable run from the umbilical junction boxes to the LIO/FTS RSDBs is approximately 100 feet.

In an exemplary embodiment, there are four on-board LIO/FTS destruct systems, first stage P & R and second stage P & R. The first and second stage systems are independent of each other except for coupling to common command destruct receivers. The P & R systems are functionally independent of each other except for the common mode operation of the optical shutters. For ground control and monitoring purposes, these four systems are identical except that the first stage systems contain more DFUs and laser initiation channels than do the second stage systems.

These four systems are managed as independent systems from the ground so that all of the on-board safety features can be individually operated and verified. In particular, the P & R systems must be managed independently to preserve redundant means of resafing the laser initiation channels. Also, because the first and second stage FTS systems are managed via separate first and second stage umbilicals, the LIO/FTS systems should preserve this first/second stage independence. Therefore, the missile/ground interface is implemented as four identical interfaces, differing only as needed to account for the larger number of laser channels in the first stage.

Above all else, the LIO/FTS missile/ground interfaces (RSDBs) must be highly reliable. An interface control failure could lead to a catastrophic hazard, while the failure of a status monitor return link could lead to unsafe operator actions. The missile/ground interfaces should convey data in forms sufficient for the information needs of the range safety operator. If proportional measurements of on-board parameters are required, the interface must be able to supply the data in a proportional form (e.g., FIG. 9), or in a form convertible to a proportional display, and at the required precision. The interface data rate must be sufficient to support time-critical control and measurement needs.

As in the case of the DFU-RSDB harnesses, shearing of the on-board umbilical wiring to the RSDBs during missile breakup should not disarm or otherwise disable the LIO/FTS system. To guard against this, the ESA and MSA power busses in the RSDBs are not directly exposed to the umbilicals. Each bus is powered from the ground through normally open relays and monitored by the ground via optoisolators in the RSDBs. Therefore, during flight, the umbilical wiring will not carry any power generated by the LIO/FTS system, nor can power applied to any single umbilical input to the RSDBs cause system resafing.

The present FTS ground interface for each stage uses hard wired discrete lines. Three wires control the S/A motor position and three wires monitor the safe and arm switches. Relays in the umbilical junction boxes are energized from the control center to switch ±28 Vdc pad power to the S&A motors. This approach is straightforward, reliable, and tractable.

The same hard-wired discrete approach is used in a preferred exemplary embodiment to control the application of ESA and MSA arming and resafing power and to monitor the safe and arm status switches in the DFUs. This provides range-safety operators with positive control and monitoring of safe/arm status with no intervention of active components and no failure mechanisms other than wire breakage and relay failure. Several other binary (on/off) controls and status indicators will also be hard-wired. Means must be provided to protect equipment from lightening-induced transients on these long lines.

Alternate ground interface configurations can be used in accordance with the present invention. For example, another form of discrete hard-wired interfacing is available with 0–20 mA current loops. This is a mature technology designed to transmit proportional measurements over relatively long distances in noisy environments.

In the 0–20 mA current loop format, the loop current is proportional to input voltage, with zero volts translated into 4 mA and full-scale voltage into 20 mA. Frequency response is dc to several kHz. With the use of 18 gauge shielded twisted-pair wire, these loops are used to connect points up to 1000 feet apart. The transmitting and receiving circuits are available to MIL-SPEC. When calibrated at zero and full-scale input voltages, the loop accuracy can be maintained at approximately 2% of full scale.

In an exemplary LIO/FTS embodiment, discrete current loops are used to deliver proportional high voltage monitor values to the control center. Each first stage RSDB is interfaced with 12 loops, and each second stage RSDB with 6, for a total of 36 loops, each requiring two wires between the launch vehicle and the control center. These HV monitor signals are easily handled in a multiplex format, but loss of a multiplexed channel leads to the loss of all HV monitor data from a system (P or R, stage 1 or 2). With discrete loops, no single point failure will disable more than one monitor, given the common powering of all high-energy capacitors within a DFU section.

To transmit proportional measurements with greater precision than that available with the 0–20 mA loop approach, or to transmit more data over a physical channel, it is preferred to use a digital interface. At the distances involved in an exemplary embodiment, serial communications are used. The commercial standard serial bus, RS-232C, can handle data at rates up to 9600 baud (bits per second) over distances of 150 feet before the error rate becomes significant. The RS-422 bus, which is an RS-232C derivative, extends this distance to about 300 feet.

The MIL-STD-1553B bus is the standard 1 Mbit/s avionics serial data bus. It is implemented as a redundant bus pair (bus A and bus B), with one bus operating in standby mode until switched in by fault detection circuitry. The 1553B bus is able to span 1500 feet if wired with triaxial cable and operated with less than six remote terminals. The 1553B bus approach is cost competitive with several current loops. Accordingly, in a preferred embodiment, a 1553B bus link is used between the control center 263 and each of the four FTS/LIO systems (first and second stage, P and R) to transmit all BIT data to the control center. Each bus is configured with the bus master 291 in the control center and the remote terminal 296 (RT) in a RSDB.

Alternately, the control and monitor data volume between the control center and each LIO/FTS system can be easily supported by a two-fiber, bidirectional optical data link, with encoding and decoding electronics at both ends. However, to support the safety requirements for positive control and readout of safe-arm status, the links should be fault-tolerant. Lower-level links are preferred because they are able to satisfy the control and monitoring requirements.

15. Range Safety Control Console

Previously, system safe-arm control features were described for an exemplary embodiment, and preferred inhibits and interlocks were discussed. An exemplary embodiment of MSA and ESA safe-arm mechanisms was subsequently described after which interfacing of these mechanisms to ground and flight control and monitoring systems was discussed. Attention will now be focused on exemplary destruct system control panels to be provided in the control center.

The control of the on-board LIO/FTS systems essentially reduces to the control of the ESA and MSA mechanisms in the DFUs. The addition of BIT functions makes the control of these mechanisms mode-dependent. To be acceptable, these control elements should be absolved of compromising in-flight destruct system reliability.

In a preferred embodiment, the need for on-board mode control circuits is eliminated, and the operator is presented with a direct yet safe access to the on-board system. This "discrete arming" approach, which will be fully described later, completely separates the ESA and MSA arming functions at the control console and keeps them separate throughout the system. The operator is provided controls that enable and arm the ESAs and separate controls which enable, arm, and resafe the MSAs.

Mode supervision is provided by a mode interlock switch and a mode interlock and alarm generator state machine located in each control panel (P and R). The operator uses the mode interlock switch to declare his intentions (laser energy BIT, continuity BIT, prepare for launch, or resafe and standby). If the system is not in a safe-arm configuration safe for the intended operating mode, the mode interlock state machine prevents the mode interlock switch from issuing control power for the intended operations, and also activates alarms. If, during the exercise of a mode, the system assumes an unsafe configuration, the interlock state machine resafes the system.

It will be apparent that alternate embodiments of the console control can be envisioned. For example, in an alternate embodiment, mode-dependent power can be issued to the on-board systems and on-board, mode-dependent interlocks are supplied to prevent the system from entering unsafe configurations.

16. Ordnance Initiation Systems

For FTS, the command destruct fire commands are preferably routed directly from the command destruct receivers to the DFUs. For OIS systems, the firing commands are generated by the guidance computer and can be routed directly to the LFUs or via the LIO interface units. In any case, the OIS LFU, in general, should be equipped with one trigger circuit and high energy switch per laser (discrete firing) while the FTS DFUs can be bank fired as mentioned previously.

Figure 12:
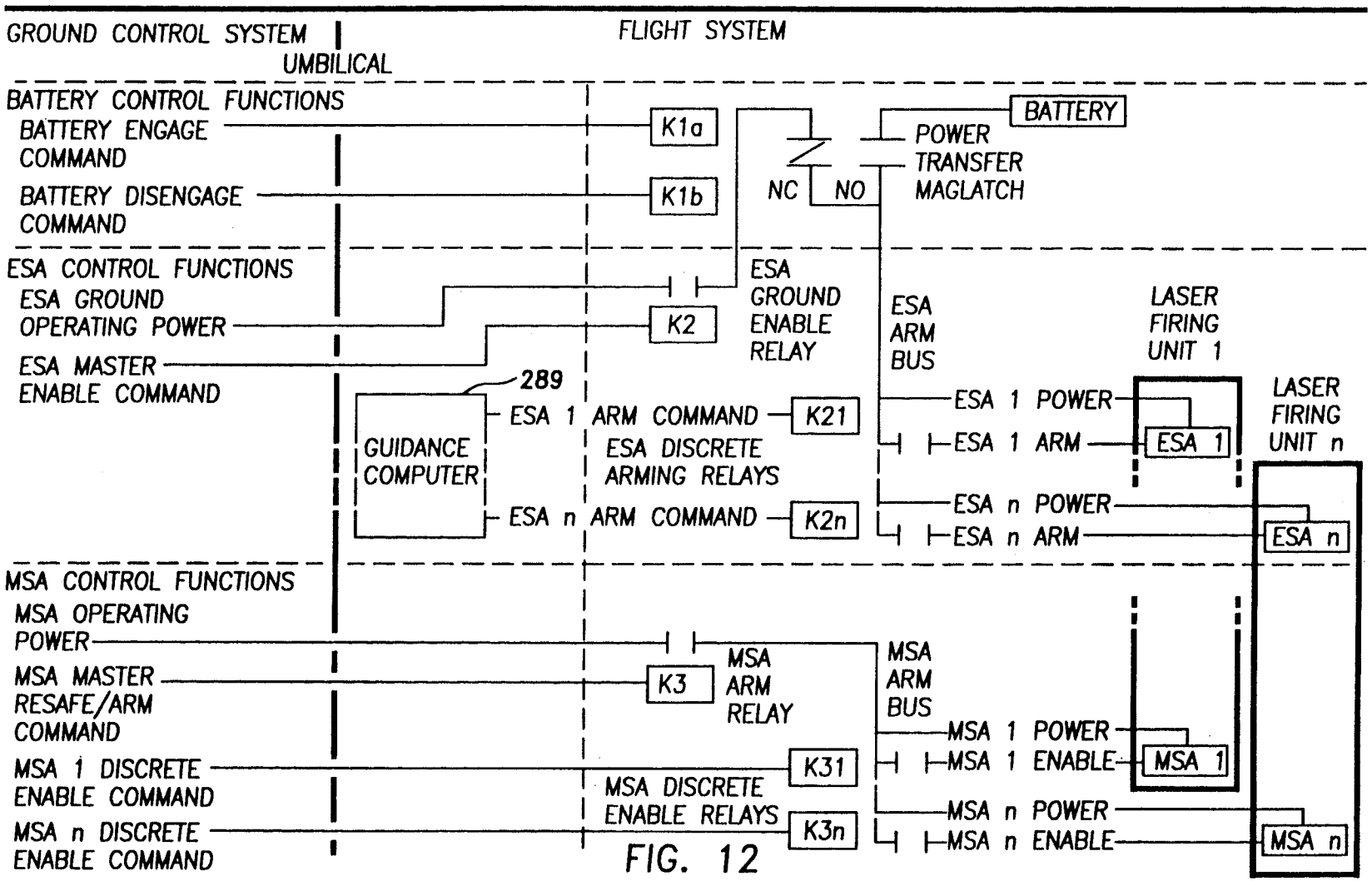
FIG. 12 is an adaptation of an exemplary FTS embodiment to an OIS.
Figure 13A:
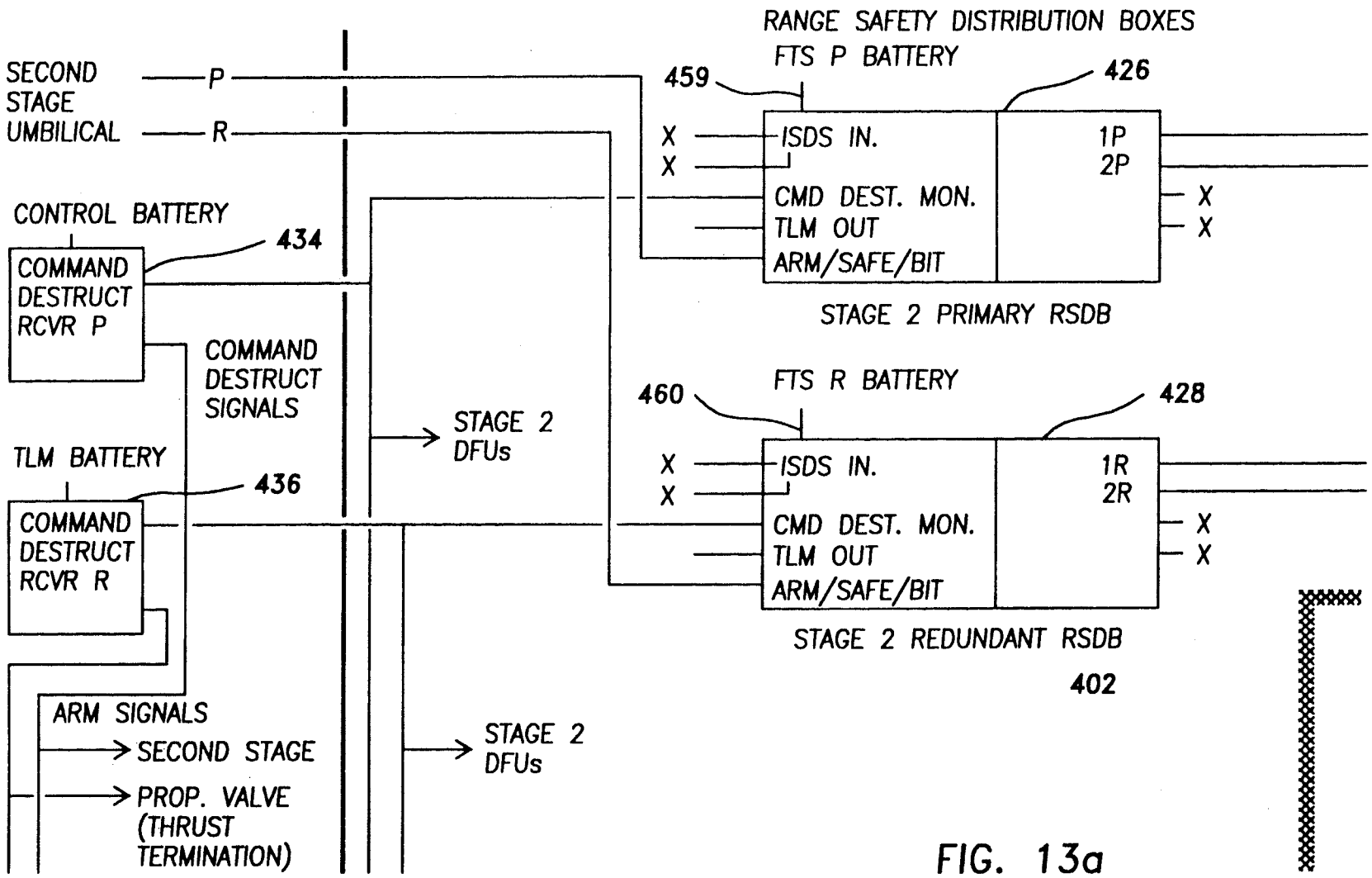
Figure 13B:
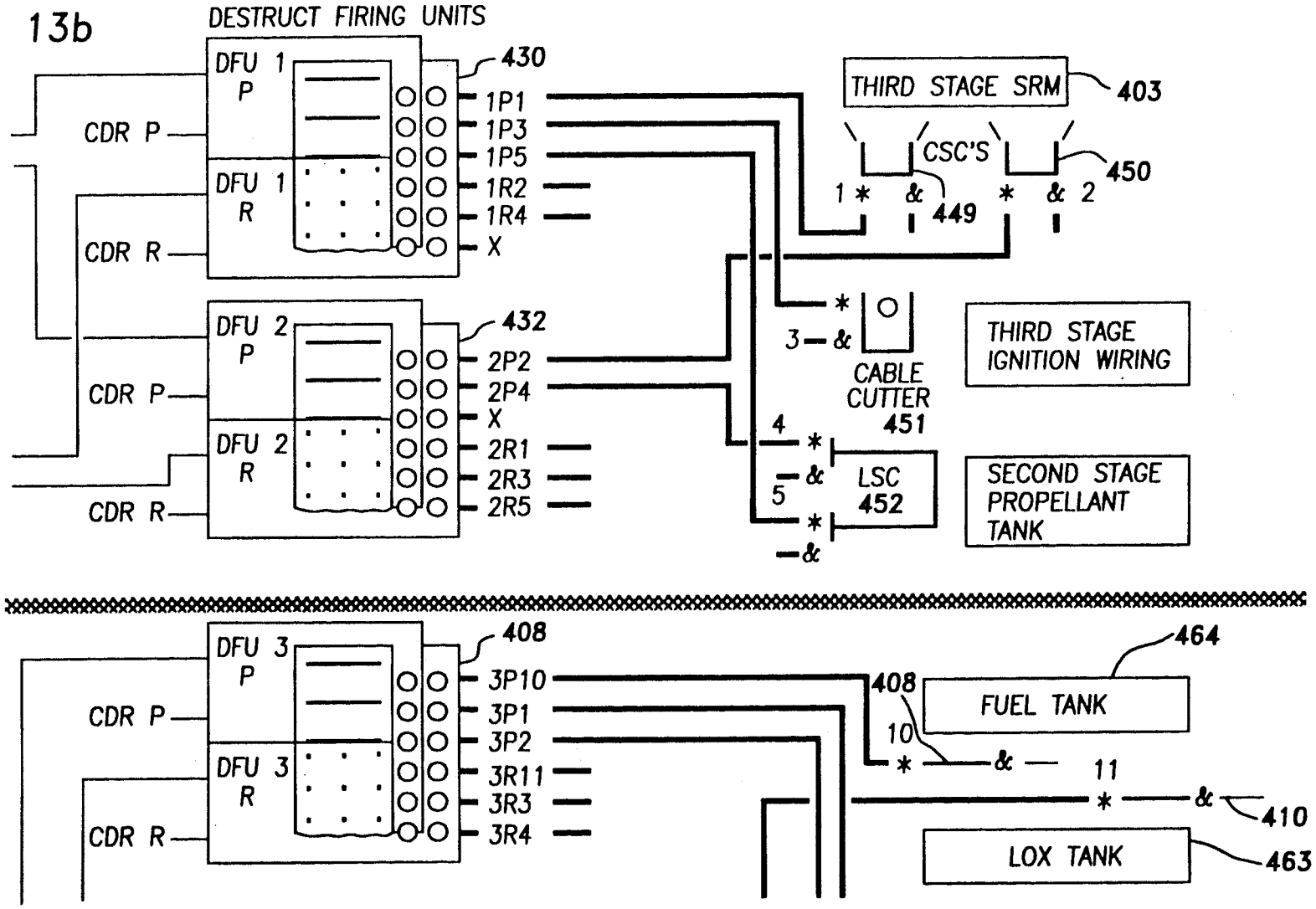
Figure 13C:
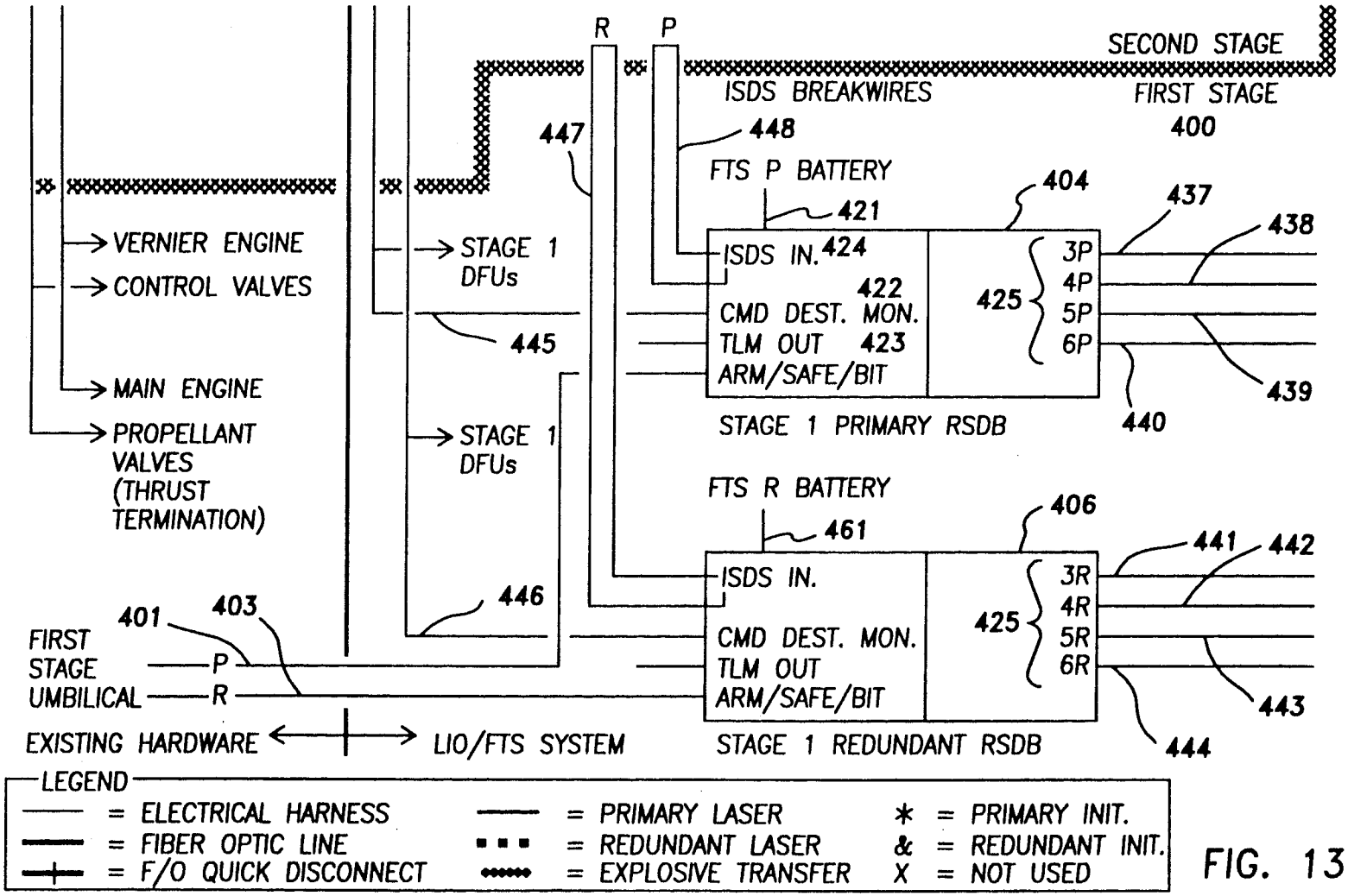
Figure 13D:
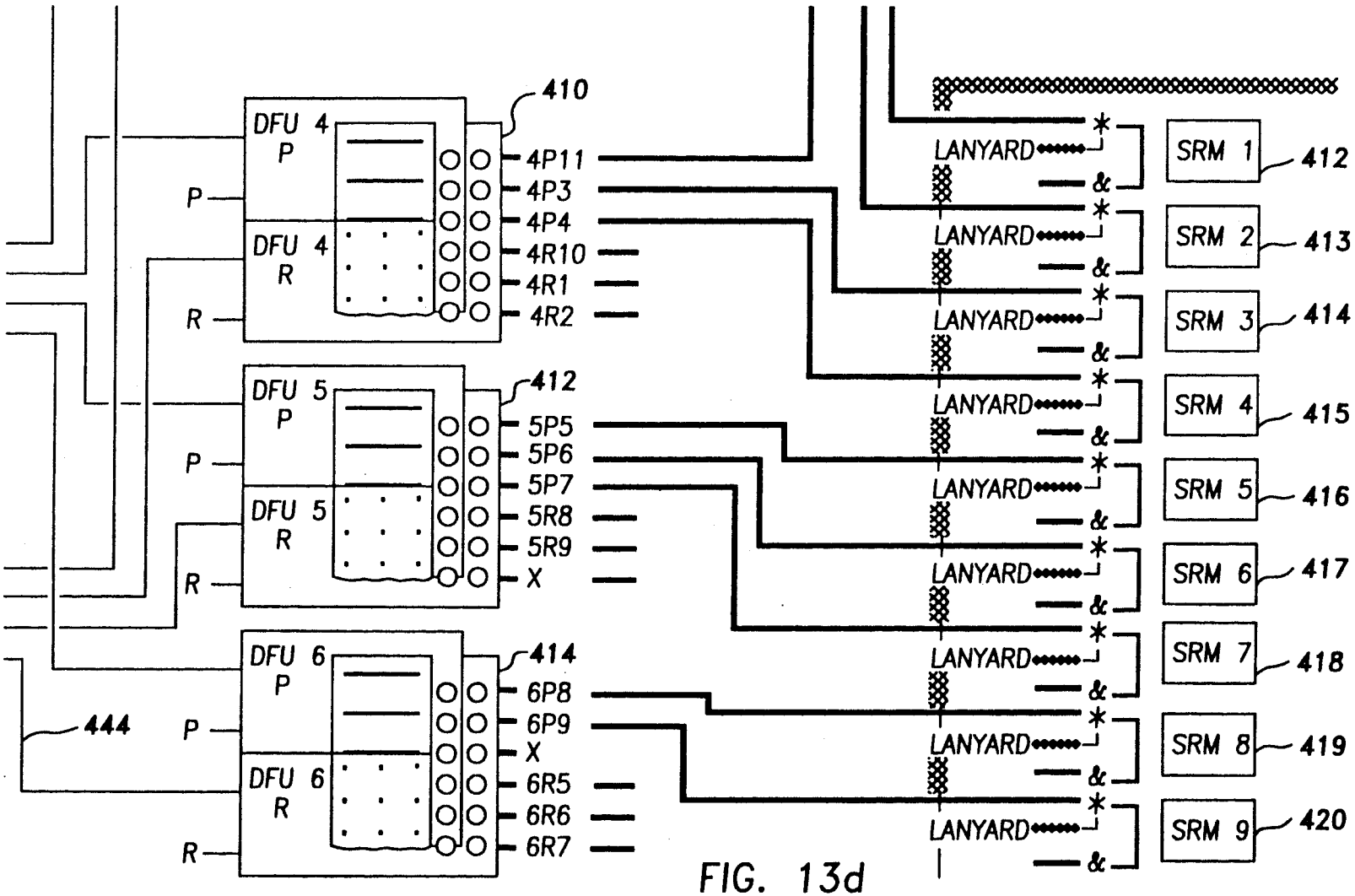

FIG. 12 is an adaptation of an arming and safing control approach to OIS. The arming point for OIS systems is a user option. If the user elects to fully arm the OIS firing units on the ground, then the arming and safing circuits are identical for OIS and FTS. If the user elects to arm the OIS firing units in flight, the MSAs should still be armed on the pad, as in FTS, with the ESAs being armed in flight by control signals from, the guidance computer 289, as shown in FIG. 12.

C. Exemplary Baseline System

1. Overview

An exemplary, preferred LIO/FTS baseline embodiment for a Delta II system will now be described. FIG. 13 is a summary ship set interconnect diagram for an exemplary baseline system.

The FIG. 13 system includes a first stage 400, a second stage 402, and a third stage 403. The first stage includes two range safety distribution boxes (RSDB) (404 and 406), four destruct firing units (408A, 410A, 412A, and 414A), interconnecting electrical harnesses, fiber optic cable assemblies (FOCA), 22 laser initiated detonators (LID), 2 tank destruct charges (408 and 410) and 9 SRM destruct assemblies (412–420).

Each RSDB (as described previously with respect to FIGS. 8–9, includes a hermetic housing assembly, a relay chassis assembly, a main printed wiring assembly (PWA), a BIT PWA and a quad DFU interface PWA. The hermetic housing assembly includes a deep-drawn stainless-steel enclosure, or can, with shock mounts and a connector panel assembly. As shown in FIG. 13, the connector panel assembly further includes a panel, an FTS battery connector 421, a command destruct signal monitor controller 422, an umbilical connector 423, an ISDS breakwire connector 424, 4 DFU interface connectors 425 and 24 FOCA SMA feedthroughs.

The relay chassis assembly includes: a battery test relay and load/driver; an FTS power transfer maglatch; an ESA master ground enable relay; 4 ESA discrete arming relays; MSA master ground arm relay; and 4 MSA discrete enable relays. The main PWA includes: a main printed wiring board (PWB); a power conditioning assembly with EMI filters and a logic voltage regulator; a power bus monitor with ESA and MSA power bus optoisolator drivers; an ISDS/destruct monitor assembly with a breakwire keep-alive and autodestruct delay circuit and fire command monitor optoisolator/-driver; and TL registers and drivers.

The BIT PWA includes: a BIT PWB; a continuity BIT data acquisition circuit; a laser energy BIT data acquisition circuit; a BIT data controller; and a 1553B bus remote terminal. The Quad DFU interface PWA includes: a DFU interface PWB; MSA monitor pull-up resistors; 16 0–20 mA drivers and 24 photoreceivers.

Figure 22A:
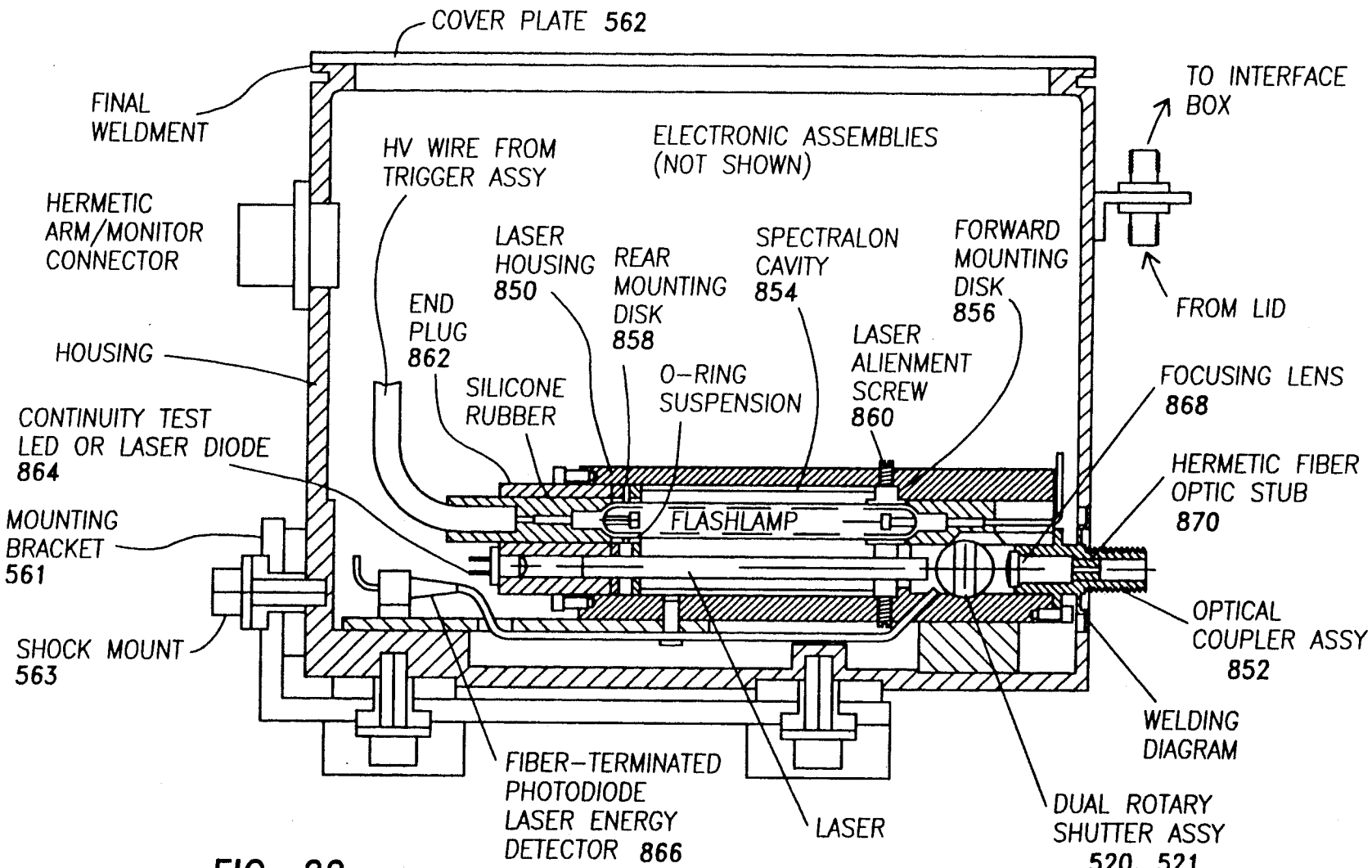
FIGS. 22a–b show an exemplary baseline embodiment of a destruct firing unit.
Figure 22B:
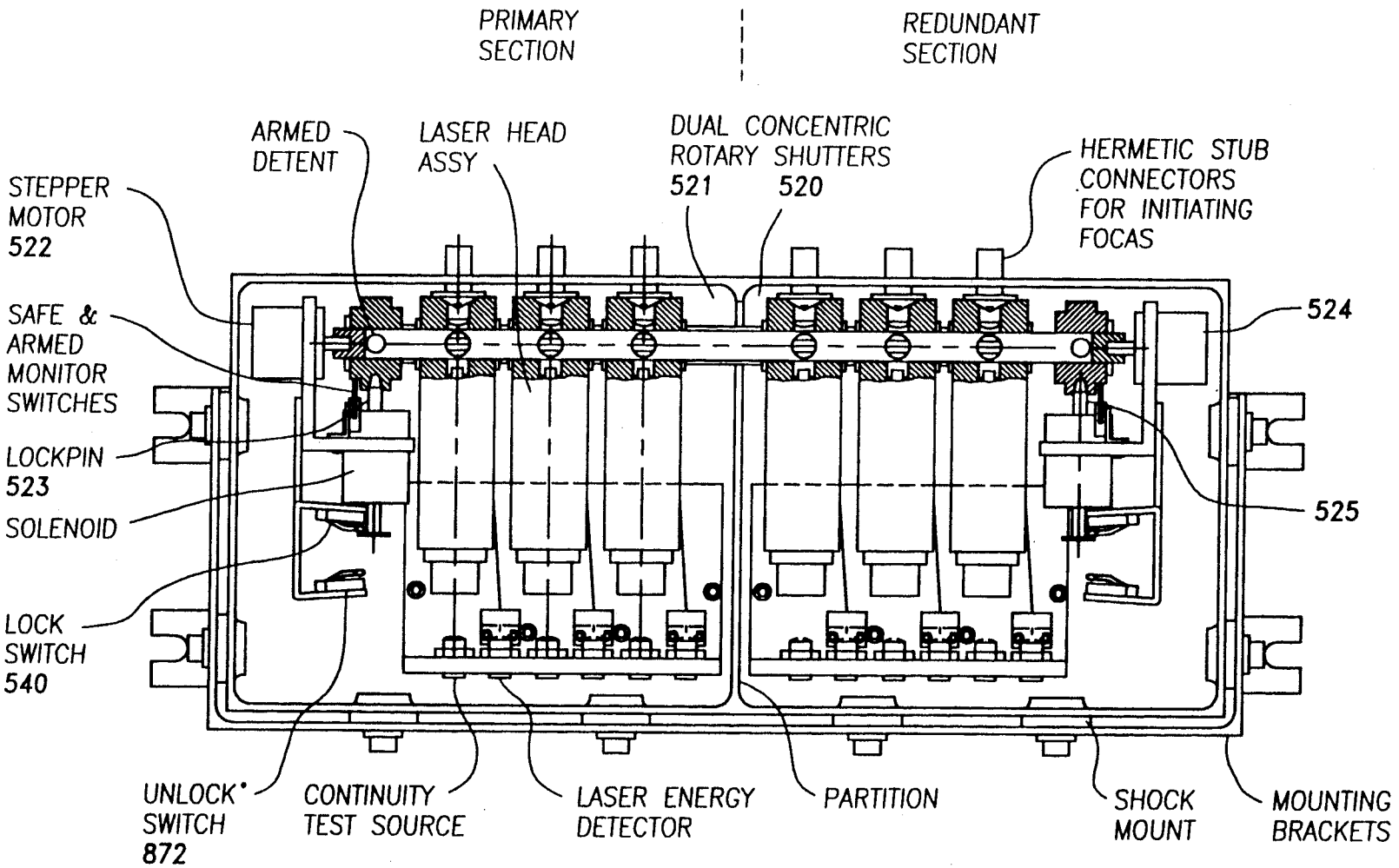
Figure 23A:
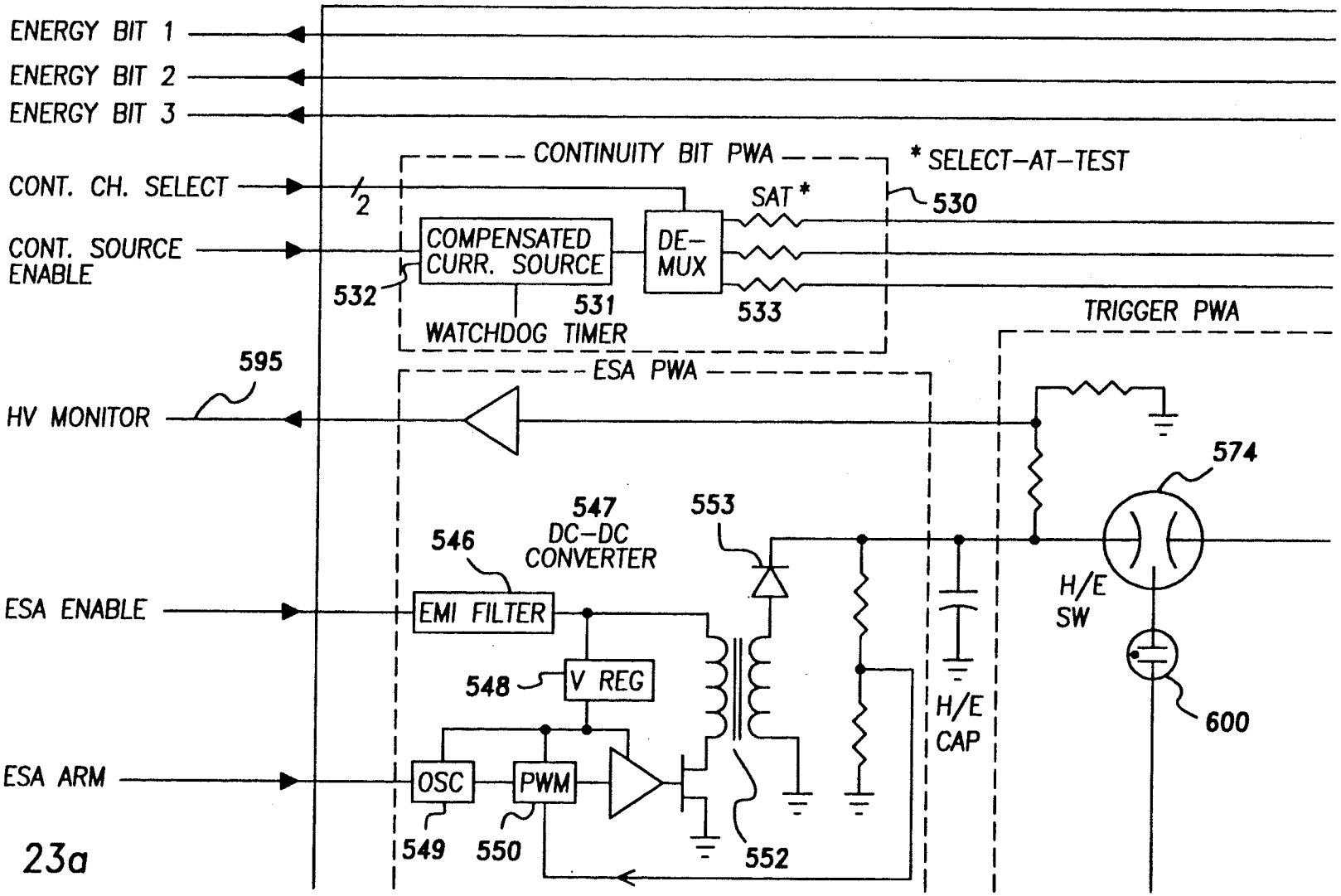
Figure 23B:
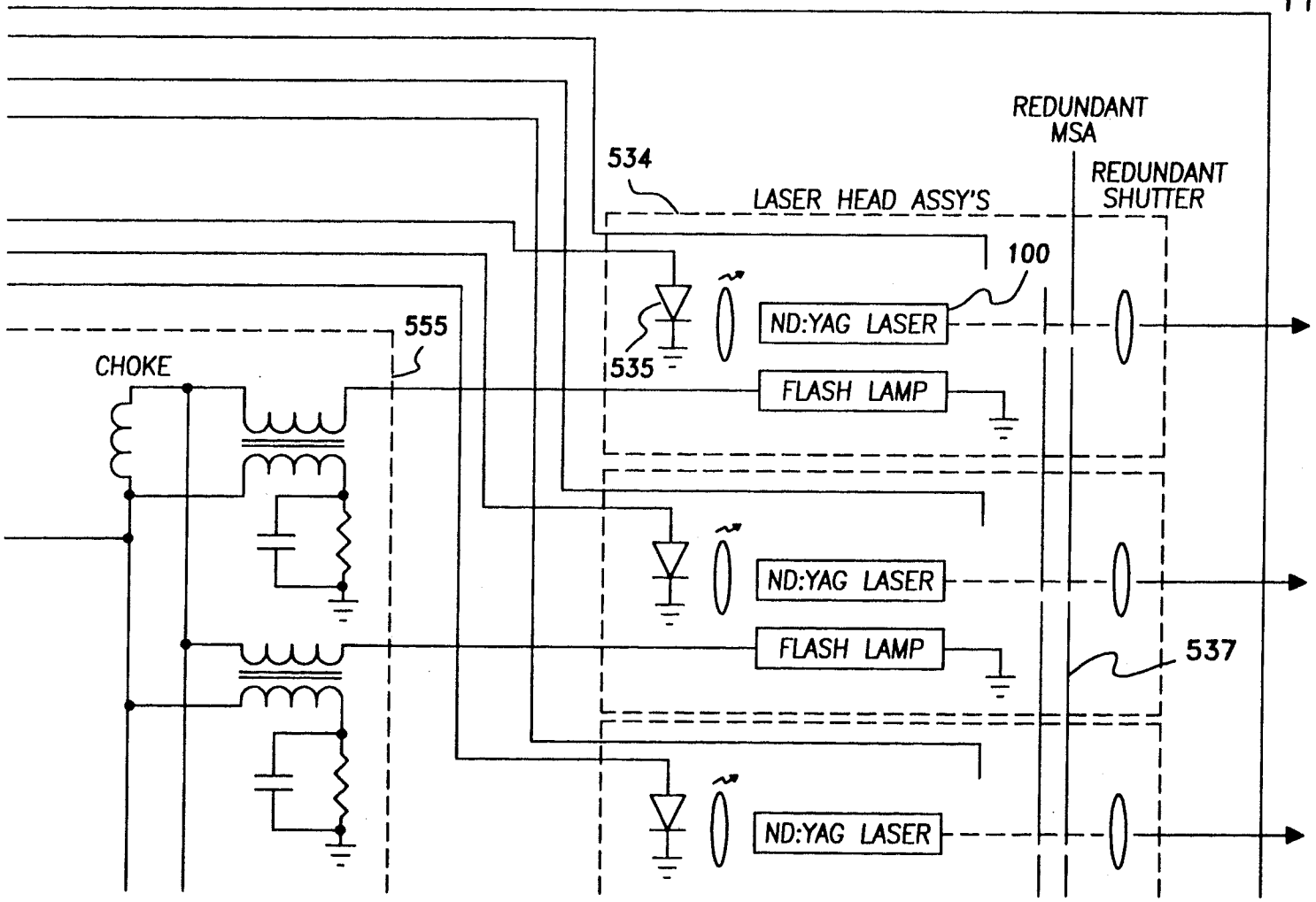
Figure 23C:
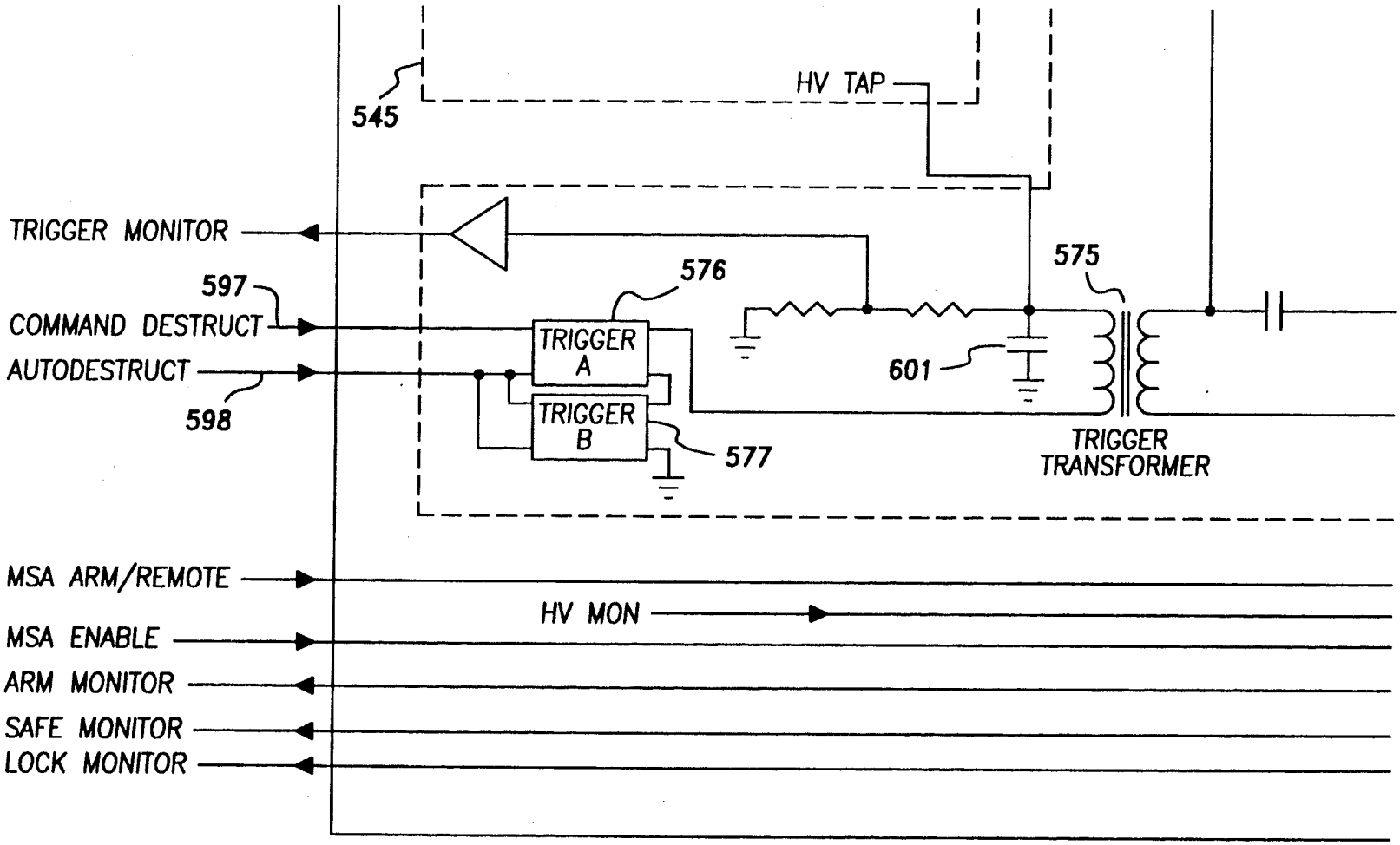
Figure 23D:
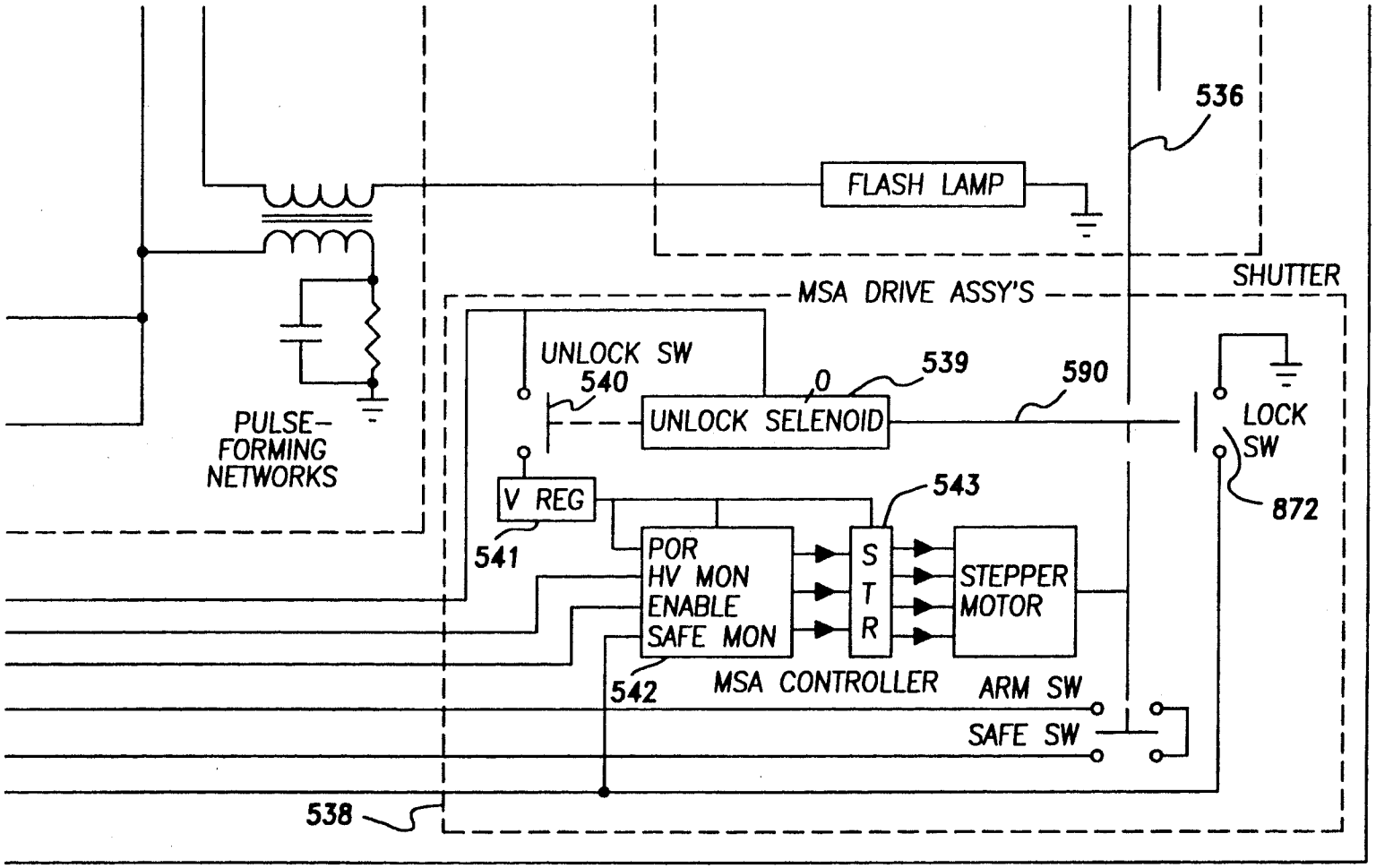
Figure 24A:
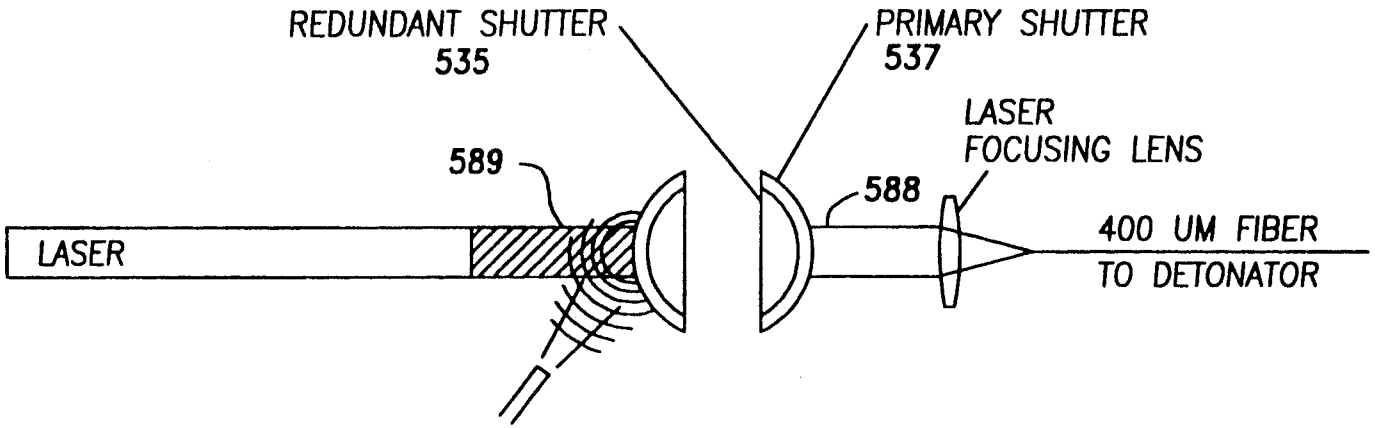
FIGS. 24a–b show a rotary shutter detail.
Figure 24B:
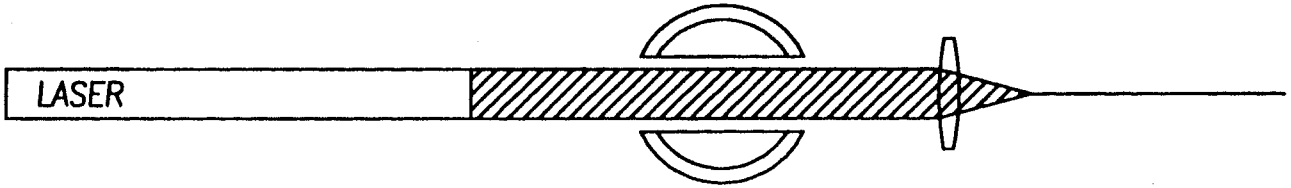

As shown in FIGS. 22*a–b*, each destruct firing unit (DFU) of FIG. 13 includes a housing assembly; 2 capacitor assemblies, 2 mechanical safe/arm driver assemblies; and, 2 laser bank assemblies. The housing assembly further includes a cover plate and a housing with shock mounts. The closure assembly includes a connector plate; laser bank mounting brackets; 2 arm/monitor input connectors; 2 command destruct input connectors; and, 2 return continuity FOCA bracket assemblies with SMA feedthru connectors.

As will be described with respect to FIGS. 22–26, the MSA drive assemblies include: an unlock solenoid; a lockpin; an unlock switch; a lock switch; a safe monitor switch; an arm monitor switch; a stepper motor; a shutter sleeve (primary) or rod (redundant); and an MSA controller PWA with an MSA controller PWB, a voltage regulator, an MSA controller state machine and a stepper motor drive IC.

Further, as will be described with respect to FIG. 23, each laser bank assembly includes three laser head assemblies, an ESA PWA, a trigger PWA, and a continuity BIT PWA. A laser head assembly includes a laser housing assembly having: an Nd:YAG laser; a Xenon flashlamp; a continuity BIT laser diode; and, a laser diode collimating lens. The laser head assembly further includes a hermetic optical coupler assembly having: a laser focusing lens and a hermetic optical interface. An ESA PWA further includes an ESA PWB; an EMI filter circuit; an oscillator/PWM; an HV power transformer; and, three HV monitor drivers.

Figure 7A:
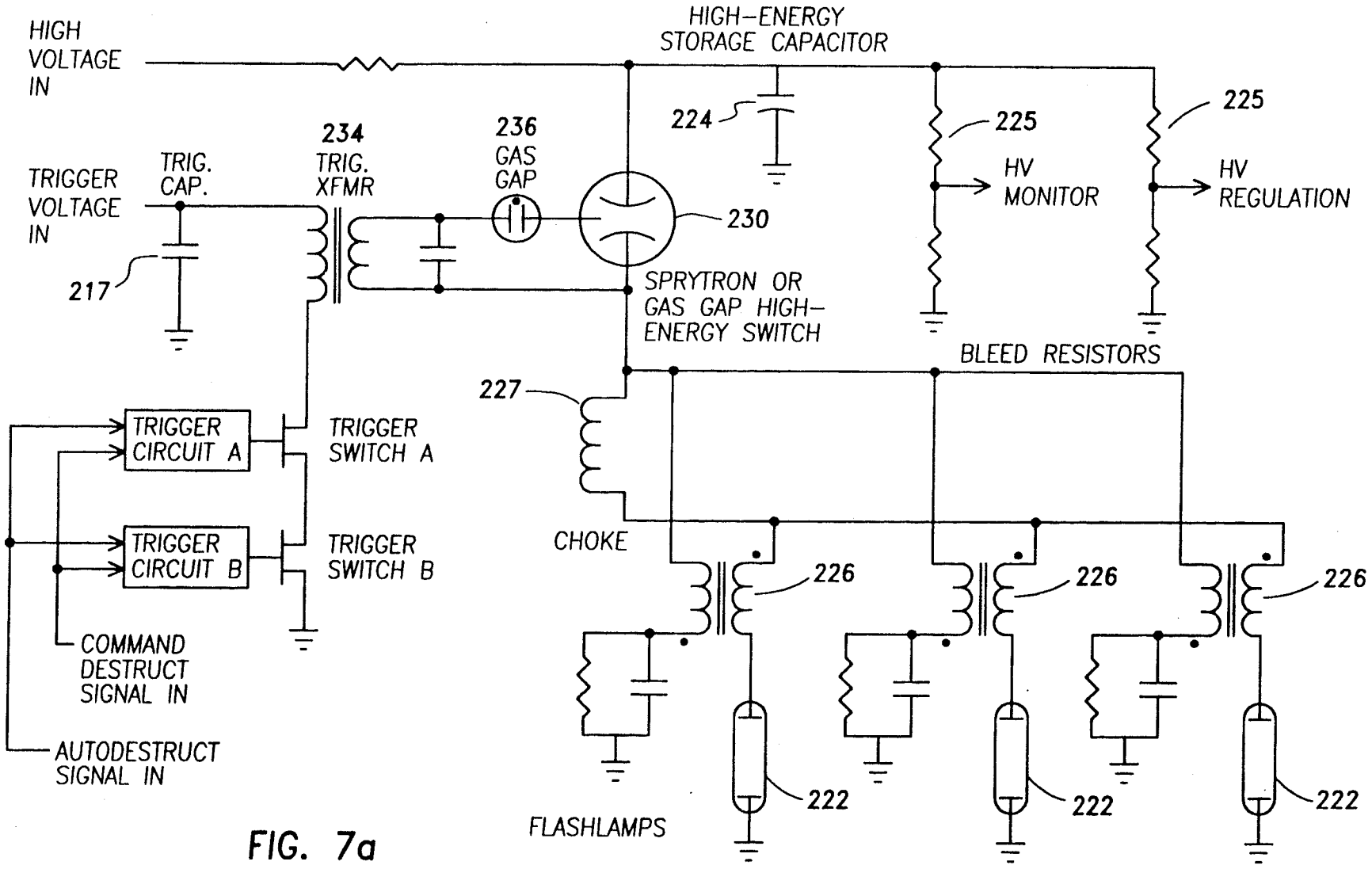
FIG. 7*a* shows use of a single high-energy switch to operate multiple flashlamps.
Figure 7B:
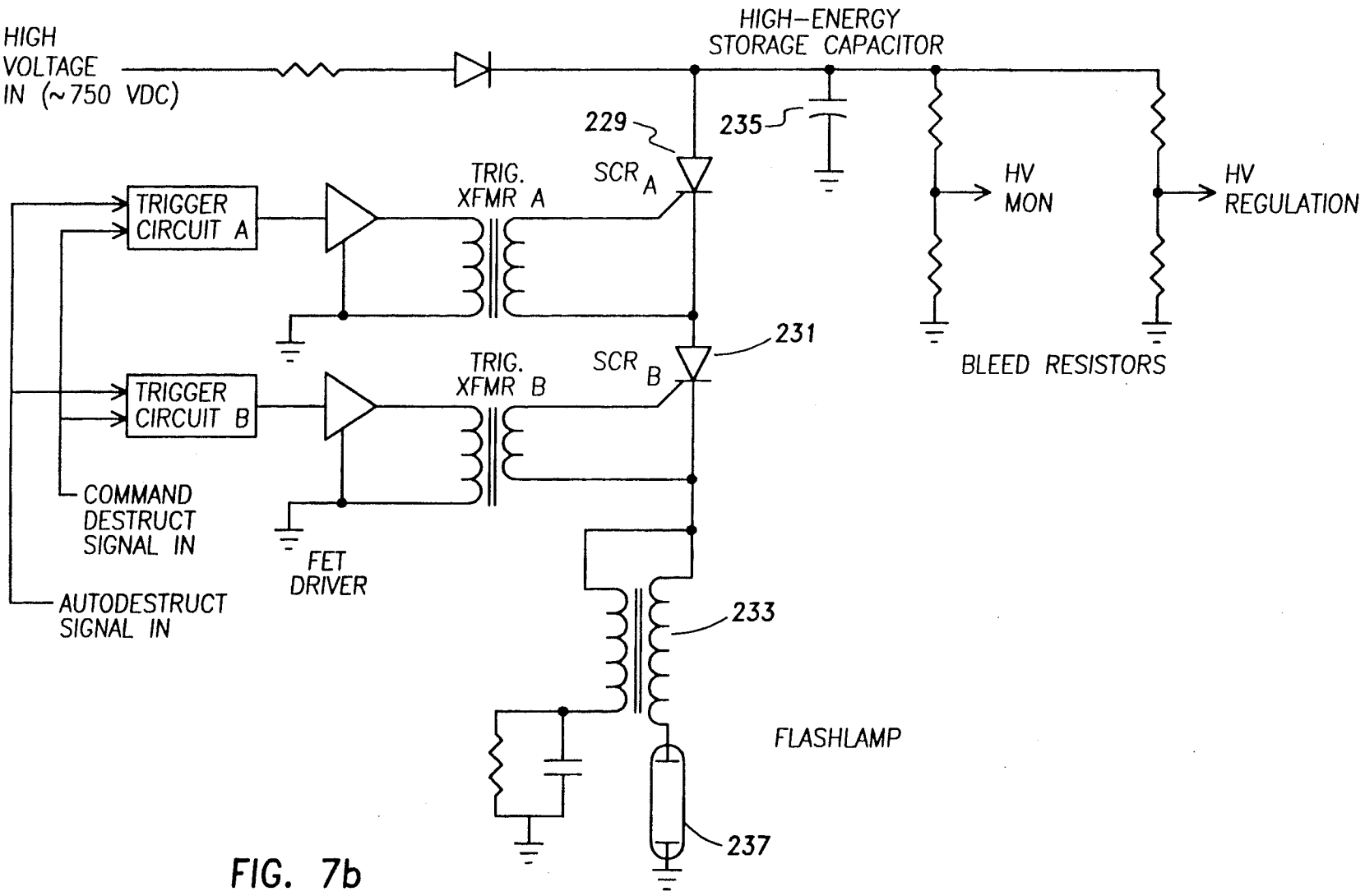
FIG. 7*b* shows an alternate high-energy switch arrangement.

As was described with respect to FIG. 7, a trigger PWA further includes: a trigger PWB; three pulse forming networks; a high energy switch; a trigger pulse forming circuit; trigger monitor drivers; and, 2 trigger logic circuits. As described with respect to FIGS. 8–9, a continuity BIT PWA further includes a continuity BIT PWA; a watchdog timer; a temperature compensated current source; a channel select multiplexer and 3 select-at-test resistors.

As will be further described with respect to FIG. 21, the FOCAs include four DFU tank destruct LID FOCAs and 18 DFU SRM disconnect FOCAs. The tank destruct LID FOCA each include fiber optic cable, 2 SMA connectors (DFU/BIT termination) and a modified dual-fiber SMA connector (LID termination). The SRM disconnect FOCAs each include fiber optic cable, 2 SMA connectors and dual fiber quick disconnect.

As described with respect to FIG. 6, the 22 LIDs each include a live hermetic assembly, a plano-convex focusing lens with dichroic coating, and a lens retainer. The hermetic assembly includes: a detonator body; a glass-to-metal seal preform having an optical window and metal sleeve; $Zr/KClO_4$ initiation mixture; CP DDT mixture; PETN output mixture; and, a metal closure disk.

The 9 SRM destruct assemblies of FIG. 13 each include: an SRM destruct charge; an SRM disconnect with 2 SRM FOCA (including fiber optic cable, modified dual-fiber SMA connector for LID termination, and dual fiber quick disconnect); two ISDS lanyard-activated percussion detonators; and 2 ISDS SRM ETAs.

The first stage electrical harnesses include: 2 RSDB umbilicals 401 and 403A; 8 RSDB DFU harnesses 437–444; 2 RSDB command destruct receiver (CDR) disconnect harnesses 445 to 446 associated with primary and redundant CDRs 434 and 436, respectively; and 2 RSDB ISDS breakwire harnesses 447 and 448.

The second stage 402 is identical to the first stage with minor exceptions. More particularly, the second stage RSDBs 426 and 428 do not include a breakwire connector, use 2 DIU (destruct initiation unit) interface connectors, use 12 FOCA SMA feedthroughs and use 2 DFU Interface PWA.

Further, only 2 DFUs 430 and 432 are included in the second stage. The second stage only uses: 4 DFU harnesses for the RSDB; 4 DFU harnesses and 2 RSDB harnesses for the CDRs 434 and 436; and the RSDB ISDS breakwire harness is eliminated. In addition, 10 DFU LID FOCAs and 10 LIDs are used. Finally, the second stage includes 2 third stage destruct CSCs 449, 450; third stage cable cutter 451 and a second stage destruct LSC 452.

In an alternate command destruct receiver (CDR) destruct signal distribution scheme, opto-convertors can be used to interface the CDRs with the RSDBs. For example, first and second opto-convertors receiving inputs from both CDRs 434, 436 can provide outputs to the first and second RSDBs, respectively in FIG. 13.

The exemplary LIO/FTS embodiment encompasses only destruct functions, not thrust termination functions. A preferred destruct system equipment includes known components, such as:

FTS batteries (P and R)
Command destruct receivers (P and R)
Battery—RSDB harnesses (P and R)
Telemetry—RSDB harnesses (P and R)

An exemplary ground support equipment (GSE) does not include the FTS control console containing the destruct system control panels, nor does it include destruct transmitters or their controls, control center-to-pad wiring, pad power supplies, umbilical junction boxes, umbilicals, or umbilical connectors. However, a system control diagram will be discussed later with respect to FIGS. 28–30 to illustrate how circuits in the various units are functionally interconnected.

2. Location of On-Board Equipment

Figure 14:
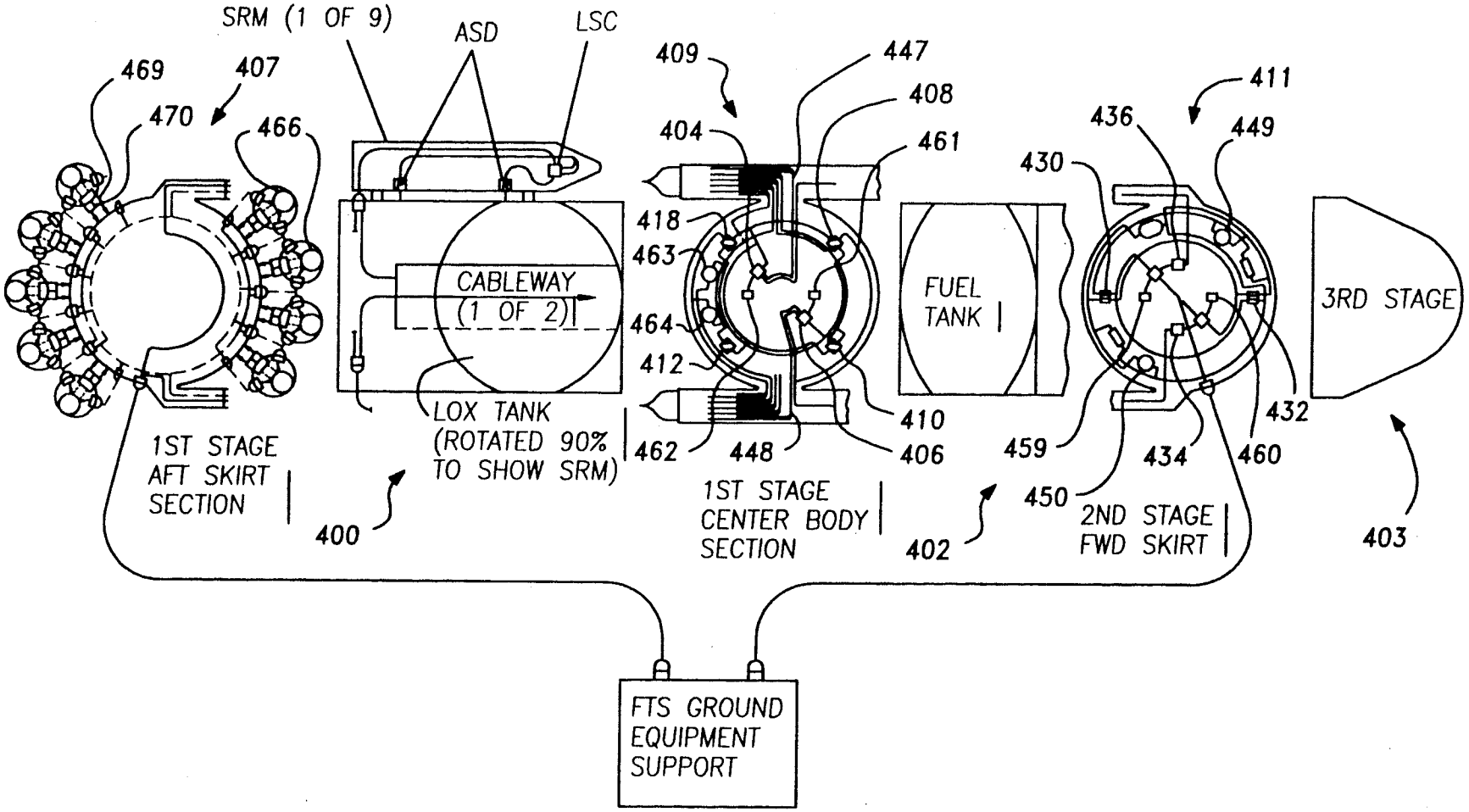
FIG. 14 shows a general arrangement of exemplary on-board LIO/FTS equipment.
Figure 15A:
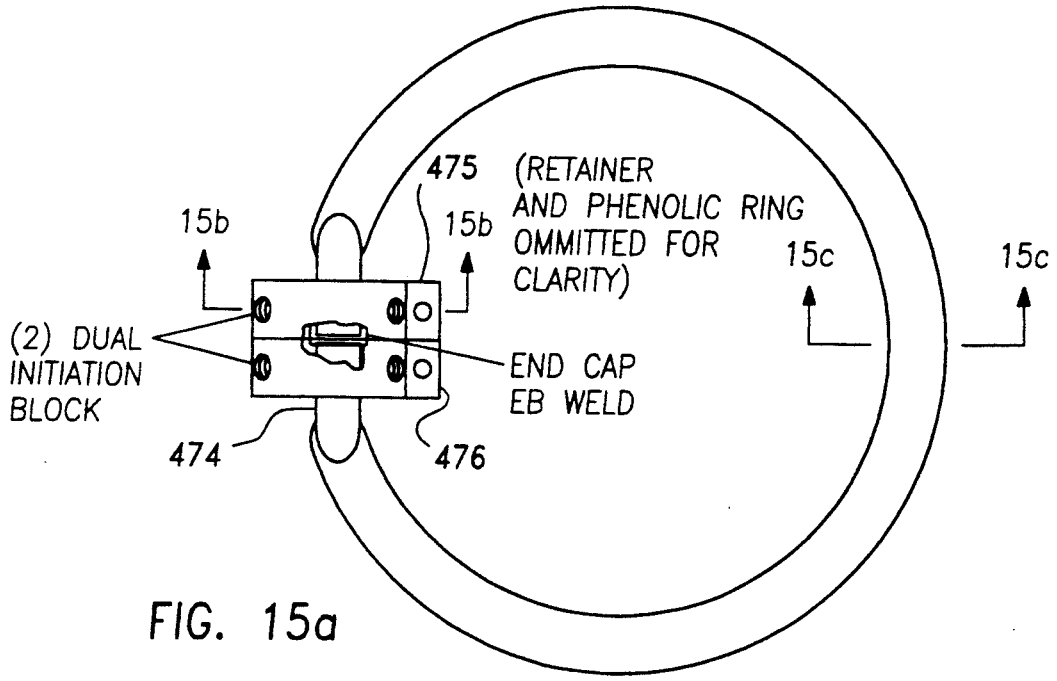
FIGS. 15*a*–*d* show an exemplary baseline embodiment of a circular linear destruct charge.
Figure 15B:
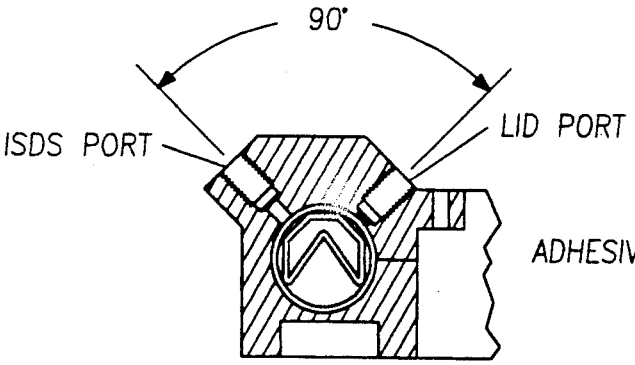
Figure 15C:
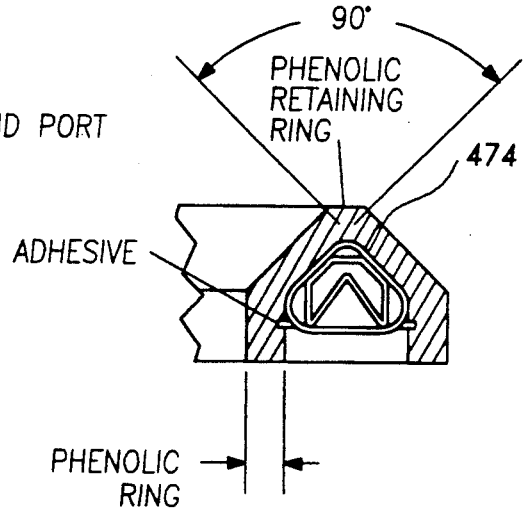
Figure 15D:
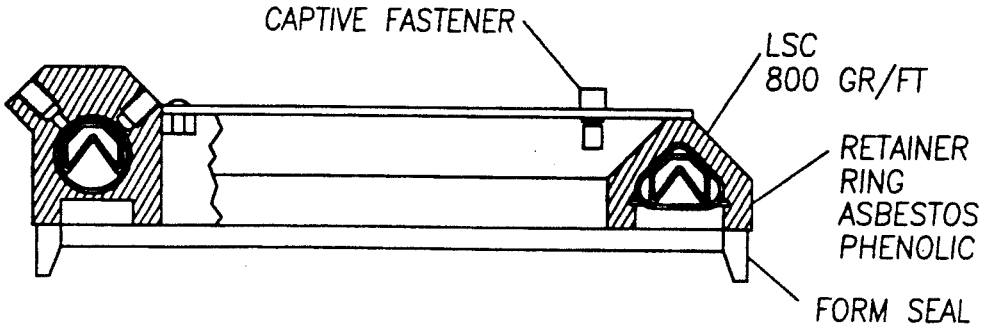

FIG. 14 shows a general arrangement of exemplary on-board LIO/FTS equipment. FIG. 14 shows the first, second and third stages 400, 402 and 403 mentioned above. The first stage includes an aft skirt section 407 and a center body section 409 in which LIO/FTS equipment can be situated. Further, LIO/FTS equipment can be situated in a forward skirt 411 of the second stage.

The second-stage forward skirt section, the first-stage centerbody section, and the first-stage aft skirt section include electrical harnesses designed to carry only primary or redundant circuits. Primary and redundant harnesses are physically separated as far as possible away from each other. There are no in-line connectors except for stage ½ quick disconnects for CDR destruct and ISDS breakwire signals, and the stage 1/SRM FOCA quick disconnects.

Both second-stage RSDBs and DFUs are located in the forward skirt section. The second-stage system is powered by redundant FTS batteries 459, 460 and fired by the redundant CDRs 434, 436 located in the same section. The second-stage system has no autodestruct ADS capability. The destruct charges are located in the FTS with third-stage destruct circular shaped charges (CSCs) being two redundantly-initiated CSCs 449, 450. The DFUs 430, 432 are connected to the ordnance devices so that the primary and redundant lasers for each device are located in different DFUs. Two of the twelve laser heads in the second stage are not used.

The two first-stage RSDBs 404, 406 and four first-stage/SRM DFUs (408A, 410A, 412A, 414A are located in the first-stage centerbody section of FIGS. 13–14 between the LOX and fuel tanks 463, 464, respectively. The first-stage system is powered by redundant FTS batteries 461, 462 located in the same section. The first-stage system is fired by destruct commands from the second-stage CDRs 434, 436 and by ISDS breakwires 447, 448 attached to the RSDBs.

Two known BC/FPD devices are also located in the centerbody. The SRM destruct charges 466 are contained in the SRMs located in the aft section. The SRM initiating FOCAs are dressed down the left and right cableways to the aft skirt area where they terminate in quick disconnects. The FOCAs are routed so that the primary and redundant FOCAs for each SRM are in opposite cableways. FOCAs are connected to DFUs so that the primary and redundant lasers for each tank and SRM destruct charge are located in separate DFUs. Two of the 24 first-stage laser heads are not used.

Each SRM carries a circular linear shape charge, such as CLSC 466 located on the forward motor dome. Each CLSC is optically initiated by redundant FOCAs which run down the SRM and terminate at quick disconnects to first-stage DFU laser firing channels.

Each SRM also carries redundant percussion detonator ISDS sensors 469, 470 actuated by lanyards attached to the first stage. One sensor is mounted near the forward SRM strut, and the second by the aft SRM strut. Each ISDS sensor is connected to the CLSC by an ETA.

The destruct devices used in the exemplary embodiment have been selected only for illustration only. An exemplary baseline design for the SRM destruct device includes two elements: a circular linear destruct charge (CLDC) and an inadvertent separation destruct sensor (ISDS) each of which will be separately described.

The CLDC baseline design is a form, fit, and function replacement for a known CLDC designated Hercules Part No. 270800-009. A 800 gr/ft CH6 linear shaped charge (LSC) and associated standoff are retained to assure equivalent performance. To assure mechanical interfaces, a foam seal and retainer plate are also retained. However, to provide a hermetically sealed CLDC and both redundant LID and ISDS ports, the FCDC port adapter is eliminated and replaced with a thin wall stainless steel tube 474 and two dual initiation blocks 475, 476 as shown in FIGS. 15*a–d*. In addition, the 8.0 inch diameter may be increased to 12.0 inch diameter to better facilitate the LSC bending.

The thin wall tube 474 is swaged into a triangular shape along most of its length to assure alignment of the LSC output chevron. The LSC is placed in the tube, the two dual initiation blocks slipped over the round section of the tube, and the end caps are electron-beam welded before the assembly is bent to the "circular" configuration.

Figure 16:
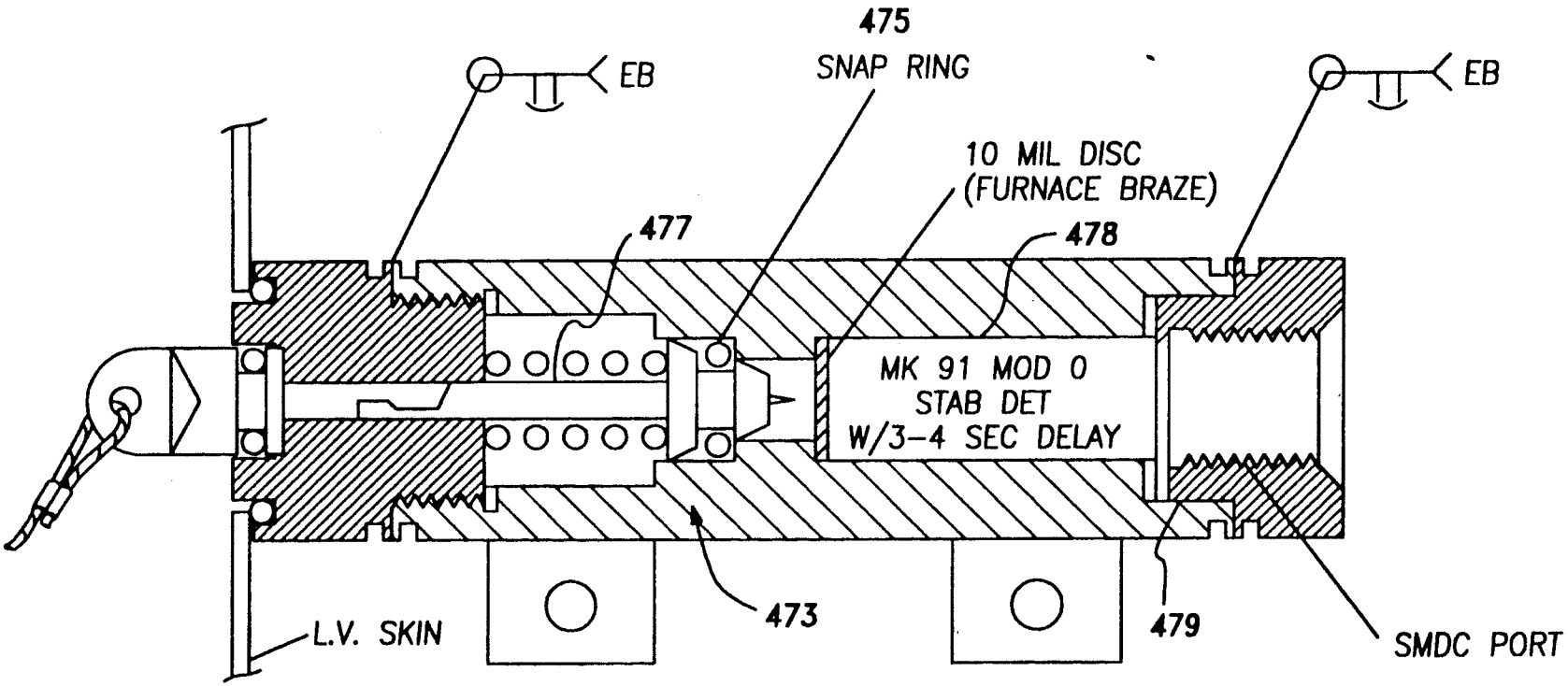
FIG. 16 shows an exemplary SRM ISDS.

The ISDS exemplary baseline embodiment as shown in FIG. 16, uses a one-shot mechanical firing pin device. One ISDS is mounted in the SRM near the forward attachment strut and the other in the SRM near the aft attachment strut. A lanyard is attached to a firing pin assembly on one end and the Delta boost motor on the other.

Whenever the SRM is separated from the first stage (normal staging or inadvertent separation), the lanyard causes the firing pin assembly 473 to translate outward thereby storing firing energy in a spring. After approximately ⅓ full travel, a snap ring 475 (which keeps the firing pin off the delay detonator during flight vibration, shock, etc.) expands outward. After full travel, the two-piece firing pin shaft 477 separates and the stored spring energy propels the firing pin inward which initiates a delay detonator 478. At the end of a fixed delay (e.g., 3 to 4 seconds establishes a minimum SRM/booster safe-separation time for normal staging), the delay detonator output initiates a hermetically sealed ETS assembly 479 that transfers the detonation to the CLDC ISDS port.

Figure 17:
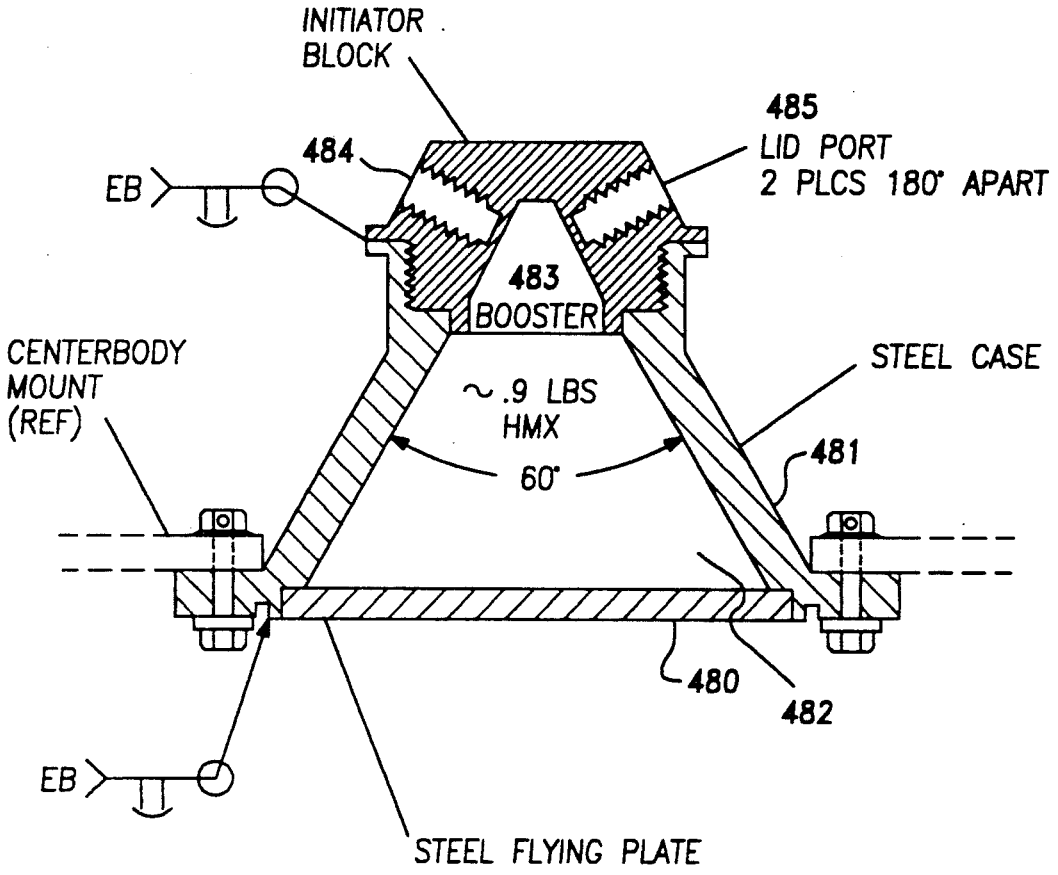
FIG. 17 shows a bulk charge/flying plate destructor.
Figure 18A:
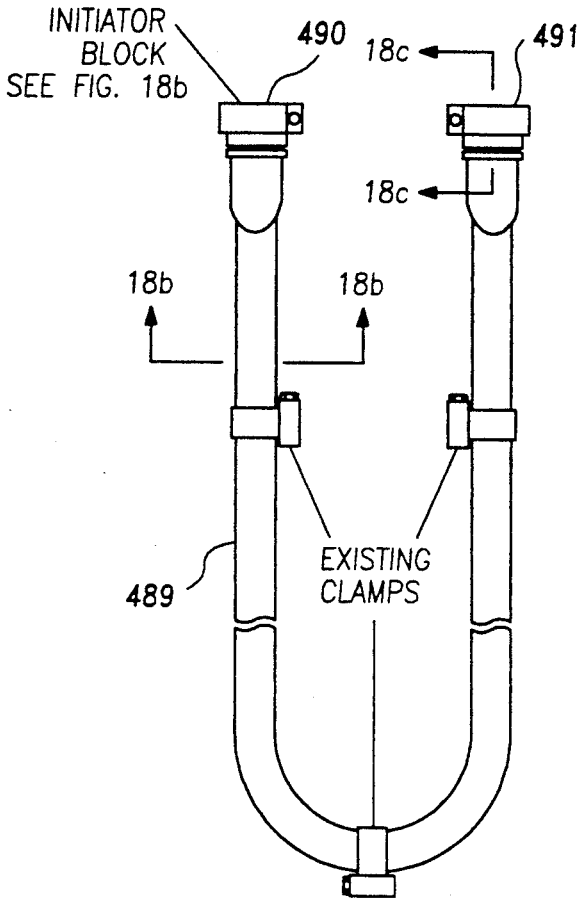
FIGS. 18*a*–*d* show an exemplary, preferred second stage destruct charge.
Figure 18D:
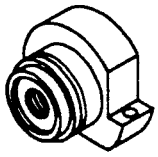
Figure 18B:
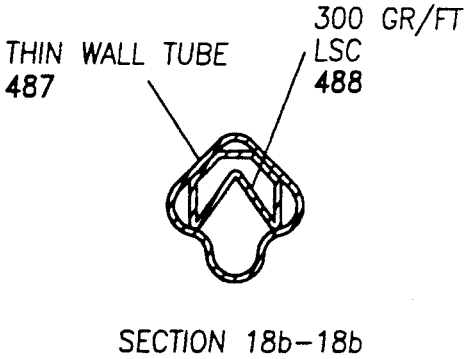
Figure 18C:
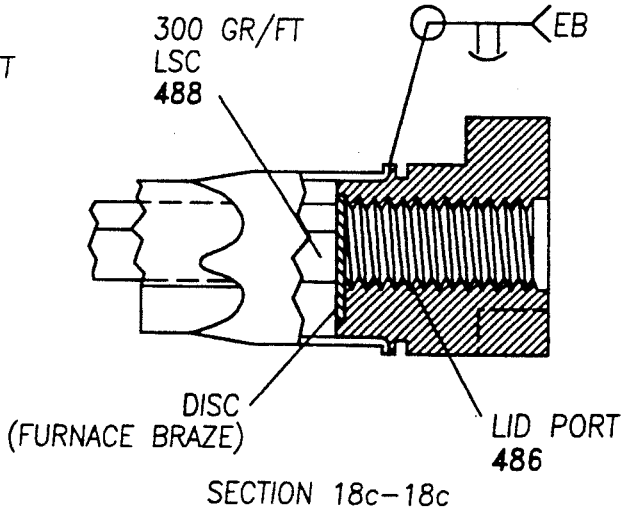

The BC/FPD baseline embodiment for the first stage destruct device is shown in FIG. 17 and includes a relatively heavy wall 60° cone machined from mild steel. A ¼ inch-thick mild steel plate 480 is welded to the base of the cone 481 and a conical cavity 482 which is filled with approximately 0.9 lb of the high explosive HMX. An LID holder/booster 483 is then threaded into the apex of the cone and welded in place resulting in a hermetically-sealed BC/FPD. Firing either o the LIDs initiates the booster via LID ports 484, 485 which in turn initiates the HMX. This explosively accelerates the ¼ inch thick plate to approximately 3,500 ft/sec, rupturing the tank at which it is directed. In addition, massive breakup depends upon the amount of fuel in the tank.

In an alternate baseline first stage destruct device, LSC can be confined in a thin wall tube, similar to the SRM baseline embodiment versus a BC/FPD. The LSC assembly cuts the LOX and fuel tanks in the same way as six strands of primacord in known devices, but is hermetically sealed and initiated at both ends. The hermetic seal is formed by using a glass-to-metal (window) seal in the initiator block of the BC/FPD and by the addition of an initiation charge ahead of the booster provides the required hermetic deal, thus eliminating a separate LID (just a FOCA interface).

A preferred baseline embodiment of the second-stage destruct device is a form, fit and function replacement for the known Delta II LSC. The only modifications are the use of metal-to-metal seals and the addition of LID ports 486 as shown in FIGS. 18*a–d*.

A copper-sheathed 300 gr/ft (RDX) LSC is retained as is, but the heavy wall molded-polyethylene charge holder is replaced by a thin-wall stainless steel tube 487. The thin-wall tube is swaged to a somewhat diamond shape along most of its length. This shape assures alignment of the LSC output chevron and the optimum standoff from the target (fuel/oxidizer tanks). The LSC 488 is placed in the tube, before bending to a U-shape 489, and the two initiation blocks 490, 491 are welded to each end providing the hermetic seal. The sealed assembly is then bent to the U-shaped configuration.

In an alternate baseline second stage destruct device embodiment, glass-to-metal (window) seals can be used in the initiation blocks and an initiation charge can be added on the LSC side of the window to provide the required hermetic seal and eliminate need for a separate LID (just a FOCA interface).

A baseline embodiment of the third stage PAM destruct device is a form, fit, and function replacement for the known Delta II destruct device. The only modifications are the metal-to-metal seals and the addition of a MK 15 MOD 0 explosive lead as well as a LID port 492 as shown in FIG. 19.

The metal-to-metal seal consists of a machined steel adaptor 493 which is furnace brazed to an empty (not loaded) steel housing 496. The booster and RDX charge/liner 494 are assembled into a charge holder subassembly which includes a plastic charge holder 495 in known fashion. The MK 15 MOD 0 explosive lead 497 is then inserted into a hole in the plastic charge holder, formerly reserved for primacord (see FIG. 19), and the charge-holder subassembly 498 is pressed into the steel housing 496. A forward closure, stamped from mild steel, is pressed against the charge holder and welded in place to provide a hermetic seal.

Figure 19:
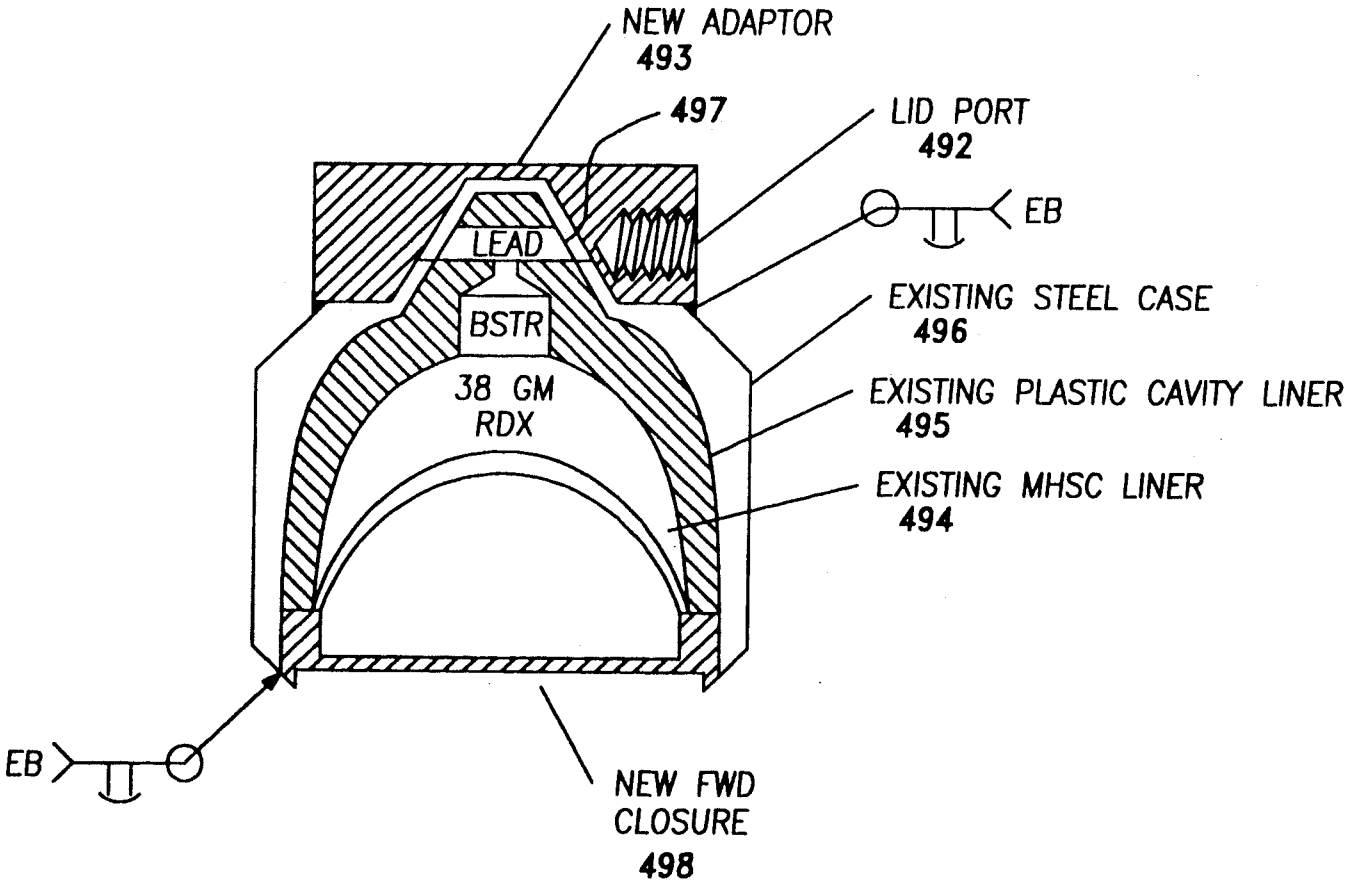
FIG. 19 shows an exemplary, preferred third stage destruct charge.

Because the FIG. 19 device is redundantly initiated, two devices will provide the same reliability as the four devices previously used.

Figure 20:
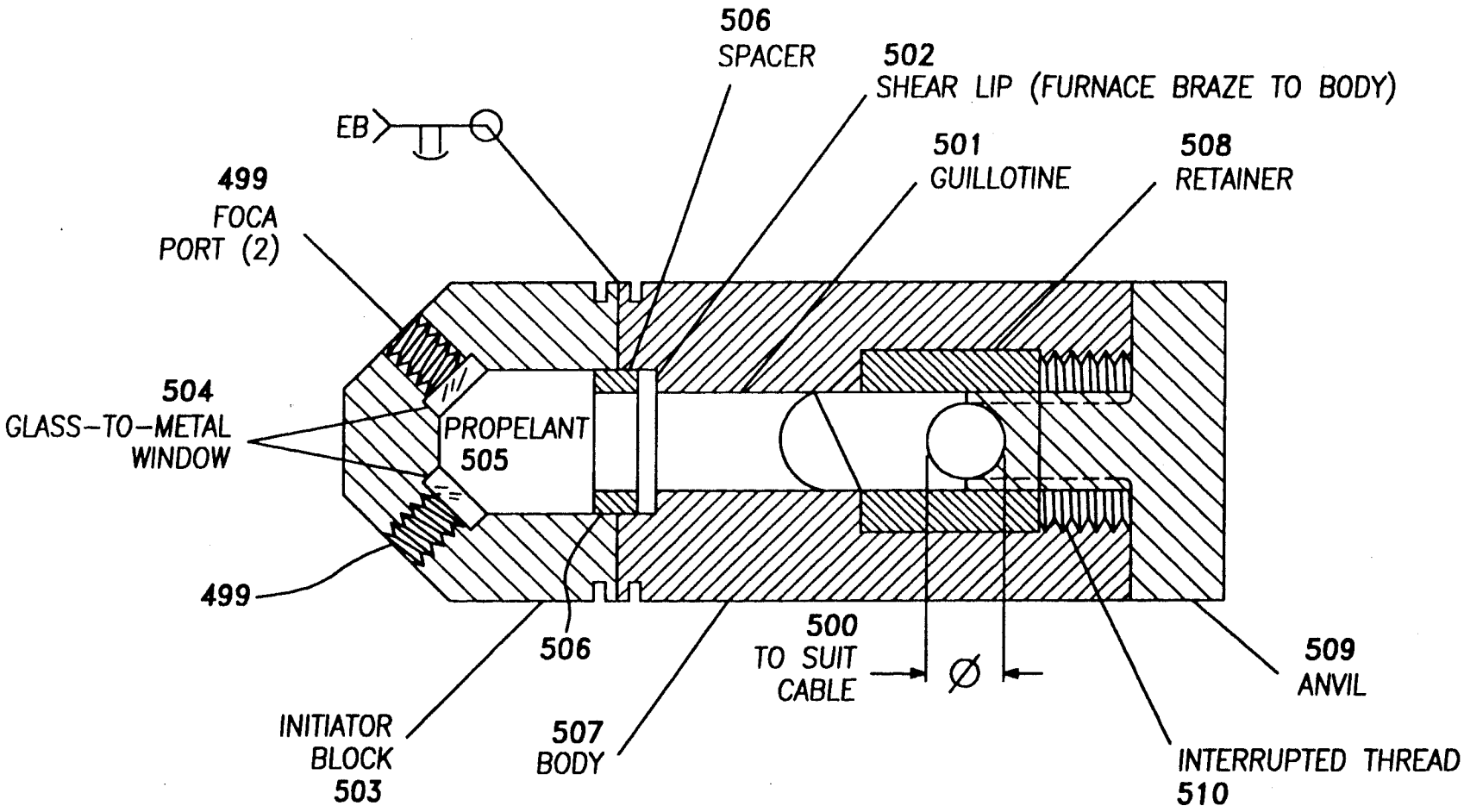
FIG. 20 shows an exemplary third stage cable cutter.

The baseline embodiment for the third stage cable cutter performs the same function as the ETA which is replaced by a FOCA. It completely severs the third stage event sequencing system ignition cable to inhibit spin-up, separation, and solid motor ignition. The cable cutter modifies an existing guillotine design and includes metal-to-metal seals and two redundant FOCA ports 499 as shown in FIG. 20.

The body is machined from stainless steel and has a U-shaped slot 500 on the cable end to accommodate the third stage cable. The guillotine 501 has a shear lip 502 that is furnace brazed to the body 507 before further assembly.

The initiator block 503 is machined from stainless steel and has glass windows 504 fuzed in place at both fiber-optic ports to provide a hermetic seal (windows/fiberoptics are used versus metal discs/LIDs because detonation is not required for initiation). The laser-initiated propellant 505 is pressed into the initiation block and a spacer 506 is pressed to form a subassembly which is welded to the body.

At time of installation, the U-shaped opening is slipped over the cable. A retainer 508 machined from stainless steel, with an identical U-shaped opening and a thru-hole slightly larger than the guillotine diameter, is installed over the other side of the cable. The anvil 509, machined from stainless steel, is then threaded into an interrupted thread 510 at an end of the body to complete the assembly.

In an alternate baseline PAM destruct device, dual LID ports in each adaptor can be provided to assure that, in the event of any single downstream failure, all four charges would still be initiated, increasing the motor case venting and propellant burning. In the exemplary baseline embodiment, a single failure results in three of four charges being initiated (50% larger hole area than existing).

In an alternate baseline third stage cable cutter, LSC can be used, hermetically sealed and configured in a U shape where larger wire bundles are used.

3. Laser-Initiated Detonators

FIG. 6 is a cross-section of an exemplary laser initiated detonator design. As mentioned previously, an exemplary LID configuration includes: a initiation mixture $Zr/KClO_4$; laser-welded glass-to-metal seal; with an optical dichroic coating for improved S/N ratio for built-in-test (BIT); a welded stainless-steel closure disc; an all-fire energy of 10.0 millijoules; direct attachment to stainless steel (SMA type) fiberoptic connectors; a CP DDT column (2:1 L/D); a PETN output charge; a function time of 60–70 uses (over temperature range); a dual-fiber interface For BIT; and NSI compatible threads.

The detonator body is made of 304L stainless steel and is form and fit compatible with the known NASA standard initiator. The glass-to-metal seal preform, consisting of a silica glass optical window sealed to a 304L stainless steel sleeve, is welded into the detonator body. An initiation mixture charge of approximately 30 mg of Zr/KClO4 is pressed into the detonator body against the optical window at a density of approximately 2.2 $gm/cm_3$. A DDT column of approximately 50 mg of CP is pressed on top of the initiation mixture at a density of approximately 1.6 gm/cm. An output charge of approximately 40 mg of PETN is pressed on top of the CP column at a density of approximately 1.6 gm/cm3. Finally, a stainless steel closure disk is placed on top of the output charge and stitch welded to the detonator body. This completes the fabrication of the live hermetic assembly.

A focusing lens assembly is then inserted into the input end of the detonator housing and held in place by a lens retainer. The lens assembly consists of a dichroically coated plano-convex lens held in a cylindrical lens holder. The lens holder positions the lens both axially and radially with respect to the optical window. This completes the fabrication of the LID. The input end of the detonator housing is internally threaded to receive the SMA fiber optic connector.

The lens is designed to focus the laser energy onto a 400 um-diameter spot at the surface of the initiation mixture. The dichroic filter is designed to pass the 1.064 um laser energy and block the 0.904 μm laser diode continuity test energy.

Using a 200 μs laser pulse, the exemplary detonator design described has a No-Fire energy density of approximately 1.0 J/cm2 and an All-Fire energy density of approximately 7.9 J/cm2 (10 mJ delivered to the initiation mixture interface). Function time is approximately 60–70 us over temperature range.

The initiation mixture has an autoignition temperature of 287° C. (550° F.), and the CP DDT column has an autoignition temperature of 360° C. (680° F.). The PETN melts at 200 C. (392 F.), interrupting the explosive train and making the LID incapable of producing a detonation output.

4. Fiber-Optic Cable Assembly (FOCA)

FIG. 21 shows an exemplary configuration of a typical FOCA. The preferred fiber-optic cable used is obtained from available Hareaus Amersil and, from inside-out, consists of a 400 μm-diameter core glass fiber 514, a glass cladding layer (diameter 440 μm) 516, with a polyamide buffer, two Kevlar braid tension members (inner braid 50 denier 515, outer braid 200 denier), and a high-density polyethylene outer jacket 518. The overall cable diameter is 3 mm.

The optical fiber is non-radiation hardened and exhibits a transmission loss of less than 7 dB/km. The fiber has a numerical aperture of approximately 0.2 at the laser wavelength, for a full-cone divergence angle of approximately 24 degrees.

For all FOCA-to-box connections at each RSDB (except at the aforementioned LID and the SRM quick-disconnects), the fiber optic cable is terminated in single-fiber stainless steel SMA connector, such as the 906 series offered by Optical Fiber Technologies, Inc. These connectors conform to the MIL-C-83522 fiber optic SMA connector standard. The connectors include captive nuts drilled for safety wires.

The connectors are attached to the fiber optic cable using an epoxy-and-crimp strain relief technique. After assembly, the end of the connector is buffed on a special wheel to polish the end of the optical fiber. The typical insertion loss at each interconnect is approximately 1.5 dB, with a variability of less than 0.2 dB after 500 insertions. If keyed connectors are required to prevent the incorrect hookup of FOCAs, industry standard keyable series connectors are available with movable keys.

An exemplary continuity BIT described previously approach requires the mating of two FOCAs to each LID, an initiating FOCA and a return continuity FOCA. A preferred FOCA-to-LID connector is a modified stainless steel SMA connector of the type described above. However, this connector is altered by drilling a second fiber hole through the connector body, parallel to a concentric fiber hole provided by the manufacturer. The initiating FOCA (e.g., fiber 514) is terminated in the concentric hole, while the return continuity FOCA (e.g., fiber 519) is terminated in the offset hole. The two cables are captured by a common epoxy-and-crimp strain relief operation.

Each SRM includes a pair of two-fiber quick-disconnect fiber optic connectors. Each connector handles one initiating FOCA and its companion return-continuity FOCA.

5. Destruct Firing Unit

Six identical six-channel DFUs are used with the exemplary LIO/FTS. Two DFUs are used in the second stage (10 of 12 laser initiation channels utilized) and four are used in the first stage (22 of 24 laser initiation utilized).

In a preferred baseline DFU embodiment, concentric rotary shutters are used. This embodiment appears well suited to vibration environments and supports several alternate BIT embodiments.

FIG. 22*b* shows concentric shutters 520, 521. The inner shutter 521 is driven by shutter drive 522 with associated lockpin 523. The outer shutter 520 is driven by shutter drive 524 with associated lockpin 525. The laser beams are coupled into the initiating FOCAs via hermetic stub optical feedthroughs.

a. Hermetically Sealed Housing Assembly

As shown in FIG. 22*a*, an exemplary baseline DFU embodiment features a stainless steel housing and a stainless steel cover plate 562. The housing is attached to a mounting bracket 561 by shock mounts 563. The housing may also carry a bracket for SMA unions if continuity BIT FOCAs are to be interfaced at the DFUs enroute the RSDBs.

The opening of the housing includes a thin welding lip to which the cover plate is welded to finalize the DFU assembly. This closure allows the welded unit to be opened several times if necessary.

To finalize the assembly, exposed edges of the plate and can are welded together. This closure allows the welded unit to be opened several times if necessary by grinding off the existing weld and rewelding the shorter flanges. Stainless steel provides a low risk to both structural and production engineering requirements. However, plated aluminum can, for example, be substituted if lower weight is required. The welded assembly is purged and backfilled with dry nitrogen by a purge port mounted in the connector plate.

FIG. 23 is a summary schematic of one-half of a DFU. In FIG. 23, a continuity BIT assembly 530 includes a watchdog timer 531, a compensated current source 532 and a demultiplexer 533. The continuity BIT energy is optically coupled to laser head assemblies 534 via laser diodes 535. Primary and redundant shutters are illustrated as elements 536, 537, respectively, to control passage of laser energy to LID. The shutters thus constitute a mechanical safe/arm (MSA) control, and are driven by MSA drive assemblies such as driver assembly 538.

The drive assembly 538 includes unlock solenoid 539 which controls an unlock switch 540 and a lock switch 872. The drive assembly further includes voltage regulator 541, controller 542, driver IC 543 and stepper motor 544.

An electronic safe/arm (ESA) 545 which will be discussed later includes an EMI filter 546, and a Dc-Dc converter 547. The Dc-Dc converter includes voltage regulator 548, oscillator 549, pulse width modulator 550, FET driver 551, FET switch 557, transformer 552 and diode 553. Further, the ESA 545 includes HV monitors 554. A number of passive components are not included in this summary schematic.

A trigger circuit 555 receives energy from the ESA to form pulses for triggering flashlamps in the laser head assemblies. The trigger circuit includes pulse forming networks 570. Further, the trigger circuit includes a high energy switch 574, transformer 575 and A,B triggers 576, 577, each responsive to command destruct or autodestruct input signals.

b. Laser Head Assembly

FIGS. 22*a* and *b* show the preferred laser head assembly. The assembly consists of two major parts, a laser housing assembly 850 and optical coupler assembly 852. The laser housing is a machined stainless steel block containing a cylindrical pumping cavity 854 lined with "Spectralon" or other suitable reflective coating to maximize pumping efficiency. Each cavity contains a laser and a flashlamp, mounted parallel to each other in the pumping cavity. The laser is a 3.0 mm diameter $\times$50.8 mm long nd:YAG laser rod operating at 1.064 $\mu$m. The rod is optically coated at each end to provide a resonating cavity. The flashlamp contains xenon gas at 450 torr in a glass envelop of 5 mm outside diameter and an interelectode spacing of 36 mm.

The laser is mounted in a pair of O-rings, one located in the forward mounting disk 856 and the other located in the rear mounting disk 858. The O-rings are selected to protect the laser rod from damaging levels of shock and vibration, yet maintain the rod sufficiently well aligned to couple properly into the optical coupler assembly. O-ring compression also prevents the laser rod from moving along its axis. The mounting disks are keyed to prevent their rotation in the housing. Four laser alignment screws 860 located in the laser housing in the plane of the forward mounting disk are used to align the laser within the housing by slightly displacing the mounting disk laterally.

The front terminal of the flashlamp is connected to the ground node of the firing circuit, while the rear terminal is connected to a high-voltage wire which will supply the firing current from the trigger assembly. The ends of the flashlamp are embedded in a resilent and insulating potting compound such as silicone rubber and supported by the forward mounting disk and the rear end plug. The potting compound provides shock and vibration isolation of the flashlamp, and also provides high voltage isolation of the rear terminal of the flashlamp.

An end plug 862 located at the rear of the laser housing provides strain relief for the firing lead and provides a mounting location for a collimated light emitting diode (LED) or laser diode continuity test source 864.

The laser housing has a longitudinal hole in its front surface to receive the optical coupler assembly, and a transverse hole behind this location to receive the optical shutters. A location is provided in the housing to mount the optical fiber pigtail of a fiber-terminated photodiode 866 such that the fiber views a surface of the shutter for the purpose of sampling laser output energy.

The optical coupler assembly consists of a cylindrical body with a mounting flange and a welding diaphragm, a laser focusing lens 868, and a hermetic optical fiber stub 870. The outboard end of the optical coupler body is configured as an SMA fiber optic connector receptacle to receive the energy transfer FOCA leading to the laser initiated device.

The mid section of the coupler body contains a fiber stub hermetically sealed to the body by means of epoxy or other means such as S-glass or metalization and soldering. The stub is the same diameter and optical composition as the initiating FOCA, namely 400 um diameter core in the preferred embodiment.

The inboard end of the coupler body is sized to fit snugly into the hole in the front of the laser housing, and the body features a flange by which the body is screwed to the laser housing. The coupler body and the hole in the laser housing can be machined as tapers to facilitate the snug fit of the coupler to the housing with nominal dimensional tolerances.

The inside diameter of the inboard end of the coupler body is configured as a lens holder to receive and hold the focusing lens. The lens is positioned in the coupler body so as to focus the nominal laser beam onto the inboard end of the hermetic stub. The final alignment of the laser head assembly is accomplished by the alignment screws in the laser housing after the optical coupler assembly has been installed. Alternately, the hole receiving the coupler assembly can be custom reamed after laser alignment testing to eliminate the need for alignment screws.

The mid section of the coupler body also features a welding diaphragm. The diaphragm lip is welded to a similar diaphragm located in the destruct firing unit housing wall. The purpose of these two diaphragms is, when welded together, to form a hermetic seal between the optical coupler assembly and the DFU housing which provides both mechanical compliance and thermal isolation. The mechanical compliance is necessary to minimize mechanical coupling from the DFU housing to the laser head assembly which might otherwise damage or misalign the laser head assembly. The thermal isolation allows the hermetic welding of the optical coupler to the DFU housing without inducing sufficient heat into the coupler and laser housing to affect optical alignment.

In FIG. 22*a*, the diaphragms are illustrated as parent metal members, although they could also be configured as thin metal disks welded to the optical coupler body and the DFU housing respectively. This latter approach is feasible because the weldment of the disk to the optical coupler body would be performed prior to optical alignment.

The three laser head assemblies for each DFU section are ganged together on a mounting plate. A bushing is located between each laser head asembly to provide a bearing surface for the primary (sleeve) shutter.

c. Mechanical Safe/Arm

As described previously, concentric shutters, as shown in FIGS. 24*a–b*, are included in an exemplary preferred embodiment of the mechanized safe/arm. A concentric rod and sleeve arrangement provides redundant optical path interruption. The rod, or redundant shutter 536, is drilled with six transverse holes, one at each laser optical axis, and is rotated between its safe position (holes perpendicular to optical axes) of FIG. 24*a*, and armed position (holes aligned with opitcal axes) of FIG. 24*b* by the shutter drive mechanism in the redundant DFU section.

The sleeve, or primary shutter 537 is a metal tube featuring six transverse holes, one at each laser optical axis, and is rotated between its safe position (holes perpendicular to optical axes) and armed position (holes aligned with optical axes) by the shutter drive mechanism in the primary DFU section. The sleeve is supported by a bushing at each end, and by a bushing between each laser head assembly.

The DFU is optically armed when both shutters are rotated so that their holes are lined up with the laser optical axes. Both shutters have their centers of mass coincident with their axes of rotation, thereby eliminating induced torques under translational motion of the DFU.

The surfaces of the primary shutter which are exposed to the lasers when the shutter is in the safe position feature a matte finish. These surfaces constitute laser energy test targets which diffusely reflect the laser beams when the lasers are fired with the primary shutter closed. A small portion of the laser beam reflected off each target is coupled into the fiber optic pigtail of the laser energy detector associated with that laser head. This coupling is deliberately inefficient to provide an attenuated sample of the laser beam. The reflectivity of the shutter surface is selected to provide further attenuation as necessary to avoid saturating the laser energy photodector. Because the target surfaces are cylindrical, the laser energy samples acquired by the fiber optic probes are not affected by the precise angular position of the shutter.

In the exemplary baseline embodiment, continuity test energy is injected at the back of the laser by a fixed laser diode (e.g., 265 in FIG. 8). If it is desirable for operational purposes to perform continuity testing with the shutters closed, an optional optical test input port can be provided by a mirror 588 located on each primary shutter block. This port can be driven by the laser diode relocated to the front of the laser head assembly or by GSE-generated continuity test energy introduced to the DFU over a FOCA (one for each laser head in the DFU). Either of these approaches is substantially affected by mirror angle errors, leading to a degree of shutter safe-angle accuracy not otherwise required. The lossier diffuse target approach used for laser energy test coupling can be used provided a rather powerful continuity energy source is also used.

The drive mechanisms (e.g., one of which is represented as 538 in FIG. 23) for the two concentric shutters are at opposite ends of the DFU and are identical and electrically and mechanically independent. The only coupling between them is any friction between the rod and sleeve shutters. Since the control system allows the primary and redundant shutters to be unlocked and rotated independently, this coupling is not significant.

Each shutter is directly driven by a stepper motor (e.g., 544). Since the shutters encounter no spring resistance, the torque requirements are easily met with off-the-shelf motors. Bushings can be used to facilitate rotary movement of the shutters. When armed, laser energy from rod 579 (FIG. 8) passes to a fiber optic cable 254 (FIG. 8) connected to an LID.

In an examplary embodiment as shown in FIG. 22*b*, each shutter is restrained by a lockpin 523, which engages the shutter assembly either at a safe detent at the safe angle, or at an armed detent the armed angle. The lockpins and detents are tapered so that the lockpins provide positive indexing when engaged. Each lockpin is retracted by a solenoid lockpin actuator, and is spring-loaded to its unpowered, extended position by a spring in the solenoid. The solenoid is powered by the MSA arm/resafe signal applied to its DFU section. In an alternate embodiment, each lockpin and lockpin actuator is replaced by an electro-mechanical brake assembly. The brake is spring loaded to its engaged position, so that removing power to the brake actuator causes the respective shutter to be locked in its present position. Applying power to the brake actuator frees the shutter to be rotated by its drive motor. The use of a brake has no impact on system design except that the shutters can be locked in any position, not just at detented angles.

Each shutter operates a safe monitor switch and an arm monitor switch. Although optointerrupter-based switches provide better performance under vibration, the exemplary baseline embodiment uses mechanical switch contacts so that shutter position can be read out without applying power to the DFU. These switches are driven by cams attached to the shutter rod or sleeve. Two other mechanical switches are coupled to the lockpin. A normally-closed contact pair (the lock switch) provides lock monitor status to the control center while a normally-open pair (the unlock switch) controls power to the stepper motor controller.

Each stepper motor is operated by an independent but identical controller. Each controller includes a power-on-reset (POR) circuit, a small state machine or similar logic controller, a stepper motor driver IC, and a voltage regulator which powers all these circuits as shown in FIG. 23. The voltage regulator in turn is powered only when the MSA arm/resafe signal has been applied to the DFU section long enough to actuate the lockpin solenoid and hold the unlock switch closed.

The state machine, which is implemented as either a registered ROM or a programmable logic device (PDL), has four logic inputs (POR, MSA safe monitor, MSA enable, and HV monitor) and three logic outputs to a driver IC (set (S), direction (R), advance (T) as shown in FIG. 23). When power is applied, the state machine implements the following MSA control logic:

1. At POR, the state machine executes a resafing sequence which returns the stepper motor to the safe position from any initial position under closed loop observation of the safe monitor switch (leaves the motor in the safe position if already at safe position).

This action is independent of the values of the MSA enable signal and the ESA HV monitor signal.

2. While MSA enable is not asserted, the controller does nothing (remains safe), regardless of the value of HV monitor.

3. While HV monitor is present, the MSA enable input is ignored. This is an unconditional MSA arming-lockout interlock which prevents the MSA from being armed when high voltage is present in the ESA.

4. If MSA enable is asserted, and while HV monitor is not present, the state machine executes an arming sequence which advances the shutter to the armed position (e.g., six 15-degree steps) under open loop control.

5. Upon completion of the arming sequence, the state machine disregards the HV monitor input. While MSA enable is asserted, the controller remains in this state. If MSA enable is removed, the controller executes the resafing sequence. The MSA enable signal can be applied and removed to arm and resafe the shutter (providing the MSA arm/resafe signal is still holding in the lockpin solenoid).

Upon removal of power, the stepper motor remains in its present position and the lockpin engages the safe or armed detent. If the shutter is in transit between safe and armed positions, it stops in its present position and the lockpin may not engage either detent.

To arm the MSA, the MSA arm/resafe and MSA enable are applied together long enough for the state machine to execute its resafe and arm sequences. MSA arm/resafe and MSA enable are then removed, and the MSA remains in the armed, locked, and unpowered state. The method to resafe the MSA is to apply MSA arm/resafe in the absence of MSA enable (the resafe control at the control panel FIG. 27*c* automatically drops MSA enable power when the resafe button is pushed).

The MSA's HV monitor-driven arming lockout feature is a safety interlock intended to prohibit MSA arming during laser energy testing. In the preferred embodiment, this interlock is unconditional, and it is defeated for launch by arming and unpowering the MSAs first and then arming the ESAs with open shutters. If other operational requirements prevail, the MSA controller can be provided with a mode-dependent logic input, or the interlock function can be reallocated.

d. ESA Assembly

In a preferred embodiment, each laser bank assembly contains one ESA assembly 545 (FIG. 23), possibly portioned with other circuits on one or more PWAs. The ESA assembly includes the pulse-width-modulated (PWM) flyback-type dc/dc converter 547 having a 28 vdc enable power input 547 and a logic level oscillator arming input 594. The enable power passes through a passive EMI 546 filter to suppress conducted interference generated by the converter. A logic voltage regulator 548 supplies power to the oscillator, the PWM, and the high voltage monitor buffers.

The arming input 594 passes through a passive signal conditioner to suppress overvoltage input transients. The converter requires both enable power and oscillator arming signals to operate.

The dc/dc converter 547 supplies a high voltage output to charge the high-energy storage capacitor 573 to its operating voltage. This voltage is on the order of 1.5 kV. The PWM maintains high voltage regulation to +/−2%. The converter is designed to produce 10% over nominal operating voltage under open loop conditions so that PWM failure will not lead to the loss of all-fire energy. A voltage tap from the primary of power transformer 552 provides the several hundred volts used to charge the "Sprytron" trigger capacitor.

The ESA assembly also contains a buffer amplifier 596 to condition the high voltage monitor signal from the firing capacitor for transmission to the RSDB. All high voltage circuits are encapsulated in rigid foam to suppress high voltage arcing regardless of gas composition and pressure inside the DFU.

e. Trigger Assembly

In the FIG. 23 embodiment, each laser bank assembly contains one trigger assembly 555, possibly partitioned with other circuits on one or several PWAs. The trigger assembly contains dual trigger input circuits 576, 577 (trigger A and trigger B), a single "Sprytron" high-energy switch 574 and its associated components, and three pulse-forming networks 570 (PFN). As in the ESA assembly, all high voltage circuits are encapsulated.

Each trigger input circuit has a command destruct input 597 and an autodestruct input 598, and each circuit closes its output FET upon receipt of either input signal. Signal conditioning circuits within the trigger input circuits discriminate against false triggering caused by noise. The output FETs of each trigger input circuit are wired in series to form a wired-AND gate which operates the "Sprytron" trigger 574. Therefore, no single-point failure in the trigger input circuits can cause inadvertent firing, but any failure which disables either of the trigger input circuits disables the laser bank assembly.

A "Sprytron" vacuum arc switch 600 is configured to stand off the stored energy applied by the high voltage storage capacitors 573. The "Sprytron" is triggered when both trigger input circuits close their output switches, thereby shorting a trigger capacitor 601 through the primary of the trigger transformer. The trigger transformer output is applied to a fixed gas gap 600 in series with the "Sprytron" trigger electrodes. When the transformer output exceeds the gas gap's breakdown voltage, a fast-risetime pulse is applied to the "Sprytron" trigger electrodes, causing the "Sprytron" main gap to break down. This high-energy switching circuit is laid out to accommodate the less expensive triggered gas gap switch should its use be preferred over the "Sprytron".

Each flashlamp is operated in series with the secondary coil of a pulse-forming transformer 572 to provide series-injection triggering. The primary coil of each PFN transformer connects a pulse-forming capacitor 571 to the low side of the high-energy switch 574. The return side of each flashlamp is grounded.

When the high energy switch is triggered, it discharges the PFN capacitors 571 through the PFN transformer primaries. This action creates a nominally 10 kV transient pulse across the secondary of each PFN transformer, causing the flashlamps to break down and conduct. When the flashtubes conduct, the high-energy storage capacitor 573 is discharged through the flashlamps and the high-energy switch, causing the lasers to be pumped. A choke in series with the transformer secondaries provides current limiting.

As previously explained, an alternate embodiment of the high-energy switch uses a pair of SCRs to fire each flashlamp. In this case, each flashlamp is accompanied by a dedicated high-energy switch and a dedicated high-energy storage capacitor. In this case, each high-energy capacitor is provided with a high-voltage monitor circuit.

f. Continuity BIT Assembly

Each laser bank assembly further includes a continuity BIT assembly 530 (FIG. 23), possibly implemented with other circuits on one or more PWA. This assembly includes the temperature compensated current source 532 and a set of three analog switches. Control signals from the RSDB close one of the three switches identified by multiplexer 533 and enable the current source. The current flows through a select-at-test resistor 604 and the continuity test laser diode 535 for the selected channel. This arrangement is intended to produce a calibrated optical energy output over temperature. At the completion of the laser diode operating cycle, the RSDB selects the next channel or stops the test. The watchdog timer 531 on the continuity BIT PWA shuts off the current source after a default period.

6. Range Safety Distribution Box

As mentioned previously, a preferred LIO/FTS system uses four interface units to connect the four independent LIO/FTS systems (first and second stage, primary and redundant) to the control center via LV umbilicals. The second stage interface units are identical to those in the first stage except that they have no ISDS breakwire autodestruct triggers and must interface two DFUs instead of four. This section describes the identical primary and redundant first stage interface units.

Figure 25A:
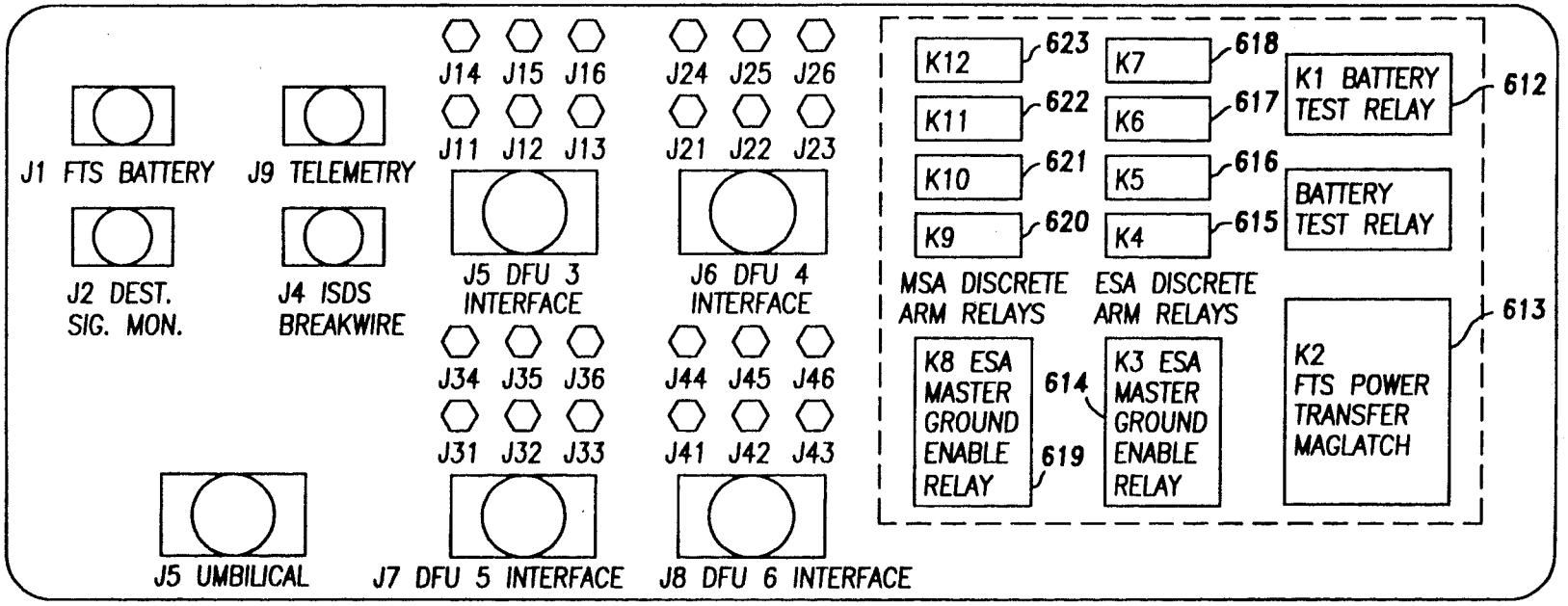
FIGS. 25a–b show a range safety distribution box layout.
Figure 25B:
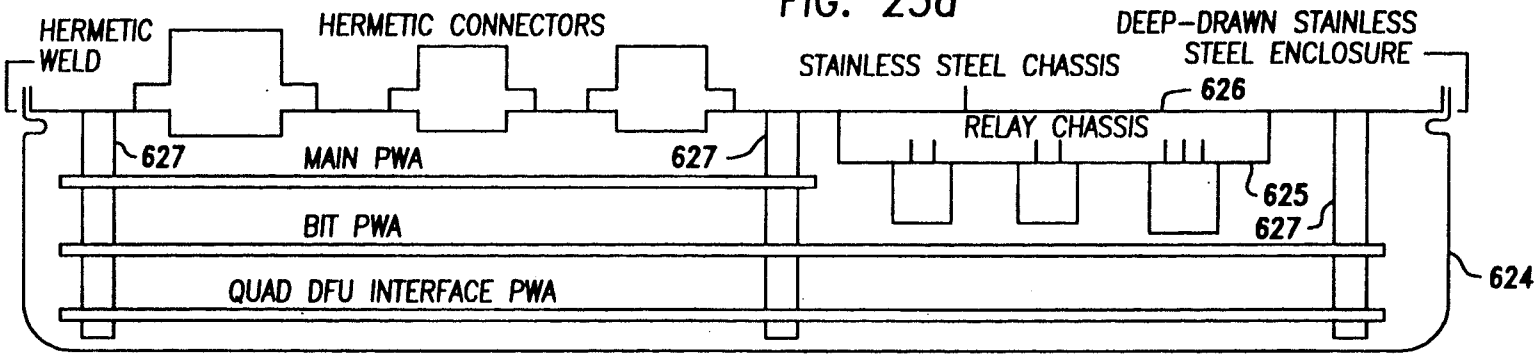
Figure 26A:
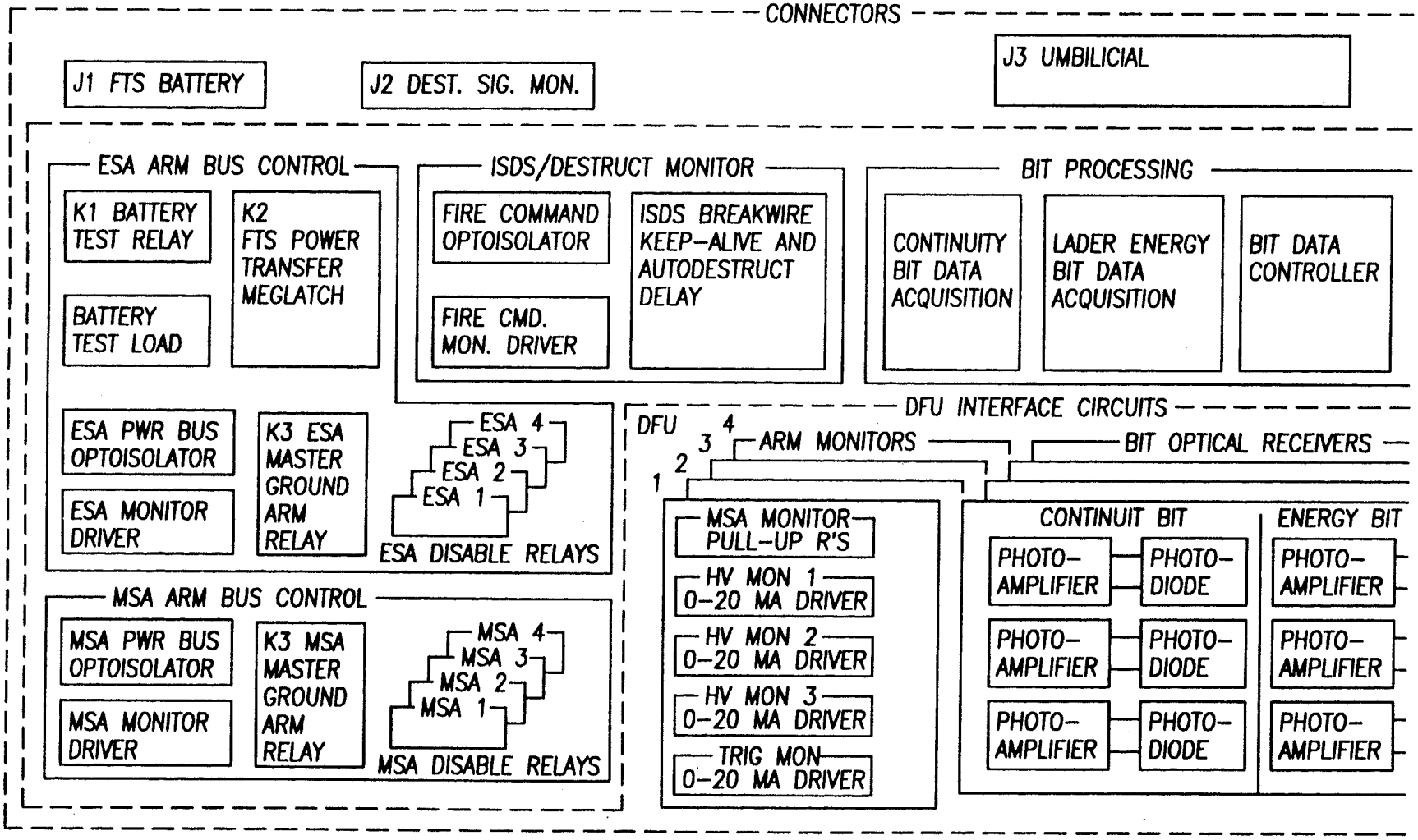
Figure 26B:
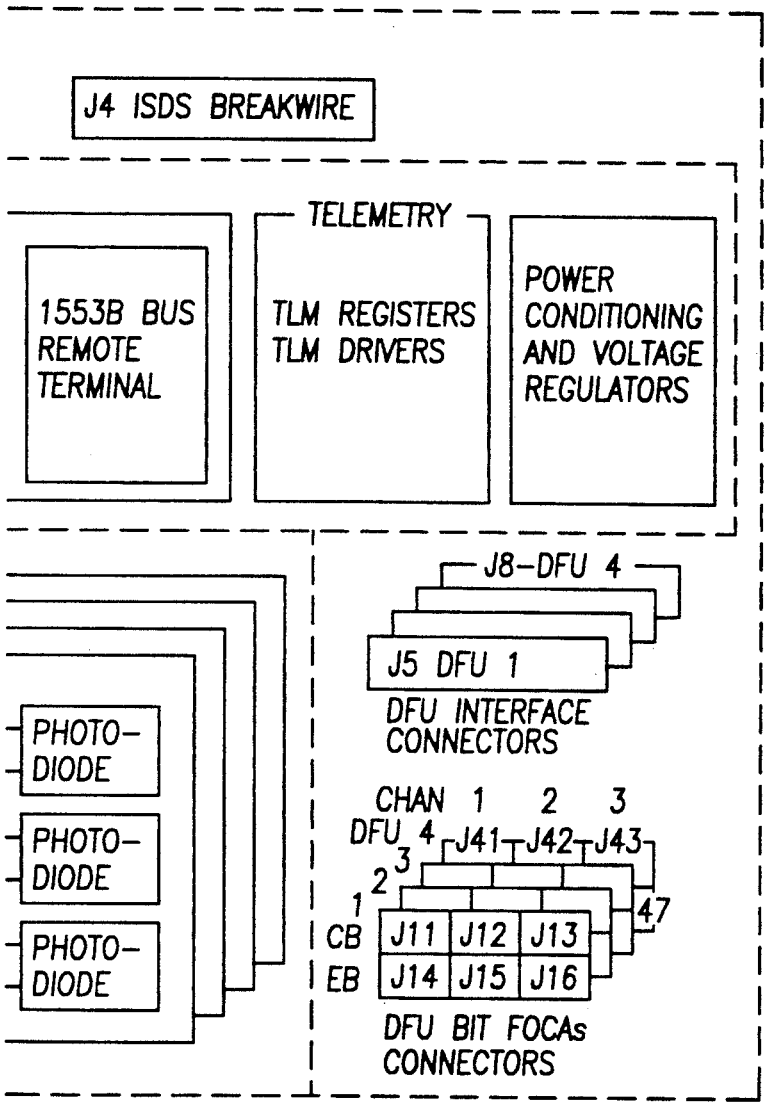

In addition to interfacing DFUs to ground control, the RSDBs interface the DFUs to the FTS batteries, ISDS, and telemetry. FIGS. 25*a–b* show the proposed physical layout of the unit, while FIG. 26 identifies the electronic circuits previously described as being included in the unit. A control panel associated with an exemplary RSDB is shown in FIG. 27.

A preferred embodiment of the RSDB is an electronic assembly performing low voltage power and command/control/monitoring interfacing to the DFUs. The unit contains 12 electromechanical relays 612–623 and three PWAs and has an envelope of approximately 6"×6"×12" (432 cubic inches). All connectors and internal assemblies are mounted to a stainless steel base plate which is welded into a deep drawn stainless steel can 624. The relays and other heavy components are mounted on an internal chassis 625 welded to the base plate 626. The three PWAs are stacked on a number of posts 627 attached to the baseplate. The PWAs, relay assembly, and connectors are hard-wired together; there are no connectors within the RSDB. The finished units are purged and backfilled via a purge port in the baseplate. The RSDB is attached to the LV by means of four shock mounts attached to the can.

The relays control the application of enable signals and arming power to the DFUs. The PWAs contain the following circuits:

Safe/arm monitor umbilical and TLM drivers
ESA and MSA arm bus monitors
BIT measurement and 1553 bus interface
ISDS autodestruct circuit.

The RSDB function description is easiest to present as part of the system control description to be provided later.

In the exemplary baseline embodiment, BIT measurement signals originating in the DFUs and LIDs are routed to the RSDB via FOCA for BIT signal processing. If GSE test processing is preferred, these FOCAs can be terminated on a convenient test access panel on the LV.

7. LIO/FTS Control Panel

While the LV is on the ground, the primary and redundant on-board LIO/FTS systems are controlled from the control center by an identical pair of LIO/FTS control panels. These panels are part of a range safety console. In a preferred embodiment, the panels include their own operating and logic power supplies and require only wall plug power from the console. FIG. 27 is a control panel layout. For purposes of generality, the control panel shown features three high-voltage monitor indicators for each DFU section, reflecting the alternate SCR high-energy switching circuit which requires one high-energy storage capacitor per laser firing channel. In the case of the preferred DFU embodiment featuring a common "Sprytron" high-energy switch per DFU section, the control panel would require only one high-voltage monitor indicator and one trigger monitor indicator per DFU section.

Each FIG. 27 panel is configured as a chassis drawer equipped with slides for maintenance access. The back panel of the chassis is a connector panel. The top of the chassis carries the power supplies at the rear and a card cage at the front. The card cage carries eight 4.5×6.5" edge-connected PWAs. The PWAs can be extended upward for maintenance access when the control panel is extended from the console. The front panel of the chassis is the control panel, which folds down for maintenance access.

Figure 28A:
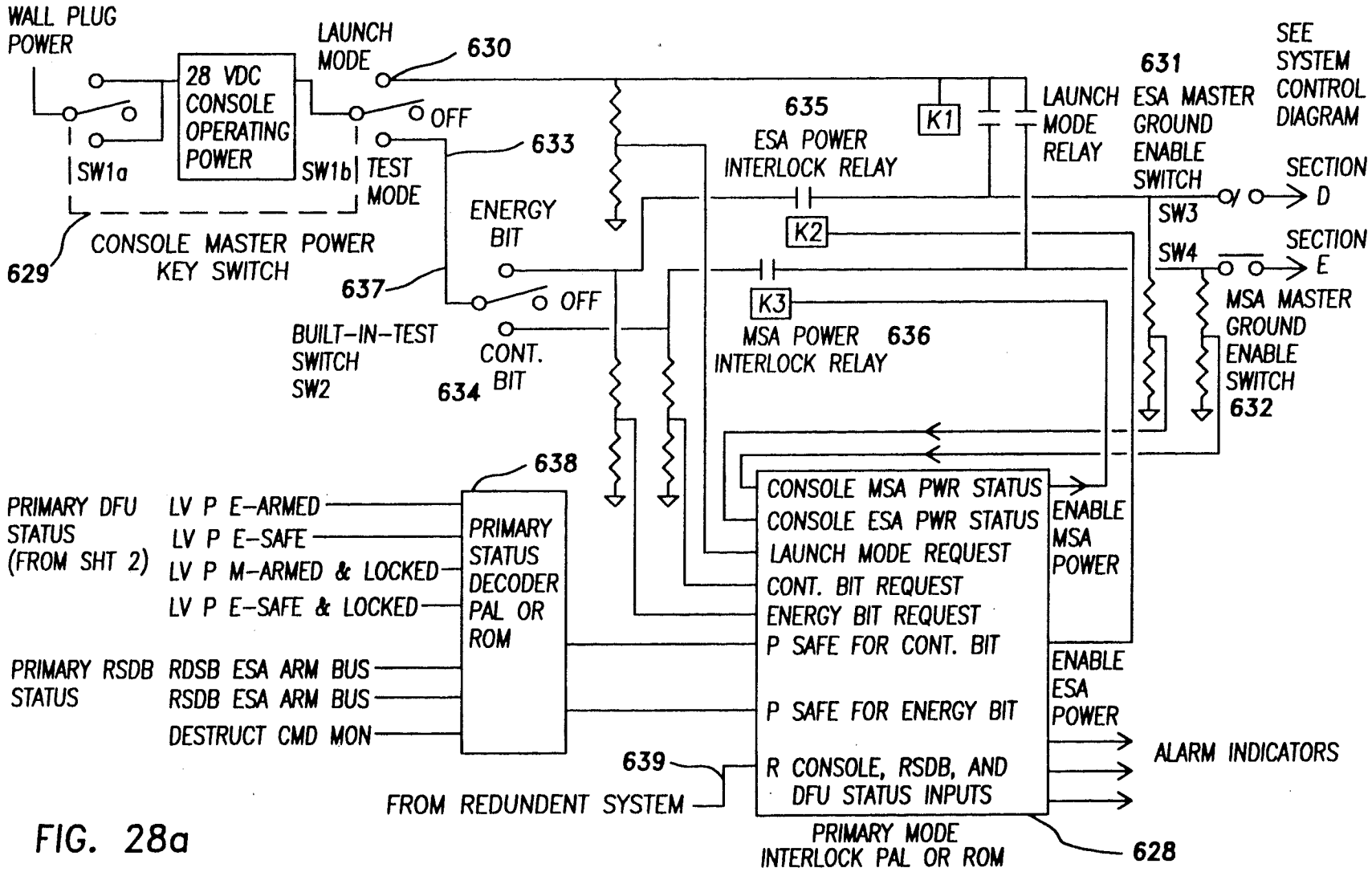
FIGS. 28a–b show a control panel summary schematic.
Figures 1, 28B:
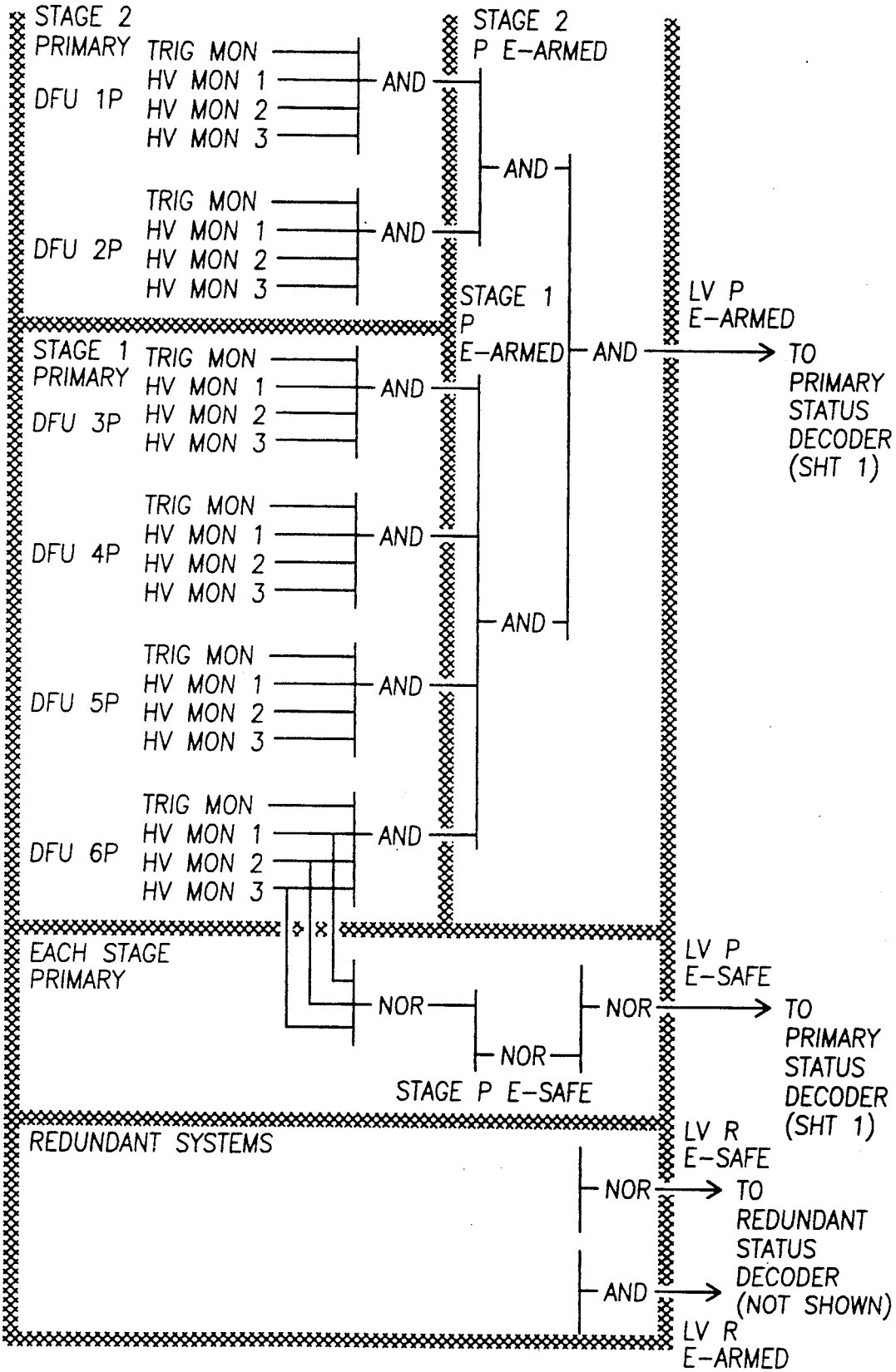
Figures 2, 28B:
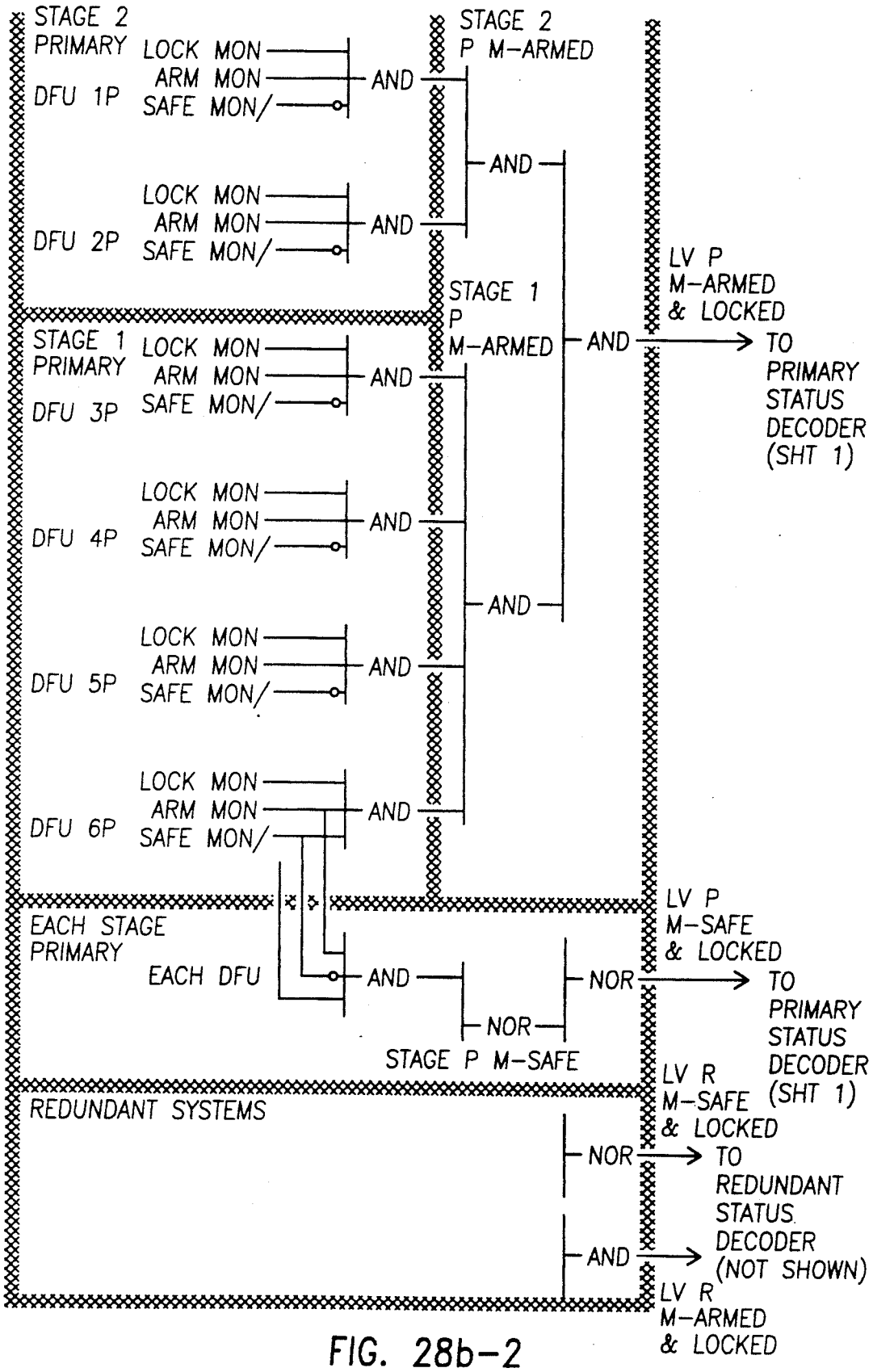

FIGS. 28*a–b* are a summary schematic of the mode interlock circuit. The other functions performed by the control panel will be identified later. The mode interlock circuit comprises a set of relays, a set of safe/arm status (Boolean) summing gates, and a state machine 628 or similar logic controller. The state machine is implemented as a registered ROM or programmable logic device.

A master power key switch 629, when switched to a launch mode position 630, powers the console's ESA master enable switch 631 and MSA master arm switch 631, 632 via the launch mode relay. When switched to a test mode position 633, the key switch provides power to a BIT select switch 634. The BIT select switch routes power to either the ESA master enable switch or MSA master arm switch, but not both at the same time, via an ESA power interlock relay 635 and an MSA power interlock relay 636 in series with a manually operated BIT select switch 637.

This arrangement requires positive action by both the operator and the state machine to provide arming power during test operations. The state machine operates these relays in accordance with the manual switch request only if the LIO/FTS is safe for the test mode requested.

The MSA safe and arm monitor signals and ESA HV monitor signals (FIG. 28*b*) are ANDed and ORed at the control panel to provide logic signals representing system-wide all-safe and all-armed signals. These signals, as well as other safe and arm control states present in the RSDB are input to the state machine 628 via a primary status decoder 638 (FIG. 28*a*) to form a state-dependent address component. The same signals from the companion (P or R) control panel are also input to the mode interlock state machine 628 via line 639.

The mode interlock state machine drops out the ESA or MSA arming power if any unsafe monitor condition should occur during powered testing. This action induces ESA resafing by removing ESA arming power or MSA resafing by asserting the MSA arm/resafe signal.

8. System Control

Figure 29B:
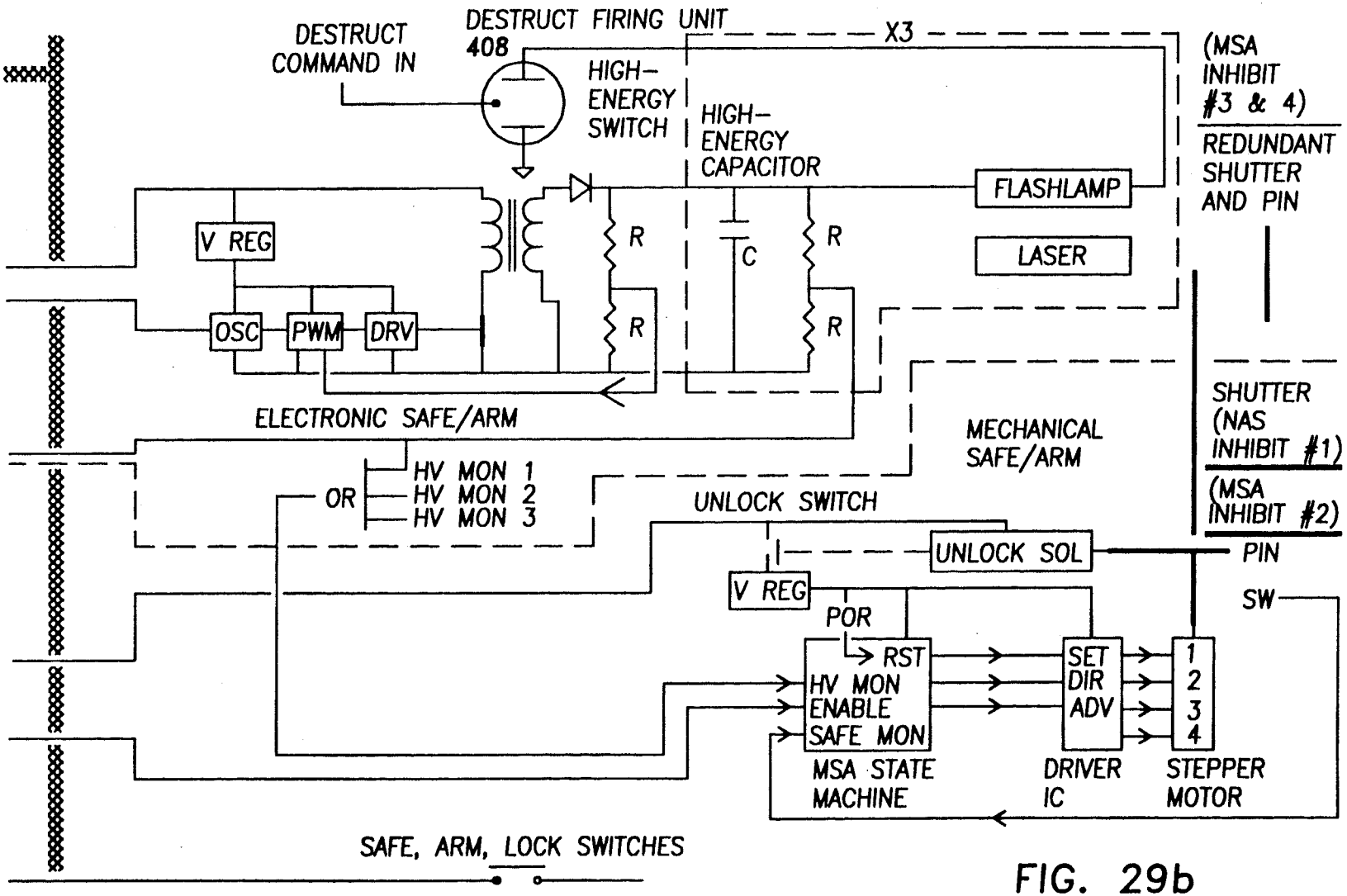

FIG. 29 is a summary system control architecture diagram, and FIGS. 30*a–f* represent a detailed system control diagram. The methods selected to interface the various system locations, as described previously, include the perceived preference of the range safety community for discrete hard-wired circuits. The physical layer of the proposed control interface must be designed to reflect actual conditions.

FIGS. 29 and 30*a–f* portray separation of LIO/FTS system components horizontally and functional domains vertically. The diagrams represent one of the two redundant control systems required. Starting at the left of FIG. 29, the LIO/FTS control panel 650 in the control center communicates with the fixed umbilical towers at the pad. This distance is estimated to be 300 yards. The only ground support equipment (GSE) equipment required at the pad are one or more 28 vdc power supplies to supply ground arming energy to the LIO/FTS. If desired, this power could be supplied from the control center, eliminating all equipment at the pad.

The wiring from the control center is connected to the RSDBs via the first and second stage umbilicals which, together with the umbilical harnesses in the LV, are estimated to be 100 feet long. Each RSDB is connected to each DFU in the same stage by a multiwire (approximately 16 conductors plus grounds) electrical arm/monitor harness and six single-fiber FOCAs carrying BIT data. The RSDB-to-DFU harnesses are less than 20 feet long.

9. Functional Description

This description follows the organization of FIGS. 30*a–f*. Interlocks and inhibits are highlighted and labelled on FIG. 29.

a. Power and Mode Control

Figure 30A:
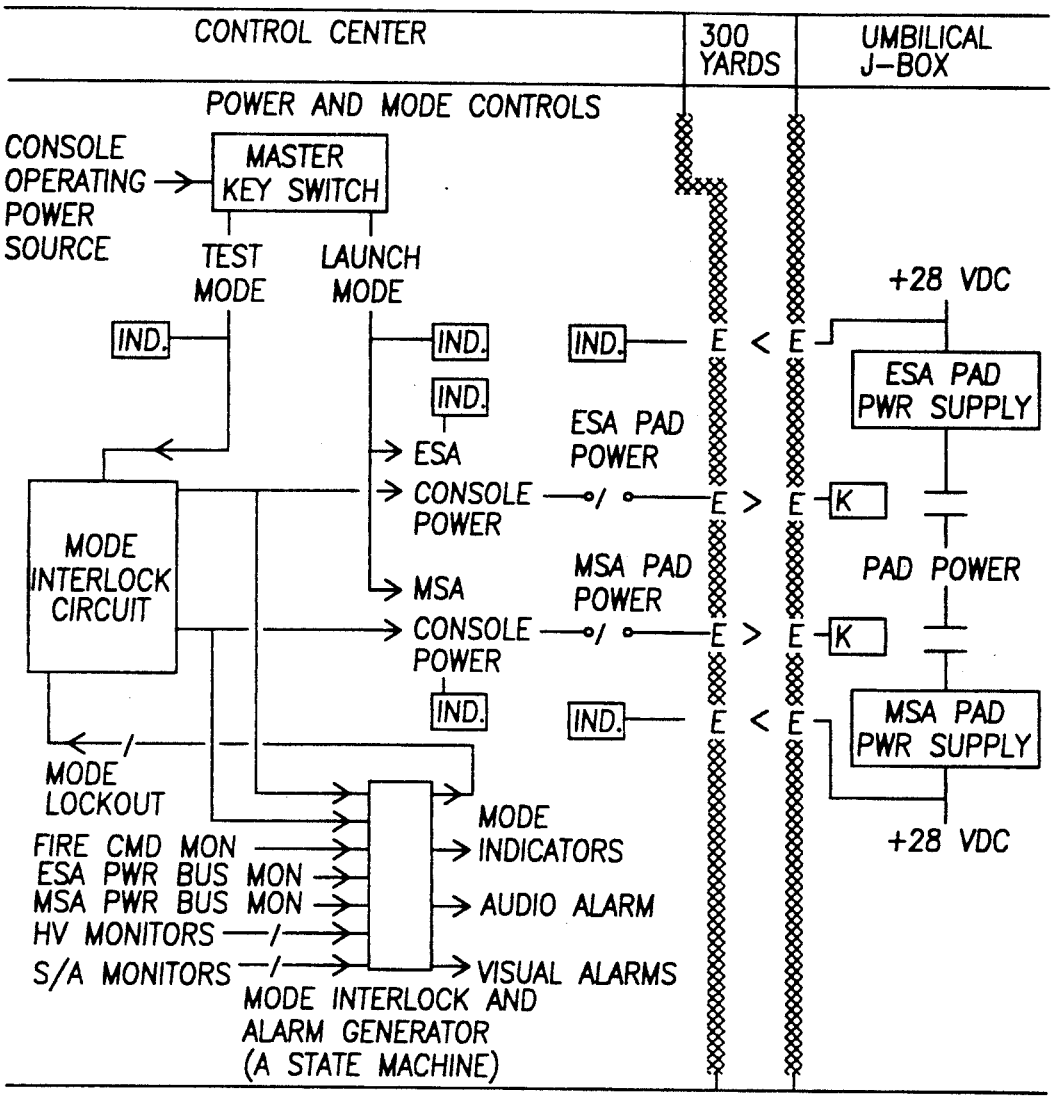
FIGS. 30a–f show system control diagrams.

The master key switch/mode interlock circuit 629 controls the power for the circuits described below. Monitor functions are powered unconditionally from the master key switch as shown in FIG. 30*a*. The mode interlock is counted as ESA inhibit #1 and its verification is provided by a control panel ESA console power indicator.

b. Safe/Arm Monitors

Figure 30B:
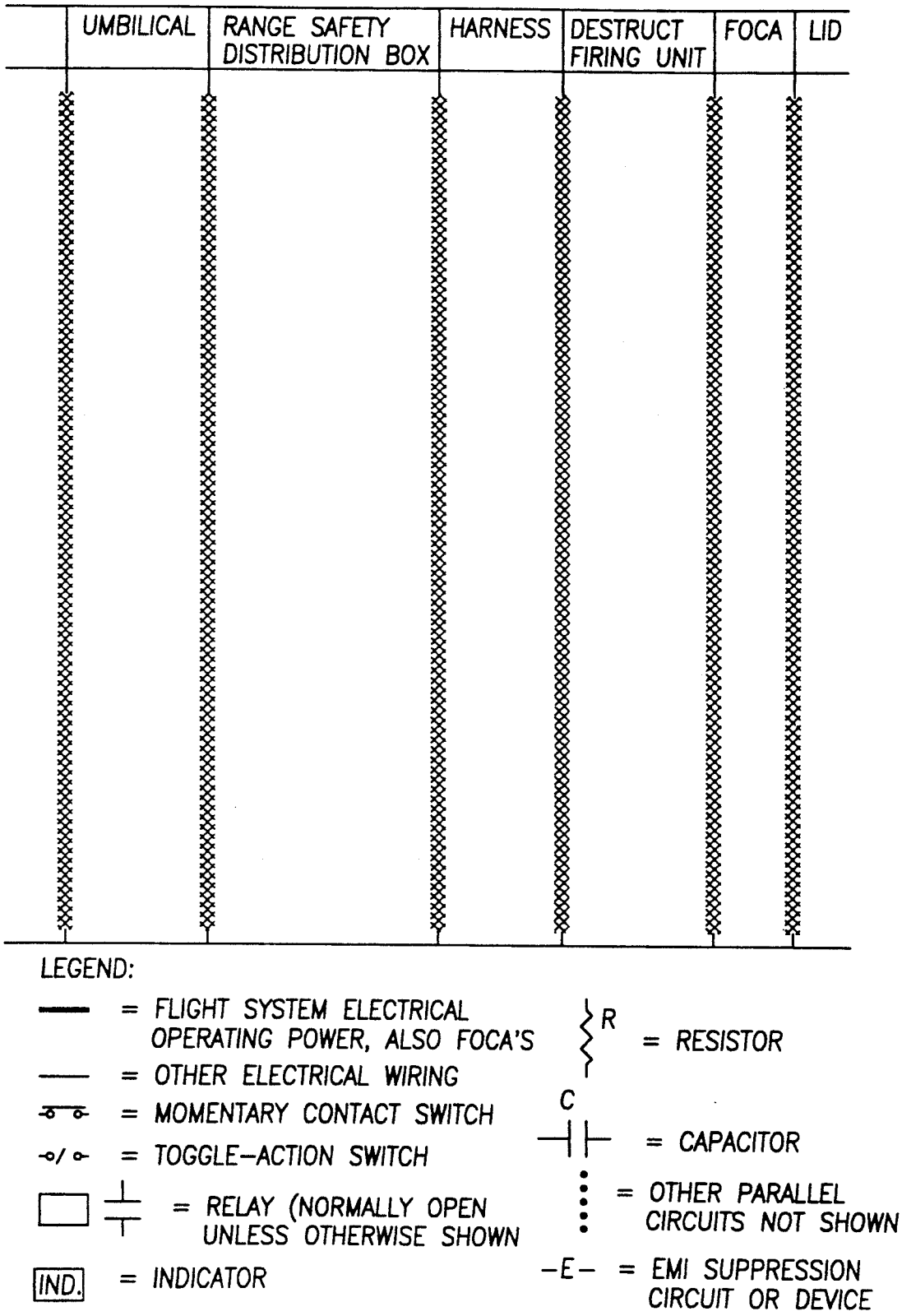
Figures 1, 30B:
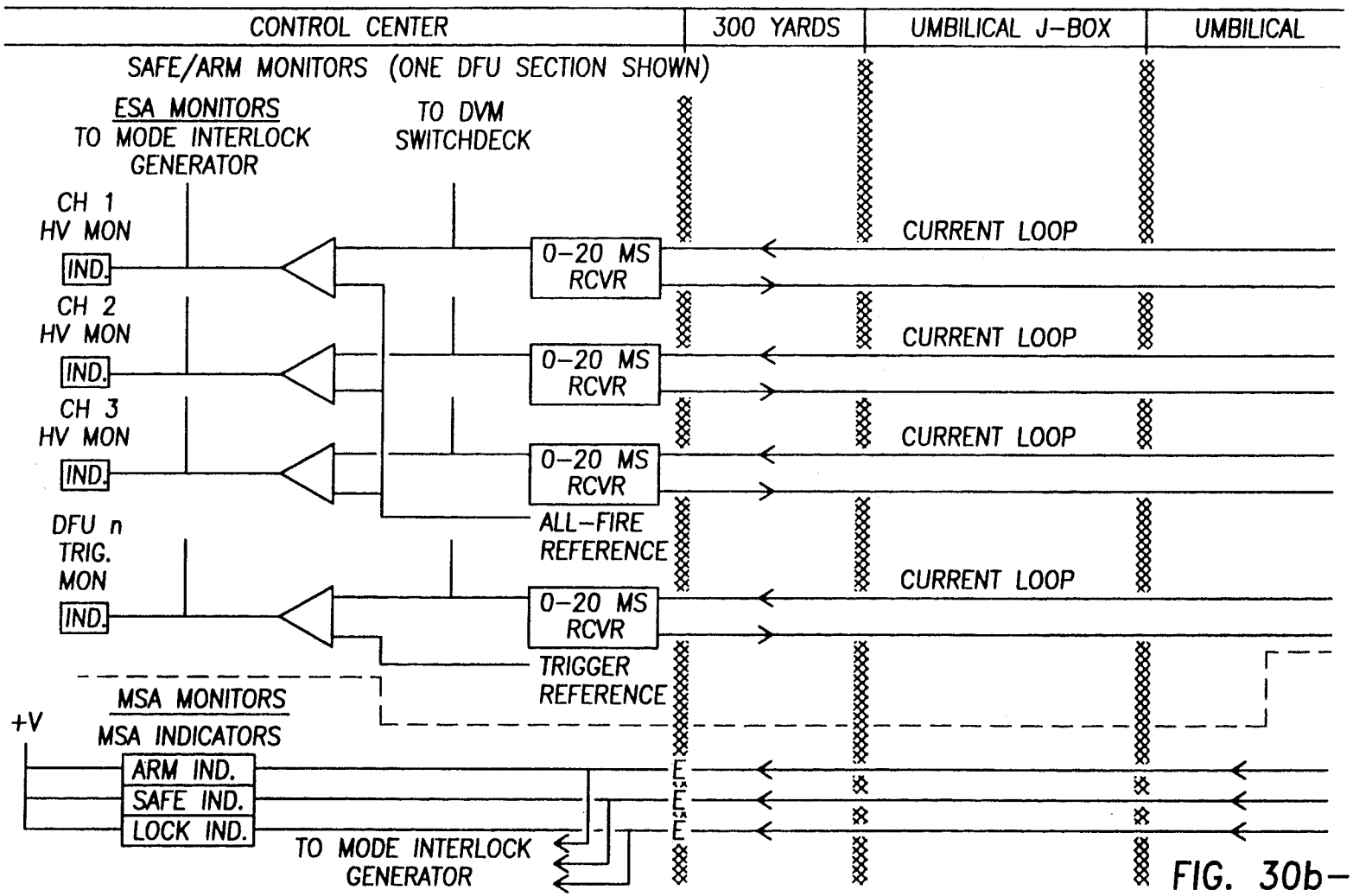
Figures 2, 30B:
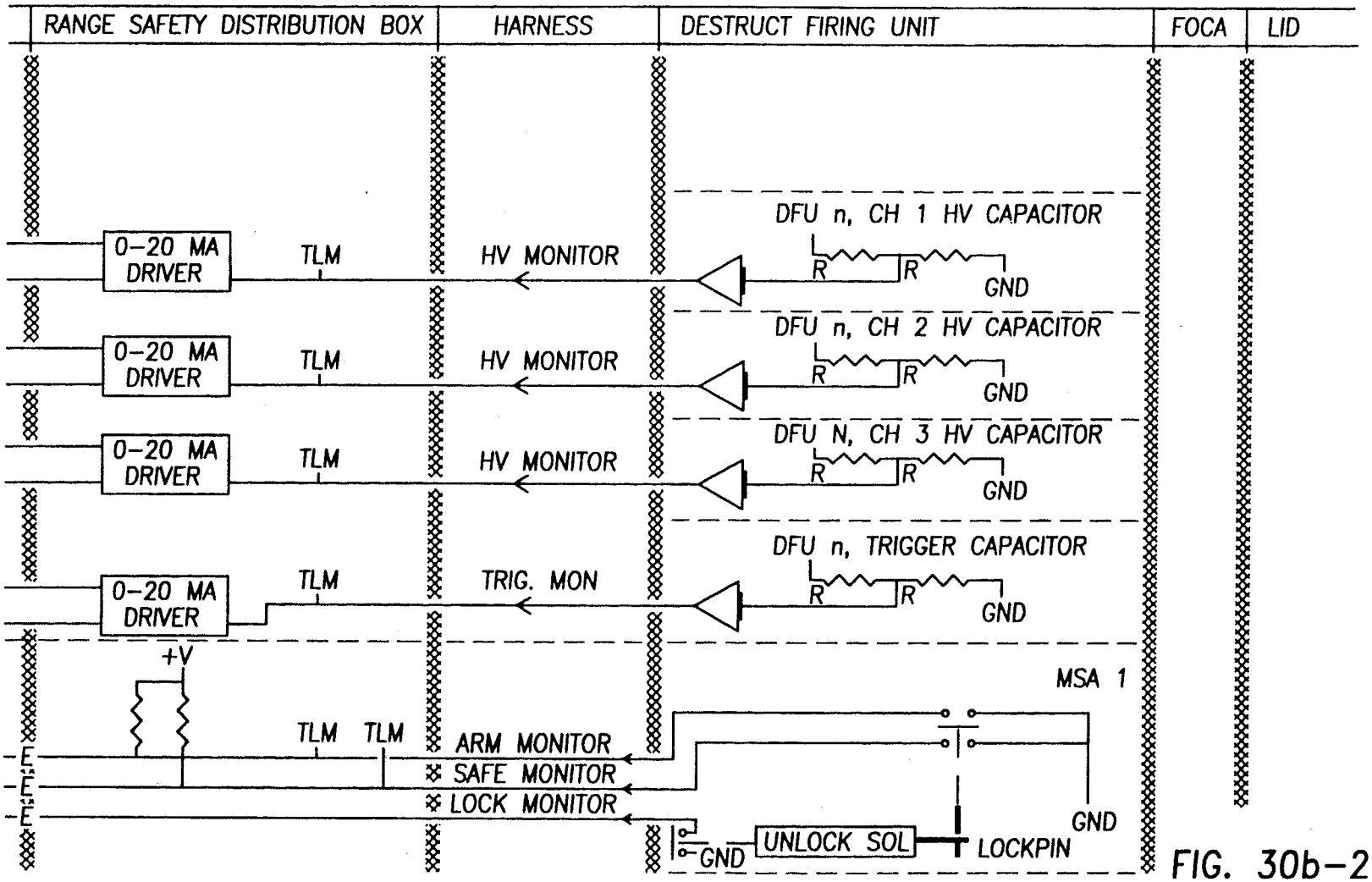

As shown in FIG. 30*b*, the HV monitor signal from each high-energy capacitor and the trigger capacitor monitor signal from each trigger capacitor are buffered in the DFUs and sent to the RSDBs as discretely wired analog voltage levels. The signals drive 0–20 mA drivers in the RSDBs for transmission to the control center. Telemetry data is derived in the RSDBs. At the control panel, the proportional outputs of the 0–20 mA receivers 649 are thresholded to drive HV status indicators 651. A digital voltmeter (DVM) in the control panel may be used to access the proportional signals one at a time. As noted above, only one high energy capacitor and HV monitor signal is required in a preferred DFU high energy switching circuit.

The MSA monitor switches (safe, arm, lock) are wired to powered indicators 652 at the control panel so that MSA status can be read without powering the MSA. Pull-up resistors 653 are provided in the RSDB to provide a switch sense current for telemetry purposes after umbilical separation. Provisions are required to prevent lightning-induced transients from harmfully propagating into both the LV and the control panel.

All ESA and MSA monitor signals are summed into the mode interlock state machine.

c. FTS Battery control

Figures 1, 30C:
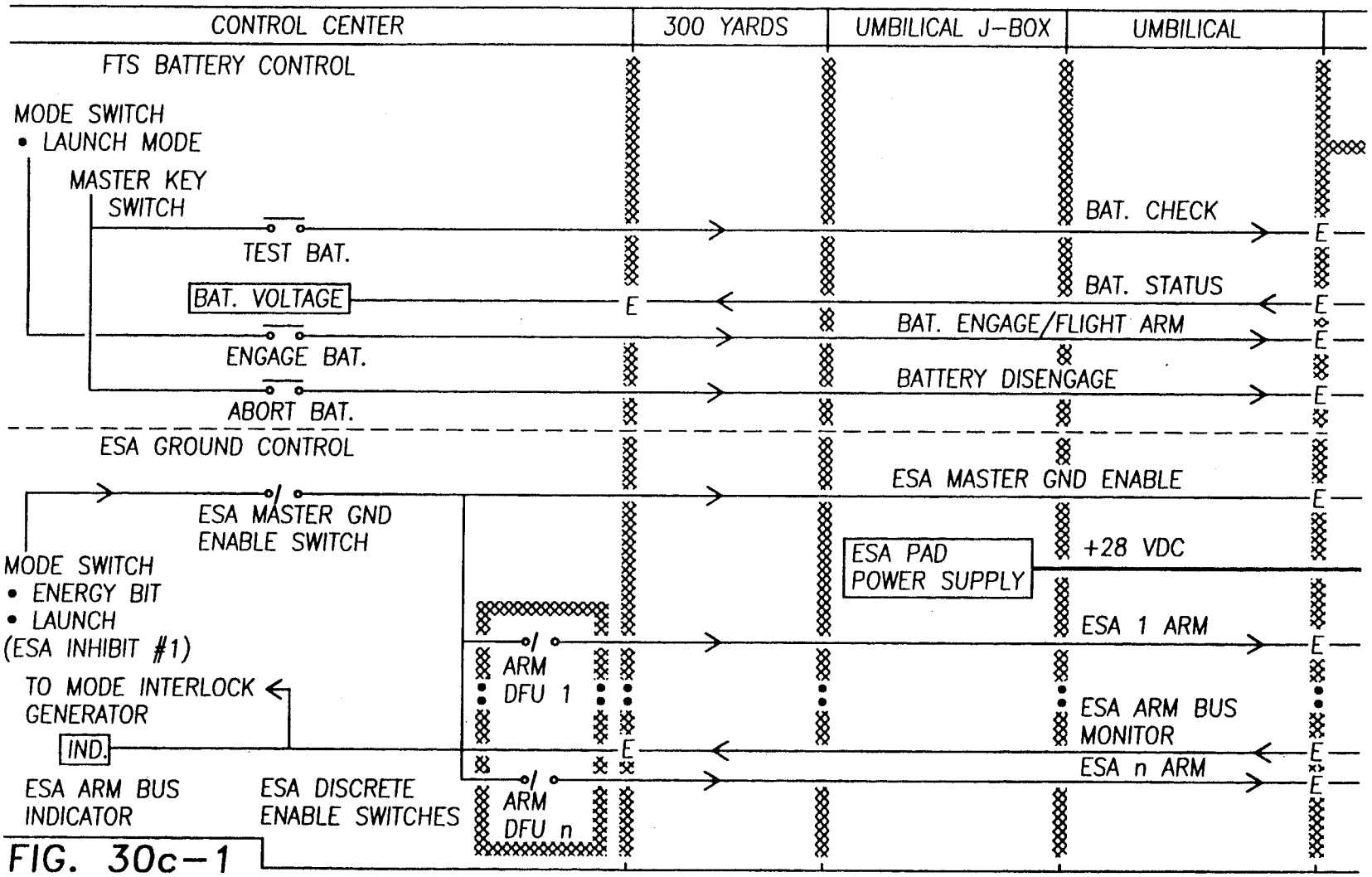
Figures 2, 30C:
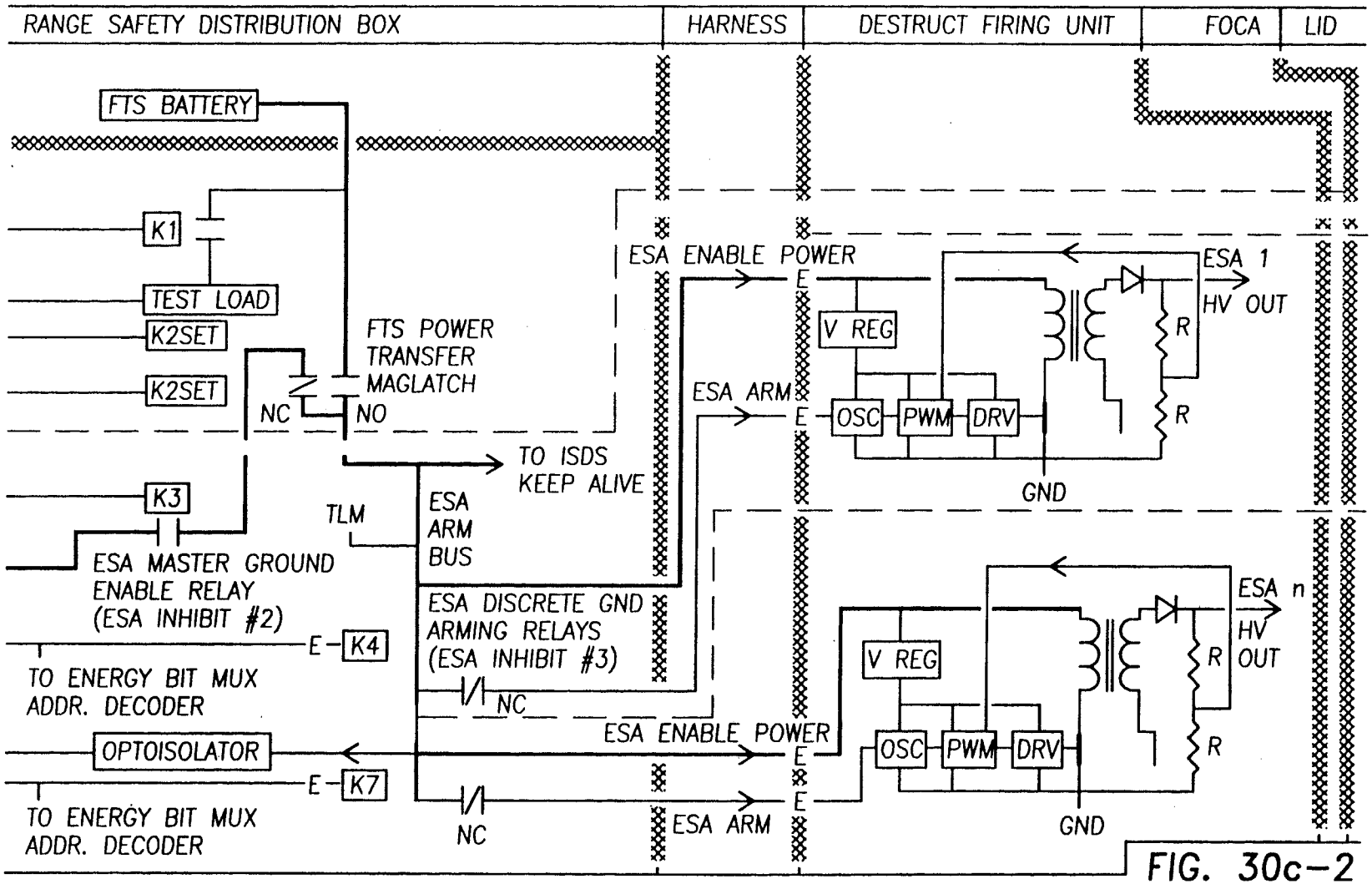

A dedicated FTS battery shown in the upper portion of FIG. 30*c* is connected to each RSDB and is isolated from the RSDB ESA arm bus by an FTS power transfer maglatch 655. A battery test button 656 on the control panel connects the battery to a test load in the RSDB and the load is monitored by an indicator 657 in the control panel. Battery testing does not interact with LIO/FTS arming and can be performed while in any system operating mode.

The FTS power transfer maglatch 655, under control of battery engage and battery abort switches 658, 659 on the control panel, switches the RSDB ESA arm bus between the ESA master ground enable relay and the FTS battery. The power transfer is break-before-make. This simple arrangement is possible because the RSDB ESA arm bus supports only the ESAs, which are not affected by power dropouts except to the extent that average power level is affected.

d. ESA Ground Control

In the energy BIT and launch modes, the control panel ESA master ground enable switch 631 (FIG. 28*a*) powers the RSDB ESA arm bus via the RSDB ESA master ground enable relay (see lower portion of FIG. 30c). This relay is counted as ESA inhibit #2 and is verified by an RSDB ESA arm bus indicator 632 at the control panel.

The RSDB ESA arm bus provides ESA enable power directly to each connected ESA. The bus also provides ESA arming signals to each connected ESA via normally closed contacts 633, 634 on dedicated ESA ground arming relays. Therefore, once the umbilical is open, ESA operation is maintained by maintaining power on the RSDB ESA arm bus. The discrete ESA arming relays provide selective ground arming for test purposes. These relays are counted as ESA inhibit #3 and are verified by the HV monitor signals from the DFUs.

e. MSA Ground Control

Figures 1, 30D:
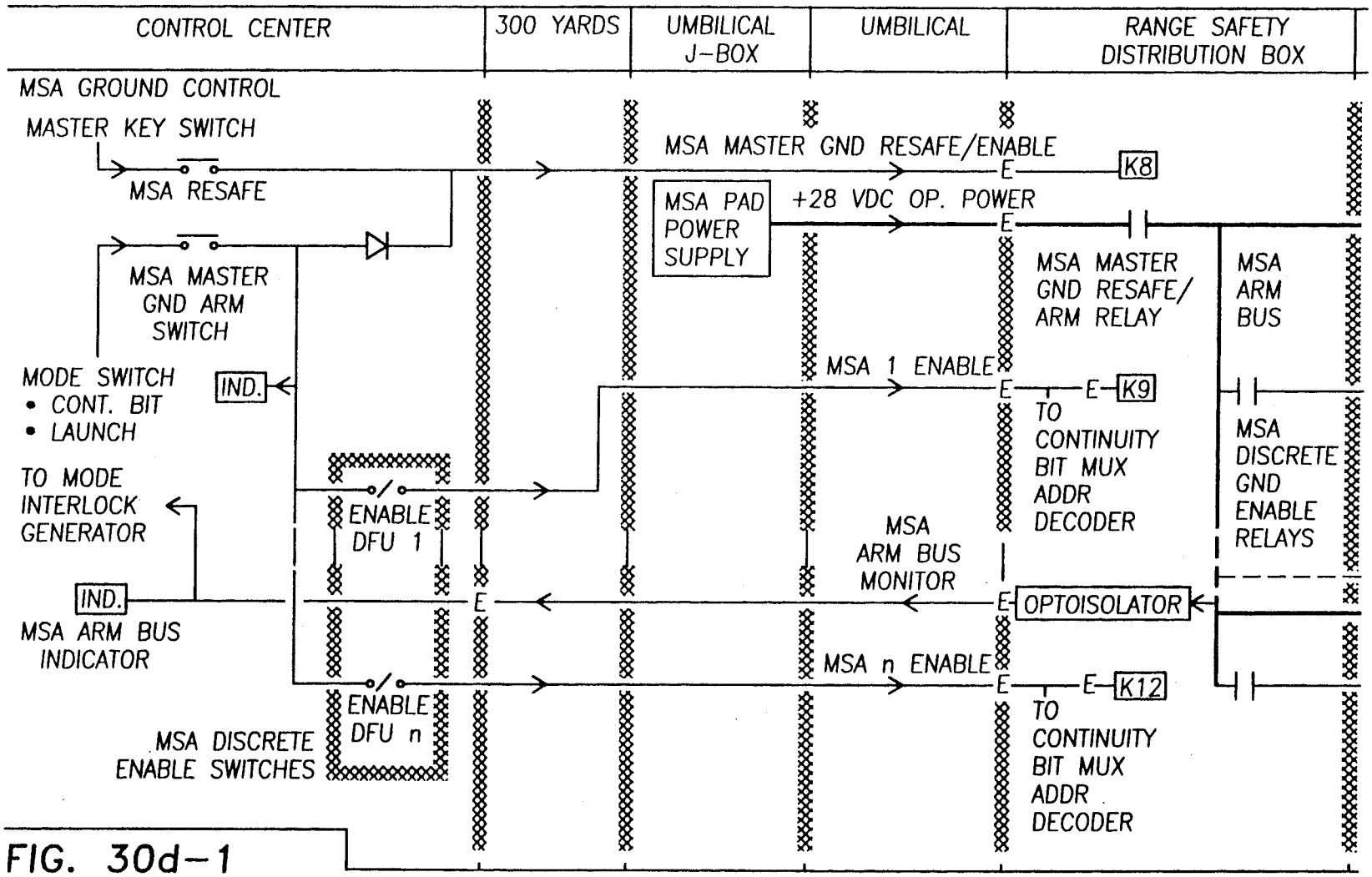
Figures 2, 30D:
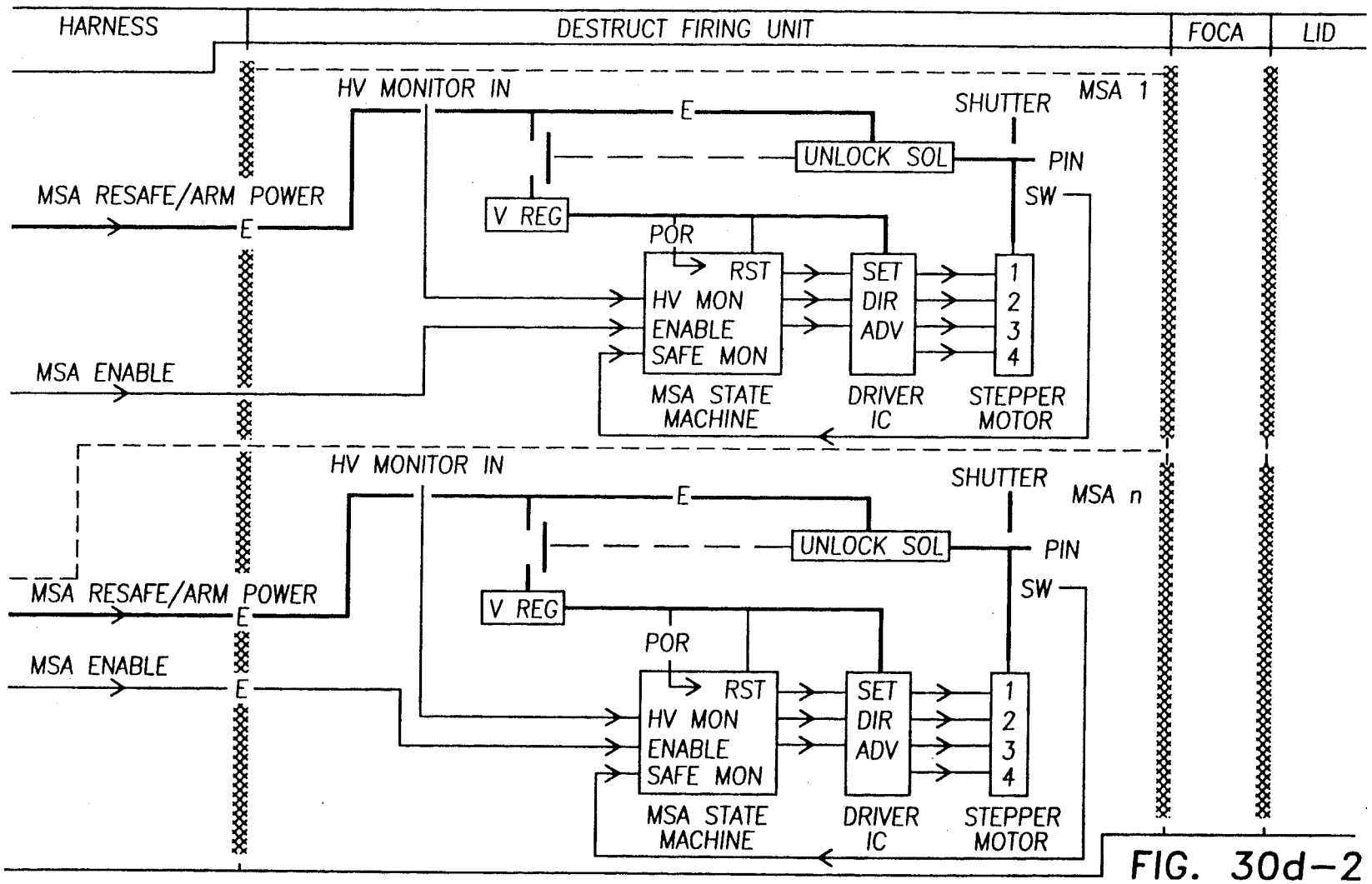

The MSA ground control circuits are symmetric to the ESA ground control circuits except for reversed designation of the "enable" and "arm" commands. In the progressive arming of an ordnance system, the "enable" command should be expressed before the "arm" command, and the system should progress first to an enabled state and then to an armed state as shown in FIG. 30d. In the case of the ESA control circuits, the control panel controls are toggle controls (as opposed to momentary contact controls), and the desired progression can be accomplished by first powering the RSDB ESA arm busses (the enable step) followed by selecting the PWM oscillator control signals (the arming step).

In the case of the MSA control circuits, however, the preferred embodiment requires the use of a momentary contact control to power the RSDB MSA arm busses. This configuration requires that other MSA control inputs (of which there is one per MSA) be expressed prior to powering the RSDB MSA arm busses. For this reason, the switches which power the RSDB MSA arm busses are designated MSA arming switches, since they are the final controls operated to arm the MSAs.

Aside from this reversal of "arm" and "enable" designation of ESA and MSA operating controls, the ESA and MSA control circuits differ in the following respects: (1) the MSA master ground arm switch 632 is momentary contact, 2) the MSA discrete ground enable relay contacts are normally open, 3) the RSDB MSA arm bus is not powered by the battery at any time, and 4) an MSA resafe switch 635 is provided. The MSA master ground arm switch powers the RSDB MSA arm bus via a relay 636. This action resafes all MSAs attached to the bus. If any MSA discrete relays are closed, those MSAs then arm (given the absence of high voltage in those DFUs).

f. Continuity Built-In Test

Figures 1, 30E:
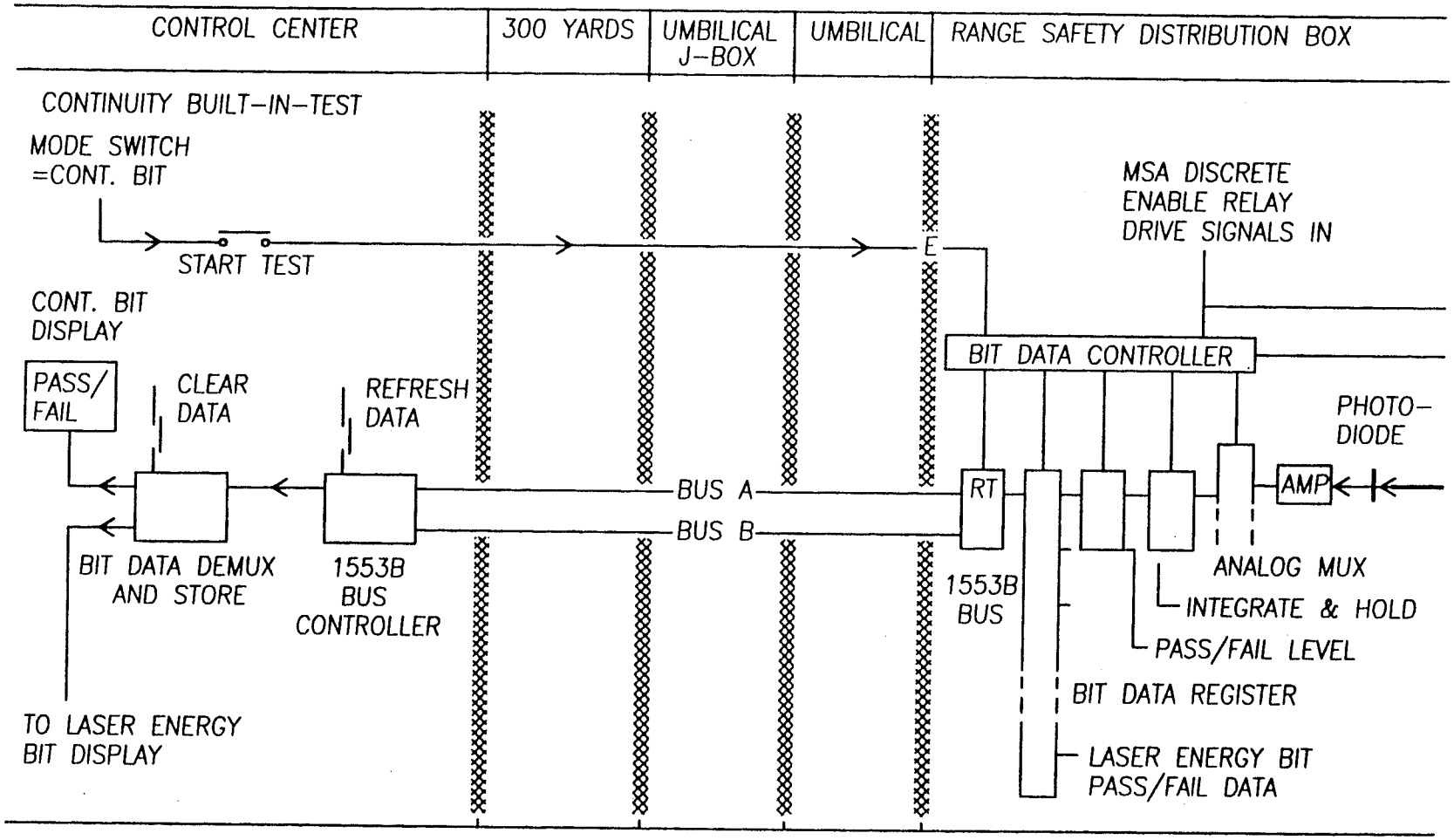
Figures 2, 30E:
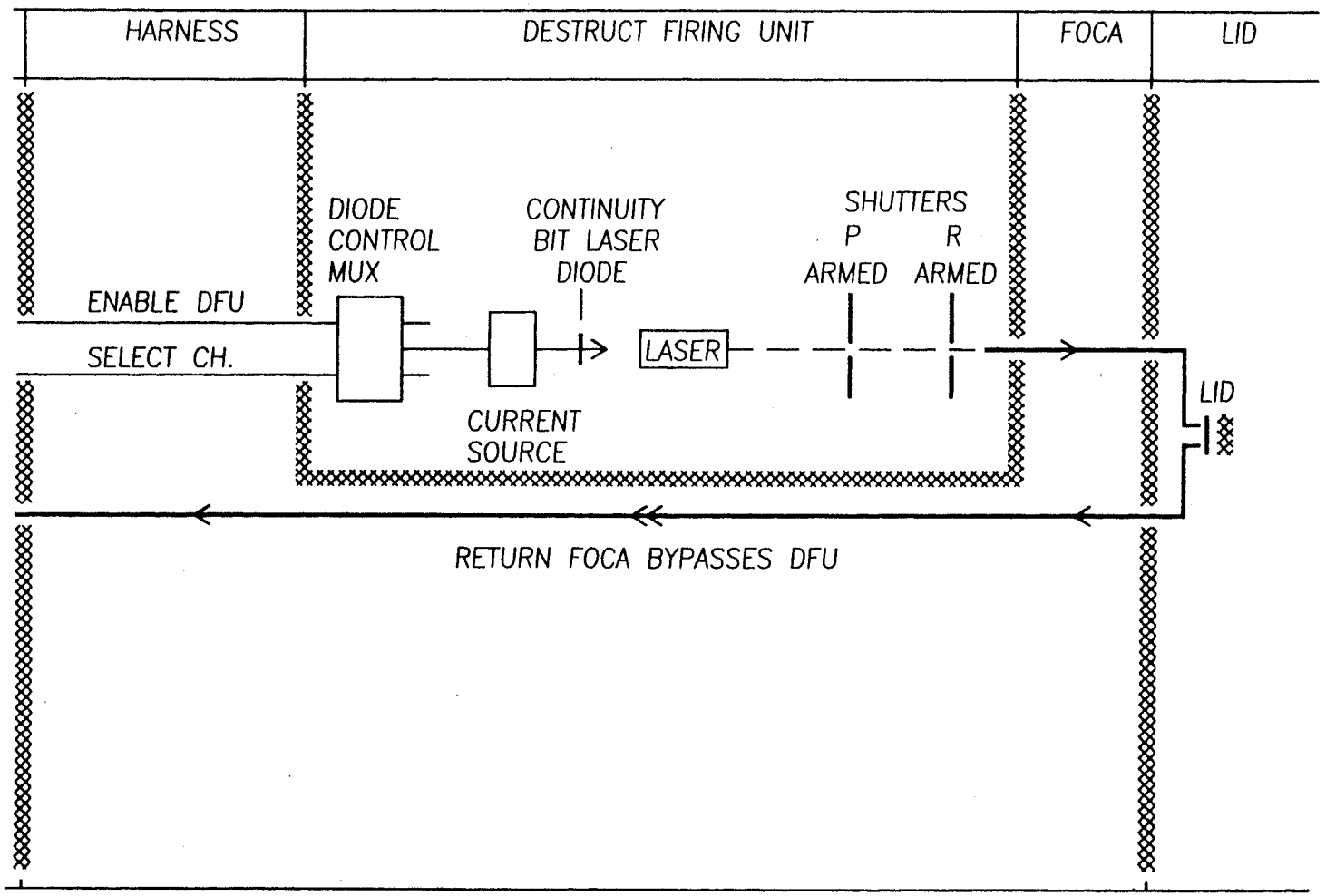

These functions are shown in FIG. 30e and have already been described above.

g. Laser Energy Built-in Test

Figures 1, 30F:
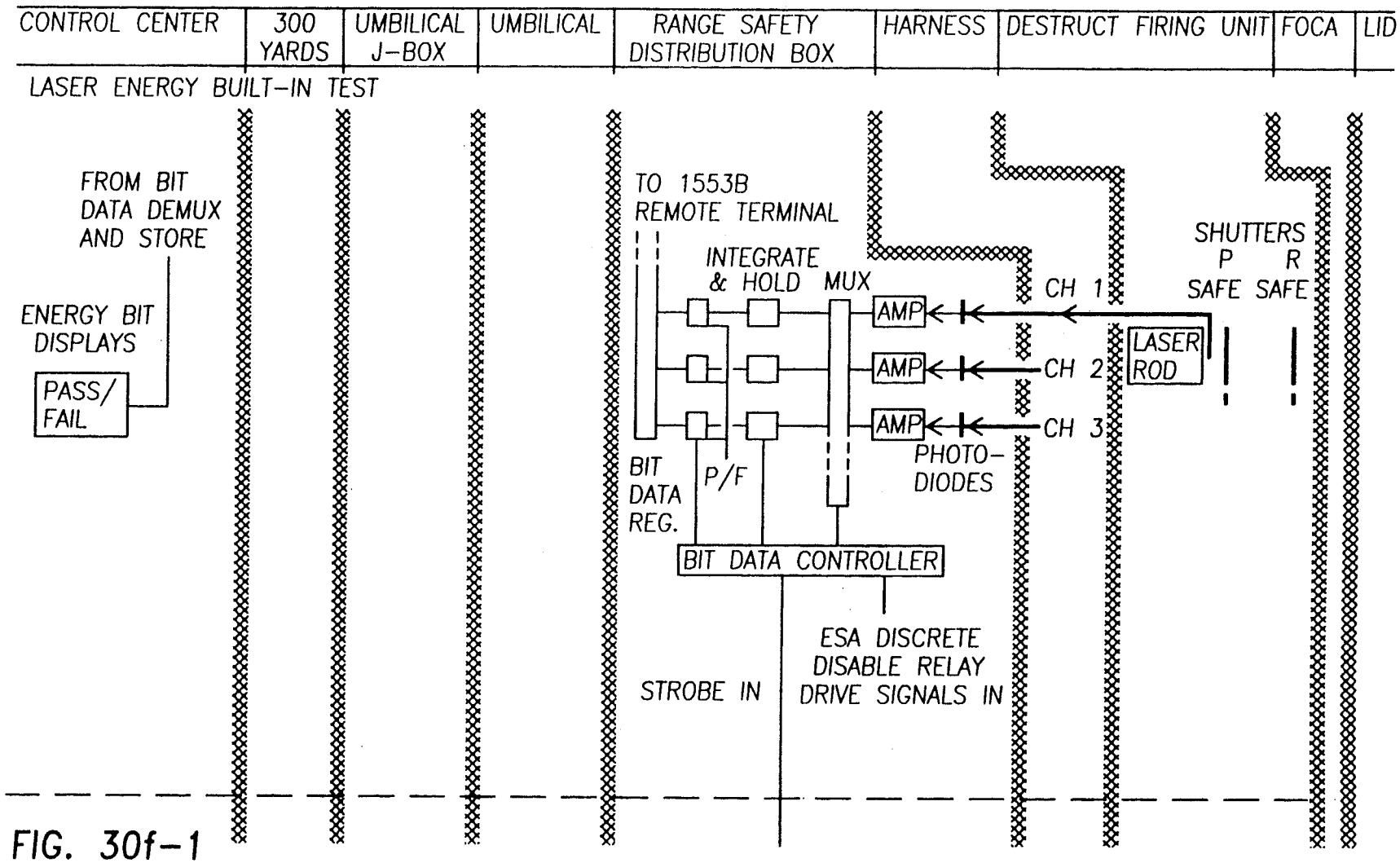
Figures 2, 30F:
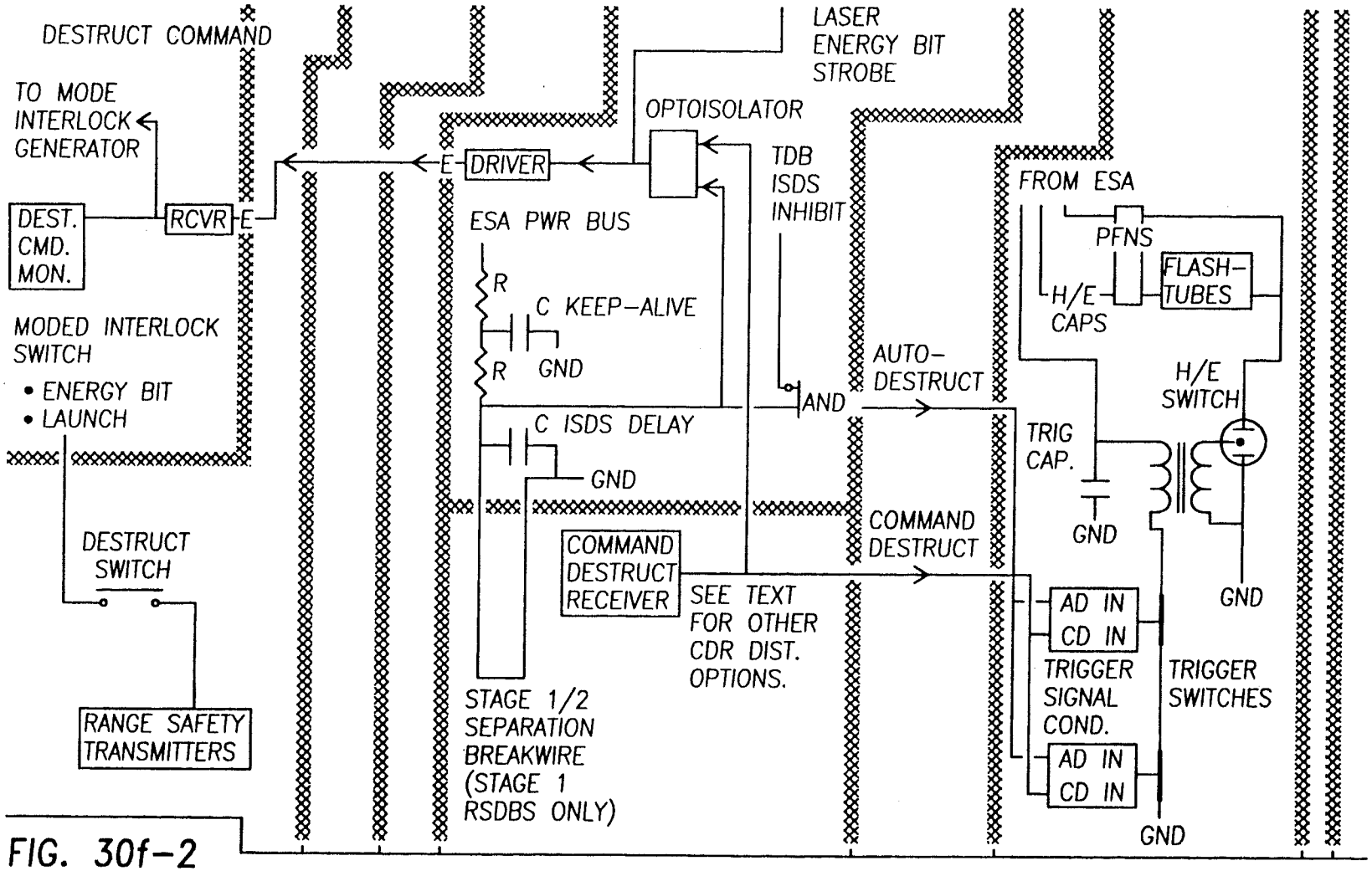

These functions are shown in FIG. 30f (upper portion) and have also been described above. FIG. 30f shows the laser energy detectors located in the RSDBS and driven by fiber optic links from the DFUs. Alternately, the laser energy detectors can be located in the DFUs and the results forwarded to the RSDBs electrically.

h. Destruct Command

The command destruct signals, as shown in the lower portion of FIG. 30f, are wired directly from the CDRs to the DFUs, but are monitored by the RSDB to provide destruct status to the control panel, and synchronization for the energy BIT data acquisition circuits. A powered ISDS breakwire in each first stage RSDB independently generates an autodestruct signal. This function can be overridden in the RSDB during normal staging if an ISDS inhibit input is supplied.

i. Sequence of Operations

I. Continuity Test Mode (With Through-the-Shutter Test Energy)

The primary and redundant control systems should be operated symmetrically as described here since the MSAs operate common-mode shutters. The sequence of operations for continuity testing is as follows:

1. Operator inspects unpowered panel, selects all arming and enabling toggle switches to off and selects the BIT mode select switch off.

1R. Operator repeats step 1 for other (redundant) control panel.

2. Operator selects master power key switch to test mode. The key can be removed at this point to permit testing but deny access to launch mode.

2R. Operator repeats step 2 for other control panel.

3. Operator selects BIT mode select switch to continuity test.

(a) If all HV monitor and trigger monitor status values indicate safe, and other ESA arming functions indicate unpowered, the mode interlock switch grants power to the MSA master ground arm switch and the MSA console power indicator is illuminated.

(b) If any ESA power or arm monitor indicates unsafe, the mode interlock switch denies MSA arming power and turns on alarms.

3R. Operator repeats step 3 for other control panel.

4. Operator selects MSA pad power supply on and verifies indicator.

4R. Operator repeats step 4 for other control panel.

5. Operator selects one MSA enable switch on, then presses and holds MSA ground arm switch for the selected DFU's stage and verifies status for that MSA transition from safe and locked to armed and locked. This arms one MSA in one DFU.

5R. Operator repeats step 5 for same DFU on other control panel. This arms the second MSA in the selected DFU.

6. Operator confirms DFU selected indicator in the continuity BIT panel cluster.

6R. Operator repeats step 6 on other control panel.

7. Operator presses Perform Test switch in the continuity BIT panel cluster and observes the three continuity test indicators transition from no-go to go. Operator presses the switch to refresh the data as required. Operator records results, press the Clear Data switch and observes test indicators transition to no-go.

7R. Operator repeats step 7 for other control panel. This completes continuity BIT for the selected DFU.

8. Operator selects MSA enable for previously tested DFU to disable and selects MSA enable for the next DFU. Operator presses MSA ground arm switch(s) for the appropriate stage(s) and observes the deselected MSA transition to safe and locked and the selected MSA transition to armed and locked.

8R. Operator repeats step 8 for the other control panel.

9. Operator repeats steps 7 through 8R until all six DFUs are tested.

10. Operator deselects the last selected DFU and presses the MSA resafe switch(s) to return all MSAs control by the panel to the safe and locked position. Operator returns BIT mode select switch to off.

10R. Operator repeats step 10 for the other panel.

II. Laser Energy Test Mode

Once the companion system is powered up for status integrity, the laser energy tests can be conducted on one system at a time, via the following sequence:

1 through 2R. See Continuity Test Mode.

3. Operator selects BIT mode select switch to energy BIT mode.

(a) If all MSAs are safe and locked, and all other status indications are safe for continuity testing, the mode interlock circuit grants ESA arming power and the ESA console power indicator is illuminated.

(b) If conditions are not safe, the mode interlock circuit denies ESA arming power and turns on alarms. This interlock and indicator constitute ESA inhibit #1.

3R. Operator repeats step 3 for other control panel.

4. Operator selects ESA pad power switch on and verifies pad power indicator.

5. Operator selects first or second stage ESA ground enable switch on and verifies RSDB ESA arm bus indicator. The driven relay and this indicator constitute ESA inhibit #2.

6. Operator selects one ESA discrete arming switch on and verifies the trigger monitor and three HV monitor indicators for the selected DFU. The driven relays and the HV monitors constitute ESA inhibit #3.

7. Operator verifies the DFU selection in the display in the laser energy BIT panel cluster.

8. Operator fires the selected DFU via the normal destruct command input to the range safety transmitters and verifies the receipt of a fire command monitor and the transition of the laser energy data indicators from no-go to go. Operator records results, presses the Clear Data switch and observes the data indicators transition to no-go.

9. Operator deselects previously tested ESA and repeats steps 6 through 9 until all lasers in the section have been test fired.

10. Operator deselects all ESAs, selects the ESA ground enable switch(es) to safe and selects BIT mode select switch off.

11. Operator repeats steps 4 through 10 for other control panel.

III. Launch Mode

The primary and redundant systems can be armed one after the other or in symmetry. The only requirement is the MSAs in each section be armed before the ESAs in the same section. The sequence of operations is as follows:

1. Operator inspects console to ensure all controls in off position.

1R. Operator repeats step 1 for redundant system.

2. Operator selects master power key switch to launch mode and verifies launch mode console power indicator and MSA and ESA console power indicators. redundant system.

3. Operator presses battery test switch to test battery status if desired.

3R. Operator repeats step 3 for redundant system.

4. Operator selects all MSA enable switches on panel to enable. Operator presses the stage 1 and 2 MSA ground arm switches and verifies that all MSA indicators transition from safe and locked to armed and lock. Operator releases MSA ground arm switches.

4R. Operator repeats step 4 for redundant system and confirms MSA armed and locked indicators in the launch status clusters of both panels.

5. Operator selects all ESA arm switches on panel to arm. Operator selects the stage 1 and 2 ESA ground enable switches and verifies that all HV and trigger indicators indicate armed.

5R. Operator repeats step 5 for the redundant panel.

6. Operator presses stage 1 and 2 battery engage switches, selects stage 1 and 2 ESA arm switches to safe, and verifies that the RSDB ESA arm bus indicator and all ESA trigger and HV monitors remain armed.

6R. Operator repeats step 6 for the redundant panel and confirms ESA armed-on-battery indicators in the launch status clusters of both panels. The LIO/FTS system is now fully armed and ready for launch.

IV. Launch Abort

1. Operator resafes all MSAs by pressing MSA resafe switches on both panels.

2. If batteries are engaged, operator aborts batteries by pressing all battery abort switches.

3. Operator resafes all ESAs by selecting all ESA ground enable and arm switches off.

4. Operator removes console operating power by selecting key switch to off if desired.

10. Laser initiation Energy Budget

Of the energy emitted from the output facet of the laser, 0.4 db is lost in the laser head optical system and fails to couple into the internal FOCA jumper. An additional 1.5 db is lost at the fiber interface at the DFU hermetic feedthrough. For the SRM energy transfer FOCAs, an additional 1.5 db is lost at the in-line quick disconnect. Therefore, the total energy transfer loss is between 3.92 db for the SRM LIDs and 2.42 db for the other LIDs.

To deliver 35 mJ to the LID (350% of LID All-Fire energy), each high-energy capacitor must store 5.1 J, representing a 5.0 uF capacitor charged to 1.4 kV. An estimated 1.2% of this energy is present in the laser output beam. The rest is lost in coupling the capacitor to the xenon flashlamp and the flashlamp to the laser.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. Apparatus for ordnance initiation comprising:

an explosive charge;

means for generating command control signals;

means for initiating said charge;

means responsive to said command control signals for firing laser energy into said charge initiating means and;

means for performing a laser energy test of said laser energy firing means.

2. Apparatus according to claim 1, wherein said initiating means is a laser initiated device.

3. Apparatus according to claim 2, wherein said laser initiated device is a deflagration-to-detonation (DDT) laser initiated device.

4. Apparatus according to claim 2, wherein said laser initiated device includes an optical interface to provide hermeticity and backpressure containment.

5. Apparatus according to claim 4, wherein said optical interface includes a glass-to-metal seal and a focusing element.

6. Apparatus according to claim 5, wherein a gradient index (grin) lens is used as the focusing element and glass-to-metal seal.

7. Apparatus according to claim 5, wherein a plano convex lens is used as the focusing element.

8. Apparatus according to claim 4, wherein said optical interface includes a fiber optic means in a low melting-point glass header with a metal sleeve.

9. Apparatus according to claim 1, wherein said laser firing means includes an optically pumped solid state laser.

10. Apparatus according to claim 1, wherein said laser firing means includes an electrically pumped laser diode.

11. Apparatus according to claim 1, further including safe/arm means for controllably placing said laser firing means into either a safe condition or an arm condition.

12. Apparatus according to claim 11, wherein said safe/arm means includes a mechanical safe/arm device for interrupting laser energy from contacting the initiating means.

13. Apparatus according to claim 12, wherein said mechanical safe/arm device includes coaxial rotary shutters.

14. Apparatus according to claim 12, wherein said laser firing means includes a plurality of laser channels and a common mechanical safe/arm device to interrupt laser energy in said laser channels.

15. Apparatus according to claim 12, wherein said mechanical safe/arm device further includes means for deflecting laser energy to perform said laser energy test.

16. Apparatus according to claim 12, further comprising means for performing a laser path continuity test.

17. Apparatus according to claim 16, wherein said mechanical safe/arm device further includes means for selectively passing frequencies of energy used to perform said continuity test.

18. Apparatus according to claim 16, wherein said mechanical safe/arm device includes a set of holes through an opaque surface for passing attentuated firing laser energy during said continuity test.

19. Apparatus according to claim 18, wherein firing laser energy reflected by said opaque surface is detected as a measure of laser energy.

20. Apparatus according to claim 1, wherein a fiber optic cable assembly is used as an energy transfer system (ETS) between said laser firing means and said initiating means.

21. Apparatus according to claim 20, further comprising means for performing a laser path continuity test.

22. Apparatus according to claim 21, wherein said continuity test means further includes means for integrating and holding energy used to perform said continuity test.

23. Apparatus according to claim 21, wherein said continuity test means includes a light emitting diode to provide energy for performing said continuity test through said laser firing means.

24. Apparatus according to claim 21, further comprising means for performing a laser obtained during said continuity test and said energy test being directed to said command control signal generating means via a common interface.

25. Apparatus according to claim 1, wherein said laser energy test means further includes means for integrating and holding energy used to perform said laser energy test.

26. Apparatus according to claim 1, further including means for interfacing said laser firing means with said control signal generating means.

27. Apparatus according to claim 1, wherein said laser firing means further includes:

a plurality of laser channels simultaneously driven by a common pumping means.

28. Apparatus for ordnance initiation comprising:

means for generating command control signals;

means for initiating a charge; and means responsive to said command control signals for firing laser energy into said charge initiating means, wherein said laser firing means includes a plurality of laser channels each with respective laser pumping means, said laser pumping means being activated by a high energy switch.

29. Apparatus according to claim 28, wherein said high energy switch is a single vacuum arc switch.

30. Apparatus according to claim 28, wherein said high energy switch includes plural SCRs.

31. Apparatus for ordnance initiation comprising:

means for generating command control signals;

means for initiating a charge;

means responsive to said command control signals for firing laser energy into said charge initiating means; and safe/arm means for arming said laser firing means, wherein said safe/arm includes an electrical safe/arm device for controlling pumping energy for said laser firing means.

32. System for controlling a launch vehicle having at least one ordnance device comprising:

means for generating control signals;

means for producing laser energy in response to a command from said control signal generating means, said laser energy activating said at least one ordnance; and means for interfacing said control signals with said laser energy producing means, wherein said interfacing means further includes:

means for electrically and mechanically inhibiting laser energy activation of said at least one ordnance.

33. System according to claim 32, wherein said means for producing laser energy includes a plurality of laser firing units.

34. System according to claim 32, wherein said means for producing laser energy activates said at least one ordnance via a fiber optic cable assembly.

35. System according to claim 32, wherein redundant interfacing means are provided to establish at least two control signal paths for said at least one ordnance.

36. System according to claim 32, wherein said mechanical inhibiting means further includes means for locking said mechanical inhibiting means in an armed state.

37. System according to claim 36, wherein said locking means isolates said mechanical inhibiting means from arming power until said locking means has been actuated.

38. System according to claim 32, wherein said mechanical inhibiting means further includes a voltage monitor safety interlock to inhibit arming of said mechanical inhibiting means when laser activating voltage is present.

39. System according to claim 32, wherein said mechanical inhibiting means and said electrical inhibiting means are powered by independent buses included in said interfacing means.

40. System according to claim 32, wherein said means for producing laser energy includes a plurality of laser firing units, and said electrical inhibiting means further includes a common relay for enabling said plurality of laser firing units.

41. System according to claim 40, further including means for separately arming each laser firing unit.

42. System according to claim 41, wherein said separate arming means are a plurality of normally-closed relays.

43. System according to claim 32, wherein said electrical inhibiting means further includes means for limiting current to said electrical inhibiting means.

44. System according to claim 43, wherein said current is limited to a value adequate for arming said electrical inhibiting means to permit laser energy activation of said at least one ordnance, but insufficient to arm said mechanical inhibiting means.

45. System according to claim 32, wherein said control signal generating means includes means for interlocking control of said electrical inhibit means and said mechanical inhibit means.

46. System according to claim 45, wherein said control signal generating means further includes a mode selection switch, and said interlock control means further includes a state-machine which gates power to said electrical inhibit means and said mechanical inhibit means in response to a status of said electrical inhibit means, said mechanical inhibit means, and said mode selection switch.

47. System for controlling a launch vehicle having at least one ordnance device comprising:

means for generating control signals;

means for producing laser energy in response to a command from said control signal generating means, said laser energy activating said at least one ordnance; and means for interfacing said control signals with said laser energy producing means, wherein said interfacing means further includes:

means for electrically and mechanically inhibiting laser energy activation of said at least one ordnance, wherein said electrical inhibiting means further includes means for supplying power to said electrical inhibiting means, said power supplying means including:

a bus; and a switch in series with said bus, said switch being a non-electric control element.

48. System according to claim 47, wherein said non-electric control element is a magnetically latching relay.

49. Apparatus for activating an ordnance device comprising:

a plurality of lasers;

means for supplying energy for activating said lasers;

means for storing said energy;

means for pumping said lasers with said stored energy;

means for forming pulses of said stored energy to activate said pumping means; and means for triggering said pulse forming means, said triggering means including a high energy switch for activating said plurality of lasers.

50. Apparatus according to claim 49, wherein said pumping means includes a flashlamp for activating said plurality of lasers.

51. Apparatus according to claim 49, further including means for electrically inhibiting activation of said pumping means.

52. Apparatus according to claim 49, further including means for mechanically inhibiting laser energy from exiting said apparatus.

53. System for activating a launch vehicle comprising:

means for propelling the launch vehicle;

means for redundantly activating said propelling means via a plurality of laser energy channels; and means for redundantly activating said plurality of laser energy channels, said redundant activating means including redundant means for generating command signals and redundant means for interfacing said command signals with said laser energy channels.

54. Method for controlling activation of a launch vehicle having at least one laser initiated ordnance comprising the steps of:

selecting a test or launch mode of the launch vehicle;

selecting a laser path continuity test once said test mode has been selected;

executing said laser continuity test for all laser firing channels included in the launch vehicle and;

selecting a laser energy test mode for each of said laser firing channels.

55. Method according to claim 54, wherein said laser energy test can only be performed if mechanical laser energy shutters are located at positions which inhibit laser initiation of the at least one ordnance.

56. Method according to claim 54, wherein said laser path continuity test and said laser energy test are performed for redundant operator control panels.

57. Method for controlling activation of a launch vehicle having at least one laser initiated ordnance comprising the steps of:

selecting a test or launch mode of the launch vehicle;

selecting a laser path continuity test once said test mode has been selected; and executing said laser continuity test for all laser firing channels included in the launch vehicle, wherein said continuity test can only be performed in the absence of voltage used to pump lasers in said laser firing channels.

58. Method for controlling activation of a launch vehicle having at least one laser initiated ordnance comprising the steps of:

selecting a test or launch mode of the launch vehicle;

selecting a laser path continuity test once said test mode has been selected; and executing said laser continuity test for all laser firing channels included in the launch vehicle, wherein selection of the launch mode further includes the steps of:

mechanically enabling each laser firing channel in a portion of the launch vehicle; and electrically enabling each laser firing channel in a portion of the launch vehicle.

59. Method according to claim 58, further including a step of aborting launch, said step of aborting further including the steps of:

mechanically resafing all laser firing channels;

electrically resafing all laser firing channels; and removing operating power.

* * * * *